US011565728B2

(12) United States Patent
Gotlund et al.

(10) Patent No.: US 11,565,728 B2
(45) **Date of Patent: *Jan. 31, 2023**

(54) RAILCAR TRUCK ROLLER BEARING ADAPTER-PAD SYSTEMS

(71) Applicant: Nevis Industries LLC, Wilmington, DE (US)

(72) Inventors: Erik Gotlund, Green Oaks, IL (US); Jon R. Jeambey, Naperville, IL (US); F. Andrew Nibouar, Chicago, IL (US); James A. Pike, Fairview, PA (US); Jason C. Bryant, Erie, PA (US); Jonathan A. Stull, Erie, PA (US); William A. Kurtzhals, Erie, PA (US); Roshan N. Manibharathi, Hoffman Estates, IL (US)

(73) Assignee: Nevis Industries LLC, Wilmington, DE (US)

( * ) Notice: Subject to any disclaimer, the term of this patent is extended or adjusted under 35 U.S.C. 154(b) by 178 days.

This patent is subject to a terminal disclaimer.

(21) Appl. No.: 16/792,804

(22) Filed: Feb. 17, 2020

(65) Prior Publication Data

US 2020/0255039 A1 Aug. 13, 2020

Related U.S. Application Data

(60) Continuation of application No. 15/858,076, filed on Dec. 29, 2017, now Pat. No. 10,569,790, and a (Continued)

(51) Int. Cl.

*B61F 5/26* (2006.01)
*B61F 5/14* (2006.01)

(Continued)

(52) U.S. Cl.

CPC ..... *B61F 5/142* (2013.01); *B61F 3/02* (2013.01); *B61F 5/06* (2013.01); *B61F 5/125* (2013.01);

(Continued)

(58) Field of Classification Search

CPC .. B61F 5/305; B61F 15/00; B61F 5/28; B61F 15/02; B61F 15/18; B61F 15/20;

(Continued)

(56) References Cited

U.S. PATENT DOCUMENTS 14,981 A 5/1856 Arnett
50,771 A 10/1865 Nimbs (Continued)

FOREIGN PATENT DOCUMENTS

AU 2016203549 A1 6/2016
CN 1777484 A 5/2006

(Continued)

OTHER PUBLICATIONS

May 25, 2021 (MX) Second Office Action—App No. MX/a/2017/002324.

(Continued)

*Primary Examiner* — Mark T Le
(74) *Attorney, Agent, or Firm* — Banner & Witcoff, Ltd.

(57) ABSTRACT

A railcar truck and adapter pad system for placement between a roller bearing and side frame pedestal roof of a three-piece railcar truck. Many different features of the pad and/or the adapter-pad interface are configured to improve stiffness characteristics to satisfy both curving and high speed performance of the railcar truck.

19 Claims, 88 Drawing Sheets

Related U.S. Application Data continuation of application No. 15/835,907, filed on Dec. 8, 2017, now Pat. No. 10,752,265, and a continuation of application No. 15/668,427, filed on Aug. 3, 2017, now Pat. No. 10,562,547, application No. 15/835,907, filed on Dec. 8, 2017, now Pat. No. 10,752,265, which is a continuation-in-part of application No. 15/378,472, filed on Dec. 14, 2016, now Pat. No. 10,583,848, which is a continuation of application No. 15/152,860, filed on May 12, 2016, now Pat. No. 9,637,143, which is a continuation-in-part of application No. 14/585,569, filed on Dec. 30, 2014, now Pat. No. 9,434,393, and a continuation-in-part of application No. 14/562,082, filed on Dec. 5, 2014, now Pat. No. 9,580,087, and a continuation-in-part of application No. 14/562,005, filed on Dec. 5, 2014, now Pat. No. 9,758,181, application No. 15/668,427, filed on Aug. 3, 2017, now Pat. No. 10,562,547, which is a division of application No. 14/562,005, filed on Dec. 5, 2014, now Pat. No. 9,758,181, application No. 15/152,860, filed on May 12, 2016, now Pat. No. 9,637,143, which is a continuation-in-part of application No. 14/561,897, filed on Dec. 5, 2014, now Pat. No. 9,669,846.

(60) Provisional application No. 62/065,438, filed on Oct. 17, 2014, provisional application No. 61/921,961, filed on Dec. 30, 2013, provisional application No. 62/440,704, filed on Dec. 30, 2016, provisional application No. 62/161,139, filed on May 13, 2015.

(51) Int. Cl.

| | |
|---|---|
| ***B61F 5/12*** | (2006.01) |
| ***B61F 5/30*** | (2006.01) |
| ***B61F 5/32*** | (2006.01) |
| ***B61F 5/50*** | (2006.01) |
| ***B61F 5/06*** | (2006.01) |
| ***B61F 3/02*** | (2006.01) |

(52) U.S. Cl.

CPC ..... *B61F 5/14* (2013.01); *B61F 5/26* (2013.01); *B61F 5/30* (2013.01); *B61F 5/305* (2013.01); *B61F 5/32* (2013.01); *B61F 5/50* (2013.01); *Y10T 29/49622* (2015.01)

(58) Field of Classification Search

CPC .... B61F 5/32; B61F 5/26; B61F 5/125; B61F 5/30; B61F 5/50; B61F 5/142; B61F 5/06; B61F 5/14; B61F 3/02; Y10T 29/49622

See application file for complete search history.

(56) References Cited

U.S. PATENT DOCUMENTS

| | | | |
|---|---|---|---|
| 99,774 | A | 2/1870 | Higley |
| 115,261 | A | 5/1871 | Winslow |
| 124,227 | A | 3/1872 | Stewart |
| 142,104 | A | 8/1873 | Hogan |
| 145,004 | A | 11/1873 | Muzzey |
| 150,720 | A | 5/1874 | Shattuck |
| 154,542 | A | 9/1874 | Cummings |
| 174,341 | A | 2/1876 | Cox |
| 183,023 | A | 10/1876 | Remsen |
| 201,310 | A | 3/1878 | Vincent et al. |
| 208,215 | A | 9/1878 | Vincent |
| 208,857 | A | 10/1878 | Sisum |
| 235,852 | A | 12/1880 | Browne |
| 253,439 | A | 2/1882 | Smith |
| 301,510 | A | 7/1884 | Meatyard |
| 309,657 | A | 12/1884 | Shedlock |
| 312,079 | A | 2/1885 | Briody et al. |
| 321,392 | A | 6/1885 | Sisum |
| 416,773 | A | 12/1889 | Behrens |
| 444,509 | A | 1/1891 | Sharpneck |
| 528,844 | A | 11/1894 | Barber |
| 560,258 | A | 5/1896 | Cloud |
| 625,853 | A | 5/1899 | Schumacher |
| 692,086 | A | 1/1902 | Stephenson |
| 693,984 | A | 2/1902 | McMunn |
| 696,617 | A | 4/1902 | Woods |
| 702,025 | A | 6/1902 | McElroy |
| 708,855 | A | 9/1902 | Barber |
| 743,559 | A | 11/1903 | Read |
| 775,271 | A | 11/1904 | Graham |
| 895,157 | A | 8/1908 | Bush |
| 908,359 | A | 12/1908 | Vauclain |
| 931,658 | A | 8/1909 | Stephenson |
| 977,139 | A | 11/1910 | Sharpneck |
| 1,002,442 | A | 9/1911 | Perkins |
| 1,010,034 | A | 11/1911 | Floyd |
| 1,011,885 | A | 12/1911 | Chase |
| 1,029,325 | A | 6/1912 | Van Sweringen |
| 1,057,402 | A | 4/1913 | Berg |
| 1,060,222 | A | 4/1913 | Woodard |
| 1,072,721 | A | 9/1913 | Hewitt |
| 1,072,725 | A | 9/1913 | Hewitt |
| 1,072,726 | A | 9/1913 | Hewitt |
| 1,072,727 | A | 9/1913 | Hewitt |
| 1,079,178 | A | 11/1913 | Kiesel, Jr. |
| 1,092,814 | A | 4/1914 | Kellogg |
| 1,097,970 | A | 5/1914 | Doerr |
| 1,099,890 | A | 6/1914 | Vaughan |
| 1,099,891 | A | 6/1914 | Vaughan |
| 1,104,667 | A | 7/1914 | Henderson |
| 1,130,730 | A | 3/1915 | Hewitt |
| 1,141,029 | A | 5/1915 | Whittenburg |
| 1,141,667 | A | 6/1915 | Thompson |
| 1,146,493 | A | 7/1915 | Gilman |
| 1,146,875 | A | 7/1915 | Hess |
| 1,160,751 | A | 11/1915 | Pflager |
| 1,180,717 | A | 4/1916 | Hewitt |
| 1,190,703 | A | 7/1916 | Barber |
| 1,191,136 | A | 7/1916 | Muhfeld et al. |
| 1,264,184 | A | 4/1918 | Hewitt |
| 1,306,460 | A | 6/1919 | Beasley |
| 1,325,772 | A | 12/1919 | Anger |
| 1,370,377 | A | 3/1921 | Stafford |
| 1,377,702 | A | 5/1921 | Lamont |
| 1,377,703 | A | 5/1921 | Lamont |
| 1,388,818 | A | 8/1921 | Marsh |
| 1,389,928 | A | 9/1921 | Barks |
| 1,393,798 | A | 10/1921 | Lamont |
| 1,406,099 | A | 2/1922 | Stafford |
| 1,410,516 | A | 3/1922 | Sandman |
| 1,414,960 | A | 5/1922 | Kadel |
| 1,593,249 | A | 7/1926 | Draper |
| 1,652,657 | A | 12/1927 | Blunt |
| 1,695,085 | A | 12/1928 | Cardwell |
| 1,696,608 | A | 12/1928 | Kjolseth |
| 1,697,514 | A | 1/1929 | Priebe |
| 1,704,052 | A | 3/1929 | Melcher |
| 1,705,555 | A | 3/1929 | Buckwalter |
| 1,708,993 | A | 4/1929 | Woodman |
| 1,730,234 | A | 10/1929 | Oconnor |
| 1,742,860 | A | 1/1930 | Horger |
| 1,744,277 | A | 1/1930 | Melcher |
| 1,745,319 | A | 1/1930 | Brittain, Jr. |
| 1,745,321 | A | 1/1930 | Brittain, Jr. |
| 1,746,301 | A | 2/1930 | Bettendorf |
| 1,750,344 | A | 3/1930 | Bettendorf |
| 1,763,982 | A | 6/1930 | Obrien |
| 1,765,878 | A | 6/1930 | Pflager |
| 1,823,884 | A | 9/1931 | Brittain, Jr. |
| 1,859,265 | A | 5/1932 | Brittain, Jr. et al. |
| 1,872,882 | A | 8/1932 | Buckius |
| 1,928,740 | A | 10/1933 | Tatum |
| 1,929,803 | A | 10/1933 | Brittain, Jr. |

(56) References Cited

U.S. PATENT DOCUMENTS

| | | | |
|---|---|---|---|
| 1,932,236 | A | 10/1933 | Tyson |
| 1,933,456 | A | 10/1933 | Swallow |
| 1,933,459 | A | 10/1933 | Tatum |
| 1,934,918 | A | 11/1933 | Everson |
| 1,941,159 | A | 12/1933 | Tatum |
| 1,941,996 | A | 1/1934 | Mussey |
| 1,943,055 | A | 1/1934 | Brittain, Jr. |
| 1,958,188 | A | 5/1934 | Drews |
| 1,967,804 | A | 7/1934 | Buckwalter |
| 1,967,808 | A | 7/1934 | Buckwalter |
| 1,979,235 | A | 10/1934 | Tatum |
| 1,990,095 | A | 2/1935 | Rohlfing |
| 2,012,949 | A | 9/1935 | Drenning |
| 2,014,224 | A | 9/1935 | Campbell |
| 2,023,756 | A | 12/1935 | Brownyer |
| 2,031,777 | A | 2/1936 | Johnson |
| 2,094,235 | A | 9/1937 | Gibbons |
| 2,100,065 | A | 11/1937 | Buckwalter |
| 2,207,848 | A | 7/1940 | Barrows |
| 2,229,429 | A | 1/1941 | Travilla, Jr. |
| 2,230,215 | A | 1/1941 | Mussey |
| 2,273,201 | A | 2/1942 | Holland et al. |
| 2,314,644 | A | 3/1943 | Adams et al. |
| 2,374,777 | A | 5/1945 | Pflager |
| 2,387,072 | A | 10/1945 | Holland et al. |
| 2,389,840 | A | 11/1945 | Bruce |
| 2,573,159 | A | 10/1951 | Noe |
| 2,709,007 | A | 5/1955 | Metzger |
| 2,737,907 | A | 3/1956 | Janeway |
| 2,762,317 | A | 9/1956 | Palmgren |
| 2,774,312 | A | 12/1956 | Rossell |
| 2,777,402 | A | 1/1957 | Rossell |
| 2,802,662 | A | 8/1957 | Hirst |
| 2,818,821 | A | 1/1958 | Cregier |
| 2,836,130 | A | 5/1958 | Rossell |
| 2,921,540 | A | 1/1960 | Williams |
| 2,948,414 | A | 8/1960 | Metzger |
| 3,006,290 | A | 10/1961 | Seelig, Jr. |
| 3,098,682 | A | 7/1963 | Thomas |
| 3,168,202 | A | 2/1965 | Cope |
| 3,206,039 | A | 9/1965 | Metzger |
| 3,211,112 | A | 10/1965 | Baker |
| 3,218,989 | A | 11/1965 | Kreiner et al. |
| 3,254,613 | A | 6/1966 | Weber |
| 3,274,955 | A | 9/1966 | Thomas |
| 3,286,653 | A | 11/1966 | Weber |
| 3,302,589 | A | 2/1967 | Williams |
| 3,313,245 | A | 4/1967 | Sundby |
| 3,320,904 | A | 5/1967 | Weber |
| 3,339,498 | A | 9/1967 | Weber |
| 3,352,255 | A | 11/1967 | Sheppard |
| 3,359,923 | A | 12/1967 | Wood |
| 3,380,400 | A | 4/1968 | Barber |
| 3,381,629 | A | 5/1968 | Jones |
| 3,397,653 | A | 8/1968 | Williams |
| 3,446,265 | A | 5/1969 | Buck |
| 3,461,814 | A | 8/1969 | Weber et al. |
| 3,461,815 | A | 8/1969 | Gedris et al. |
| 3,512,482 | A | 5/1970 | Lich |
| 3,517,620 | A | 6/1970 | Weber |
| 3,539,170 | A | 11/1970 | Hamel |
| 3,559,589 | A | 2/1971 | Williams |
| 3,575,117 | A | 4/1971 | Tack |
| 3,595,350 | A | 7/1971 | Wiebe |
| 3,599,574 | A | 8/1971 | Robertson |
| 3,603,265 | A | 9/1971 | Barber |
| 3,618,533 | A | 11/1971 | Hirst |
| 3,621,792 | A | 11/1971 | Lich |
| 3,626,864 | A | 12/1971 | Wiebe |
| 3,650,220 | A | 3/1972 | Lich |
| 3,670,660 | A | 6/1972 | Weber et al. |
| 3,680,888 | A | 8/1972 | Hirst |
| 3,682,104 | A | 8/1972 | Henricot |
| 3,687,086 | A | 8/1972 | Barber |
| 3,699,897 | A | 10/1972 | Sherrick |
| 3,707,927 | A | 1/1973 | Geyer et al. |
| 3,712,247 | A | 1/1973 | Young |
| 3,716,903 | A | 2/1973 | Tack |
| 3,736,978 | A | 6/1973 | Taccone |
| 3,748,001 | A | 7/1973 | Neumann et al. |
| 3,762,339 | A | 10/1973 | Dwyer |
| 3,772,995 | A | 11/1973 | Wright |
| 3,785,298 | A | 1/1974 | Reynolds |
| 3,799,067 | A | 3/1974 | Neuman et al. |
| 3,802,353 | A | 4/1974 | Korpics |
| 3,805,707 | A | 4/1974 | Neumann et al. |
| 3,817,188 | A | 6/1974 | Lich |
| 3,837,293 | A | 9/1974 | Neumann et al. |
| 3,839,969 | A | 10/1974 | Thum |
| 3,841,233 | A | 10/1974 | Sinclair |
| 3,844,226 | A | 10/1974 | Brodeur et al. |
| 3,845,725 | A | 11/1974 | Gierlach |
| 3,855,942 | A | 12/1974 | Mulcahy |
| 3,857,341 | A | 12/1974 | Neumann |
| 3,857,556 | A | 12/1974 | Wing |
| 3,868,912 | A | 3/1975 | Wagner et al. |
| 3,872,795 | A | 3/1975 | Tack |
| 3,888,187 | A | 6/1975 | Van Moss, Jr. |
| 3,897,736 | A | 8/1975 | Tack |
| 3,897,737 | A | 8/1975 | Davis |
| 3,901,163 | A | 8/1975 | Neumann |
| 3,910,655 | A | 10/1975 | Willison et al. |
| 3,945,327 | A | 3/1976 | Henricot |
| 3,961,584 | A | 6/1976 | Paton et al. |
| 3,965,825 | A | 6/1976 | Sherrick |
| 3,977,332 | A | 8/1976 | Bullock |
| 3,995,720 | A | 12/1976 | Wiebe |
| 4,000,931 | A | 1/1977 | Geyer |
| 4,003,318 | A | 1/1977 | Bullock et al. |
| 4,004,525 | A | 1/1977 | Wiebe et al. |
| 4,026,217 | A | 5/1977 | Cross et al. |
| 4,034,681 | A | 7/1977 | Neumann et al. |
| 4,040,362 | A | 8/1977 | Oppenheim et al. |
| 4,067,261 | A | 1/1978 | Scheflel |
| 4,067,262 | A | 1/1978 | Scheflel |
| 4,072,112 | A | 2/1978 | Wiebe |
| 4,077,496 | A | 3/1978 | Wiebe |
| 4,078,501 | A | 3/1978 | Neumann et al. |
| 4,080,016 | A | 3/1978 | Wiebe |
| 4,082,043 | A | 4/1978 | Hammonds et al. |
| 4,084,513 | A | 4/1978 | Bullock |
| 4,084,514 | A | 4/1978 | Bullock |
| 4,084,705 | A | 4/1978 | Oshinsky et al. |
| 4,090,750 | A | 5/1978 | Wiebe |
| 4,103,623 | A | 8/1978 | Radwill |
| 4,109,585 | A | 8/1978 | Brose |
| 4,111,131 | A | 9/1978 | Bullock |
| 4,114,540 | A | 9/1978 | Strugielski et al. |
| 4,130,066 | A | 12/1978 | Mulcahy |
| 4,131,152 | A | 12/1978 | Ruddle et al. |
| 4,132,176 | A | 1/1979 | Wiebe |
| 4,134,343 | A | 1/1979 | Jackson |
| 4,135,833 | A | 1/1979 | MacDonnell et al. |
| 4,136,620 | A | 1/1979 | Scheflel et al. |
| D251,168 | S | 2/1979 | Perkey |
| 4,143,701 | A | 3/1979 | Oshinsky et al. |
| 4,150,627 | A | 4/1979 | Paton et al. |
| 4,151,801 | A | 5/1979 | Scheflel et al. |
| 4,167,907 | A | 9/1979 | Mulcahy et al. |
| 4,179,995 | A | 12/1979 | Day |
| 4,192,240 | A | 3/1980 | Korpics |
| 4,196,672 | A | 4/1980 | Bullock |
| 4,198,911 | A | 4/1980 | Wiebe |
| 4,203,371 | A | 5/1980 | Tack |
| 4,224,876 | A | 9/1980 | Larsen |
| 4,230,047 | A | 10/1980 | Wiebe |
| 4,236,457 | A | 12/1980 | Cope |
| 4,237,793 | A | 12/1980 | Holden et al. |
| 4,239,007 | A | 12/1980 | Kleykamp et al. |
| 4,242,966 | A | 1/1981 | Holt et al. |
| 4,245,564 | A | 1/1981 | Eulenfeld |
| 4,254,712 | A | 3/1981 | O'Neil |
| 4,254,713 | A | 3/1981 | Clafford |
| 4,256,041 | A | 3/1981 | Kemper et al. |

(56) References Cited

U.S. PATENT DOCUMENTS 4,265,182 A 5/1981 Neff et al.
4,274,340 A 6/1981 Neumann et al.
4,276,833 A 7/1981 Bullock
4,278,030 A 7/1981 Ahlborn et al.
4,295,429 A 10/1981 Wiebe
4,311,098 A 1/1982 Irwin
4,313,384 A 2/1982 Holden et al.
4,316,417 A 2/1982 Martin
4,322,981 A 4/1982 Radwill
4,330,498 A 5/1982 Kleykamp et al.
4,333,403 A 6/1982 Tack et al.
4,333,404 A 6/1982 Kleykamp
4,338,865 A 7/1982 Eggert, Jr.
4,342,266 A 8/1982 Cooley
4,351,242 A 9/1982 Irwin
4,356,774 A 11/1982 Wear et al.
4,356,775 A 11/1982 Paton et al.
4,357,880 A 11/1982 Weber
4,363,276 A 12/1982 Neumann
4,363,278 A 12/1982 Mulcahy
4,370,933 A 2/1983 Mulcahy
4,373,446 A 2/1983 Cope
4,380,199 A 4/1983 Thomson et al.
4,408,810 A 10/1983 Geyer
4,413,569 A 11/1983 Mulcahy
4,416,203 A 11/1983 Sherrick
4,426,934 A 1/1984 Geyer
4,428,303 A 1/1984 Tack
4,433,629 A 2/1984 Roush, Jr.
4,434,720 A 3/1984 Mulcahy et al.
4,438,703 A 3/1984 Eggert, Jr.
4,440,095 A 4/1984 Mathieu
4,444,122 A 4/1984 Dickhart, III
4,452,299 A 6/1984 Gruber et al.
4,455,946 A 6/1984 List
4,458,604 A 7/1984 Cope
4,478,154 A 10/1984 Holden et al.
4,480,553 A 11/1984 Scheffel
4,483,253 A 11/1984 List
4,488,495 A 12/1984 Dean, II
RE31,784 E 1/1985 Wiebe
4,491,075 A 1/1985 Neumann
4,512,261 A 4/1985 Horger
4,527,487 A 7/1985 Pinto
4,537,138 A 8/1985 Bullock
RE31,988 E 9/1985 Wiebe
4,546,706 A 10/1985 Jackson et al.
4,552,074 A 11/1985 Mulcahy et al.
4,574,708 A 3/1986 Solomon
4,637,319 A 1/1987 Moehling et al.
4,674,412 A 6/1987 Mulcahy et al.
4,729,325 A 3/1988 Henkel
4,744,308 A 5/1988 Long et al.
4,753,174 A 6/1988 Berg et al.
4,765,251 A 8/1988 Guins
4,776,283 A 10/1988 Shozi et al.
4,785,740 A 11/1988 Grandy
4,800,748 A 1/1989 Fischer et al.
4,825,775 A 5/1989 Stein et al.
4,825,776 A 5/1989 Spencer
4,825,777 A 5/1989 Cummins
4,838,174 A 6/1989 Moehling
4,841,875 A 6/1989 Corsten et al.
4,915,031 A 4/1990 Wiebe
4,926,757 A 5/1990 Spencer
4,932,330 A 6/1990 Herring, Jr.
4,936,226 A 6/1990 Wiebe
4,938,152 A 7/1990 List
4,953,471 A 9/1990 Wronkiewicz et al.
4,964,346 A 10/1990 Kirilloff et al.
4,974,521 A 12/1990 Eungard
4,977,835 A 12/1990 Altherr
4,982,781 A 1/1991 Carpenter et al.
4,986,192 A 1/1991 Wiebe
5,009,521 A 4/1991 Wiebe
5,027,716 A 7/1991 Weber et al.
5,046,431 A 9/1991 Wagner
5,046,866 A 9/1991 Mulcahy
5,072,673 A 12/1991 Lienard
5,081,935 A 1/1992 Pavlick
5,086,707 A 2/1992 Spencer et al.
5,086,708 A 2/1992 McKeown, Jr. et al.
5,095,823 A 3/1992 McKeown, Jr.
5,111,753 A 5/1992 Zlgler et al.
5,138,954 A 8/1992 Mulcahy
5,150,658 A 9/1992 Grandy
RE34,129 E 11/1992 Wright
5,174,218 A 12/1992 List
5,176,083 A 1/1993 Bullock
5,226,369 A 7/1993 Weber
5,237,933 A 8/1993 Bucksbee
5,239,932 A 8/1993 Weber
5,241,913 A 9/1993 Weber
5,261,332 A 11/1993 Grandy
5,305,694 A 4/1994 Wronkiewicz et al.
5,315,934 A 5/1994 List et al.
5,327,837 A 7/1994 Weber
5,404,826 A 4/1995 Rudibaugh et al.
5,410,968 A 5/1995 Hawthorne et al.
RE34,963 E 6/1995 Eungard
5,424,376 A 6/1995 Chang et al.
5,425,312 A 6/1995 Tack, Jr.
5,438,934 A 8/1995 Goding
5,450,799 A 9/1995 Goding
5,452,665 A 9/1995 Wronkiewicz et al.
5,461,987 A 10/1995 Nassar
5,463,964 A 11/1995 Long et al.
5,481,986 A 1/1996 Spencer et al.
5,482,675 A 1/1996 Shotwell et al.
5,509,358 A 4/1996 Hawthorne et al.
5,511,489 A 4/1996 Bullock
5,524,551 A 6/1996 Hawthorne et al.
5,544,591 A 8/1996 Taillon
5,546,869 A 8/1996 Nassar
5,551,351 A 9/1996 Hardin
5,555,818 A 9/1996 Bullock
5,562,045 A 10/1996 Rudibaugh et al.
5,572,931 A 11/1996 Lazar et al.
5,718,177 A 2/1998 Wronkiewicz et al.
5,722,327 A 3/1998 Hawthorne et al.
5,735,216 A 4/1998 Bullock et al.
5,746,137 A 5/1998 Hawthorne et al.
5,752,564 A 5/1998 Callahan et al.
5,794,538 A 8/1998 Pitchford
5,799,582 A 9/1998 Rudibaugh et al.
5,802,982 A 9/1998 Weber
5,832,838 A 11/1998 Shaw
5,850,795 A 12/1998 Taillon
5,875,721 A 3/1999 Wright et al.
5,878,897 A 3/1999 Lazzaro et al.
5,904,203 A 5/1999 Mai
5,918,547 A 7/1999 Bullock et al.
5,921,186 A 7/1999 Hawthorne et al.
5,924,366 A 7/1999 Trainer et al.
5,954,114 A 9/1999 Bauer et al.
5,967,053 A 10/1999 Toussaint et al.
6,005,021 A 12/1999 Chen et al.
6,089,166 A 7/2000 Callahan et al.
6,125,767 A 10/2000 Hawthorne et al.
6,142,081 A 11/2000 Long et al.
6,173,655 B1 1/2001 Hawthorne
6,178,894 B1 1/2001 Leingang
6,186,075 B1 2/2001 Spencer
6,196,134 B1 3/2001 Stecker
6,227,122 B1 5/2001 Spencer
6,234,083 B1 5/2001 Tack, Jr.
6,259,752 B1 7/2001 Domino et al.
6,269,752 B1 8/2001 Taillon
6,276,283 B1 8/2001 Weber
6,324,995 B1 12/2001 Kaufhold et al.
6,347,588 B1 2/2002 Leingang
6,354,226 B2 3/2002 Stecker
6,371,033 B1 4/2002 Smith et al.

(56) References Cited

U.S. PATENT DOCUMENTS 6,422,155 B1 * 7/2002 Heyden ..... B61F 5/32 105/222
6,425,334 B1 7/2002 Wronkiewicz et al.
6,439,130 B1 8/2002 Scheffel
6,543,367 B1 4/2003 Stecker et al.
6,591,759 B2 * 7/2003 Bullock ..... B61F 5/305 105/224.1
6,622,776 B2 9/2003 Bauer et al.
6,659,016 B2 12/2003 Forbes
6,662,853 B2 12/2003 Bauer et al.
6,672,224 B2 1/2004 Weber et al.
6,688,236 B2 2/2004 Taillon
6,796,448 B1 9/2004 Wilt et al.
6,871,688 B2 3/2005 Yamazaki et al.
6,874,426 B2 4/2005 Forbes
6,895,866 B2 5/2005 Forbes
6,920,828 B2 7/2005 Forbes
6,968,788 B1 11/2005 Coslovi
7,004,079 B2 2/2006 Forbes
7,017,498 B2 3/2006 Berg et al.
7,143,700 B2 * 12/2006 Forbes ..... B61F 5/50 105/223
7,174,837 B2 2/2007 Berg et al.
7,231,878 B2 6/2007 Wike
7,255,048 B2 8/2007 Forbes
7,263,930 B2 9/2007 Pershwitz et al.
7,263,931 B2 9/2007 Forbes
7,267,059 B2 9/2007 Forbes
7,302,994 B2 12/2007 Mautino et al.
7,308,855 B2 12/2007 Van Auken
7,328,659 B2 2/2008 Forbes
7,337,826 B2 3/2008 Mautino et al.
7,353,759 B2 4/2008 Gray
7,387,074 B2 6/2008 Myers
7,469,641 B2 12/2008 Berg et al.
7,497,169 B2 3/2009 Forbes et al.
7,513,199 B2 4/2009 Van Auken
7,543,626 B1 6/2009 Pinkstock et al.
7,571,684 B2 8/2009 Forbes
7,603,954 B2 10/2009 Forbes
7,610,862 B2 11/2009 Forbes
7,631,603 B2 12/2009 Forbes et al.
7,654,204 B2 2/2010 Forbes
7,681,506 B2 3/2010 Forbes et al.
7,699,008 B2 4/2010 Forbes
7,739,961 B2 * 6/2010 East ..... B61F 5/305 105/218.1
7,757,871 B2 7/2010 Mautino et al.
7,775,163 B2 8/2010 Forbes et al.
7,823,513 B2 11/2010 Forbes et al.
7,845,288 B2 12/2010 Forbes et al.
7,878,125 B2 2/2011 Forbes et al.
7,926,428 B2 4/2011 Schorr et al.
7,946,229 B2 5/2011 Forbes et al.
7,966,946 B1 6/2011 Novak et al.
8,011,305 B2 9/2011 Al-Kaabi et al.
8,011,306 B2 9/2011 Forbes
8,025,014 B2 9/2011 Forbes et al.
8,104,409 B2 1/2012 Wolinski et al.
8,113,126 B2 2/2012 Forbes et al.
8,205,560 B2 6/2012 East et al.
8,272,333 B2 9/2012 Forbes et al.
8,413,592 B2 4/2013 Forbes et al.
8,567,320 B2 10/2013 Tavares et al.
8,590,460 B2 11/2013 Wike
8,746,151 B2 6/2014 Forbes et al.
D721,074 S 1/2015 Harris
9,216,450 B2 12/2015 Gotland et al.
9,434,393 B2 * 9/2016 Gotlund ..... B61F 5/125
9,637,143 B2 * 5/2017 Gotlund ..... B61F 5/14
9,669,846 B2 * 6/2017 Gotlund ..... B61F 5/305
9,758,181 B2 * 9/2017 Gotlund ..... B61F 5/125
10,358,151 B2 * 7/2019 Gotlund ..... B61F 3/02
10,562,547 B2 * 2/2020 Gotlund ..... B61F 5/26
10,569,790 B2 * 2/2020 Gotlund ..... B61F 5/50
10,752,265 B2 * 8/2020 Gotlund ..... B61F 5/32
2001/0000571 A1 5/2001 Bauer et al.
2001/0008108 A1 7/2001 Stecker
2002/0038979 A1 4/2002 Watanabe et al.
2003/0062772 A1 4/2003 Rasmussen
2003/0136542 A1 7/2003 Bauer et al.
2003/0196648 A1 10/2003 Schroer et al.
2003/0221811 A1 12/2003 Smith et al.
2004/0020403 A1 2/2004 Forbes
2004/0031413 A1 2/2004 Smith
2004/0173555 A1 9/2004 Wilt et al.
2004/0211543 A1 10/2004 Wick et al.
2005/0005815 A1 1/2005 Forbes et al.
2005/0022689 A1 2/2005 Forbes et al.
2005/0223936 A1 10/2005 Forbes
2005/0268812 A1 12/2005 Auken
2005/0268813 A1 12/2005 Van Auken
2006/0021727 A1 2/2006 Rizzo
2006/0117985 A1 6/2006 Forbes et al.
2006/0137565 A1 6/2006 Forbes et al.
2007/0051270 A1 3/2007 Forbes et al.
2007/0084377 A1 4/2007 Myers
2007/0084818 A1 4/2007 Brabb et al.
2007/0137516 A1 6/2007 Gray
2007/0181033 A1 8/2007 Forbes et al.
2007/0209546 A1 9/2007 Forbes
2008/0017065 A1 1/2008 Berg et al.
2008/0066641 A1 3/2008 Forbes et al.
2008/0128377 A1 6/2008 Mautino et al.
2008/0271633 A1 11/2008 Forbes et al.
2009/0126599 A1 5/2009 Forbes et al.
2009/0158956 A1 6/2009 Forbes et al.
2009/0158957 A1 6/2009 East et al.
2009/0289024 A1 11/2009 Nibouar et al.
2009/0294396 A1 12/2009 Smerecky et al.
2010/0037797 A1 2/2010 Forbes
2010/0064930 A1 3/2010 Schorr et al.
2010/0095864 A1 4/2010 Forbes
2010/0139521 A1 6/2010 Forbes
2010/0154672 A1 6/2010 Forbes et al.
2010/0199880 A1 8/2010 East et al.
2010/0288157 A1 11/2010 LeFebvre et al.
2010/0326943 A1 12/2010 Mautino et al.
2011/0068077 A1 3/2011 Smyth
2011/0073002 A1 3/2011 Forbes et al.
2011/0126392 A1 6/2011 Forbes
2011/0168655 A1 7/2011 Nibouar et al.
2011/0185939 A1 8/2011 Forbes et al.
2012/0186486 A1 7/2012 Tavares et al.
2012/0222581 A1 9/2012 Jeambey et al.
2012/0234202 A1 9/2012 Tavares et al.
2012/0291661 A1 11/2012 Gotlund et al.
2012/0318166 A1 12/2012 Wike
2013/0055922 A1 3/2013 Sun et al.
2013/0098261 A1 4/2013 Forbes et al.
2013/0098262 A1 4/2013 Forbes et al.
2014/0060380 A1 3/2014 Berg et al.
2014/0109792 A1 4/2014 Forbes et al.
2014/0318412 A1 10/2014 East et al.
2015/0183445 A1 7/2015 Gotlund et al.
2015/0183446 A1 7/2015 Gotlund et al.
2015/0353105 A1 12/2015 Nishimura et al.
2016/0137211 A1 5/2016 Gotlund et al.
2016/0257314 A1 9/2016 Gotlund et al.
2017/0096149 A1 4/2017 Gotlund et al.
2017/0232503 A1 8/2017 Nibouar et al.
2018/0118232 A1 5/2018 Gotlund et al.

FOREIGN PATENT DOCUMENTS

CN 101010231 A 8/2007
CN 202541562 U 11/2012
CN 103693063 A 4/2014
CN 106132800 A 11/2016
DE 9315991 U1 2/1994
EP 0596044 B1 5/1996
EP 0825084 A2 2/1998
EP 1060971 A1 12/2000
EP 1531018 A1 5/2005

(56) References Cited

FOREIGN PATENT DOCUMENTS

| | | | |
|---|---|---|---|
| EP | 2022580 | A1 | 2/2009 |
| EP | 2149413 | A1 | 2/2010 |
| GB | 221961 | A | 9/1924 |
| GB | 355247 | A | 8/1931 |
| GB | 1037298 | A | 7/1966 |
| GB | 2055722 | A | 3/1981 |
| RU | 2082638 | C1 | 6/1997 |
| RU | 2116921 | C1 | 8/1998 |
| RU | 54138 | U1 | 6/2006 |
| RU | 2373091 | C2 | 11/2009 |
| RU | 2401756 | C2 | 10/2010 |
| RU | 2426053 | C1 | 8/2011 |
| RU | 115743 | U1 | 5/2012 |
| RU | 2546352 | C2 | 4/2015 |
| WO | 9301962 | A1 | 2/1993 |
| WO | 0151331 | A1 | 7/2001 |
| WO | 0181024 | A1 | 11/2001 |
| WO | 200240333 | A1 | 5/2002 |
| WO | 2008154712 | A1 | 12/2008 |
| WO | 2010033694 | A1 | 3/2010 |
| WO | 2015103075 | A2 | 7/2015 |
| WO | 2015103276 | A2 | 7/2015 |
| WO | 2016099876 | A1 | 6/2016 |
| WO | 2018126186 | A1 | 7/2018 |

OTHER PUBLICATIONS

"Air Set Casting", Butler Foundry, retrieved Oct. 7, 2009 from http://www.foundry-casting.co.uk/air-set-casting.html; 2 pp.
"Air-Set (no bake) Process", Bernier Cast Metals Inc., retrieved Oct. 7, 2009 from http://www.bernierinc.com/Air_Set.html; 1 page.
"Comparators for the Definition of Surface Quality of Steel Castings", Steel Castings Research and Trade Association, 1981 Scrata; 44 pp.
"Dimensional Capabilities of Steel Castings", SFSA Supplement 3, retrieved Jan. 12, 2010 from www.sfsa.org/sfsa/pubs/hbk/s3.pdf; 33 pp.
"Green Sand Molding", Bernier Cast Metals Inc., retrieved Oct. 7, 2009 from http://www.bernierinc.com/Green_Sand_Molding.html; 1 page.
"Optimising Sand Use in Foundries", Environmental Technology Best Practice Programme, Mar. 1998, GG119.
"Precision Air-Set Casting Process", Armstrong Mold Corporation, retrieved Oct. 7, 2009 from http://www.armstrongmold.com/pages/airset.html; 2 pp.
"Sand Casting", Custom PartNet, retrieved Oct. 7, 2009 from http://www.custompartnet.com/wu/SandCasting 7 pp.
"Standard Practice for Steel Castings", Feb. 1990, Surface Acceptance Standards, Visual Examination ASTM-A 802/A 802M,; 2 pp.
Oct. 10, 2008—"The Sand Process" By Tom Clark, McCann Sales, Inc., Internet Archive www.mccannsales.com:book:sandcasting.pdf.
2009 "Design for Economical Sand Molding", Casting Design and Performance, ASM International, Materials Park, Ohio, pp. 81-87.
Aug. 16, 2011—U.S. Office Action—U.S. Appl. No. 12/685,346.
Dec. 16, 2011—(WO) International Preliminary Report—App. PCT/US2011/020207.
Aug. 8, 2012—(WO) International Search Report and Written Opinion—App. PCT/US2012/037880.
Aug. 14, 2012—(WO) International Search Report and Written Opinion—PCT/US2012/037905.
Aug. 22, 2012—(WO) International Search Report and Written Opinion—App. PCT/US2012/037984.
Aug. 23, 2012—(WO) International Search Report and Written Opinion—App. PCT/US2012/037946.
Aug. 30, 2012—(WO) International Search Report and Written Opinion—App. PCT/US2012/037880.
Jul. 27, 2012—U.S. Office Action—U.S. Appl. No. 12/685,346.
May 8, 2012—U.S. Office Action—U.S. Appl. No. 12/685,346.
Oct. 25, 2012—(WO) International Search Report and Written Opinion—App. PCT/US2012/037947.
Feb. 25, 2013—(CN) Office Action—App. 200980122328.8.
Jan. 23, 2013—U.S. Office Action—U.S. Appl. No. 12/685,346.
Jul. 3, 2014—(CN) Office Action—App. 201180005770.X.
Jun. 3, 2014—(CN) Office Action—App. 201280001865.9.
Jun. 4, 2014—(CN) Office Action—App. 201280001875.2.
Oct. 6, 2014—U.S. Nonfinal Office Action—U.S. Appl. No. 13/109,870.
Apr. 7, 2015—(WO) Partial International Search Report—App. PCT/US2014/072350.
Apr. 7, 2015—(WO) Partial International Search Report—App. PCT/US2014/072772.
Apr. 29, 2015—(CN) Office Action—App. 201180005770.X.
Aug. 17, 2015—(AU) Office Action—App. 2011203691.
Feb. 5, 2015—(MX) Office Action—App. MX/A/2013/000184.
Feb. 6, 2015—(AU) Office Action—App. 2012255890.
Feb. 9, 2015—(AU) Office Action—App. 2012255926.
Feb. 9, 2015—(AU) Office Action—App. 2012255940.
Feb. 12, 2015—(AU) Office Action in App. 2012255958.
Feb. 16, 2015—(CN) Office Action—App. 201280001875.2.
Feb. 26, 2015—(MX) Office Action—App. MX/X/2013/000187.
Jul. 6, 2015—U.S. Office Action—U.S. Appl. No. 13/109,880.
Jul. 7, 2015—(MX) Office Action—App. MX/A/2014/012161.
Jul. 9, 2015—(WO) International Search Report and Written Opinion—App. PCT/US2014/072350.
Jul. 9, 2015—(WO) International Search Report and Written Opinion—App. PCT/US2014/072772.
Jul. 28, 2015—(MX) Office Action—App. MX/A/2013/000185.
Jul. 31, 2015—(MX) Office Action—App. MX/A/2013/000187.
Jun. 3, 2015—(MX) Office Action—App. MX/A/2013/000184.
Jun. 3, 2015—U.S. Office Action—U.S. Appl. No. 13/109,866.
Mar. 3, 2015—(MX) Office Action—App. MX/A/2013/000186.
Mar. 5, 2015—(MX) Office Action—App. MX/A/2013/000185.
Sep. 28, 2020 (CA) First Office Action—App. No. 3048639.
Nov. 20, 2020 (IN) Office Action—App. No. 201947029462.
Oct. 21, 2020 (CN) First Office Action—App. No. 201911126255.1.
Jun. 5, 2019 (CN) Second Office Action—App. No. 201610926907.X.
Apr. 7, 2020 (CN) First Office Action—App. No. 2019202945.
Jul. 7, 2020—(BR) OA—App. No. BR112017024355-5.
Dec. 10, 2020 (MX) First Office Action—App. No. MX/a/2017/002324.
Nikipedia, Cope and Drag, retrieved Oct. 7, 2009 from http://en.wikipedia.org/wiki/Cop_and_drag; 1 page.
Wikipedia, Flask (casting), retrieved Oct. 7, 2009 from http://en.wikipedia.org/wiki/casting_flask; 1 page.
Wikipedia, Molding Sand, retrieved Oct. 7, 2009 from http://en.wikipedia.org/wiki/molding_sand; 1 page.
Wikipedia, No bake mold casting, retrieved Oct. 7, 2009 from http://en.wikipedioa.org/wiki/no_bake_mold_casting; 2 pp.
Wikipedia, Sand Casting, retrieved Oct. 7, 2009 from http://en.wikipedia.org/wiki/sand_casting; 10 pp .
Zhukovsky, S.S. and Lyass, A.M., "Molds and Cores Made of Cold-Hardening Mixtures", Machinery Engineering, 1978 Moscow, pp. 188-191, 196-197.
Mar. 27, 2019—(CN) Office Action—App 2014800757467.
Apr. 18, 2019—U.S. Office Action—App 158362381.
Apr. 4, 201—(CA) Office Action—App 2803969.
May 8, 2019—(IN) Office Action—App. 11389/DELNP/2012.
Apr. 30, 2018—(WO) International Search Report and Written Opinion.
Jun. 20, 2019—U.S. Office Action—U.S. Appl. No. 15/668,427.
Jul. 10, 2019—(CZ) Office Action—App. No. PV 2012-964.
Jan. 25, 2019—(RU) Decision on Grant—App. 201714338.
Jun. 27, 2019 (CA) Office Action—App 2985895.
Sep. 4, 2019 (CN) Not of Allowance—App 201680041419.9.
Sep. 19, 2019 (AU) Not of Allowance—App 2016262092.
Sep. 18, 2019 (MX) First Office Action—App MX/a/2016/008608.
Jun. 27, 2019 (IN) Office Action—App 201647025661.
Sep. 29, 2019 (CN) Notice of Allowance—App 201480075746.7.
Jun. 25, 2019—(CA) Examiner's Report—Ap. 2803966.
Jul. 15, 2019—(IN) First Examination Report—App. No. 11390/DELNP/2012.

(56) References Cited

OTHER PUBLICATIONS

Jun. 19, 2020 (CN) First Office Action—App 201780087506.2.
Jun. 17, 2021 (IN) Office Action—App. No. 202048039154.
Sep. 18, 2020 (CA) Office Action—App. No. 3048637.
Sep. 28, 2020 (IN) Office Action—App. No. 201947029632.
Feb. 26, 2021 (AU) Examination Report—App No. 2020200046.
Mar. 10, 2015—(CN) Office Action—App. 201280001871.4.
Mar. 11, 2015—(CN) Office Action—App. 201280001874.8.
Mar. 17, 2015—(CN) Office Action—App. 201280001865.9.
May 8, 2015—U.S. Office Action—U.S. Appl. No. 13/109,843.
Oct. 13, 2015—(CN) Office Action—App. 2011800005770.X.
Oct. 20, 2015—(CN) Office Action—App. 201280001871.4.
Oct. 21, 2015—(CN) Office Action—App. 20120001874.8.
Dec. 7, 2016—(CA) Office Action—App. 2786788.
Jan. 20, 2016—U.S. Office Action—U.S. Appl. No. 14/585,569.
Mar. 31, 2016—(CN) Office Action—App. 201280001871.4.
May 26, 2016—(RU) Office Action—App. 2012156922.
May 31, 2016—(RU) Office Action—App. 2012156914.
Oct. 4, 2016—U.S. Office Action—U.S. Appl. No. 14/562,005.
Oct. 14, 2016—U.S. Office Action—U.S. Appl. No. 14/561,897.
Sep. 2, 2016—(WO) International Search Report and Written Opinion—App. PCT/US2016/032148.
Apr. 5, 2017—U.S. Office Action—U.S. Appl. No. 14/586,483.
Feb. 22, 2017—(RU) Office Action—App. 2012156922.
Jan. 4, 2017—U.S. Office Action—U.S. Appl. No. 14/562,005.
Jun. 16, 2017—(AU) Office Action—App. 2016203549.
Mar. 22, 2017—(CA) Office Action—App. 2935300.
Mar. 27, 2017—(CA) Office Action—App. 2935380.
Nov. 27, 2017—(CN) Office Action—App. 201480075746.7.
Oct. 26, 2017—U.S. Office Action—U.S. Appl. No. 14/943,269.
Sep. 4, 2017—(CN) Office Action—App. 201610327401.7.
Apr. 4, 2018—(CA) Office Action—App. 2803969.
Apr. 18, 2018—U.S. Office Action—U.S. Appl. No. 15/362,381.
Apr. 24, 2018—(WO) International Search Report and Written Opinion.
Apr. 30, 2018—(WO) International Search Report and Written Opinion Application No. PCT/US2017/069053.
Dec. 3, 2018—(CA) Office Action—App. 2803966.
Dec. 28, 2018—(CN) Office Action—App 201680041419.9.
Feb. 12, 2018—(RU) Office Action—App. 201714338.
Jan. 3, 201—(IN) Office Action—App. 6030/CHENP/2012.
Jan. 22, 2018—(AU) Office Action—App. 2016256795.
Jul. 27, 2018—(CN) Office Action—App. 201480075746.7.
Jul. 3, 2018—(CN) Office Action—App. 201610327401.7.
Jun. 26, 2018—(BR) Office Action—App. 112012033682.7.
Jun. 26, 2018—(CN) Office Action—App. 201610926907.
Mar. 9, 2018—(CA) Office Action—App. 2803966.
Oct. 26, 2018—(CA) Office Action—App. 2985895.
Sep. 4, 2018—U.S. Office Action—U.S. Appl. No. 15/858,076.
Sep. 5, 2018—U.S. Office Action—U.S. Appl. No. 15/856,221.
Sep. 26, 2018—(AU) Office Action—App. 2016262092.
Feb. 27, 2019'U.S. Office Action—U.S. Appl. No. 15/378,472.
Jan. 10, 2019—(AU) Office Action—App. 2016262092.
Jan. 28, 2019—(CZ) Office Action—App. PV2012-447.
Mlogilyov, V.K. and Lev, O.I., Molder reference book, Moscow, Machinery Engineering, 1988, pp. 15-36, Tables 9-13 and 16-22.
Mlogilyov, V.K. et al., Machinery Engineering, 1988 Moscow, pp. 15-24, 34-36.
Rajput, R. K., A Textbook of Manufacturing Technology: Manufacturing Processes, Oct. 1, 2007, Firewall Media, pp. 74-78.
Steel Castings Handbook, 6th Edition, Dec. 1995, Steel Founders' Society of America, ASM International, 4 pp.
Wikipedia, Chill (casting), retrieved Oct. 7, 2009 from http://en.wikipedia.org/wiki/Chill (foundry); 2 pp.
Apr. 8, 2020 (AU) Examination Report—App. No. 2019202938.
Apr. 18, 2022—(IN) Office Action—App. No. 202118049451.
Feb. 23, 2022 (AU) Notice of Acceptance—App No. 2020200046.
Jul. 5, 2021—(RU) OA and RSR—App. No. 2017142553.
May 13, 2021—(IN) Examination Report—App. No. 202048015271.
Nov. 16, 2021—(RU) NOA—App. No. 2019108614.

* cited by examiner

RAILCAR TRUCK ROLLER BEARING ADAPTER-PAD SYSTEMS

CROSS-REFERENCE TO RELATED APPLICATIONS

This patent application is a continuation of U.S. patent application Ser. No. 15/858,076, filed Dec. 29, 2017, which claims the benefit of U.S. Provisional Patent Application No. 62/440,704 filed on Dec. 30, 2016. This patent application is also a continuation-in-part application of U.S. patent application Ser. No. 15/378,472 filed Dec. 14, 2016, which is a continuation application of U.S. patent application Ser. No. 15/152,860 (now U.S. Pat. No. 9,637,143) filed May 12, 2016, and which claims the benefit of U.S. Provisional Patent Application No. 62/161,139 filed May 13, 2015. U.S. patent application Ser. No. 15/152,860 is also a continuation-in-part-application of U.S. patent application Ser. No. 14/585,569 filed Dec. 30, 2014 (now U.S. Pat. No. 9,434,393), which claims the benefit of U.S. Provisional Application Nos. 61/921,961 and 62/065,438, filed Dec. 30, 2013 and Oct. 17, 2014 respectively. U.S. patent application Ser. No. 15/152,860 is also a continuation-in-part of U.S. patent application Ser. No. 14/561,897 filed Dec. 5, 2014, U.S. patent application Ser. No. 14/562,005 filed Dec. 5, 2014, and U.S. patent application Ser. No. 14/562,082 filed Dec. 5, 2014, which, in turn, each claim the benefit of U.S. Provisional Application Nos. 61/921,961 and 62/065,438, filed Dec. 30, 2013 and Oct. 17, 2014 respectively. This patent application is a continuation application of U.S. patent application Ser. No. 15/835,907 filed Dec. 8, 2017, which is a continuation application of U.S. patent application Ser. No. 15/378,472 filed Dec. 14, 2016, which is a continuation application of U.S. patent application Ser. No. 15/152,860 (now U.S. Pat. No. 9,637,143) filed May 12, 2016, and which claims the benefit of U.S. Provisional Patent Application No. 62/161,139 filed May 13, 2015. U.S. patent application Ser. No. 15/152,860 is also a continuation-in-part-application of U.S. patent application Ser. No. 14/585,569 filed Dec. 30, 2014 (now U.S. Pat. No. 9,434,393), which claims the benefit of U.S. Provisional Application Nos. 61/921,961 and 62/065,438, filed Dec. 30, 2013 and Oct. 17, 2014 respectively. U.S. patent application Ser. No. 15/152,860 is also a continuation-in-part of U.S. patent application Ser. No. 14/561,897 filed Dec. 5, 2014, U.S. patent application Ser. No. 14/562,005 filed Dec. 5, 2014, and U.S. patent application Ser. No. 14/562,082 filed Dec. 5, 2014, which, in turn, each claim the benefit of U.S. Provisional Application Nos. 61/921,961 and 62/065,438, filed Dec. 30, 2013 and Oct. 17, 2014 respectively. This patent application is a continuation application of U.S. patent application Ser. No. 15/668,427 filed Aug. 3, 2017, which is a divisional application of U.S. patent application Ser. No. 14/562,005 filed Dec. 5, 2014 (now U.S. Pat. No. 9,758,181), which claims the benefit of U.S. Provisional Patent Application No. 61/921,961, filed Dec. 30, 2013 and U.S. Provisional Patent Application No. 62/065,438, filed Oct. 17, 2014. This patent application is a continuation of U.S. patent application Ser. No. 15/378,472 filed Dec. 14, 2016, which is a continuation application of U.S. patent application Ser. No. 15/152,860 filed May 12, 2016, which claims the benefit of U.S. Provisional Patent Application No. 62/161,139 filed May 13, 2015. U.S. patent application Ser. No. 15/152,860 is also a continuation-in-part-application of U.S. patent application Ser. No. 14/585,569 filed Dec. 30, 2014 (now U.S. Pat. No. 9,434,393), which claims the benefit of U.S. Provisional Application Ser. Nos. 61/921,961 and 62/065,438, filed Dec. 30, 2013 and Oct. 17, 2014 respectively. U.S. patent application Ser. No. 15/152,860 is also a continuation-in-part of U.S. patent application Ser. No. 14/561,897 filed Dec. 5, 2014, U.S. patent application Ser. No. 14/562,005 filed Dec. 5, 2014, and U.S. patent application Ser. No. 14/562,082 filed Dec. 5, 2014, which, in turn, each claim the benefit of U.S. Provisional Application Ser. Nos. 61/921,961 and 62/065,438, filed Dec. 30, 2013 and Oct. 17, 2014 respectively. The disclosures of each of the above noted applications are hereby incorporated by reference in their entirety.

TECHNICAL FIELD

The present disclosure relates to railcar trucks, and more particularly to roller bearing adapter and adapter-pad systems that can improve stiffness, damping, and displacement characteristics to satisfy both curving and high speed performance of a three-piece railcar truck.

BACKGROUND

The conventional railway freight car truck in use in North America for many decades has been the three-piece truck, comprising a pair of parallel side frames connected by a transversely mounted bolster. The bolster is supported on the side frames by spring groups consisting of a number of individual coil springs. The wheelsets of the truck are received in bearing adapters placed in leading and trailing pedestal jaws in the side frames, so that axles of the wheelsets are parallel in a transverse or lateral position relative to the two rails. The railway car is mounted on the center plate of the bolster, which allows the truck to rotate with respect to the car. The spring groups and side frame to bolster clearance stops permit the side frames to move somewhat with respect to the bolster, about the longitudinal, vertical and transverse or lateral axes.

It has long been desired to improve the performance of the three-piece truck. Resistance to lateral and longitudinal loads and truck performance can be characterized in terms of one or more of the following well-known phenomena.

"Parallelogramming" occurs when one side frame moves forward longitudinally with respect to the other, such that the leading and trailing wheel sets remain parallel to each other but they are not perpendicular to the rails, as may happen when a railway car truck encounters a curve. This action of parallelogramming side frames is also referred to as truck warp.

"Hunting" describes an oscillating sinusoidal longitudinal and lateral movement of the wheelsets that causes the railcar body to move side-to-side. This sinusoidal movement is the harmonic oscillation caused by the tapered profile of the wheelset. While the tapered profile promotes natural oscillation of the wheelset, it is also the primary feature that allows the wheelsets to develop a rolling radius difference and negotiate curves. Hunting may be dangerous when the oscillations attain a resonant frequency. Hunting is more likely to occur when there is a lack of proper alignment in the truck as manufactured, or developed over time through various operating conditions such as wear of the truck components. Hunting is also more likely to occur when the railcar is operated at higher speeds. The speed at which hunting is observed to occur is referred to as the "hunting threshold."

Several approaches have been tried to improve the stability of the standard three-piece truck to prevent parallelogramming and hunting, while at the same time ensuring that the truck is able to develop the appropriate geometry to accommodate the different distances traveled by the wheels on the inside and outside of a turn, respectively. Additional improvement is desired, both to meet truck hunting requirements as well as to simultaneously improve stiffness, damping, and displacement characteristics that yield good high speed and curving performance.

BRIEF SUMMARY OF THE INVENTION

This Summary provides an introduction to some general concepts relating to this invention in a simplified form that are further described below in the Detailed Description.

Aspects of the disclosure herein relate to railcar trucks, roller bear adapters and adapter pads.

In one example the disclosure provides a roller bearing adapter pad configured for use with a three-piece truck having AAR standard geometry the adapter pad configured to engage a side frame pedestal roof. The roller bearing adapter pad may include a continuous top plate having a central portion, first and second upturned regions projecting upwardly from opposite edges of the central portion, a first lateral flange projecting outwardly from the first upturned region, the first lateral flange having a first lateral edge, and a second lateral flange projecting outwardly from the second upturned region, the second lateral flange having a second lateral edge, the continuous top plate having first and second longitudinal edges; a continuous bottom plate having a central portion, first and second upturned regions projecting upwardly from opposite edges of the central portion, a first lateral flange projecting outwardly from the first upturned region, the first lateral flange having a first lateral edge, and a second lateral flange projecting outwardly from the second upturned region, the second lateral flange having a second lateral edge, the continuous bottom plate having first and second longitudinal edges; an elastomeric member disposed between the top and bottom plate. The first lateral edge of the top plate and the second lateral edge of the top plate may define a inward curving or inward angled edge from an outer surface of the top plate to an inner surface of the top plate in a side view, and the first lateral edge of the bottom plate and the second lateral edge of the bottom plate define a inward curving or inward angled edge from an outer surface of the bottom plate to an inner surface of the bottom plate in a side view. The first longitudinal edge of the top plate and the second longitudinal edge of the top plate define a inward curving or inward angled edge from an outer surface of the top plate to an inner surface of the top plate in a side view, and the first longitudinal edge of the bottom plate and the second longitudinal edge of the bottom plate define a inward curving or inward angled edge from an outer surface of the bottom plate to an inner surface of the bottom plate in a side view. The first lateral edge of the top plate and the second lateral edge of the top plate include curved portions from a top view, and the first lateral edge of the bottom plate and the second lateral edge of the bottom plate include curved portions from a top view. The elastomeric member extends laterally outward beyond the first and second lateral edges of the top and bottom plates; and the elastomeric member extends longitudinally outward beyond the first and second longitudinal edges of the top and bottom plates.

The first lateral edge of the top plate and the second lateral edge of the top plate may include a continuous radius in a top view measured from a vertical axis at a center point of the central portion of the top plate, and the first lateral edge of the bottom plate and the second lateral edge of the bottom plate include a continuous radius in a top view measured from a vertical axis at a center point of the central portion of the bottom plate.

The elastomeric member may extend laterally outward beyond the first and second lateral edges of the top and bottom plates by at least 0.05 inches, and the elastomeric member may extend longitudinally outward beyond the first and second longitudinal edges of the top and bottom plates by at least 0.05 inches. The elastomeric member disposed between the central portions of the top and bottom plates may have substantially uniform thickness.

In another example, a roller bearing adapter pad system configured for use with a three-piece truck having AAR standard geometry is disclosed. The roller bearing adapter pad system may include a roller bearing adapter configured to engage a roller bearing, the roller bearing adapter comprising: a crowned top surface; a bottom surface configured to engage a roller bearing; and first and second vertical shoulders that project upwardly from opposite lateral edges of the top surface. The roller bearing adapter pad system may also include an adapter pad engaged with the roller bearing adapter and configured to engage a side frame pedestal roof. The adapter pad may include a continuous top plate having a central portion, first and second upturned regions projecting upwardly from opposite edges of the central portion, a first lateral flange projecting outwardly from the first upturned region, the first lateral flange having a first lateral edge, and a second lateral flange projecting outwardly from the second upturned region, the second lateral flange having a second lateral edge, the continuous top plate having first and second longitudinal edges; a continuous bottom plate having a central portion, first and second upturned regions projecting upwardly from opposite edges of the central portion, a first lateral flange projecting outwardly from the first upturned region, the first lateral flange having a first lateral edge, and a second lateral flange projecting outwardly from the second upturned region, the second lateral flange having a second lateral edge, the continuous bottom plate having first and second longitudinal edges; and an elastomeric member disposed between the top and bottom plate. The first and second laterally projecting flanges of the top plate and the bottom plate are entirely disposed above the vertical shoulders of the roller bearing adapter.

The first lateral edge of the top plate and the second lateral edge of the top plate may include curved portions from a top view, and the first lateral edge of the bottom plate and the second lateral edge of the bottom plate include curved portions from a top view. The first lateral edge of the top plate and the second lateral edge of the top plate may also include a continuous radius in a top view measured from a vertical axis at a center point of the central portion of the top plate, and the first lateral edge of the bottom plate and the second lateral edge of the bottom plate may also include a continuous radius in a top view measured from a vertical axis at a center point of the central portion of the bottom plate.

The first lateral edge of the top plate and the second lateral edge of the top plate define a inward curving or inward angled edge from an outer surface of the top plate to an inner surface of the top plate in a side view, and the first lateral edge of the bottom plate and the second lateral edge of the bottom plate define a inward curving or inward angled edge from an outer surface of the bottom plate to an inner surface of the bottom plate in a side view.

The first longitudinal edge of the top plate and the second longitudinal edge of the top plate define a inward curving or inward angled edge from an outer surface of the top plate to an inner surface of the top plate in a side view, and the first longitudinal edge of the bottom plate and the second longitudinal edge of the bottom plate define a inward curving or inward angled edge from an outer surface of the bottom plate to an inner surface of the bottom plate in a side view.

The elastomeric member may extend laterally outward beyond the first and second lateral edges of the top and bottom plates; and the elastomeric member may extend longitudinally outward beyond the first and second longitudinal edges of the top and bottom plates.

The highest strain values may occur inward of the outer edges of the elastomeric member when the top plate is displaced 0.234 inches laterally relative to the bottom plate. The combined top plate, bottom plate, and elastomeric member of the adapter pad provide a strain that is less than 80% when the top plate is displaced 0.234 inches laterally relative to the bottom plate. The combined top plate, bottom plate, and elastomeric member of the adapter pad provide a strain that is less than 90% when the top plate is displaced 0.234 inches laterally relative to the bottom plate.

The highest strain values occur inward of the outer edges of the elastomeric member when the top plate is displaced 0.139 inches longitudinally relative to the bottom plate. The combined top plate, bottom plate, and elastomeric member of the adapter pad provide a strain that is less than 80% when the top plate is displaced 0.139 inches longitudinally relative to the bottom plate. The combined top plate, bottom plate, and elastomeric member of the adapter pad provide a strain that is less than 90% when the top plate is displaced 0.139 inches longitudinally relative to the bottom plate.

The thickness of portions of the elastomeric members disposed between the first and second lateral flanges of the top and bottom plates are precompressed from a static state.

The roller bearing adapter pad system may also include a first compression shim disposed between the first lateral flange of the bottom plate and the first vertical shoulder of the roller bearing adapter; and a second compression shim disposed between the second lateral flange of the bottom plate and the second vertical shoulder of the roller bearing adapter.

A portion of the elastomeric member disposed between the central portions of the top and bottom plates may have a substantially uniform thickness.

In another example the disclosure provides, a roller bearing adapter pad configured for use with a three-piece truck having AAR standard geometry the adapter pad configured to engage a side frame pedestal roof. The adapter pad may include a continuous top plate having a central portion, first and second upturned regions projecting upwardly from opposite edges of the central portion, a first lateral flange projecting outwardly from the first upturned region, the first lateral flange having a first lateral edge, and a second lateral flange projecting outwardly from the second upturned region, the second lateral flange having a second lateral edge, the continuous top plate having first and second longitudinal edges; a continuous bottom plate having a central portion, first and second upturned regions projecting upwardly from opposite edges of the central portion, a first lateral flange projecting outwardly from the first upturned region, the first lateral flange having a first lateral edge, and a second lateral flange projecting outwardly from the second upturned region, the second lateral flange having a second lateral edge, the continuous bottom plate having first and second longitudinal edges; and an elastomeric member disposed between the top and bottom plate. The first lateral edge of the top plate and the second lateral edge of the top plate define a inward curving or inward angled edge from an outer surface of the top plate to an inner surface of the top plate in a side view, and the first lateral edge of the bottom plate and the second lateral edge of the bottom plate define a inward curving or inward angled edge from an outer surface of the bottom plate to an inner surface of the bottom plate in a side view; and the first longitudinal edge of the top plate and the second longitudinal edge of the top plate define a inward curving or inward angled edge from an outer surface of the top plate to an inner surface of the top plate in a side view, and the first longitudinal edge of the bottom plate and the second longitudinal edge of the bottom plate define a inward curving or inward angled edge from an outer surface of the bottom plate to an inner surface of the bottom plate in a side view. The adapter pad may also include a first compression shim disposed below the first lateral flange of the bottom plate; and a second compression shim disposed below the second lateral flange of the bottom plate.

The first lateral edge of the top plate and the second lateral edge of the top plate may include curved portions from a top view, and the first lateral edge of the bottom plate and the second lateral edge of the bottom plate may include curved portions from a top view.

The first lateral edge of the top plate and the second lateral edge of the top plate include a continuous radius in a top view measured from a vertical axis at a center point of the central portion of the top plate, and the first lateral edge of the bottom plate and the second lateral edge of the bottom plate include a continuous radius in a top view measured from a vertical axis at a center point of the central portion of the bottom plate. Any point on the lateral edge, when the top plate is rotated up to 41 milliradians from the neutral position relative to the bottom plate, may have a linear displacement less than or equal to 0.234, The elastomeric member may extend laterally outward beyond the first and second lateral edges of the top and bottom plates and, the elastomeric member extends longitudinally outward beyond the first and second longitudinal edges of the top and bottom plates.

The thickness of portions of the elastomeric members disposed between the first and second lateral flanges of the top and bottom plates may be precompressed from a static state.

The elastomeric member disposed between the central portions of the top and bottom plates may have a substantially uniform thickness.

The adapter pad may have an overall longitudinal length of about 6.5 inches to about 8.5 inches, and the adapter pad may have an overall lateral length of about 9 inches to about 11 inches.

The elastomeric member may have a hardness between 65-80 Shore A durometer.

In another example, the disclosure provides a roller bearing adapter pad system configured for use with a three-piece truck having AAR standard geometry. The roller bearing adapter pad system may include a roller bearing adapter configured to engage a roller bearing, the roller bearing adapter having a top surface; and a bottom surface configured to engage a roller bearing. The roller bearing adapter pad system may also include an adapter pad engaged with the roller bearing adapter and configured to engage a side frame pedestal roof. The adapter pad may include a top plate; a bottom plate; and an elastomeric member disposed between the top and bottom plate. The combined top plate, bottom plate, and elastomeric member may provide a longitudinal stiffness of at least 45,000 pounds per inch through a longitudinal displacement of the top plate relative to the bottom plate of up to 0.139 inches from a central position, a lateral stiffness of at least 45,000 pounds per inch through a lateral displacement of the top plate relative to the bottom plate of up to 0.234 inches from the central position, and a rotational stiffness of at least 250,000 pound*inches per radian of rotation through a rotational displacement of the top plate relative to the bottom plate of up to 41 milliradians from the central position when a vertical load of 35,000 pounds is applied to the central portions of the adapter pad. The roller bearing adapter may also include a first compression shim disposed below the first lateral flange of the bottom plate; and a second compression shim disposed below the second lateral flange of the bottom plate.

The highest strain values occur inward of the outer edges of the elastomeric member when the top plate is displaced 0.234 inches laterally relative to the bottom plate. The combined top plate, bottom plate, and elastomeric member of the adapter pad provide a strain that is less than 90% when the top plate is displaced 0.234 inches laterally relative to the bottom plate.

The highest strain values occur inward of the outer edges of the elastomeric member when the top plate is displaced 0.139 inches longitudinally relative to the bottom plate. The combined top plate, bottom plate, and elastomeric member of the adapter pad provide a strain that is less than 90% when the top plate is displaced 0.139 inches longitudinally relative to the bottom plate.

The portion of the elastomeric member disposed between the central portions of the top and bottom plates may have a substantially uniform thickness.

In another example, the disclosure provides a roller bearing adapter pad system configured for use with a three-piece truck. The roller bearing adapter pad system includes a roller bearing adapter configured to engage a roller bearing, the roller bearing adapter comprising: a top surface; and a bottom surface configured to engage a roller bearing; wherein a thickness of the roller bearing adapter measured between the top surface and the bottom surface is less than 0.95 inches as measured at a longitudinal centerline; wherein the roller bearing adapter has cross-sectional moment of inertia of a cross-section at the longitudinal centerline of the roller bearing adapter around a lateral axis about 5.9 inches above a center axis of an axle that is in the range of about 1.0 $in^4$ to about 2.0 $in^4$; wherein the roller bearing adapter has a cross-sectional moment of inertia of a cross-section at the longitudinal centerline of the roller bearing adapter around a vertical axis at the center of the adapter that is in the range of about 75 $in^4$ to about 125 $in^4$; and an adapter pad configured to engage a side frame pedestal roof, the adapter pad comprising: a top plate; a bottom plate; and an elastomeric member disposed between the top and bottom plate; wherein the combined top plate, bottom plate, and elastomeric member provide a longitudinal stiffness of at least 45,000 pounds per inch through a longitudinal displacement of the top plate relative to the bottom plate of up to 0.139 inches from a central position, a lateral stiffness of at least 45,000 pounds per inch through a lateral displacement of the top plate relative to the bottom plate of up to 0.279 inches from the central position, and a rotational stiffness of at least 250,000 pound*inches per radian of rotation through a rotational displacement of the top plate relative to the bottom plate of up to 54.4 milliradians from the central position when a vertical load of 35,000 pounds is applied to a central portion of the adapter pad.

The roller bearing adapter may have cross-sectional moment of inertia of a cross-section at the longitudinal centerline of the roller bearing adapter around a lateral axis about 5.9 inches above a center axis of an axle that is about 1.1 $in^4$. The roller bearing adapter may have a cross-sectional moment of inertia of a cross-section at the longitudinal centerline of the roller bearing adapter around a vertical axis at the center of the adapter that is in the range is about 95 $in^4$.

The adapter pad may have an overall longitudinal length of about 7.5 inches to about 9.5 inches, and wherein the adapter pad has an overall lateral length of about 9 inches to about 11 inches.

The adapter pad may have an overall longitudinal length of about 8.31 inches. The adapter pad may have an overall an overall lateral length of about 10.16 inches.

In another example, the disclosure provides a roller bearing adapter pad configured for use with a three-piece truck, the adapter pad comprising: a top plate having a central portion, first and second upturned regions projecting upwardly from opposite edges of the central portion, a first lateral flange projecting outwardly from the first upturned region, the first lateral flange having a first lateral edge, and a second lateral flange projecting outwardly from the second upturned region, the second lateral flange having a second lateral edge, the top plate having first and second longitudinal edges; a bottom plate having a central portion, first and second upturned regions projecting upwardly from opposite edges of the central portion, a first lateral flange projecting outwardly from the first upturned region, the first lateral flange having a first lateral edge, and a second lateral flange projecting outwardly from the second upturned region, the second lateral flange having a second lateral edge, the bottom plate having first and second longitudinal edges; and an elastomeric member disposed between the top and bottom plate; and wherein the roller bearing adapter pad has an overall longitudinal length of about 7.5 inches to about 9.5 inches, and wherein the adapter pad has an overall lateral length of about 9 inches to about 11 inches.

The first lateral edge of the top plate and the second lateral edge of the top plate may define a inward curving or inward angled edge from an outer surface of the top plate to an inner surface of the top plate in a side view, and wherein the first lateral edge of the bottom plate and the second lateral edge of the bottom plate define a inward curving or inward angled edge from an outer surface of the bottom plate to an inner surface of the bottom plate in a side view; and wherein the first longitudinal edge of the top plate and the second longitudinal edge of the top plate define a inward curving or inward angled edge from an outer surface of the top plate to an inner surface of the top plate in a side view, and wherein the first longitudinal edge of the bottom plate and the second longitudinal edge of the bottom plate define a inward curving or inward angled edge from an outer surface of the bottom plate to an inner surface of the bottom plate in a side view.

The first lateral edge of the top plate and the second lateral edge of the top plate include may curved portions from a top view, and wherein the first lateral edge of the bottom plate and the second lateral edge of the bottom plate include curved portions from a top view; and wherein the first lateral edge of the top plate and the second lateral edge of the top plate include a continuous radius in a top view measured from a vertical axis at a center point of the central portion of the top plate, and wherein the first lateral edge of the bottom plate and the second lateral edge of the bottom plate include a continuous radius in a top view measured from a vertical axis at a center point of the central portion of the bottom plate.

The combined top plate, bottom plate, and elastomeric member may provide a longitudinal stiffness of at least 45,000 pounds per inch, a lateral stiffness of at least 45,000 pounds per inch, and a rotational stiffness of at least 250,000 pound*inches per radian of rotation.

The combined top plate, bottom plate, and elastomeric member may provide a longitudinal stiffness of at least 45,000 pounds per inch through a longitudinal displacement of the top plate relative to the bottom plate of up to 0.139 inches from a central position when a vertical load of 35,000 pounds is applied to the central portion of the adapter pad.

The combined top plate, bottom plate, and elastomeric member may provide a lateral stiffness of at least 45,000 pounds per inch through a lateral displacement of the top plate relative to the bottom plate of up to 0.279 inches from a central position when a vertical load of 35,000 pounds is applied to the central portion of the adapter pad.

The combined top plate, bottom plate, and elastomeric member may provide a rotational stiffness of at least 250,000 pound*inches per radian of rotation through a rotational displacement of the top plate relative to the bottom plate of up to 54.4 milliradians from a central position when a vertical load of 35,000 pounds is applied to the central portion of the adapter pad.

The elastomeric member may extend laterally outward beyond the first and second lateral edges of the top and bottom plates and, wherein the elastomeric member extends longitudinally outward beyond the first and second longitudinal edges of the top and bottom plates.

The thickness of portions of the elastomeric members disposed between the first and second lateral flanges of the top and bottom plates may be precompressed from a static state.

A portion of the elastomeric member disposed between the central portions of the top and bottom plates may have a substantially uniform thickness. The substantially uniform thickness of the portion of the elastomeric member disposed between the central portions of the top and bottom plates may be about 0.21 inches.

A surface area of the elastomeric member at a cross-sectional plane centered between inner surfaces of the top and bottom plates may be between about 60 square inches and 100 square inches.

In another example, the disclosure provides a roller bearing adapter pad system configured for use with a three-piece truck having AAR standard geometry comprising: a roller bearing adapter configured to engage a roller bearing, the roller bearing adapter comprising: a crowned top surface; a bottom surface configured to engage a roller bearing; wherein the roller bearing adapter has cross-sectional moment of inertia of a cross-section at a longitudinal centerline of the roller bearing adapter around a lateral axis about 5.9 inches above a center axis of an axle that is in the range of about 1.0 $in^4$ to about 2.0 $in^4$; and wherein the roller bearing adapter has a cross-sectional moment of inertia of a cross-section at the longitudinal centerline of the roller bearing adapter around a vertical axis at the center of the adapter that is in the range of about 50 $in^4$ to about 100 $in^4$.

The roller bearing adapter pad system may further include, an adapter pad engaged with the roller bearing adapter and configured to engage a side frame pedestal roof, the adapter pad comprising: a continuous top plate; a continuous bottom plate; and an elastomeric member disposed between the top and bottom plates.

BRIEF DESCRIPTION OF THE DRAWINGS

FIG. 11 is a top view of an adapter pad according to aspects of the disclosure.

DETAILED DESCRIPTION

In the following description of various example structures according to the invention, reference is made to the accompanying drawings, which form a part hereof, and in which are shown by way of illustration various example devices, systems, and environments in which aspects of the invention may be practiced. It is to be understood that other specific arrangements of parts, example devices, systems, and environments may be utilized and structural and functional modifications may be made without departing from the scope of the present invention. Also, while the terms "top," "bottom," "front," "back," "side," "rear," and the like may be used in this specification to describe various example features and elements of the invention, these terms are used herein as a matter of convenience, e.g., based on the example orientations shown in the figures or the orientation during typical use. Additionally, the term "plurality," as used herein, indicates any number greater than one, either disjunctively or conjunctively, as necessary, up to an infinite number. Nothing in this specification should be construed as requiring a specific three dimensional orientation of structures in order to fall within the scope of this invention. Also, the reader is advised that the attached drawings are not necessarily drawn to scale.

In general, aspects of this invention relate to a railcar truck, and railcar truck roller bearing adapters and adapter pads. According to various aspects and embodiments, the railcar truck and the railcar truck roller bearing adapters and adapter pads may be formed of one or more of a variety of materials, such as metals (including metal alloys), polymers, and composites, and may be formed in one of a variety of configurations, without departing from the scope of the invention. It is understood that the railcar truck roller bearing adapters and adapter pads may contain components made of several different materials. Additionally, the components may be formed by various forming methods. For example, metal components, may be formed by forging, molding, casting, stamping, machining, and/or other known techniques. Additionally, polymer components, such as elastomers, can be manufactured by polymer processing techniques, such as various molding and casting techniques and/or other known techniques.

The various figures in this application illustrate examples of railcar trucks, railcar truck roller bearing adapters, and adapter pads according to this invention. When the same reference number appears in more than one drawing, that reference number is used consistently in this specification and the drawings refer to the same or similar parts throughout.

Figure 1A:
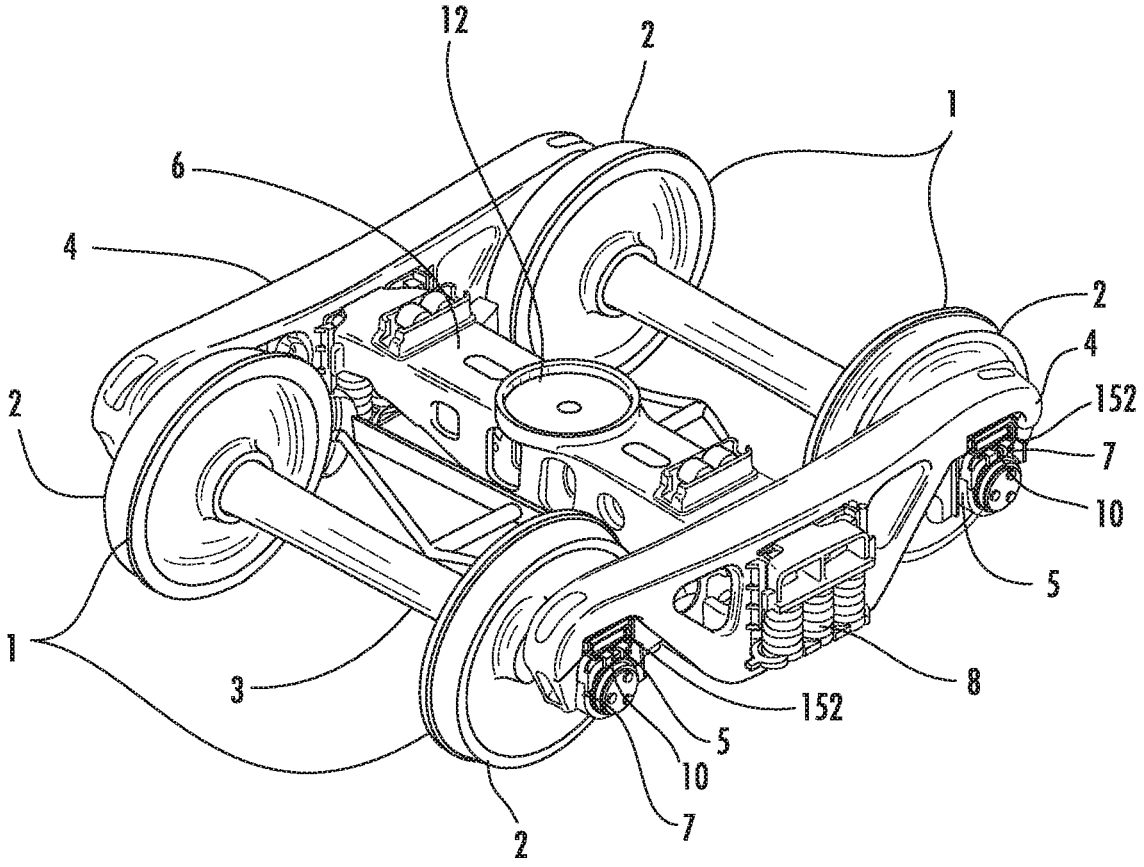
FIG. 1A is a perspective view of a standard 3-piece truck.
Figure 1B:
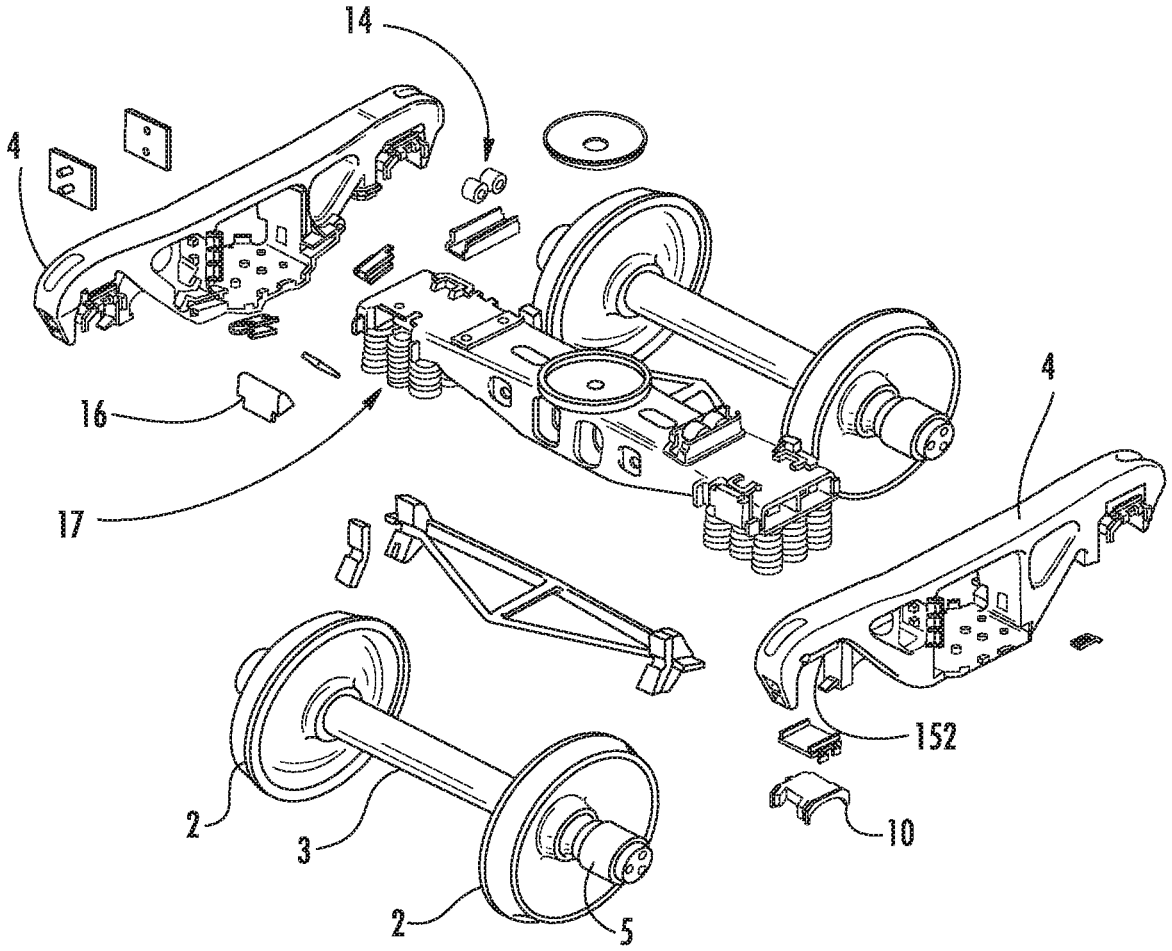
FIG. 1B is an exploded view of a standard 3-piece truck.

As shown in FIGS. 1A and 1B, a typical railroad freight car truck includes an assembly made up of two wheel sets 1 each including two wheels 2, two side frames 4, one bolster 6, two spring groups 8, a friction damping system, and four adapters 10. FIGS. 1A and 1B depict an example truck assembly.

The side frames 4 are arranged longitudinally, e.g., in the direction of the rails upon which the truck sits. The bolster 6 is aligned transversely or laterally with respect to the side frames 4 and extends through the middle of each side frame 4.

The bolster bowl 12 is the round section of the bolster 6 that includes a rim that protrudes upward. The body centerplate of the car body rests in the bolster bowl 12 and acts as a rotation point for the truck and car body. It is at this interface that the majority of the vertical load of the freight car is reacted. Usually, the bolster bowl 12 is equipped with wear plates or a wear liner so that the bolster casting 6 is prevented from wear during the service life of the freight car. Also on the top surface of the bolster 6 and located 25 inches off the centerline are the side bearings 14, which can help stabilize the car body and can provide some prevention of truck hunting if they are of the constant contact type. The side bearings 14 shown in FIG. 1B are not of the constant contact type but rather consist of rollers and a cage.

The bolster 6 rests on top of spring groups 8 that are supported underneath by the spring seat of the side frames. Additional springs, often called snubber or side springs 17, can also be part of the spring group and rest on the spring seat extending upward to the bottom of friction wedges 16 that can be part of the friction damping system.

The friction wedges 16 can be located in pockets at the end of and to each side of the bolster 6. The friction wedge pockets of the bolster can be angled, typically at an angle of about 60° from horizontal matching the angle surface of the friction wedges. The opposite face of a friction wedge 16 is typically vertical and contacts what is called the column face of the side frame. The spring force of the snubber springs 17 pushes the friction wedge 16 against the angled surface of the bolster friction wedge pocket which creates a reaction force against the vertical column face of the side frame.

As the bolster 6 moves up and down under the load from the freight car resting on the truck, the sliding of the friction wedge 16 against the column face can create column friction damping. This damping can provide for a dissipation of energy that prevents the freight car from developing undesired vibrations/oscillations when moving in railroad service. It is also these forces acting between the bolster 6 and side frame 4 through the friction wedges 16 that seeks to prevent the truck from taking on a parallelogram geometry when under operation. Hard stops, such as the gibs and rotation stops, help prevent trucks from taking on an extreme parallel shape. This resistance to parallelogramming is often called warp stiffness.

As shown in FIGS. 1A and 1B, the wheel sets 1 of the truck assembly consist of two wheels 2, an axle 3, and two roller bearings 5. The wheels are press fit onto the raised wheel seats of the axle. The journal of the axles extend outboard of the wheels and provide the mounting surface for the roller bearings 5. The roller bearings 5 are press fit onto the axle journals. The interface between the roller bearings 5 and the side frames 4 can consist of a bearing adapter 7. Typically railroad freight car trucks have been equipped with metal adapters that are precisely machined to fit on the roller bearings rather tightly while providing a looser fit to the steel side frame pedestals which envelope the interface between the roller bearings and the side frames. This interface provides a small movement between the wheel sets and the side frames which is controlled by the vertical load that exists from the freight car and the frictional forces that exist between the sliding metallic surface on top of the adapter, referred to as the adapter crown, and the bottom of the steel pedestal roof which is usually equipped with a steel wear plate.

Because the vertical load varies with the lading weight contained in the freight car and with the rocking motion of the freight car on the truck, the frictional forces at the metal adapter crown and steel pedestal roof wear plate can vary considerably and are not controlled in the typical truck. This metal to metal connection requires large wheelset forces to force sliding at the interfacing surface due to the stick-slip nature of metal sliding connections. More recent truck designs, such as those trucks qualified under the American Association of Railroads ("AAR") M-976 specification, now include an adapter pad at the interface between the steel adapter and the pedestal roof.

Some adapter pad systems have been successful in lowering wheelset forces during railcar curving by allowing low stiffness compliance between the side frame and axle. This added compliance created by the adapter pad also reduces the force it takes to pull or push a railcar through a curve as required in the M-976 specification, which is incorporated herein by reference. Adversely, these designs have lowered the speed at which the car resonates during tangential track travel, otherwise described as lowering the hunting speeds of the cars. Lowering the hunting speed is a disadvantage because it limits the operating speeds of the trains and increases the risk of derailing cars or damaging track. Other designs utilize premium side frame squaring devices such as transoms, frame bracing, steering arms, spring planks, yaw dampers, cross bracing, or additional friction wedges to improve the hunting performance. These systems, generally referred to as premium truck technology, typically increase the wheelset forces and therefore the pulling resistance during curving. In addition to increasing curve resistance, these designs have traditionally increased truck maintenance costs due to the added wear components and system complexity.

Adapter pad system embodiments described herein can meet the curving performance criteria set forth in M-976, without decreasing the critical hunting threshold. The adapter pad systems described herein also do not require any additional side frame squaring devices, such as transoms, frame bracing, steering arms, spring planks, yaw dampers, cross bracing, or additional friction wedges, to be added to a standard 3-piece truck. The resulting truck system described herein can improve the life of the wheelsets, maintain a high hunting threshold, improve the durability of the pad system, and minimize wear and forces exerted on the rails.

By way of background, there are many different rail car types and services native to the North American Rail Industry which require different truck sizes. Cars designed for 70 ton service have a Gross Rail Load of 220,000 lbs., and commonly use 28 inch or 33 inch wheels with 6 inch×11 inch bearings. Cars designed for 100 ton service have a Gross Rail Load of 263,000 lbs., and commonly use 36 inch wheels with 6.5 inch×12 inch bearings. Cars designed for 110 ton service have a Gross Rail Load of 286,000 lbs. and must meet the performance specification M-976 as mentioned above. These 110 ton cars typically use 36 inch wheels with 6.5 inch×9 inch bearings. The final car type typical to North America is designed for 125 ton service and has a Gross Rail Load of 315,000 lbs. This car type typically uses 38 inch wheels with 7 inch×12 inch bearings. The other truck sizes—70 ton, 100 ton, and 125 ton are not subject to the same strict performance standard, and thus have not required the use of pads to date.

The roller bearing adapter and matching adapter pad are the focus of this application. Embodiments of the disclosed adapter and matching adapter pad system can be used with cars designed for 110 ton service and can be scalable for use with and improve the performance of trucks for all car capacities (including 70 ton, 100 ton, 110 ton, and 125 ton), including those trucks that do not require compliance with the M-976 standard.

Figure 2:
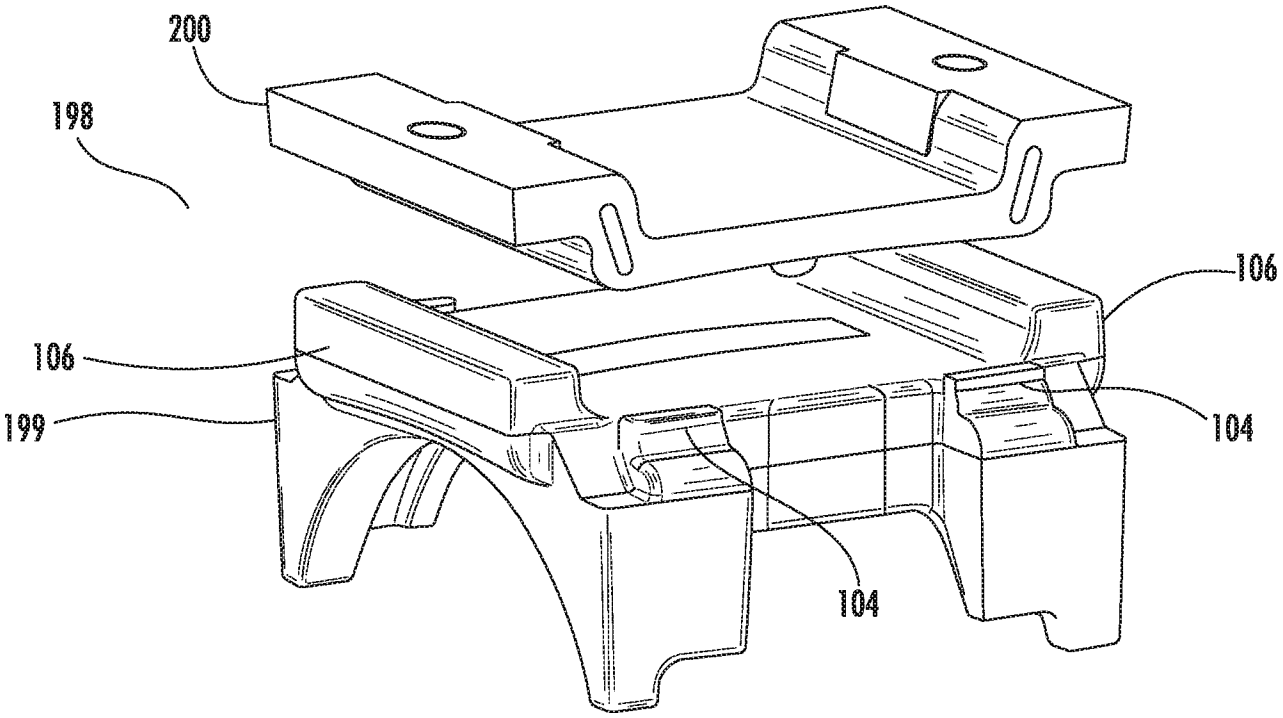
FIG. 2 is a perspective view of a roller bearing adapter and adapter pad according to aspects of the disclosure.
Figure 3:
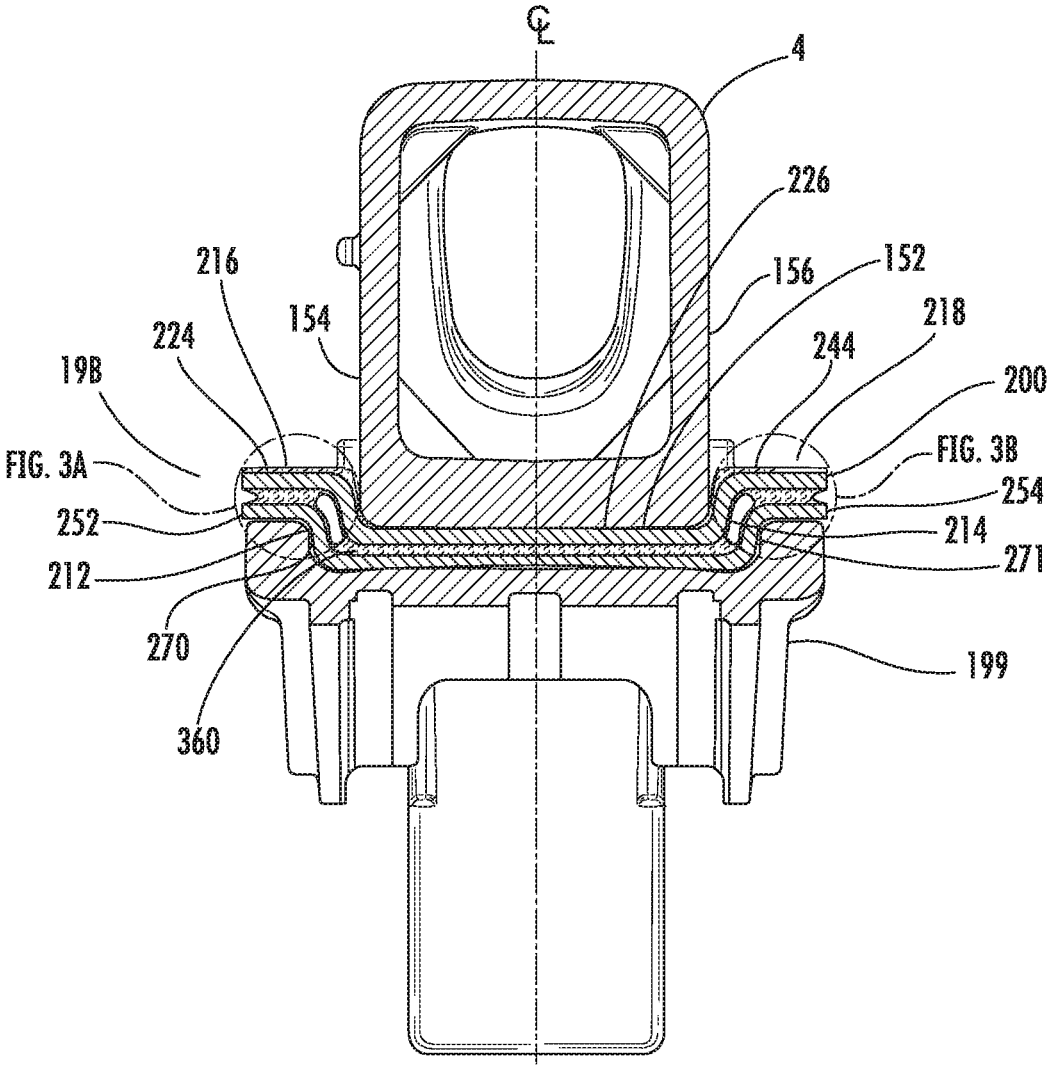
FIG. 3 is a cross-sectional view of roller bearing adapter, adapter pad, and a side frame according to aspects of the disclosure.
Figure 3A:
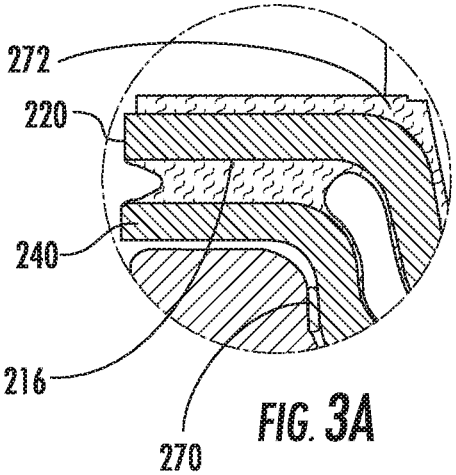
FIG. 3A is a detail view of a portion of FIG. 3.
Figure 3B:
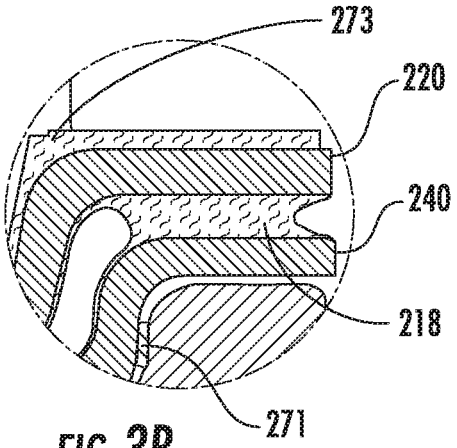
FIG. 3B is a detail view of a portion of FIG. 3.

One embodiment of the adapter pad system 198 is shown in at least FIGS. 2 and 3. The adapter pad system 198 may comprise a roller bearing adapter 199 and an adapter pad 200 configured to be disposed between a wheelset roller bearing or roller bearing 5 and a side frame pedestal roof 152 of a three-piece railcar truck. The side frame can include first and second outer sides 154, 156. The adapter pad 200 also includes an elastomeric member 360 that supports the vertical load and allows for low force longitudinal, lateral, and rotational motion of the top plate 220 (engaged with the side frame) relative to the bottom plate 240 (engaged with the roller bearing adapter) as compared to a traditional steel-steel sliding adapter system.

In some embodiments, as shown in at least FIGS. 2-3, the adapter pad system 198, when installed within a truck system is compressed with a constant vertical load, due to the weight of the railcar and truck components that are carried by the adapter pad 200 and ultimately transferred to the track through the wheel sets. While the vertical load that is imparted upon the central portion of the adapter pad 200 naturally varies with the different loading of the railcar, it has been assumed that a vertical load can be about 35,000 pounds per adapter pad for about a corresponding 286,000 gross rail load car.

It has been determined through testing that the performance of the truck system is highly influenced by the stiffness of the adapter pad 200. More specifically, in certain embodiments, it has been determined that truck performance can be improved with improved adapter pad system performance. The adapter pad system performance can be improved by increasing the stiffness of the adapter pad system 198 (measured in pounds of force per inch of displacement). Additionally, for example, it has been determined that acceptable life expectancy (measured in distance traveled under load of a truck system that includes an adapter pad 200 installed, which a design life has been determined to be 1 million miles of railcar travel) is expected for an adapter pad 200 like embodiments discussed herein when a longitudinal stiffness is at least 45,000 pounds per inch or in the range of about 45,000 pounds per inch to about 80,000 pounds per inch, and/or when a lateral stiffness is at least 45,000 pounds per inch or in the range of about 45,000 pounds per inch to about 80,000 pounds per inch, and/or when a rotational stiffness (i.e. stiffness to resist rotation about the vertical axis) is at least 250,000 pound*inches per radian or in the range of about 250,000 pound*inches per radian to about 840,000 pound*inches per radian (each of these measured when a 35,000 pound vertical load is applied to the central portion of the adapter 200). These unique stiffness combinations can maximize the hunting threshold speed, while still maintaining a curve resistance below 0.40 lbs/ton/degree of curvature as required by the M-976 specification without the use of premium truck technologies utilizing transoms, frame bracing, steering arms, spring planks, yaw dampers, cross bracing, or additional friction wedges to improve performance.

Stiffness of the adapter pad system is quantified by measuring the adapter assembly resistance to relative shear displacement of the top plate (which is engaged with the side frame), and the bottom plate (which is engaged with the roller bearing adapter). To determine the stiffness, the adapter assembly can be displaced relative to the side frame in multiple directions, such as, longitudinal (in the direction of railcar travel), lateral (across the rail tracks), yaw (rotation about a vertical axis and in line with axle center line), and vertical (between side frame pedestal roof and adapter pad top surface). A vertical load of 35,000 should be maintained during shear stiffness testing to simulate a loaded car scenario.

During testing, the force to displace the top plate relative to the bottom plate can be measured using load cells attached to a force actuator. Displacement measurements can be collected with displacement transducers, dial indicators, potentiometers, or other displacement measuring instruments. As described in more detail below, the force and displacement is plotted, with the slope of the hysteresis loop indicating the stiffness in the respective direction. The area contained within the loop is proportional to the energy displaced during the load cycle.

Embodiments of the adapter pad system 198 described herein provide a thrust lug opening width and spacing sufficient to not limit displacement within the AAR values, even with the use of high stiffness shear pads as described herein. The disclosed adapter design may utilize target adapter displacements shown in Table 1 below.

TABLE 1

AAR ADAPTER TO SIDE FRAME CLEARANCE STACKUP NEW COMPONENTS

| Features | Maximun | Minimun |
|---|---|---|
| Longitudinal Clearance (Each direction from center: in.) | .139 | .017 |
| Lateral Clearance (Each direction from center: in.) | .234 | .126 |
| Rotataional Clearance (Each direction from center: mRad.) | 41.0 | 9.2 |

Disclosed embodiments of the adapter pad system 198 with the disclosed longitudinal, lateral, and rotational shear stiffness as described herein can provide an advantageous combination of high speed stability and low curve resistance for the 3-piece truck system. Disclosed embodiments of the adapter pad system 198 can increase the warp restraint of the 3-piece truck system as compared to other adapter pad designs. This can allow for increased high speed stability. In addition to improvements in high speed stability, embodiments of the adapter pad system 198 described herein can promote longitudinal displacement of the wheelset during curving, allowing the leading and trailing axle of the truck assembly to develop an inter-axle yaw angle proportional to the curve which can lower wheelset forces. In combination, the adapter pad system 198 promotes lateral wheelset shift to develop an optimal rolling radius difference during curving. The adapter pad system stiffness and displacement ranges disclosed herein can allow for optimal inter-axle yaw angle and lateral wheelset shift, promoting low wheelset force solution through curves. Reduction in curving forces and improved high speed stability can contribute to improvements in wheelset and rail life.

Some adapter pad designs utilize multiple elastomer layers to reduce shear strain. These multiple layers can add significant thickness to the adapter system and when used in conventional trucks, raise the height of the car. Raising the height of the car creates issues coupling to other cars, as well as raises the center of gravity. As a result some designs required the use of special, non-conventional side frames to minimize the height difference. Embodiments discussed herein can allow for improved dynamic performance, without requiring the use of special, non-conventional truck components.

Embodiments discussed herein can be used with side frames having AAR standard geometry, including AAR standard pedestal geometry and AAR standard thrust lug clearances, as described in the Association of American Railroads Manual of Standards and Recommended Practices, Section SII (Oct. 25, 2010), Specification S-325 (Jun. 11, 2009)—"Side Frame, Narrow Pedestal—Limiting Dimensions" which is incorporated herein by reference. AAR standard pedestal geometry can be described as including nominal longitudinal thrust lug spacing of about 7.25-8.25 inches; nominal thrust lug width of about 3.5-3.75 inches; nominal longitudinal jaw spacing of about 8.88-11.06 inches; and nominal pedestal roof height above the centerline of the axle of about 5.38-6.89 inches. Embodiments of the adapter pad system 198 disclosed herein can be used with existing and/or standard 3 piece truck systems, including truck systems having AAR standard geometry as described in the Association of American Railroads Manual of Standards and Recommended Practices, and more specifically, Section H (Jan. 1, 2012), Specification M-924 (Feb. 1, 2014)—"Journal Roller Bearing Adapters for Freight Cars" which are incorporated herein by reference. AAR standard thrust lug clearance can be found above in Table 1 for new casting manufacturing dimensions. The thrust lug clearance is determined through the distance between the pedestal area and the roller bearing adapter openings. Standard AAR adapter dimensions can include nominal longitudinal thrust lug bearing surface spacing of about 7.156-8.656 inches; and a nominal lateral thrust lug opening of about 3.812-4.062 inches. Embodiments of the adapter pad system 198 described herein can also meet American Association of Railroads ("AAR") M-976 specification (AAR Manual of Standards and Recommended Practices, Section D (Sep. 1, 2010), Specification M-976 (Dec. 19, 2013)—"Truck Performance for Rail Cars") which is incorporated herein by reference. For example, embodiments of the adapter pad system 198 can be used in existing and/or standard 3 piece truck systems without the use of additional pieces such as transoms, frame braces, or spring planks. Additionally, for example, adapter pad systems 198 disclosed herein can fit between the roller bearing 5 and the pedestal roof 152 of existing trucks. Thus, adapter pad systems 198 disclosed herein can have a total height measured between an upper surface of the roller bearing 5 and the pedestal roof 152 of about 1.3 inches or in the range of about 1.1 inches to about 1.5 inches. While the embodiments described herein are specific to the 110 T truck, the disclosed adapter and matching adapter pad system can be scalable for use with and improve the performance of trucks for all car capacities (70 ton, 100 ton, 110 ton, and 125 ton), including those trucks that do not require compliance with the M-976 standard.

Figure 4:
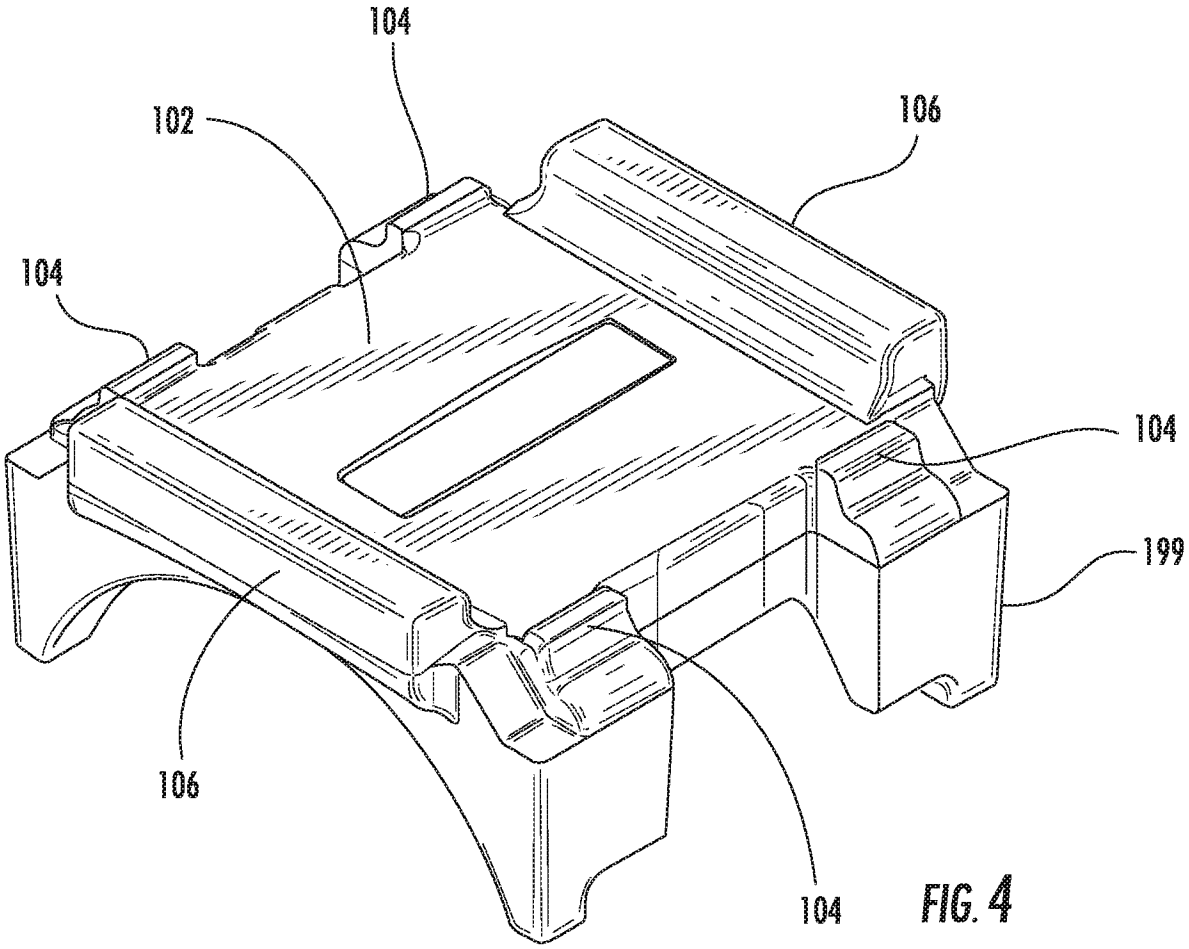
FIG. 4 is a perspective view of a roller bearing adapter according to aspects of the disclosure.

A roller bearing adapter 198 in accordance with the present disclosure is shown in FIGS. 4-10. As shown in FIG. 4, the roller bearing adapter 199 includes a pedestal crown surface 102. The pedestal crown surface or top surface 102 can in some embodiments be a crowned or curved surface such that the central area of the pedestal crown surface is higher than the lateral edges. Thus, the pedestal crown surface 102 can be generally flat in the longitudinal direction and curved in the lateral direction. The pedestal crown surface 102 can be an AAR standard pedestal crown surface but can have a thinner cross-sectional thickness than a typical roller bearing adapter. For example, in some embodiments, the roller bearing adapter thickness can be between about 0.6 inches thick (measured from the bearing surface 117 to the pedestal crown surface 102 at the centerline) to about 0.75 inches thick and in some embodiments less than about 0.75 inches thick.

As shown in FIGS. 4-8 the roller bearing adapter 199 can have an overall height of about 4.83 inches or within the range of about 4 inches to about 6 inches; an overall length of about 9.97 inches or in the range of about 9 inches to about 11 inches; and an overall width of about 10 inches or at least 7.5 inches or in the range of about 9 inches to about 11 inches.

Figure 5A:
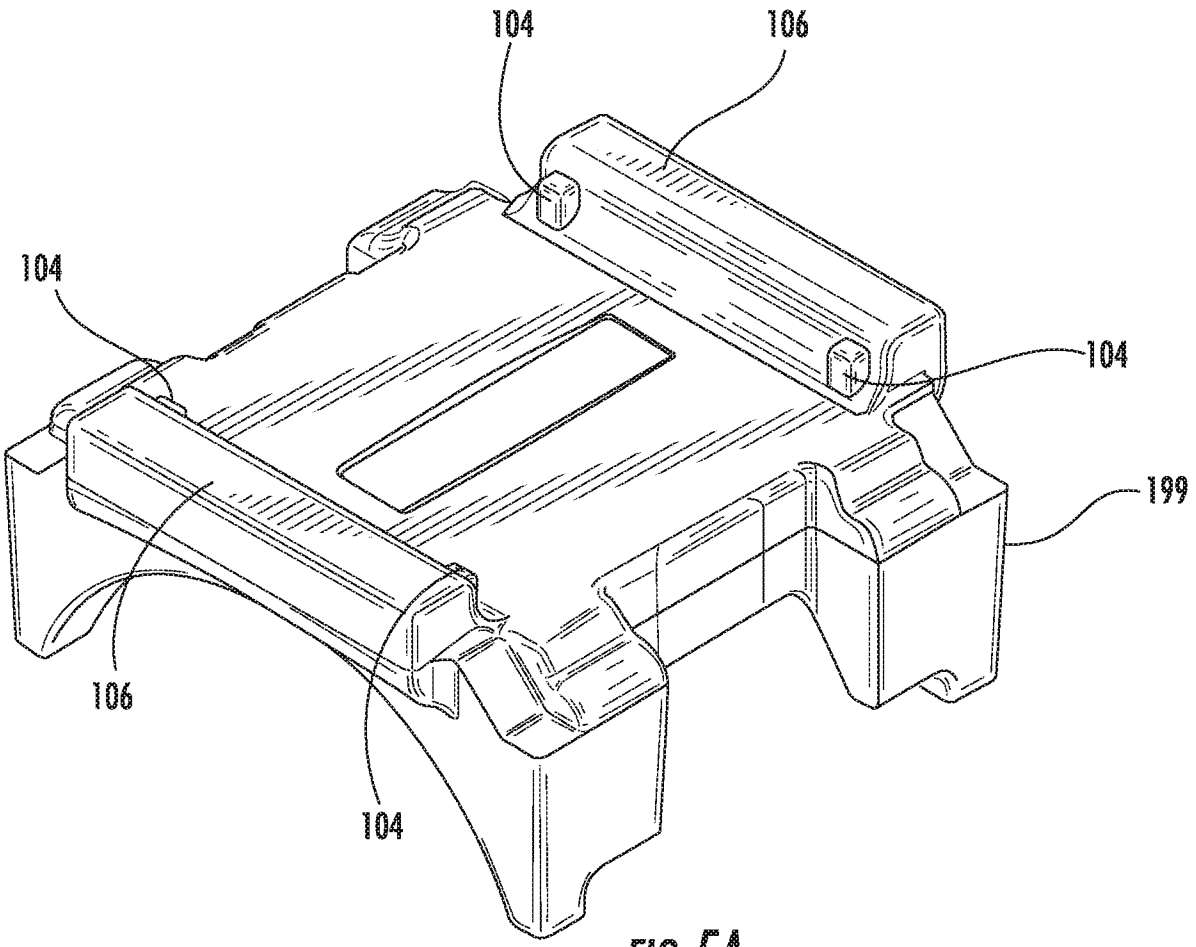
FIGS. 5A-5D are perspective views of roller bearing adapters according to aspects of the disclosure.
Figure 5B:
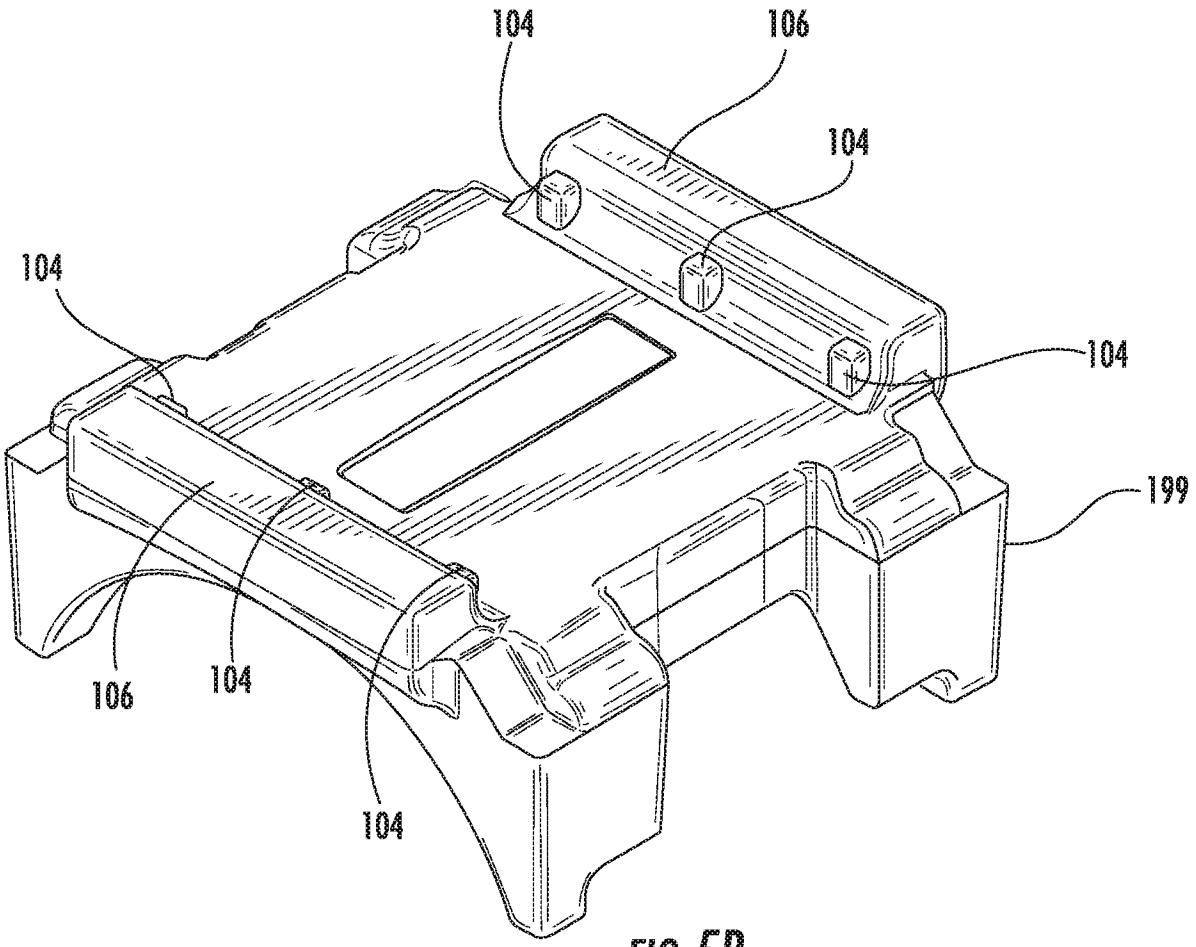

The roller bearing adapter 199 can include features to limit the motion of the adapter pad 200 relative to the roller bearing adapter 199. For example, the roller bearing adapter can include longitudinal adapter pad stops 104. As shown in FIG. 4, the longitudinal pad stops 104 can be raised vertically relative to the lateral edges of the pedestal crown surface 102. The longitudinal adapter pad stops 104 are designed to interface with slots, recesses, or edges of the bottom plate 240 of the adapter pad 200 and can engage the adapter pad 200 such that the longitudinal motion of the adapter pad 200 can be restricted or controlled to a specified value while not restricting the lateral movement of the adapter pad. Although four longitudinal adapter pad stops 104 are shown in FIG. 4, any number or design of longitudinal pad stops can be used, including continuous longitudinal pad stops that extend the entire length of the lateral edge of the pedestal crown surface 102. Examples of other possible longitudinal stops 104 are shown in FIGS. 5A-5D. For example, the longitudinal stops 104 can comprise two bosses per lateral side as shown in FIG. 5A. The longitudinal stops 104 shown in FIG. 5A can interface with reliefs in the bottom plate 240 of the adapter pad 200 that can engage these stops 104 such that the longitudinal motion can be restricted. Similar to FIG. 5A, FIG. 5B shows three stops 104 that can restrain the longitudinal movement of the adapter pad 200 relative to the adapter 199 in the same way.

Figure 5C:
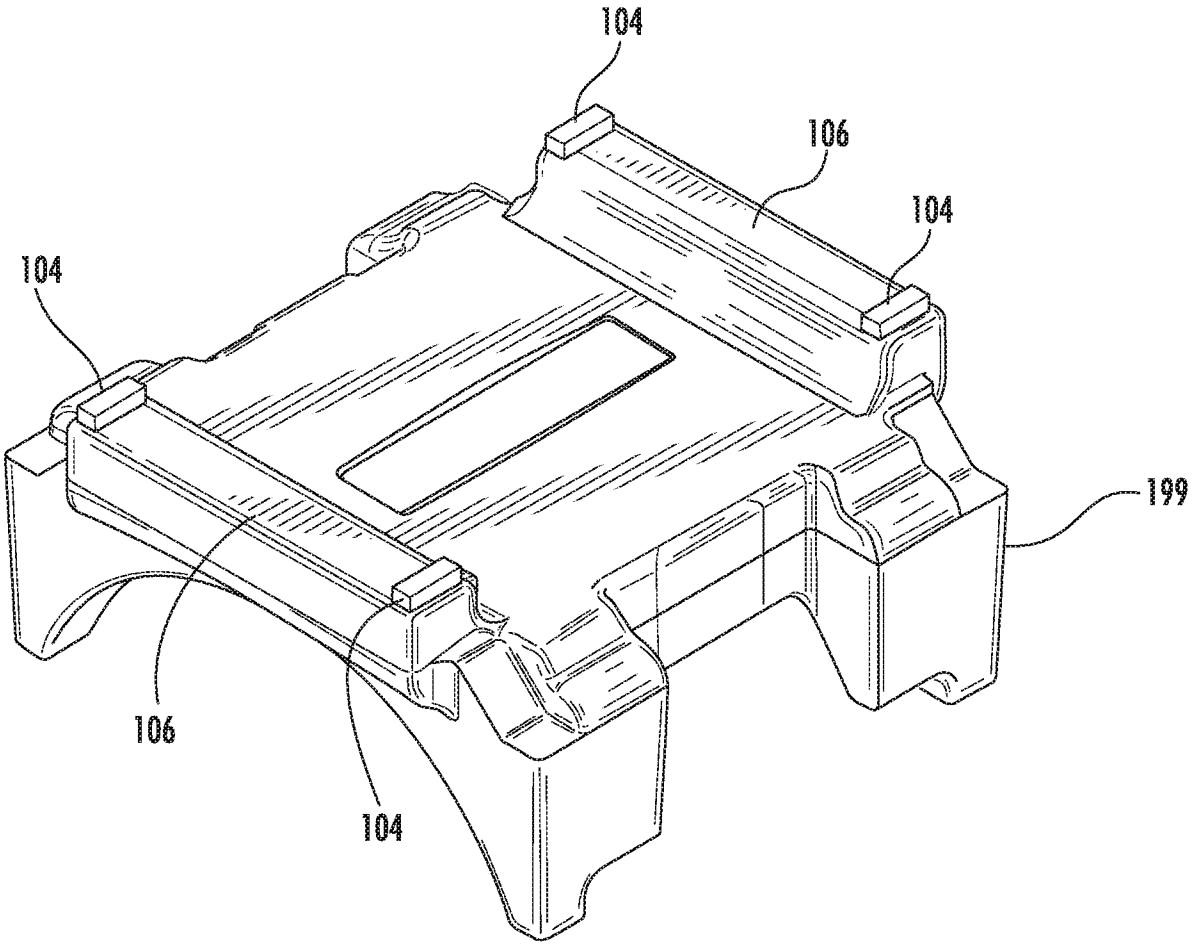
Figure 5D:
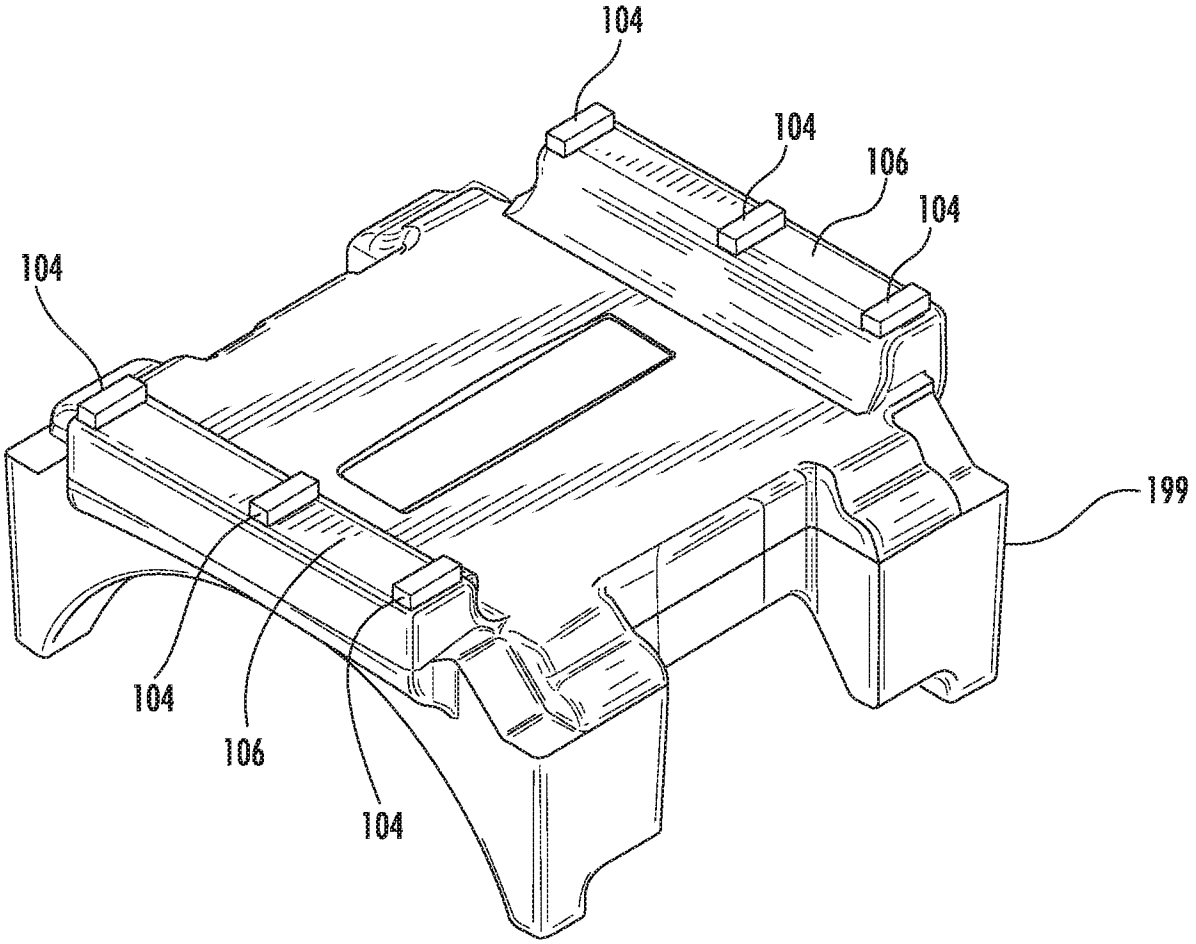
Figure 6:
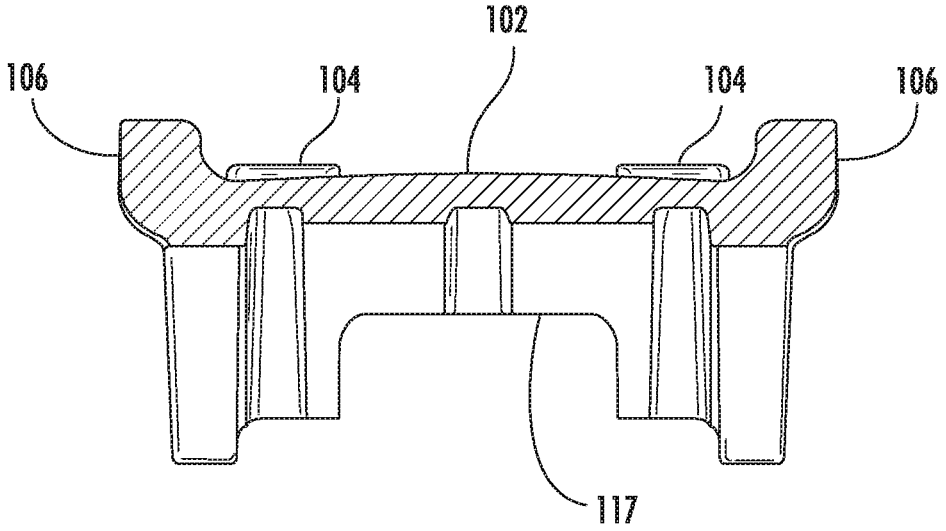
FIG. 6 is a cross-sectional view of the roller bearing adapter of FIG. 4 taken along a centerline.
Figure 7:
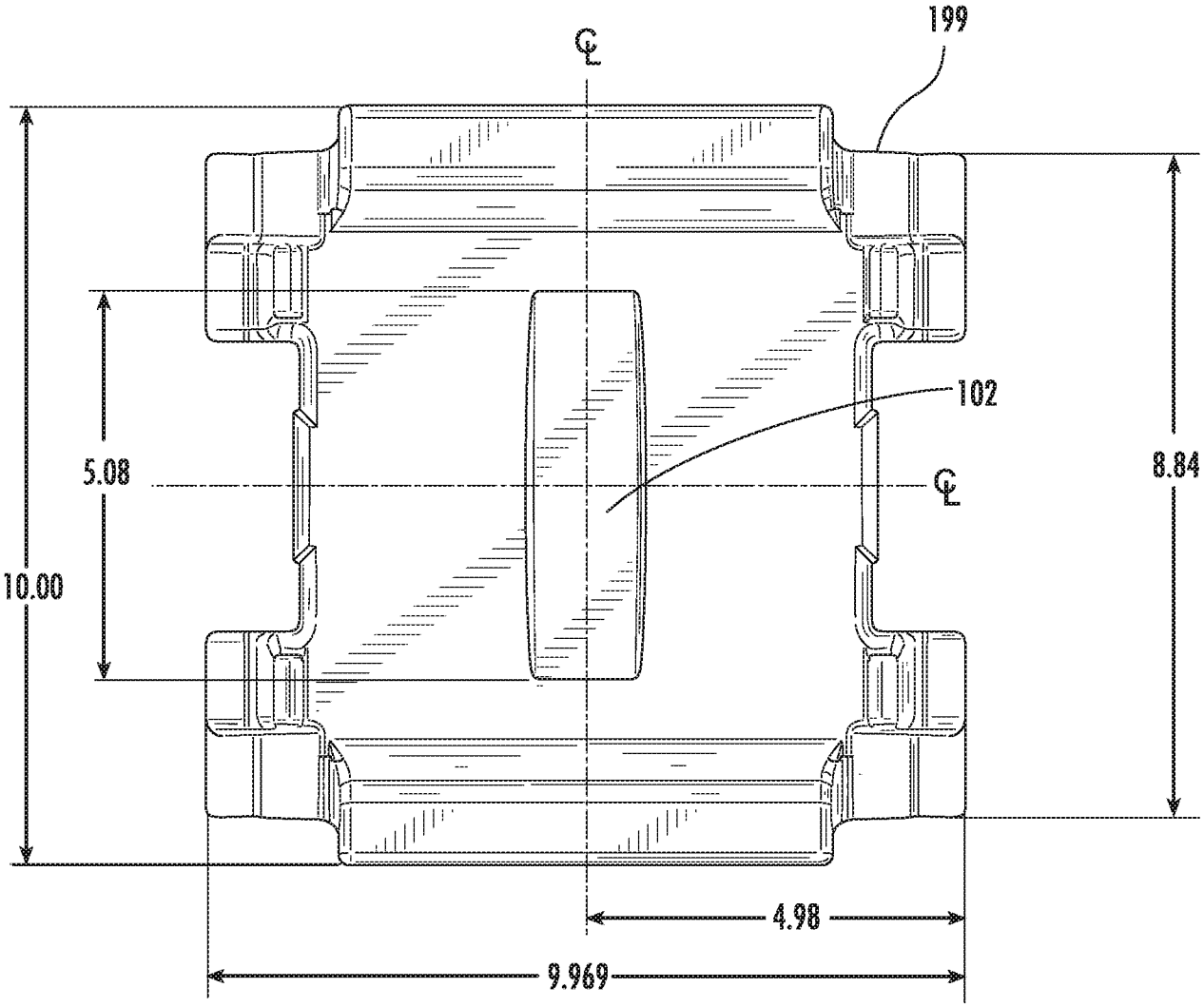
FIG. 7 is a top view of the roller bearing adapter of FIG. 4.

Longitudinal stops can be incorporated into other portions of the adapter pad. For example, as shown in FIGS. 5C and 5D, longitudinal stops 104 can be incorporated into the top surface of the vertical shoulder 106. Similarly, in these examples, reliefs in the bottom plate 240 of the adapter pad can fit around these stops 104 or bosses and provide longitudinal movement restraint of the bottom plate 240 relative to the top plate 220.

Various other combinations of sizes, shapes, and locations can be utilized for the longitudinal stops 104 in order to provide the desired restraint of movement.

As shown in FIGS. 4-8, the roller bearing adapter 199 also includes vertical shoulders 106. The vertical shoulders 106 can be raised vertically relative to the longitudinal edges of the pedestal crown surface 102. The vertical shoulders 106 are designed to improve the bending strength of the adapter 199 and minimize distortion of the adapter 199 under the high forces imparted by the adapter pad 200. By minimizing distortion of the adapter pad 200 under load, the vertical shoulders 106 can improve the load distribution to the roller bearing components and can improve bearing life. The vertical shoulders 106 are designed to interface with slots, recesses, edges, or surfaces of the bottom plate 240 of the adapter pad 200 such that the lateral motion of the bottom plate 240 is restricted or controlled to a specified value. In addition to limiting movement of the bottom plate, the vertical shoulders can provide vertical support to the laterally projecting flanges 116, 118 of the adapter pad 200 in some embodiments. The vertical shoulders 106 can extend laterally to 10 inches wide for a 6.5 inch×9 inch adapter, and vertically about 1 inch above the standard pedestal crown surface. In some embodiments the upper surface of the vertical shoulders 106 can be up to about 0.75 inch or up to about 3 inches above the pedestal crown surface 102. The vertical shoulders may also be up to about 8 inches in the longitudinal direction. The vertical shoulders may be cast integral to the adapter, and used on standard adapters for 70 T, 100 T, 110 T, or 125 T service. Although continuous vertical shoulders are shown, any number of vertical shoulders can be used. The width of the vertical shoulders can be at least 0.5 inches.

Figure 8:
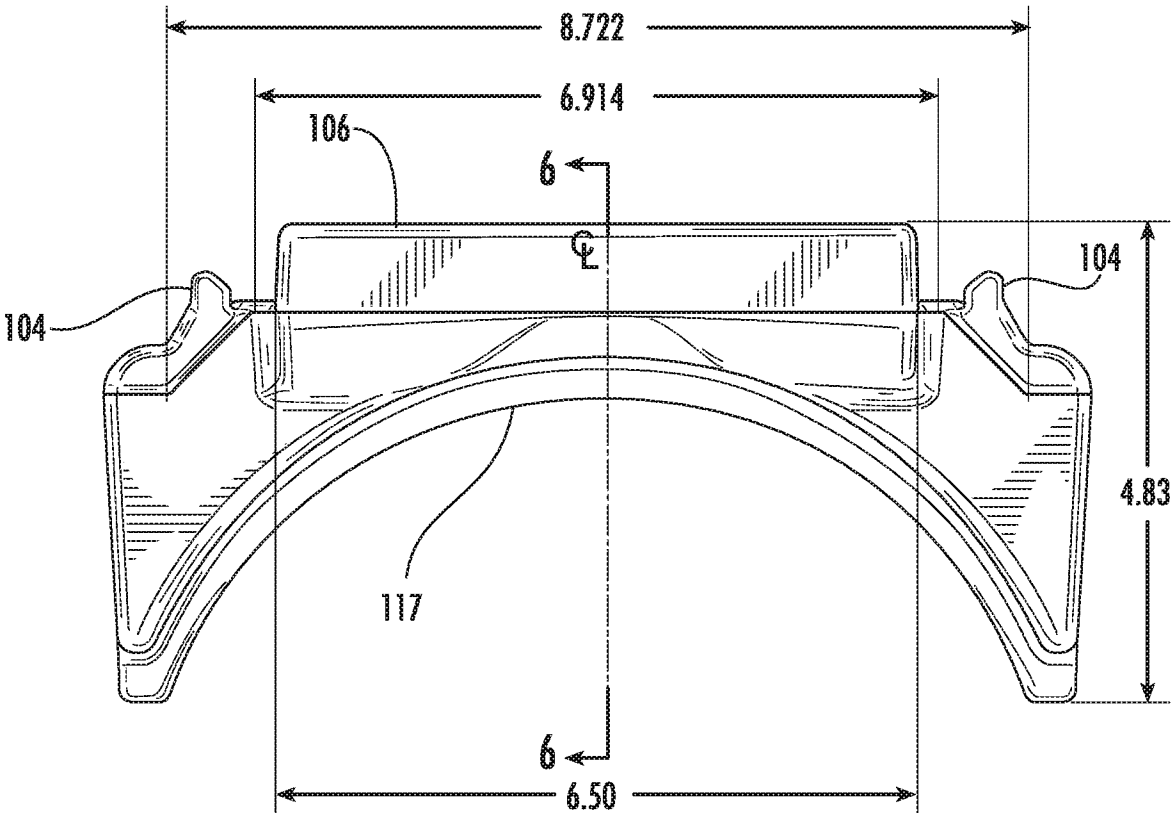
FIG. 8 is a side view of the roller bearing adapter of FIG. 4.
Figure 9:
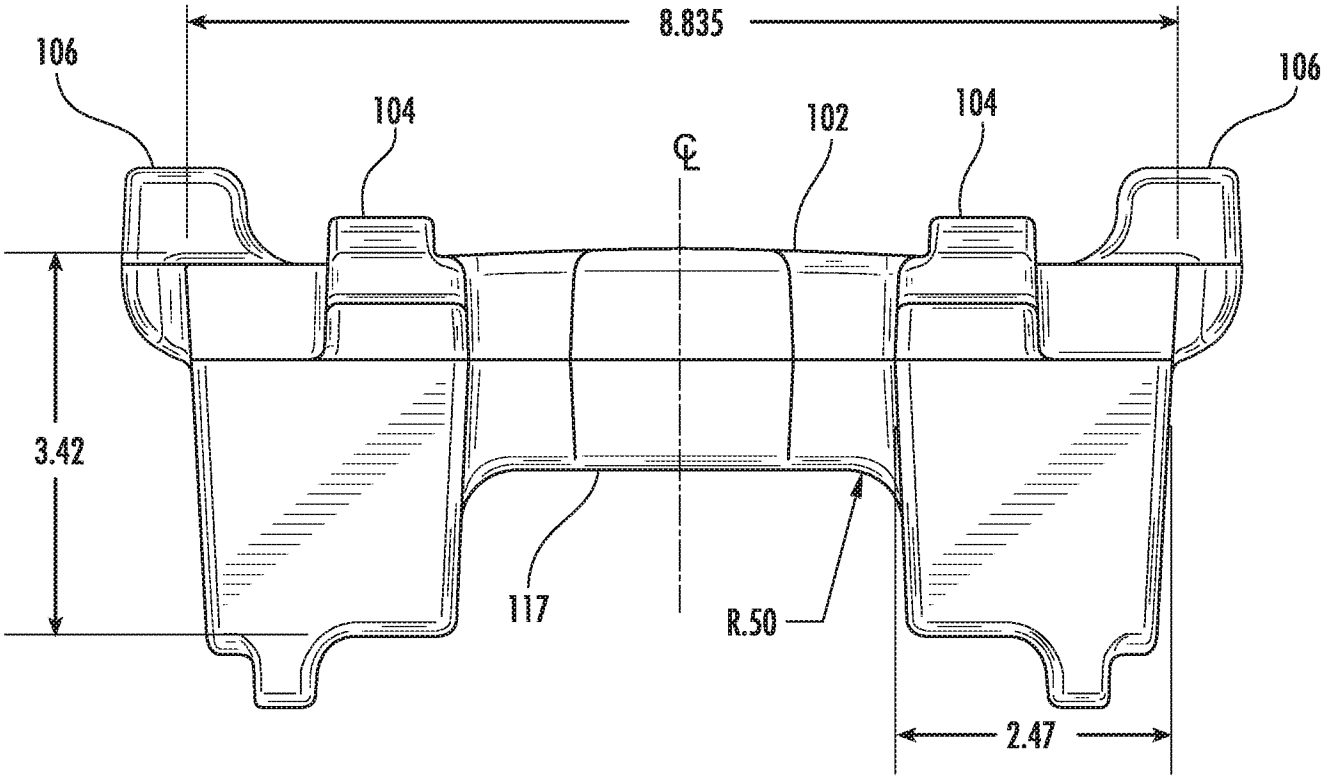
FIG. 9 is a front view of the roller bearing adapter of FIG. 4.
Figure 10:
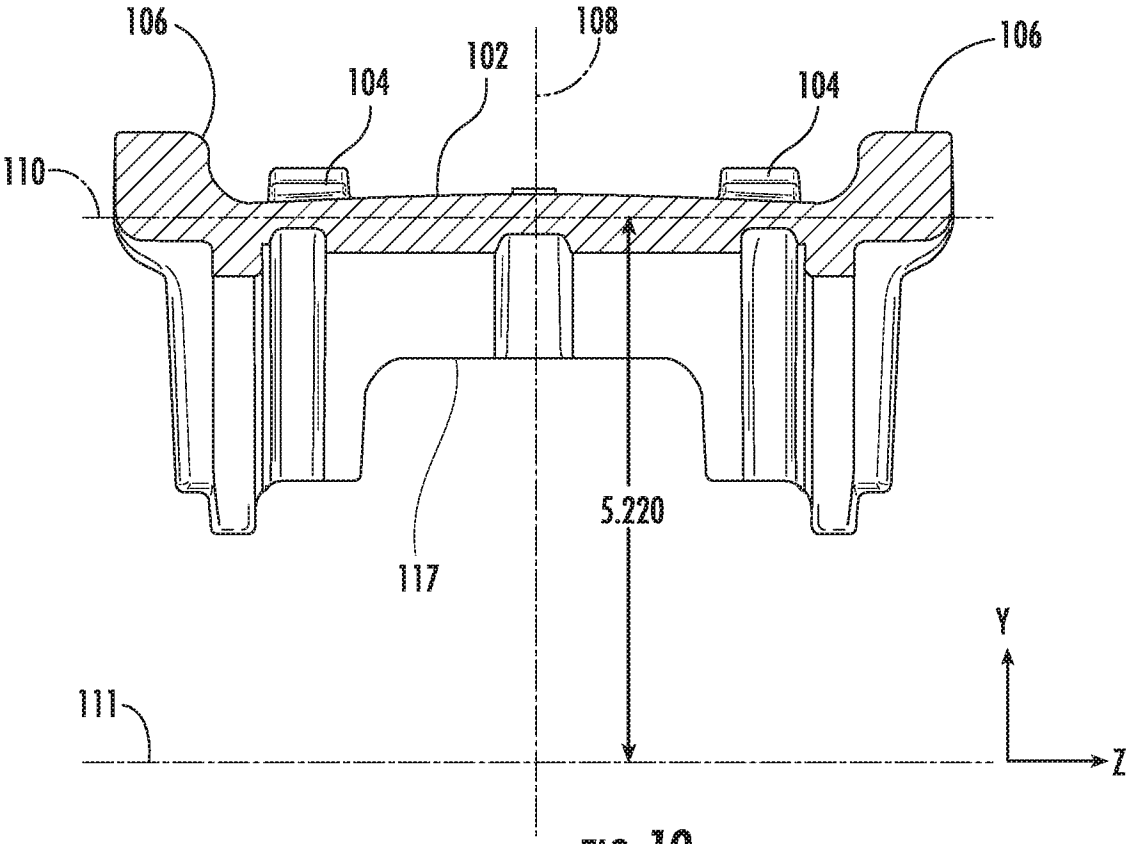
FIG. 10 is a cross-sectional view taken along line A-A of FIG. 8.
Figure 77:
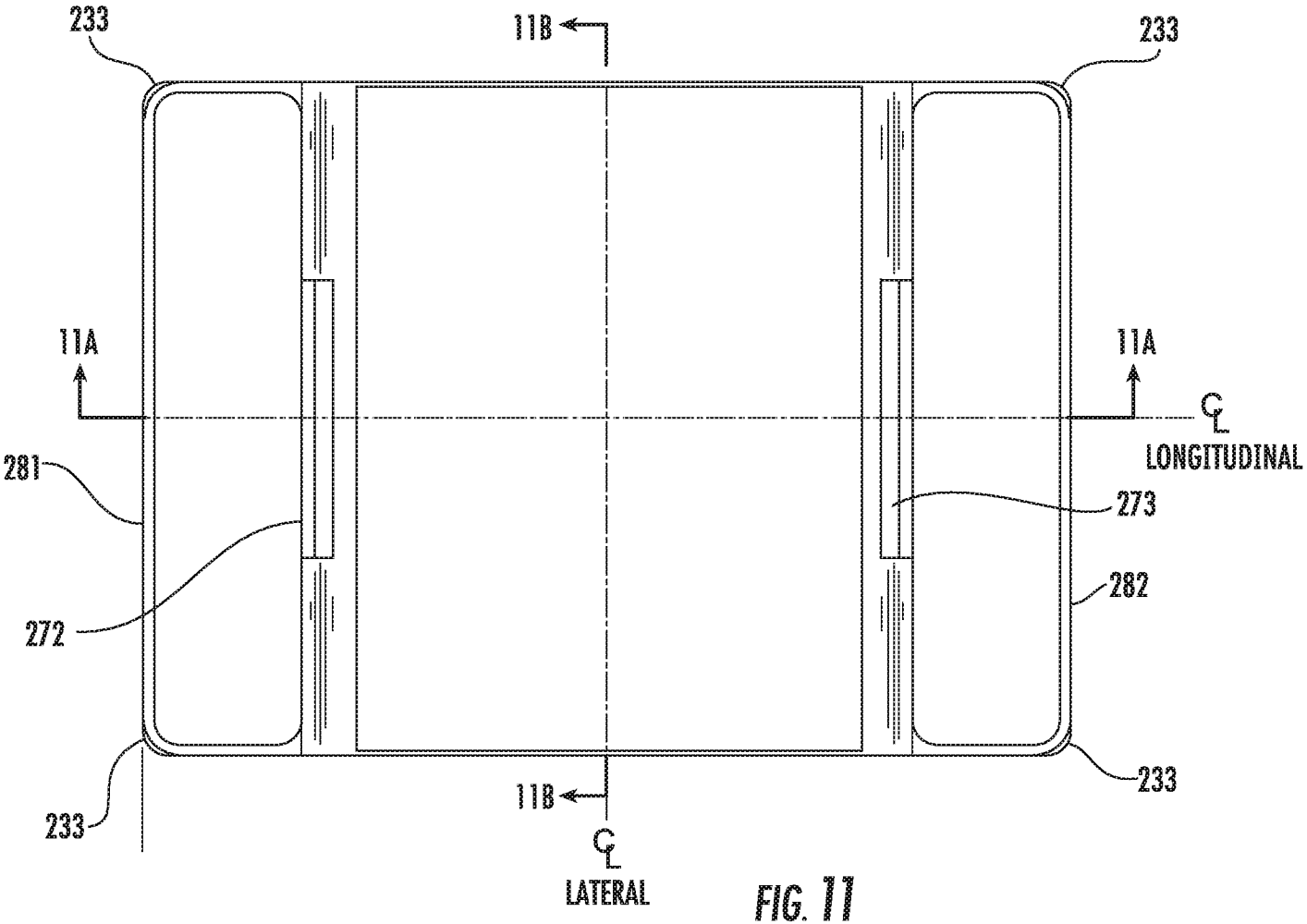

The roller bearing adapter 199 can also include features, such as the vertical shoulders 106, to improve the bending strength or cross-sectional moment of inertia of the adapter 199 to minimize distortion of the adapter 199 under the high forces imparted by the adapter pad 200. For example, for the embodiment shown in FIGS. 4, and 6-10, and more particularly shown in FIGS. 8 and 10, a cross-section of the adapter 199 can be taken approximately through the longitudinal center of the roller bearing adapter 199 as shown in FIGS. 8 and 10. As shown in FIG. 10, a neutral Y-axis 108 can extend in the vertical direction through the lateral center of the adapter 199. A neutral Z-axis 110 can extend in the lateral direction about 5.2 inches, or in the range of about 5.0 inches and 5.5, above a center axis of an axle 111. The cross-sectional moment of inertia of the cross-section shown in FIG. 10 around the neutral Z-axis 110, I z-z, at the center of the adapter can be about 1.4 $in^4$, or in the range of about 1.0 to about 2.0 $in^4$. The cross-sectional moment of inertia around the neutral Y-axis 108 at the center of the adapter, I y-y at the cross-section can be about can be about 86.8 $in^4$, or in the range of about 50 to about 100 $in^4$. Adapter designs which do not utilize vertical shoulders have significantly lower area moment of inertia through lateral sections. For example, an adapter design as shown in FIG. 10 but without vertical shoulders 106 at the same lateral centerline cross section can have a moment of inertia around the neutral Z-axis of about 0.2 $in^4$ and can have a moment of inertia around the neutral Y-axis of about 32.9 $in^4$. The resulting lower moment of inertia compared to the disclosed adapter can result in a lower stiffness and higher stresses in the adapter under similar load configurations, and possibly reduced roller bearing performance.

The roller bearing adapter 199 may be made from one or more different types of alloys of steel that have suitable strength and other performance characteristics. For example, roller bearing adapter 199 may be manufactured from cast iron of grade ASTM A-220, A-536, or cast or forged steel of grades ASTM A-148, A-126, A-236, or A-201. In some embodiments, the entire roller bearing adapter 199 is formed (cast, machined, pressed or another suitable metal forming operation) from a single monolithic member.

Figure 11A:
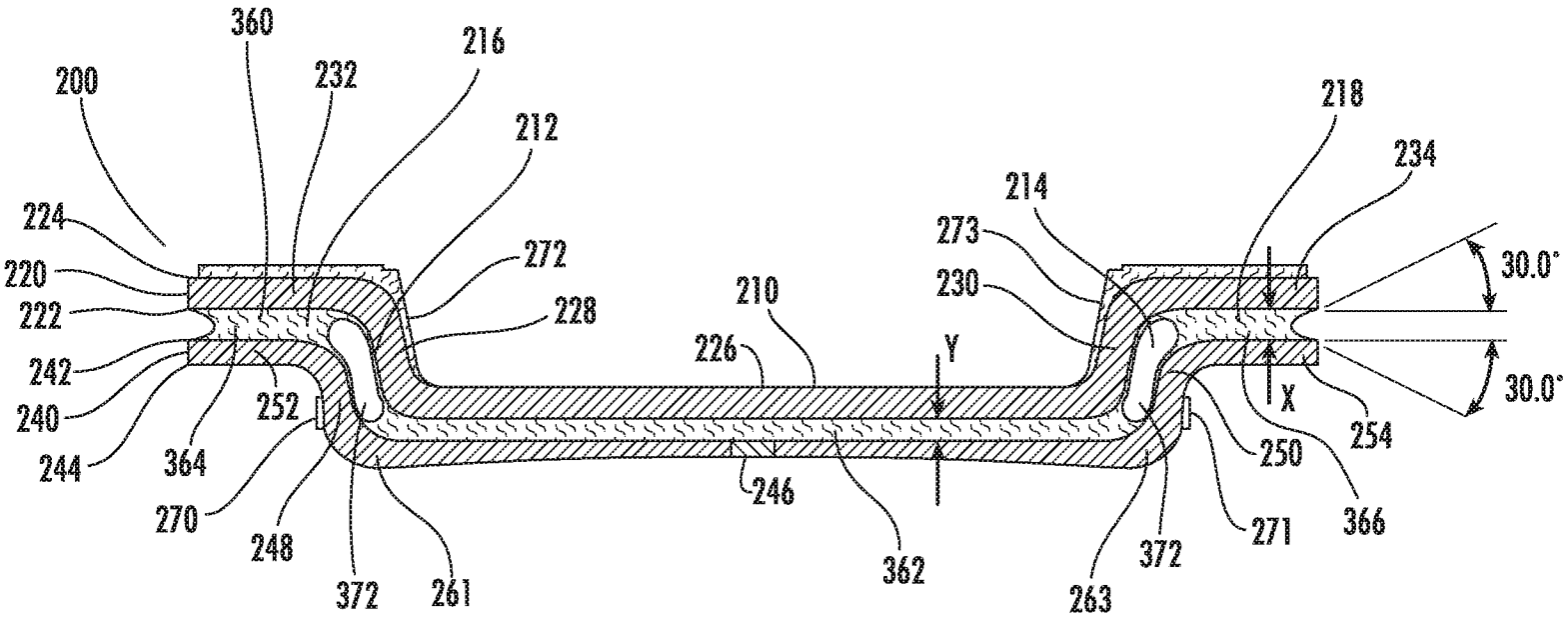
FIG. 11A is a cross-sectional view taken along line A-A of FIG. 11.

Moving now to the adapter pad 200 of the adapter system 198 which is configured to be disposed between and can engage with the roller bearing adapter 199 and the side frame pedestal roof 152 of the side frame 4. As shown in FIGS. 11-11C, and primarily FIG. 11A, the adapter pad 200 generally includes an upper member or top plate 220 having an inner surface 222 and an outer surface 224, a lower member or bottom plate 240 having an inner surface 242 and an outer surface 244, and an elastomeric member 360 disposed between the inner surfaces 222, 242 of the top and bottom plates 220, 240 along a portion of the adapter pad 200. The adapter pad 200 includes a central portion 210 that is disposed under the lower surface of the pedestal roof 152 with each plate 220, 240 having a corresponding central portion 226, 246. The adapter pad 200 further includes first and second upturned regions 212, 214 and first and second lateral flanges 216, 218. The top plate 220 has corresponding first and second upturned regions 228, 230 projecting upward from opposite edges of the central portion 226 of the upper plate 220, a first lateral flange 232 projecting outward from the first upturned region, and a second lateral flange 234 projecting outward from the second upturned region 230. Similarly, the bottom plate 240 has corresponding first and second upturned regions 248, 250 projecting upward from opposite edges of the central portion 246 of the bottom plate 240, a first lateral flange 252 projecting outward from the first upturned region, and a second lateral flange 254 projecting outward from the second upturned region 250. As shown in FIG. 3, the lateral flanges 216, 218 are disposed laterally outboard of the pedestal roof 152 when the truck system is assembled, and the central portion 210 is disposed below the pedestal roof 152. First and second upturned regions 212, 214 are disposed between the central portion 210 and the respective first and second lateral flanges 216, 218 and provide a transition therebetween.

Figure 12:
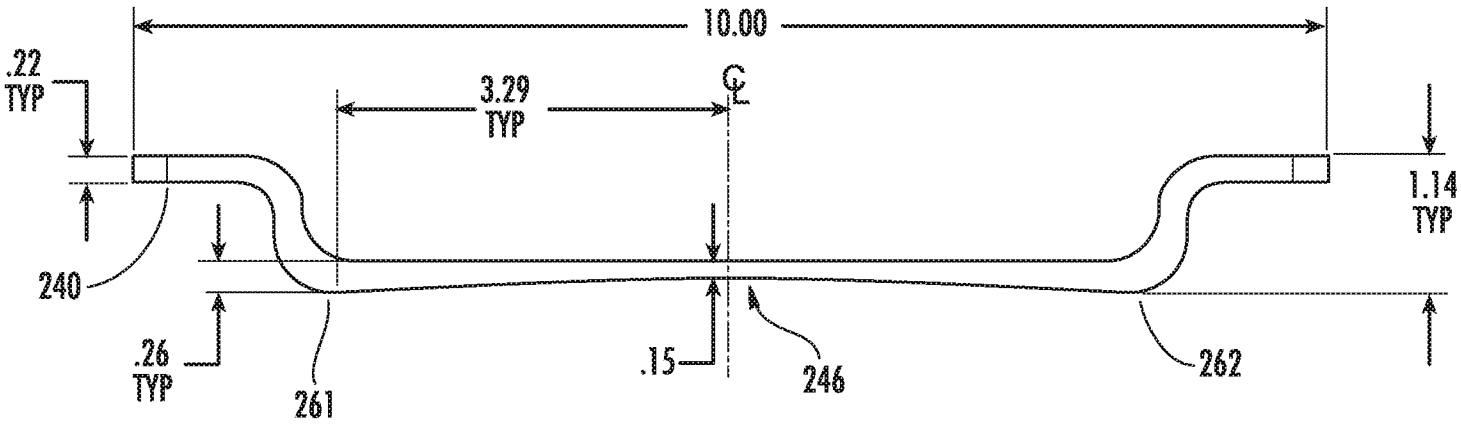
FIG. 12 is a side view of a bottom plate of an adapter pad according to aspects of the disclosure.

Turning first to the central portion 210, which can in some embodiments comprise primarily three parts including the central portion 226 of the top plate, the central portion 246 of the bottom plate and the elastomeric member 360 disposed therebetween. As discussed above, the adapter pad 200 is disposed between the side frame pedestal roof 152, which generally has a substantially flat horizontal engaging surface, and the roller bearing adapter 199 which can generally have a curved or crowned roof. As shown in FIGS. 11A and 12 the central portion 246 of the bottom plate 240 can have a curved lower surface 244 such that the outer surface 244 generally follows the curve or crown of the adapter 199. More specifically, in some embodiments the central portion 246 can have a greater thickness toward the edges 261, 262 of the central section 246 than at the center of the central section 246. For example, as shown in FIG. 12, the thickness at the center of the center portion 246 can be about 0.15 inches or in the range of about 0.06 inches to about 0.35 inches and the thickness at the edges 261, 262 can be about 0.26 inches or in the range of about 0.15 inches to about 0.5 inches.

In some embodiments, the central section 226 of the top plate 220 can include an outer surface 224 and an inner surface 222 that are substantially horizontal and parallel as shown in FIG. 11A. The thickness of the center portion 226 of the top plate 220 can be about 0.28 inches or in the range of about 0.15 inches to about 0.4 inches. In such a system, the thickness of the elastomeric section 360 can be substantially similar throughout the central portion 210 which can in some embodiments increase performance characteristics.

It has been found that an elastomeric section having a uniform thickness can in some circumstances have certain advantages. For example, in certain embodiments, linear thermal shrinkage can be constant along the length and width of the pad if the plurality of elastomer layers have common length and width dimensions among all members. For example, in some embodiments, during molding the rubber forming the elastomeric member can be injected into the mold at around 300 degrees Fahrenheit, and it can subsequently cool to room temperature. Linear thermal shrink normal to the shear plane can be related to the section thickness "T" the change in temperature, and the coefficient of thermal expansion. A non-uniform elastomer thickness can result in non-uniform shrinkage during the cooling process. Non-uniform shrinkage can result in residual tensile stresses in the areas last to cool which can negatively impact fatigue life.

With further reference to FIGS. 11-11C, and primarily FIG. 11C, in some embodiments, the first and second upturned portions 228, 230 of the top plate 220 can include an outer planar portion 228*a*, 230*a* (only the first upturned region shown in FIG. 11C) and an inner planer portion 228*d*, 230*d*. In some embodiments, the planar portions 228*a*, 230*a* and 228*d*, 230*d* can extend at an angle Δ with respect to a plane P that extends along the outer surface 224 of the center portion 226. In some embodiments, the angle Δ may be an obtuse angle and in some embodiments the angle can be within the range of about 95 degrees to about 115 degrees, such as 105 degrees, or any other angle within this range. In embodiments, as described in more detail below, where the first and/or second upturned portions 212, 214 include a grip, the planar surface may surround one or both sides of the grip, or may be alternatively arranged with respect to the grip. The first and second upturned portions 228, 230 of the top plate 220 can also include lower curved portions 228*b*, 230*b* and 228*e*, 230*e* that transition between the central portion 226 and the planar portions 228*a*, 230*a* and 228*d*, 230*d*. Similarly, the first and second upturned portions 228, 230 of the top plate 220 can also include upper curved portions 228*c*, 230*c* and 228*f*, 230*f* that transition between the lateral flanges 232, 234 and the planar portions 228*a*, 230*a* and 228*d*, 230*d*. The upper or lower curved portions 228*b*, 230*b*, 228*e*, 230*e*, 228*c*, 230*c*, 228*f*, and 230*f* may be formed with a constant curvature and/or a varying curvature. The bottom plate 240 can include similar planar portions and upper and lower curved regions. The upturned regions 212, 214 may in some embodiments not include a planar portion and may be formed with a constant curvature and/or a varying curvature.

Figure 13A:
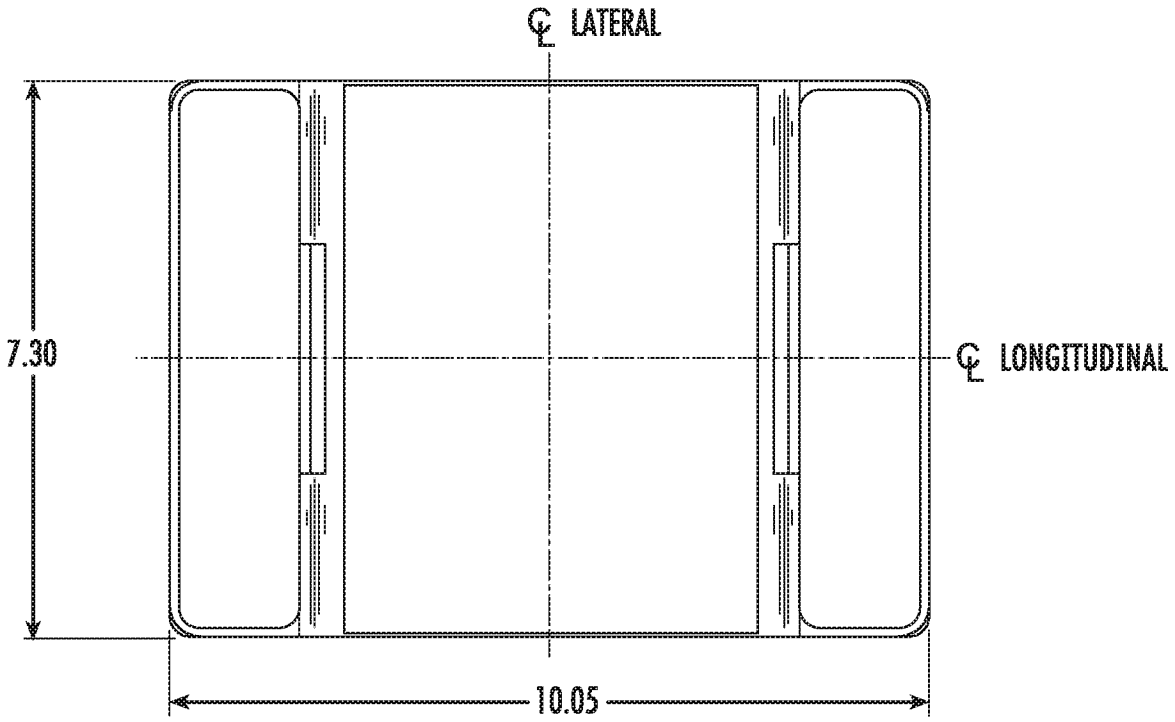
FIG. 13A is a top view of an adapter pad according to aspects of the disclosure.
Figure 13B:
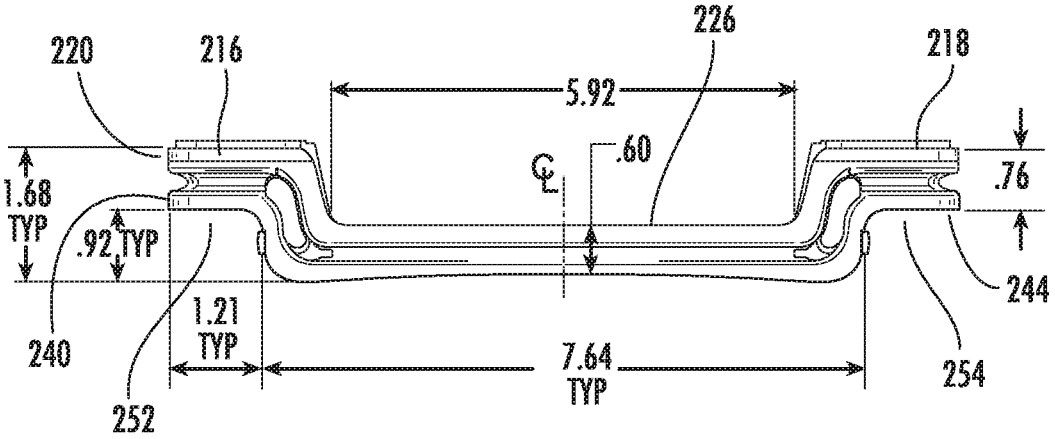
FIG. 13B is a cross-sectional view taken along the longitudinal line of FIG. 13A.

With further reference to FIG. 11A, the first and second lateral flanges 216, 218 can extend laterally outside of the side frame 4 and are disposed at a vertical height or in a plane that is different or above the central portion 210, which is disposed under and in contact with the pedestal roof 152. Accordingly, the first and second lateral flanges 216, 218 are disposed in a vertically raised position with respect to the central portion 210. The lateral projecting flanges 216, 218 can provide more area for elastomer, and as discussed below, can increase stiffness of the adapter pad. In some embodiments, as shown in FIG. 13B, the outer surface 244 of the first and second lateral flanges 252, 254 of the bottom plate 240 may be about 0.92 inches above the outer surface 244 of the lowest edge of the bottom plate 240 or in the range of about 0.25 inches to about 2 inches. In some embodiments, the first and second lateral flanges 216, 218 can include a planar and horizontal outer surfaces 224, 244, which can be parallel to the outer surface 244 of the central portion 226. In some embodiments, the outer surface 244 of the first and second lateral flanges 252, 254 of the bottom plate 240 can rest on the vertical shoulders 106 of the roller bearing adapter 199. In other embodiments, the outer surface 244 of the first and second lateral flanges 252, 254 of the bottom plate 240 does not contact the vertical shoulders 106. And in still other embodiments, the outer surface 244 of the first and second lateral flanges 252, 254 of the bottom plate 240 can indirectly contact the vertical shoulders 106 through another piece such as a compression shim. As will be discussed in more detail below, in some embodiments, about 10 percent to 30 percent of vertical force from the pedestal roof 152 can be distributed to each of the adapter pad lateral flanges 216, 218 when a vertical force is applied to the central portion 210 of the adapter pad.

Although the embodiment of the adapter pad 200 shown in at least FIGS. 11-13 includes upturned portions 212, 214 and lateral flanges 216, 218, it need not include these portions in all embodiments. The center portion 210 can in some embodiments be used without the lateral flanges 216, 218 and/or without the upturned portions 212, 214, although such designs may affect performance. In an embodiment, the lateral flanges 216, 218 can extend from the central portion without upturned portions, and without decreased performance characteristics. Similarly, in some embodiments the lateral flanges can extend outside of the central portion but in the same plane as the central portion. In still other embodiments, the adapter pad 200 can include downturned portions that can connect to lateral flanges.

The top plate 220 may be made from one or more different types of alloys with suitable strength and other performance characteristics. For example, the top plate 220 may be manufactured from ASTM A36 steel plate, or steels with a strength equivalent to or higher than those specified in ASTM A-572. In some embodiments, the entire top plate 220 is formed (cast, machined, pressed, rolled, stamped, forged or another suitable metal forming operation) from a single monolithic member. In some embodiments, the top plate 220 may be formed from a material with a constant thickness throughout. In other embodiments, the top plate 220 has a variable thickness. For example in some embodiments, the lateral flanges 232, 236 of the top plate 220 can have a thickness that is greater than or less than the thickness of the center portion 226. Similarly and as previously discussed, the bottom plate 240 can have a constant or variable thickness. In some embodiments, one, some, or all of the corners 233 of the top plate 220 may be curved.

In some embodiments, the outer surface 226 of the top plate 220 may receive a coating of an elastomeric material 265 which may be the material that contacts the pedestal roof 152. As discussed elsewhere herein the elastomeric layer 265 may provide dampening and a calibrated flexibility to the pad, as well as a compressible surface to minimize wear between the adapter pad 199 and the pedestal roof 152. The elastomeric coating 265 may be formed with a flat outer surface that follows along the geometric profile of the steel portion of the top plate 220, and can have a uniform thickness, either along the entire top plate 220, or in other embodiments, a uniform thickness within discrete portions of the pad (such as a uniform thickness in the central portion 210, a (potentially different or potentially the same) uniform thickness on one or both of the upper portions lateral flanges 232, 234, a (potentially different or potentially the same) uniform thickness on one or both of the upturned portions 228, 230, and the like.

During use, there can be heat generation in the adaptor pad 200 through friction of the pad 200 and sliding relative to the side frame pedestal roof 152 and/or relative to the bearing adaptor 199; and or the hysteretic damping of the elastomeric member 360 of the adaptor pad 200. These heat sources can cause adaptor pad temperatures to increase, which can result in lower durability and reduced stiffnesses.

In some embodiments, the first and second lateral flanges 216, 218 can include upper and lower surfaces exposed to air outside of the side frame envelope at the pedestal area (when the adapter pad is installed within a pedestal of a truck). The exposed surfaces can readily allow for heat loss from the adapter pad during operation of the railcar (acting as a fin) and can cause net heat flow from the central portion 210 of the adapter pad 200) and toward the lateral flanges 216, 218. As is easily understood, and as discussed below, heat is generated within the adapter pad 200 during railcar operation due to various reasons, such as due to friction that resists relative translation or rotation between the adapter pad 200 and the side frame and between the adapter pad 200 and the bearing adapter 199. Further, because the adapter pad 200 is in surface-to-surface contact with the side frame 4 and the bearing adapter 199, the adapter pad 200 may receive heat that is generated elsewhere and transferred to the adapter pad 200. Also, the cyclic dampening of the elastomeric portion produces heat. This heat must be ultimately removed to avoid a significant increase in the temperature of the components of the adapter pad 200 to increase the life of the components, as well to decrease the possible design constraints that might be necessary if the adapter pad 200 (or portions of the adapter pad 200) continuously operate with higher temperatures absent heat removal. This heat flow out of the adapter pad 200 may assist with the thermal design of the adapter pad 200 and the remainder of the truck system, which can have various design benefits such as broadening the possible elastomeric material choices, as well increasing the life of the elastomeric material by reducing its operating temperature, as other possible benefits.

In some embodiments, the adapter pad 200 can include additional features that can increase its ability to reduce heat in the adapter pad 200. For example, in some embodiments, first and/or second lateral flanges 216, 218 may include a portion that extends laterally from the side walls of the side frame pedestal area. During use, the laterally projecting flanges are in direct contact with airflow generated by the moving car, as opposed to the central portion which is insulated by the metal roller bearing adapter and the steel side frame pedestal region. These laterally projecting flanges can provide free surface area to transfer heat to atmosphere from the adapter pad 200. This can help dissipate heat from the hysteretic cycling of the elastomer, temperature increases of the roller bearing, and any other heat in the adapter pad 200. In certain embodiments, having first and/or second lateral flanges 216, 218 the operating temperature of the adapter pad system 198 can be reduced. For example under normal lateral shear cycling, as described below, the temperature differential between the lateral flanges 216, 218 and the center of the pad using a 5 mph constant velocity airflow over the first and second lateral flanges 216, 218 can be about 15 degrees Fahrenheit or in the range of about 5 degrees Fahrenheit to about 25 degrees Fahrenheit. Increased temperature transfer from the center of the pad to the lateral flanges can allow for further increased heat transfer to atmosphere, and therefore improved durability.

In some embodiments, one or both of the outer surface 224 of the central portion 226, or the inner surface 244 of the central portion 246 may include one or more of various surface features, and in some embodiments a pattern of surface features to make these surfaces non-smooth. For example, the upper surface may include one or more of bumps, ridges and valleys, roughened surfaces, "sticky" surfaces, and the like. These surfaces can be created through a number of methods including shot blasting surface, machining the surface, applying different substances such as different types of rubbers to the surface and the like. These surface features, when provided, may reduce the potential for lateral and/or longitudinal sliding, and/or relative rotation of the adapter pad with respect to the pedestal roof 152, which may improve adapter pad 200 dynamic loading and strength performance, and may also reduce localized heat generation within the adapter pad 800 due to friction between the adapter pad 200 and the pedestal roof 152, which must be removed from the adapter pad 200 (as discussed elsewhere herein). Similarly, a thermal barrier coating such as ceramic or porcelain can be applied to top or bottom plates 220, 240. Optionally, a thermal barrier plate can be used to thermally isolate the heat generated from the frictional sliding during the high amplitudes. This can be done in conjunction with the wear plate that is typically used with the steel-on-steel adapter plates. The plate can be formed such that an air gap is maintained and the contact areas located to the outside edges of the adapter.

The bottom plate 240 may be formed from a similar construction and materials as the top plate 220. Similarly, the outer surface 244 of the bottom plate can include surface treatments and coatings of an elastomeric material 265 as the top member.

Figure 13C:
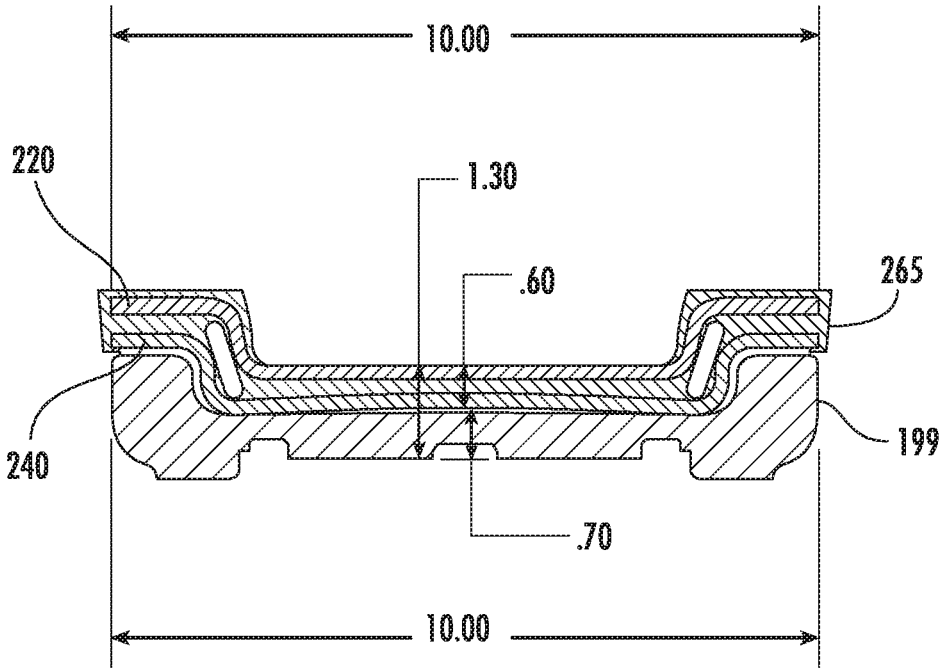
FIG. 13C is a section view along the longitudinal center centerline of an adapter pad and a portion of a roller bearing adapter according to aspects of the disclosure.
Figure 13D:
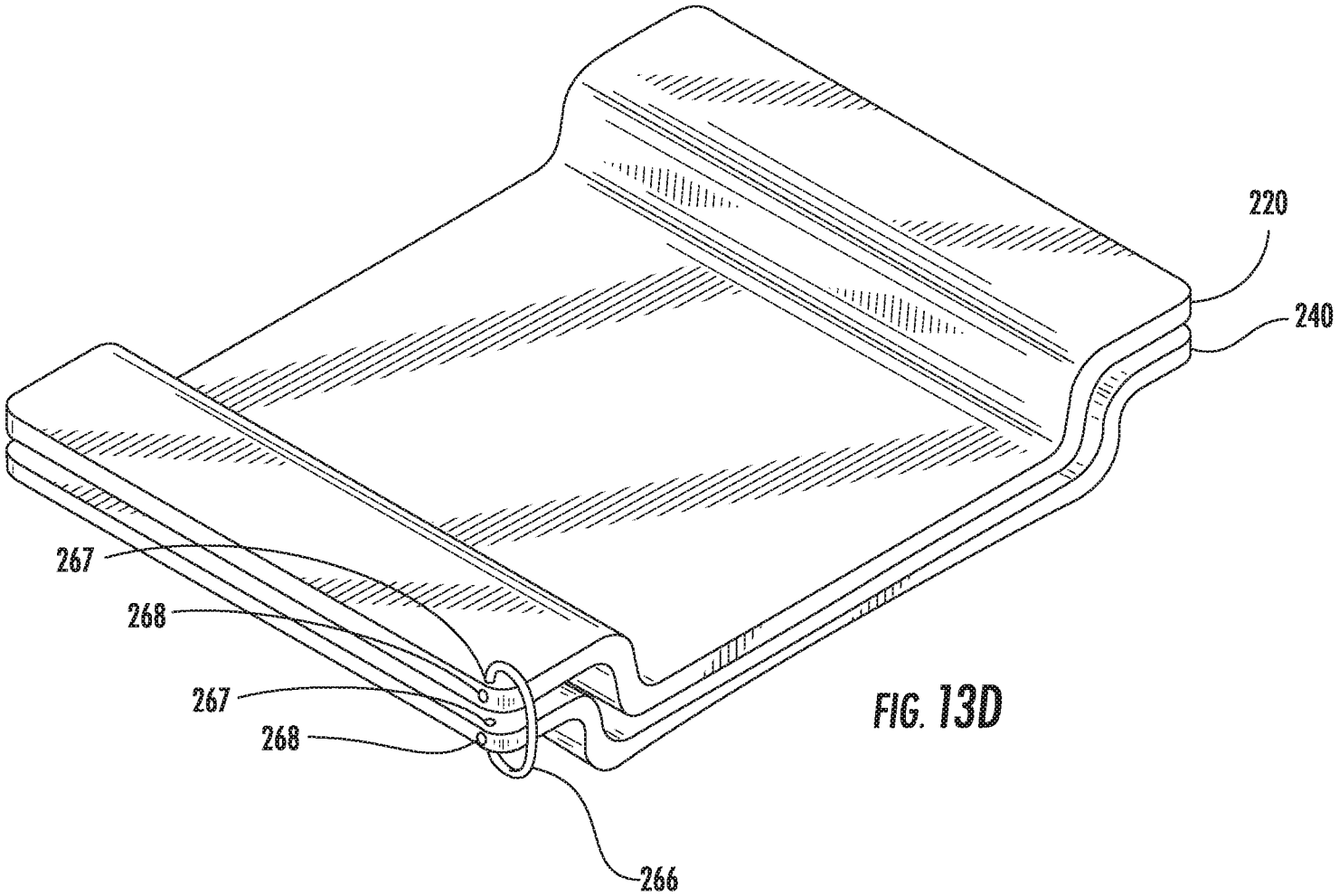
FIG. 13D is a perspective view of an adapter pad according to aspects of the disclosure with all elastomeric material removed including a ground strap.
Figure 13E:
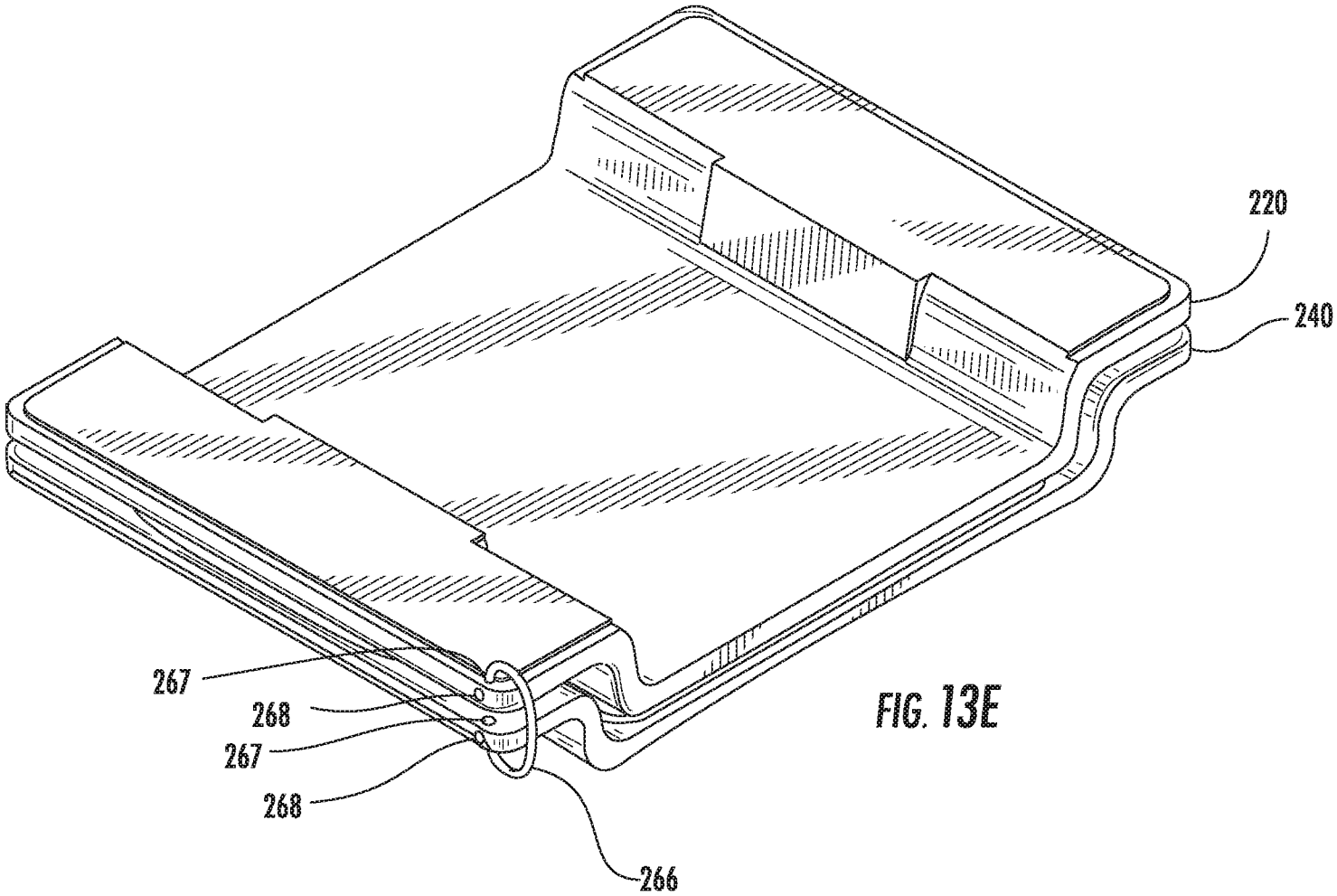
FIG. 13E is a perspective view of an adapter pad according to aspects of the disclosure including a ground strap.

In some embodiments the entire or a majority of adapter pad 200 can include a coating of an elastomeric material 265, as shown for example in FIG. 13C and FIG. 13E. In some embodiments, for example, the coating of elastomeric material may contact the pedestal roof 152, the side frame 4, and the roller bearing adapter pad 199, including the pedestal crown surface 102 and the vertical shoulders 106. In other embodiments, for example, the portions of the adapter pad 200 that contact the pedestal roof 152, side frame 4, and the roller bearing adapter pad 199, can be free of elastomeric material. As discussed elsewhere herein, the elastomeric layer 265 may provide dampening and a calibrated flexibility to the pad, as well as a compressible surface to minimize wear between the adapter pad 200, the pedestal roof 152, and the roller bearing adapter 199. The elastomeric coating 265 may follow the outer surfaces of the adapter pad 200 and can have a uniform thickness, along the outer surfaces of the adapter pad 200, or in other embodiments, a uniform thickness within discrete portions of the pad such as a uniform thickness in the central portion 210, a (potentially different or potentially the same) uniform thickness on one or both of the upper portions lateral flanges 232, 234, a (potentially different or potentially the same) uniform thickness on one or both of the upturned portions 228, 230, and the like.

In some embodiments, it may be possible to use an electrically conductive additive in the elastomeric materials discussed herein to provide electrical conductivity and shunting ability through the top and bottom plates 220, 240. These additive particles may include materials such as nickel plated graphite, silver plated aluminum, or silver plated copper. The quantity of these additives may be as little as 0.5% of the total elastomer volume to provide sufficient electrical conductivity. Similarly, to create an electrical connection between the truck side frame to the adapter, a flexible conductor can be molded into the elastomeric pad connecting the upper pad plate to the bottom plate. The encasement of the conductor can protect the conductor from environmental corrosion. Its flexibility allows it to flex as the elastomeric (e.g., rubber) material strains. In some embodiments, as shown in FIGS. 13D-13E, the electrical continuity between the side frame 4 and adapter 199 is enabled through the use of a wire ground strap 266. As shown in FIGS. 13D-13E, the wire ground strap 266 can be attached to the top and bottom plates 220, 240 using apertures 267 that can be less than about 0.20 inches from the edge of the plate. The wire ground strap 266 passes through the apertures 267 in the top and bottom plates 220, 240. The edges of the plates can be indented or deformed 268 to crimp or secure the wire ground strap 266. In some embodiments, the wire ground strap 266 may be stainless steel braid, about 0.100 inches in diameter, but may be as small as 0.050 inches.

In some embodiments, as shown in FIG. 11, the adapter pad 200 is constructed such that it is symmetrical about a lateral vertical plane that cuts through the geometric center C of the adapter pad (depicted as cutting through line B in FIG. 11) and/or symmetrical about a longitudinal vertical plane that cuts through the geometric center C of the adapter pad 200 (depicted as cutting through line A in FIG. 11).

In some embodiments, the outer lateral edges 281, 282 of the lateral flanges of the top and bottom plates 220,240 are each aligned along the same vertical plane, as best shown in FIG. 11C. In these embodiments, the lateral length of the lateral flange of the bottom plate 240 is less than the lateral length of the lateral flange of the top plate 220.

Exemplary dimensions of the adapter pad 200 are shown and described in this application; however, other dimensions may be used for portions of the adapter pad, depending upon the fixed dimensions of the side frame and the bearings used with the particular railcar truck system.

The adapter pad 200 can, in some embodiments, as shown for example in FIGS. 3 and 11-11C, also include pads or grips on top and bottom plates 220, 240 of the adapter pad which can be configured to position the adapter pad 200 relative to the side frame pedestal roof 152 and the bearing adapter 199 and also engage and restrict movement of the adapter pad 200 relative to the pedestal roof 152 and the bearing adapter 199 which can focus movement (i.e. shear) of the adapter pad 200 to the elastomeric member 360. The assembly of the adapter pad 200 to the roller bearing adapter 199 can force the adapter pad 200 to be reasonably centered with regard to the roller bearing adapter 199, and the bearing by the use of the vertical shoulders 106 and including grips. Further, the adapter pad system 198 promotes the return of the adapter 200 and wheelset to a centered, or near zero force center position.

For example, the adapter pad 200 can include a first lateral adapter grip 270 disposed between the first vertical shoulder 106 of the adapter 199 and the first upturned region 248 of the bottom plate 240; and a second lateral adapter grip 271 disposed between the second vertical shoulder 106 of the adapter 199 and the second upturned region 250 of the bottom plate 240. The lateral adapter grips 270, 271 can run the entire longitudinal length of the adapter pad 200 or a portion of the longitudinal length of the adapter pad 200. In other embodiments, the lateral adapter grips 270, 271 can comprise a plurality of lateral adapter grips that run the entire lateral length of the adapter pad 200 or any portion thereof.

The lateral adapter pad grips 270, 271 can be integrally formed with the bottom plate 240, including with being integrally formed with any elastomeric coating 265 on the adapter pad 200. In other embodiments the lateral adapter pad grips 270, 271 can be integrally formed with the adapter 199. In still other embodiments, the lateral adapter pad grips 270, 271 can be attached to the adapter 199 and/or adapter pad 200 through use of adhesives or other known methods.

The adapter pad 200 can also include a first lateral side frame grip 272 disposed on the outer surface 224 of the first upturned region 228 of the top plate 220; and a second lateral side frame grip 273 disposed on the outer surface 224 of the second upturned region 230 of the top plate 220. In some embodiments, the first lateral side frame grip 272 can be disposed on the outer surface 224 of the first lateral flange 232 of the top plate 220; and the second lateral side frame grip 273 is disposed on the outer surface 224 of the second lateral flange 234 of the top plate 220. The lateral side frame grips 272, 273 can run the entire longitudinal length of the adapter pad 200 or a portion of the longitudinal length of the adapter pad 200. In other embodiments, the lateral adapter grips 272, 273 can comprise a plurality of lateral adapter grips that run the entire lateral length of the adapter pad 200 or any portion thereof.

The grips 270, 271, 272, 273 can be formed of an elastomeric material or any other suitable material and can in certain embodiments act to properly position the adapter pad 200 with respect to the side frame pedestal 152 and the adapter 199. Additionally, the first and second lateral adapter grips 270, 271 can be configured to reduce or eliminate sliding between the adapter 199 and the bottom plate 240 of the adapter pad 200. Similarly, the first and second lateral side frame grips 272, 273 can be configured to reduce or eliminate sliding between the outer surface 224 of the top plate 220 and the pedestal 152. This can in certain embodiments, reduce or eliminate sliding between the mating surfaces of adapter 199 and the adapter pad 200, and between mating surfaces of the side frame pedestal roof 199 and the adapter pad 200 during operation of the system. Additionally, this reduction of sliding between the contacting surfaces can in some embodiments reduce heat generated by any such sliding.

Figure 14:
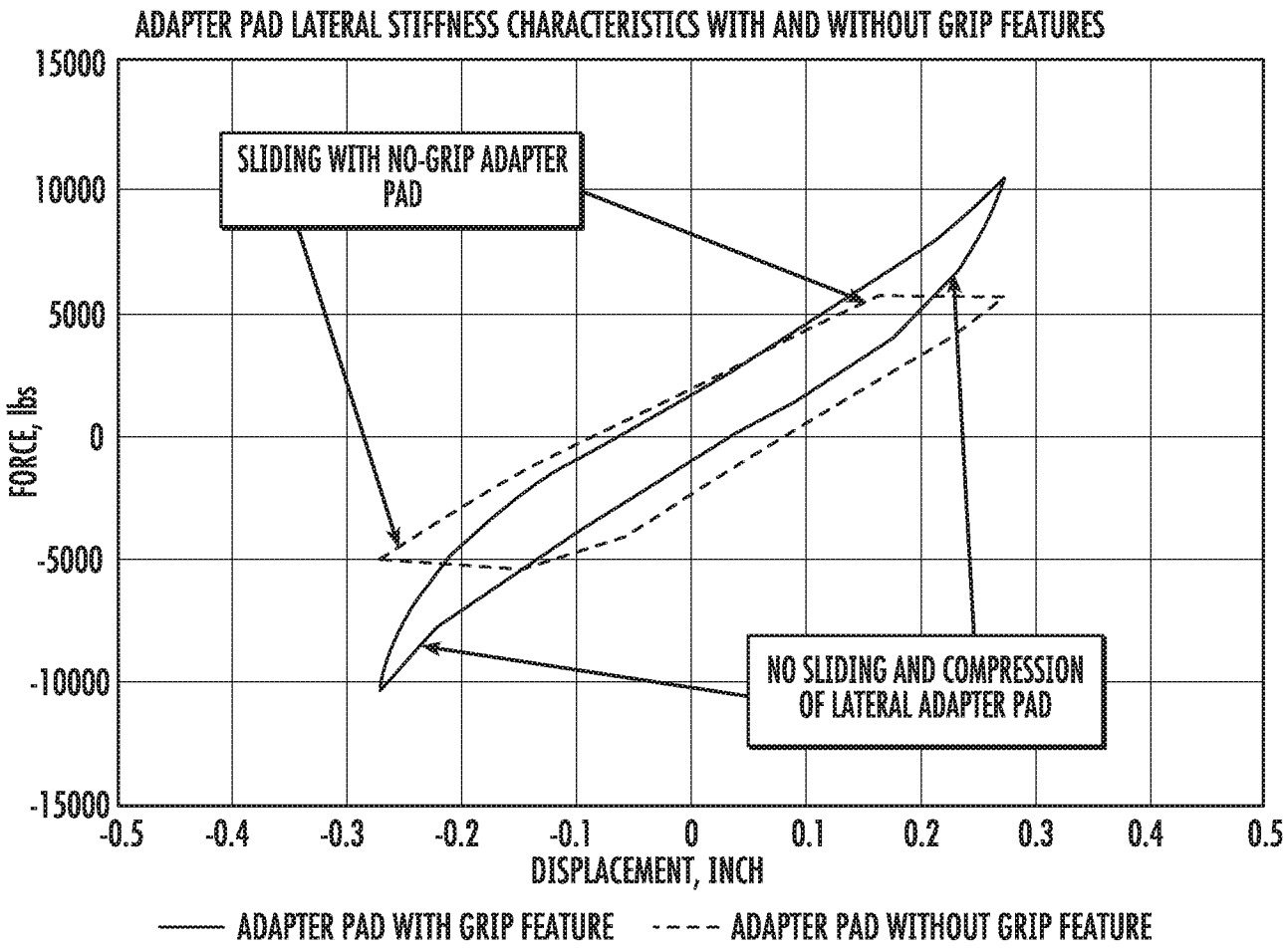
FIG. 14 is an exemplary graph depicting adapter pad lateral force vs. displacement according to aspects of the disclosure.

As discussed above, the grip features can significantly reduce relative motions between the horizontal surfaces of the adapter pad system by maintaining close-fitting contact between the vertical mating surfaces of the adapter pad assembly. Reduction of relative motions between the side frame pedestal 152 and the adapter pad 200 can improve the stiffness behavior of the adapter pad 200. As shown in FIG. 14 comparing lateral stiffness, for example, in an adapter pad system with and without grips, improvement can be seen at the end of the stroke where instead of sliding, the adapter pad/pedestal interface shows more resistance for longer lateral travel than an adapter pad system that does not include grips. Reduced sliding between the parts can also reduce physical wear of the adapter pad system.

Figure 15:
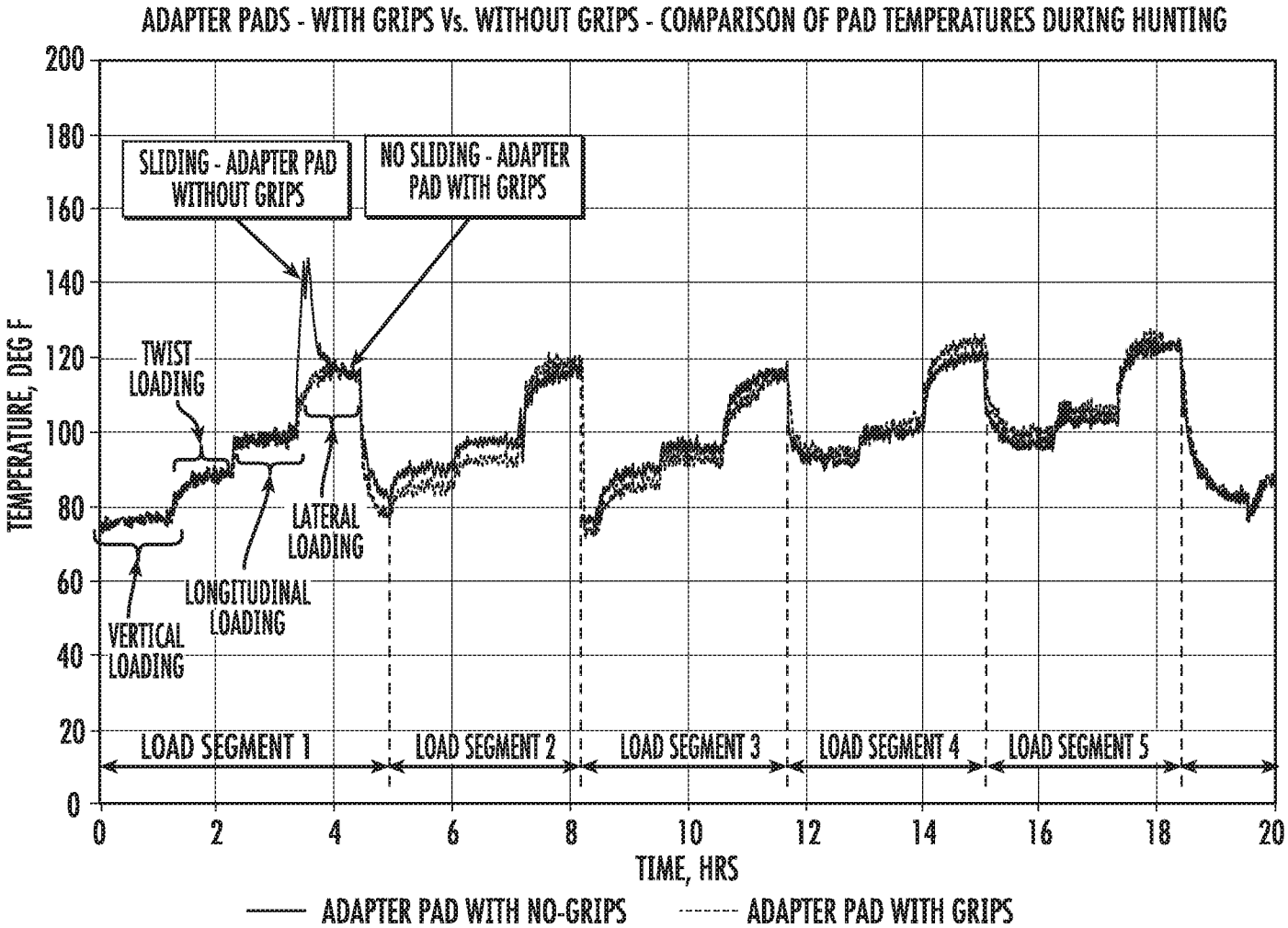
FIG. 15 is an exemplary graph depicting temperature vs. time during loading of an adapter pad according to aspects of the disclosure.

In certain embodiments, heat can be generated by movement of the adapter pad 200 relative to the roller bearing adapter 199 and the pedestal roof 152. This heat is generated by the hysteresis of the elastomer material cycling in shear displacement. As discussed above, excess heat can negatively affect the performance of the elastomeric member 360, and decrease the durability of the adapter pad. As shown in FIG. 15 which compares adapter pad fatigue dynamic characteristics with and without grips, the adapter pad 200 with grips generates less heat when compared to an adapter pad 200 without grips. In some embodiments the adapter pad 200 will not exceed about 130 degrees Fahrenheit when the adapter pad 200 is positioned between the roller bearing adapter 199 and the pedestal roof 152 of a side frame of a moving railcar. In some embodiments, the adapter pad system 198 can be configured to restrict the elastomer temperatures below the degradation temperature of the specific elastomeric and/or adhesive materials used in pad construction and in some embodiments the adapter pad system can be configured to reduce melting of the elastomeric member.

As discussed above, and as shown primarily in FIGS. 16A-B, and 11B-C, an elastomeric member 360 is disposed between the top plate 220 and the bottom plate 240. The elastomeric member 360 supports the vertical load and allows limited longitudinal, lateral, and rotational motion of the top plate 220 (supporting the side frame) relative to the bottom plate 240 (supported by the adapter). This allows the relative motion of the side frame relative to the adapter by a low stiffness, and hence, low loads as compared to sliding adapter designs. As shown in FIGS. 17A-17D the movement of the top plate 220 relative to the bottom plate 240 can be measured in longitudinal displacement (FIG. 17B), lateral displacement (FIG. 17C), and rotational displacement (FIG. 17D). The adapter pad elastomeric material 360 may be a hysteretic material and have material damping during deflection cycling. This provides another energy absorption feature, depending on selection of the material and damping. For example, a material with too much damping may cause over heating of the elastomeric member 360 and reduce its short term stiffness and long term durability. The elastomeric member 360 may be formed from any suitable elastomeric materials, such as rubber, with suitable strength, flexibility, and stiffness characteristics. In some embodiments the material used for the elastomeric material should have a durometer (hardness) of Shore A 70+/−10. Elastomers that can be used can include, but are not limited to: natural rubber; nitrile; hydrogenated nitrile; butadiene; isoprene, or polyurethane and can have a durometer of about 60-80 Shore A.

In general the elastomeric member 360 can be attached to the top and bottom plates 220, 240 through injection molding. Generally the top and bottom plates 220, 240 can be placed within the mold. In some embodiments, portions of the top and bottom plates 220, 240 can be coated with adhesive to allow the elastomeric member 360 to adhere to the plates. Additionally, in some embodiments, spacers can be placed within the mold in certain areas where the elastomeric material is not needed. Once setup is complete, elastomeric material can be heated and inserted into the mold, and the elastomeric material can flow throughout the mold cavity, adhering to the areas applied with adhesive. The elastomeric can then undergo vulcanization and/or curing.

The elastomeric member 360 may provide for dampening within the adapter pad 200, allow for discrete changes in stiffness and/or flexibility within the adapter pad 200, and to allow for differences in the dampening, stiffness, flexibility or other parameters within the different portions of the adapter pad 200 to allow for a suitable design.

As shown in FIG. 11A, the elastomeric member 360 includes a central portion 362 that is disposed within the central portion 210 of the adapter pad 200, and first and second outer elastomeric members 364, 366 that are disposed within the respective first and second lateral flanges 216, 218. The outer elastomeric members 364, 366, increase the shear area and volume of the elastomer layer 360 by extending the elastomeric material beyond the standard adapter clearance envelope through the use of the lateral flanges 216, 218. This provides more area for the elastomeric member 360 and can increase stiffness of the adapter pad 200.

Figure 16A:
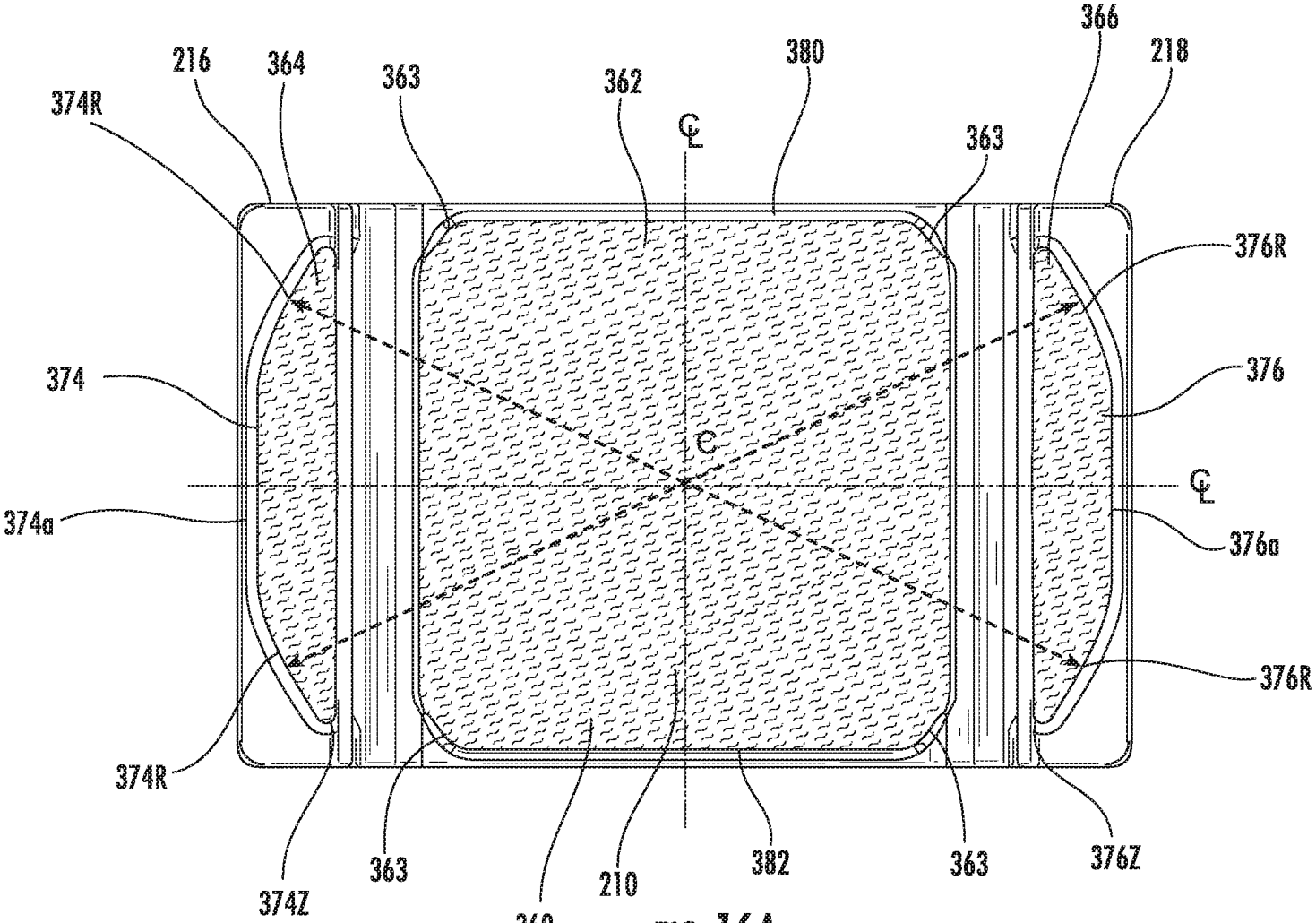
FIG. 16A is a top view of an adapter pad without the top plate according to aspects of the disclosure.
Figure 17A:
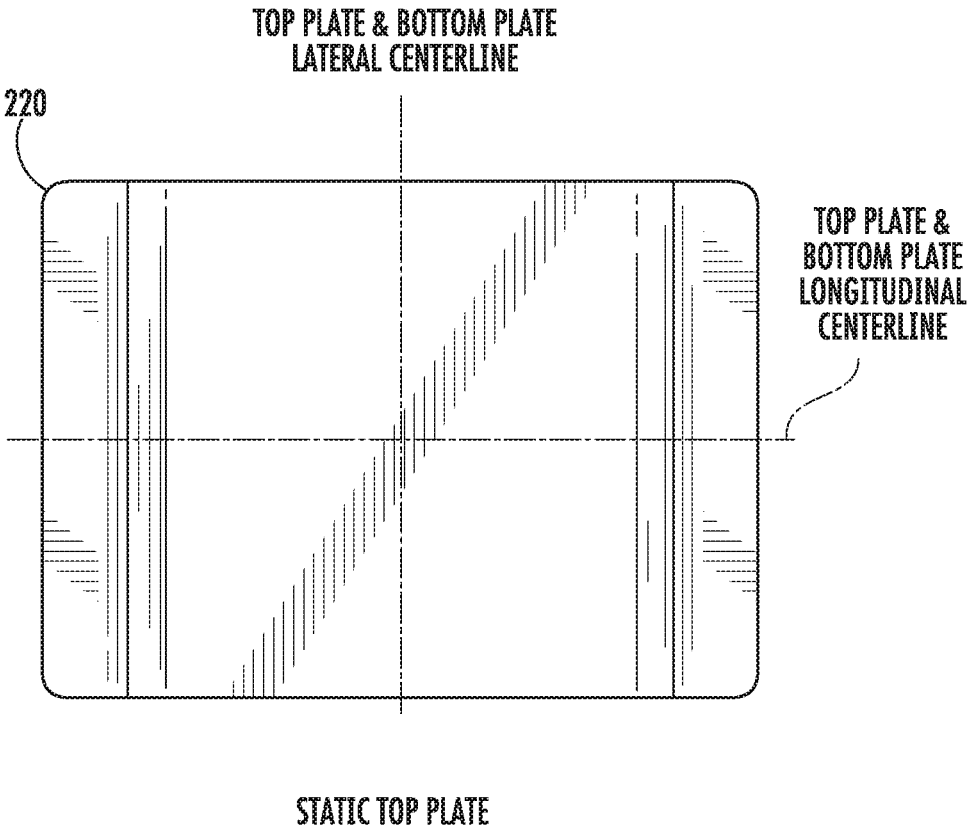
FIG. 17A is a top view of an adapter pad according to aspects of the disclosure.
Figure 17B:
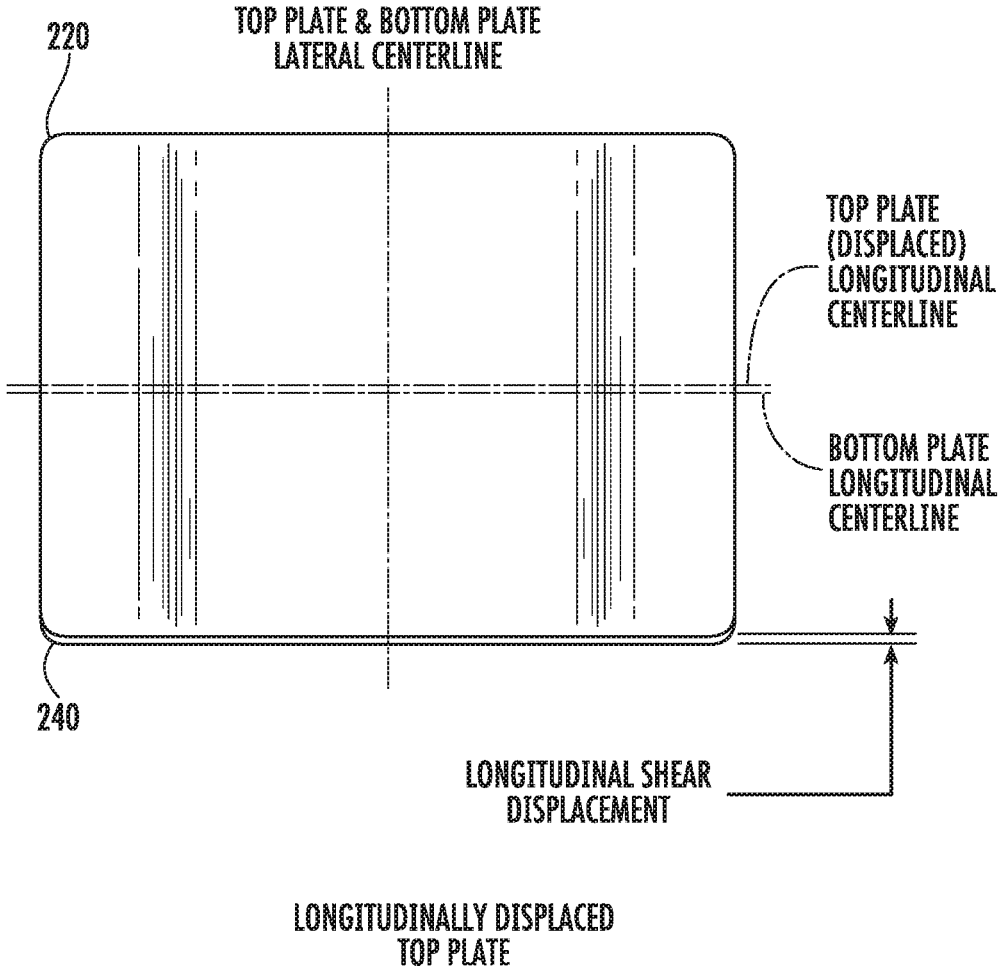
FIG. 17B is a top view of the adapter pad of FIG. 17A depicting longitudinal displacement.
Figure 17C:
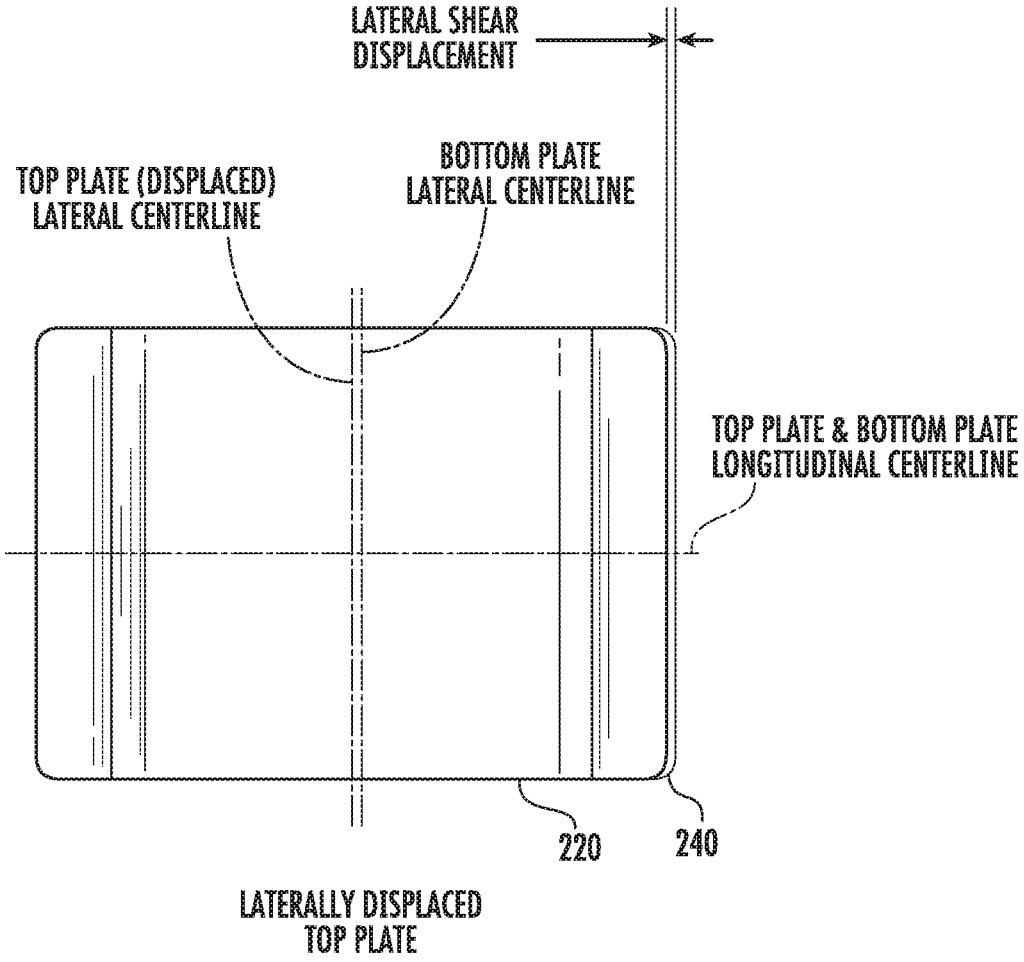
FIG. 17C is a top view of the adapter pad of FIG. 17A depicting lateral displacement.
Figure 17D:
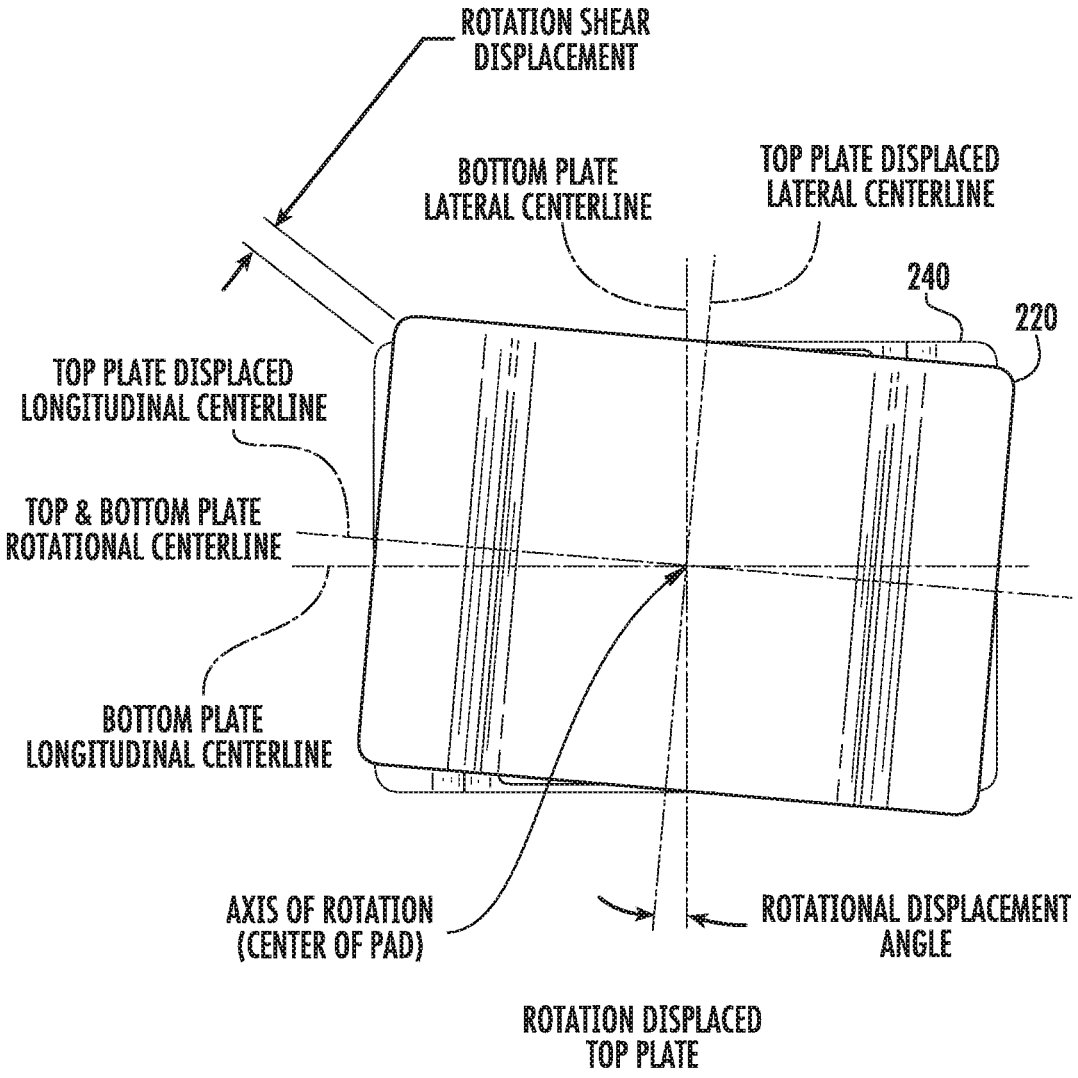
FIG. 17D is a top view of the adapter pad of FIG. 17A depicting rotational displacement.

As best shown in FIG. 16A, from a top view, the central elastomeric portion 362 can be generally square shaped and in some embodiments, as shown in FIG. 16A can have one or more rounded corners 363. Rounded corners throughout the elastomeric member 360 can reduce or eliminate stress concentrations as compared to an elastomeric member 360 with square corners. As discussed above, the thickness of the elastomeric member 362 can have a uniform thickness throughout the central portion 210.

Figure 16B:
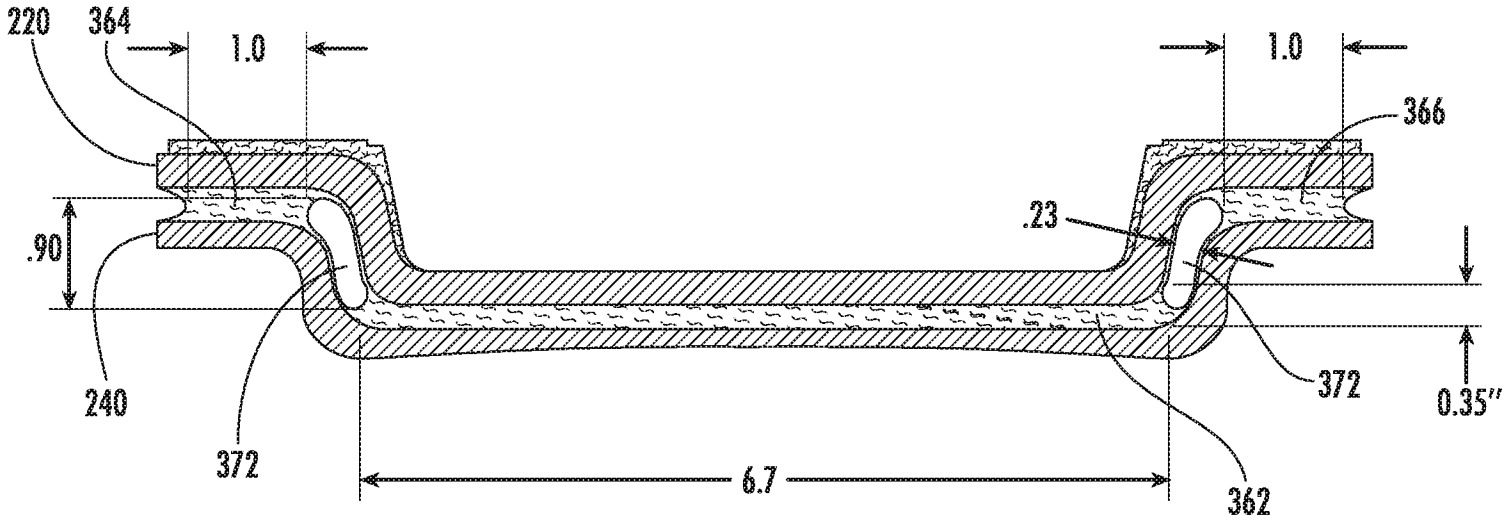
FIG. 16B is cross-sectional view of adapter pad according to aspects of the disclosure.

The central elastomeric portion 362 can be primarily disposed in the central portion 210, but in some embodiments can also be disposed in the first and second upturned regions 212, 214, as shown in FIG. 16B, and in the lateral flanges 216, 218. As shown in FIG. 16B, the central elastomeric member 362 can have a lateral length of about 6.7 inches or in the range of about 6.5 inches to about 10 inches. In some embodiments, and as shown in FIG. 16B, the elastomer 360 can be disposed between the top and bottom plates 220, 240 in the upturned regions 212, 214. In embodiments where elastomer 360 is disposed between the plates in the upturned region it can compress or shear under lateral loading. This compression of the elastomer in the upturned regions 212, 214, in concert with the shearing of the elastomer in the other regions, can allow the adapter pad to reach high stiffnesses which can increase performance.

As best shown in FIG. 16A, from a top view, the outer elastomeric portions 364, 366 within one or both of the first and second lateral flanges 216, 218 forms an outer edge 374, 376, respectively. The outer edge 374, 376 may be disposed between the top and bottom plates 220, 240 such that a portion of one or both of the top or bottom plates 220, 240 extends radially outward past at least a portion of the outer edge 374, 376 of the elastomeric portion.

In some embodiments, the outer edge 374, 376 may be a longitudinal outer edge (374*a*, 376*a*) (i.e. may extend generally in the longitudinal direction when the adapter pad 200 is installed within a truck system) and may include a curved portion that is not in the same shape and alignment with the outer longitudinal edge of the top and/or bottom plates 220, 240. While the term "longitudinal outer edge" is used, this is meant to define the portion of the outer edge that extends between the opposed lateral edges 280, 282 (i.e. the two edges that extend laterally between the first and second lateral flanges 216, 218 and through the central portion 210), and as discussed herein may be curved with each portion of the curve including at least a vector component that faces in the lateral direction (i.e. perpendicular to the direction of motion of the truck that receives the adapter pad 200).

For example, at least a portion 374R, 376R of the outer edge 374, 376 may be formed with a continuous radius (R) with respect to a geometric center of the adapter pad, as annotated as "C" on FIG. 16A. In some embodiments each outer edge 374, 376 may include two discontinuous curved edges 374R, 376R with a constant radius, with a center section between the two that may be straight or at a different curve(s) than the constant radius portions. In other embodiments, the constant radius portion may be continuous and extend from proximate to both opposite lateral edges 380, 382 upon the respective lateral flange, such as throughout the entirety of the respective lateral flange, or between the opposed lateral edges but mating with a portion 374*z*, 376*z* extending from the respective upturned portion 212, 214 to the edge 374, 376 with the radius geometry.

Figure 11B:
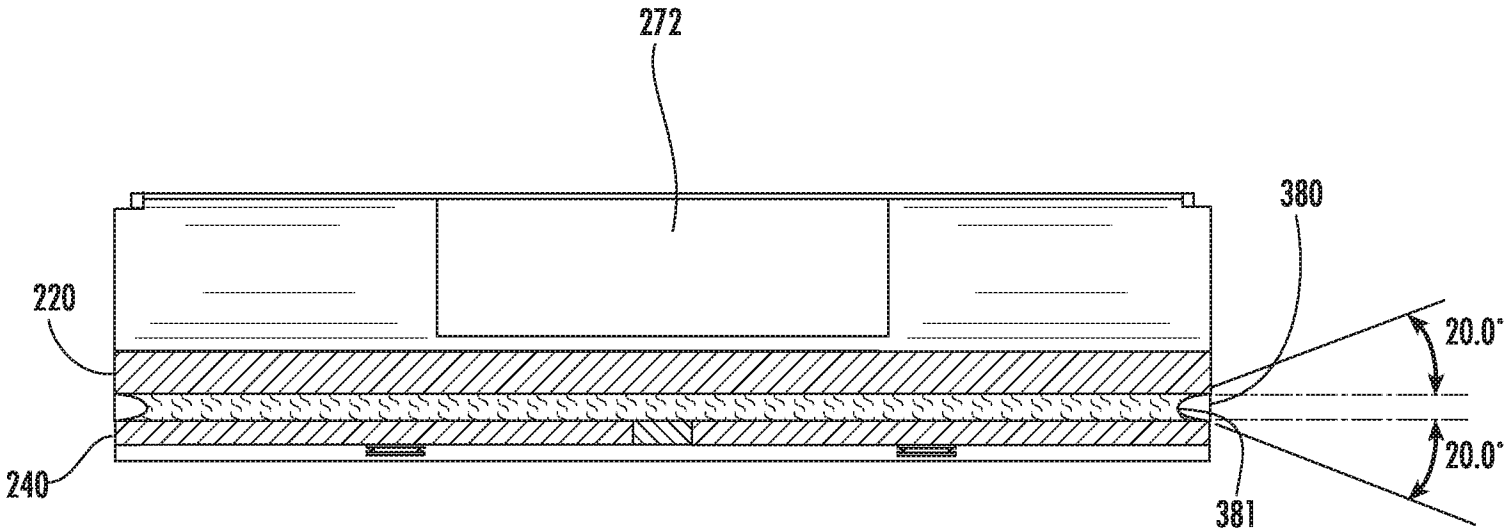
FIG. 11B is a cross-sectional view taken along line B-B of FIG. 11.
Figure 11C:
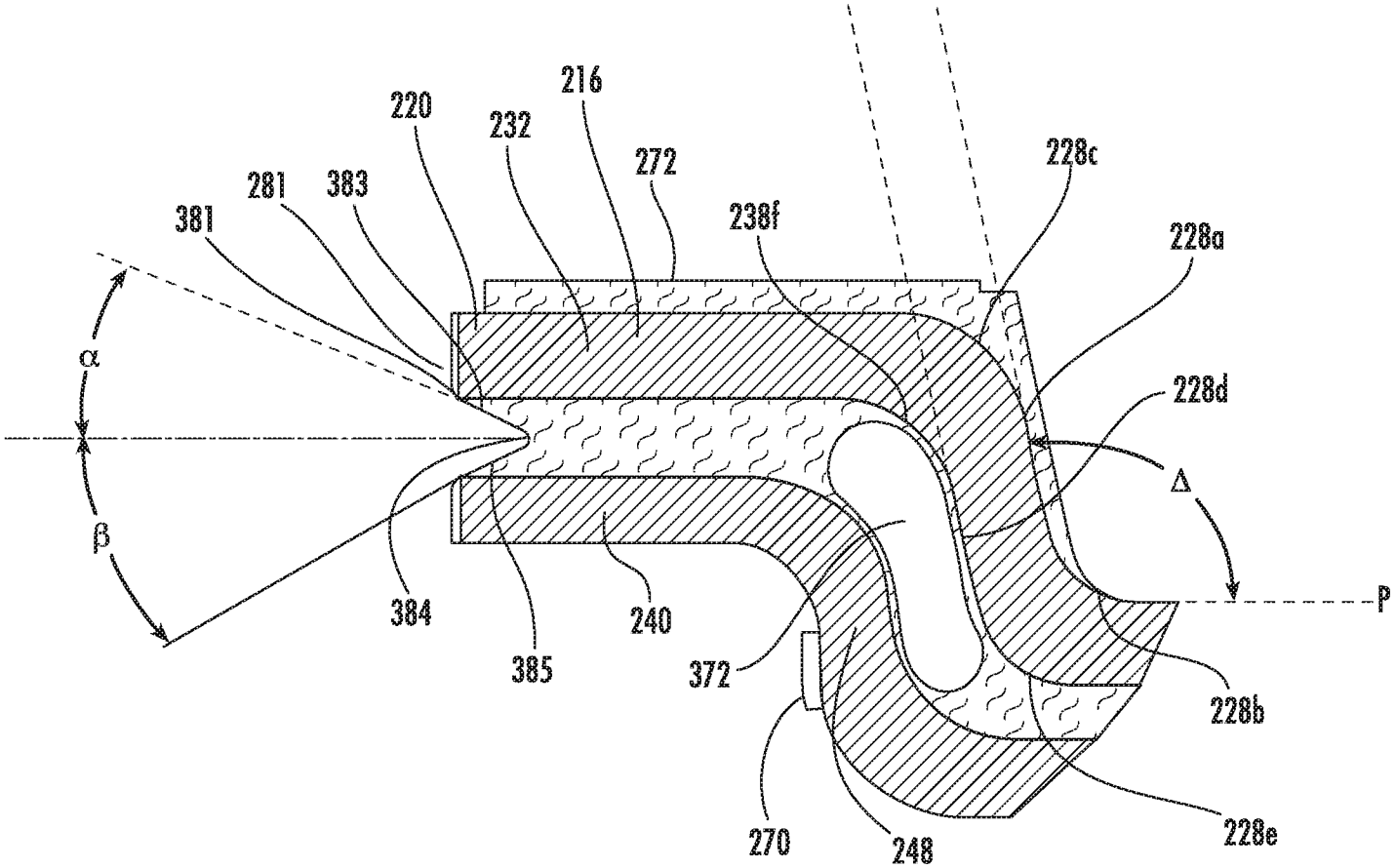
FIG. 11C is a detail view of detail G of FIG. 11.

In some embodiments, the lateral edges 380, 382 and the longitudinal outer edges 374*a*, 376*a*, and any other edge of the elastomeric portion 360 may include an internally recessed contour 381, as best depicted in FIG. 11A-11C. In some embodiments, the internally recessed contour 381 may be the same profile about the entire perimeter of the elastomeric member 360, while in other embodiments; the internally recessed contour 381 may be at differing profiles depending upon the expected compression to be felt by that portion of the elastomeric member 360.

As can be appreciated, and discussed elsewhere herein, the elastomeric member 360 compresses and deforms under load and the elastomeric material presses radially outward proximate to the outer edges. The internally recessed contour 381 minimizes or eliminates the deformation of the elastomeric member 360 beyond the nominal outer edge of the member 360, which can in certain embodiments enhance the fatigue life of the adapter pad 200.

The internally recessed contour 381 may include a first portion 383 that generally extends downward from a lower surface of the top plate 220, a second portion 385 that generally extends upward from the upper surface of the bottom plate 240, and a transition 384 therebetween. In some embodiments, one or both of the first and second portions 383, 385 may be planar (along a straight portion of the elastomeric portion) or linear (along curved portions of the elastomeric portion) (collectively a linear portion) that extends from the respective surface of the top and bottom plates 220, 240 at angles $\alpha$, and $\beta$.

In some embodiments, the first and second portions 383, 385 may extend at the same relative angle, while in other embodiments, the first and second portions 383, 385 may extend at differing relative angles. In some embodiments, the angle(s) may be about 30 degrees to the neighboring surface of the top or bottom plate 220, 240, such as an angle within the range of between about 15 and about 45 degrees, inclusive of all angles within this range. As shown in FIG. 11B, the central elastomeric portion 362 can likewise include a similar internally recessed contour 381 extending around the outer edge of the central portion.

As best shown in FIGS. 11A, 11C, and 16B, one or both of the upturned portions 212, 214 may include a hollow portion(s) 372 within a cavity formed between the top and bottom plate 220, 240, which is a void where substantially no elastomeric material is provided, and can establish a discontinuity within the elastomeric member within the respective first and/or second upturned portions 212, 214. The hollow portions 372 may provide a complete separation between the elastomeric member 360 disposed within the central portion 210, and the elastomeric member disposed in the lateral flanges 216, 218. In certain embodiments, the void may include a very small thickness layer of elastomeric material that contact each of the top and bottom plate 220, 240 through the transition, which can be a function of possible limitations of the tooling used in the molding process, but this thin layer (when existing) does not materially contribute to the performance of the adapter pad 200. Additionally, in some embodiments the hollow portion 372 can include small portions of elastomeric material that extend between the top and bottom plates 220, 240, but it is otherwise substantially hollow. In some embodiments, the width of the hollow portion 372 can be about 0.25 inches or in the range of about 0.1 inches to about 0.5 inches, or at least as wide as the maximum lateral and rotational motion on the adapter pad 200. In some embodiments, the hollow portion(s) 372 are configured to provide a lateral void between the top and bottom plate 220, 240 extending through the respective transition portion 212, 214, such that the respective inner surfaces of the top and bottom plates 220, 240 within the transition portion do not contact each other during lateral or rotation relative motion therebetween and/or in view of the lateral and/or rotational displacement during railcar operations with the adapter pad 200 disposed in position in the railcar truck system.

The hollow portion 372 can function to limit the bending stresses in the top and bottom plates 220, 240. The hollow portion 372 may be about 0.25 inches. At the about 0.25 inch motion range, the upturned regions of the top and bottom plate 220, 240 can engage and prevent further relative motion. This can put an upper limit on the elastomer strain in the lateral direction and the metal stress.

As will be discussed in more detail below, the elastomeric member 360 and particularly the outer elastomeric members 364, 366 can be configured in such a manner that the elastomer's rotational shear stresses, through a displacement of up to 41 milliradians, are no greater than the elastomer's lateral and longitudinal shear stresses through a displacement of up to 0.23 inches laterally and of up to 0.14 inches longitudinally. For example, the outer elastomeric members 364, 366 can be configured such that any point on curves 374R, 376R has less than or equal rotational shear displacement as the lateral or longitudinal shear displacements. And because shear strain is directly proportional to shear displacement, all points along the curve 374R, 376R can be subject to the same strain.

The elastomeric member 360 can be measured in a cross-sectional plane through about the center of the elastomeric material 360 centered between the inner surfaces of the top and bottom plates 220, 240. In embodiments where there are a plurality of elastomeric members each member can be measured separately and each member can be added together to determine the measurements of the entire elastomeric member 360. In some embodiments, the total shear width, or length in the lateral direction, of the elastomeric member 360 can be about 9.6 inches or in the range of about 6 inches to about 14 inches. Similarly, the total shear length, or length in the longitudinal direction, of the elastomeric member 360 can be about 6.9 inches or in the range of about 6 inches to about 10 inches. The composite shear perimeter, or perimeter of all portions of the elastomeric member can be about 51.70 inches or in the range of about 35 inches to about 75 inches. In some embodiments the total surface area of the elastomeric member 360 in the shear plane can be about 55.5 square inches or in the range of about 50 square inches to about 70 square inches. The total surface area of the elastomeric member 360 outside of the central portion can be about 15.5 square inches or in the range of about 5 square inches to about 30 square inches, or greater than 5 square inches. Thus, the surface area of the elastomeric member in the lateral flanges 216, 218 can be about 7.75 square inches each or in the range of about 2.5 square inches to about 15 square inches, or greater than 2.5 square inches.

As will be discussed in more detail below, the elastomer layers 364, 366 outside of the central area 210 can contribute to the overall stiffness of the adapter pad 200. For example in some embodiments, the elastomeric member 360 outside of the central area 210 can contribute about 15%, or in the range of about 5% to about 30%, of the total lateral and longitudinal stiffness of the adapter pad, and 33%, or in the range of about 15% to about 60%, of the rotational stiffness of the adapter pad 200.

As previously discussed, the elastomeric member 360 of the adapter pad 200 provides shear resistance during loading in the lateral, longitudinal, and rotational directions under a vertical load. This shear resistance is caused by relative movement between the top and bottom plates 220, 240 reacted through the elastomeric member 360. Simple shear strain is defined as d/t where d=displacement of the elastomeric member and t=thickness of the elastomeric member. In some embodiments, the shear strain can reach values greater than 100% under maximum displacement conditions. For example, in some embodiments, lateral strain achieves 110% or 120% or 130%. In some embodiments shear strain does not exceed 105%, 110%, 115%, or 120%, or 130% under maximum displacement.

To reduce the stresses in the elastomeric member 360 under maximum shear displacement, it can be beneficial to provide normal stress, or compression, to the elastomeric member 360 during shear loading. In some embodiments, vertical loading of adapter pads is transferred through the pedestal roof 152 of the side frame, to the central area 210. Additionally, although the top and bottom plates 220, 240 can contact the vertical shoulders of the adapter, in some embodiments, the top and bottom plates 220, 240 are flexible and the vertical load on the central region 210 is not transferred equally to the lateral flanges 216, 218 and can create a non-uniform distribution of the vertical load to the elastomeric member 360. This can result in less compression of the elastomeric member 360 outside of the area under the pedestal roof 152. Various methods can be used that can increase the normal stress or compression in the elastomeric member 360 outside of the pedestal roof 152, for example, in the lateral flanges 216, 218.

In embodiments, the elastomeric member 360, outside the pedestal roof 152 area can be compressed greater than 0.020 inches, or greater than 7% of the static thickness of the elastomeric member 360. In certain embodiments, precompression of this magnitude allows for improved fatigue life of the elastomeric member 360. Additionally, in embodiments discussed herein about 10 percent to 30 percent of vertical force can be distributed to each of the adapter pad lateral flanges 216, 218 when a vertical force is applied to the central portion 210 of the adapter pad 200. And in embodiments discussed herein the reaction of the vertical load at the vertical shoulders 106 can provide a vertical force greater than 3000 pounds to precompress the elastomeric member.

Figure 18:
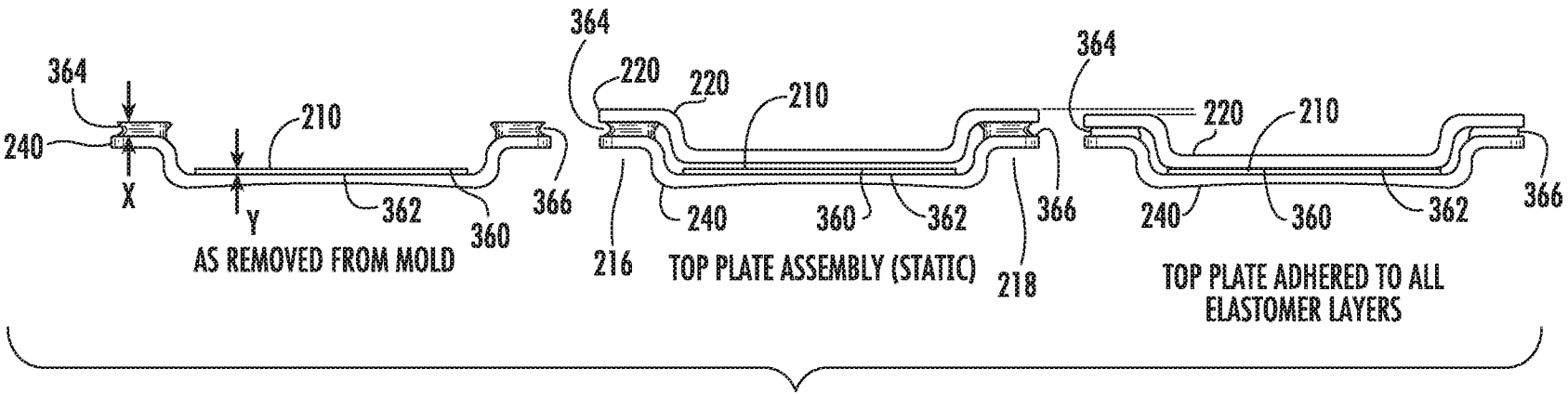
FIG. 18 is a depiction of a method of manufacturing an adapter pad according to aspects of the disclosure.

In some embodiments, as shown primarily in FIG. 18, compression of the elastomeric member 360 in the region outside the pedestal roof 152 (in the outer elastomeric members 364, 366), can be accomplished with an elastomeric member 360 having a non-uniform thickness along the length of the elastomeric member 360. For example, in some embodiments, the first and/or second outer portions 364, 366 may be formed with a thickness X while the central portion 362 may be formed with a different or smaller thickness Y. The geometry (such as the bends through the upturned portions 212, 214) of the top and bottom plates 220, 240 may be formed to accommodate the differences in thickness between X, Y allowing the elastomeric portions in the central and outer portions to contact the inner surfaces of the top and bottom plates 220, 240 as desired. In certain embodiments, the difference in thickness of the elastomeric member forming the first and/or second outer portions 364, 366 and the central portion 362 can assist in reducing the simple shear strains of the outer layers based upon in-plane forces applied to the adapter pad in the longitudinal, lateral, and rotational directions.

In some embodiments, as shown in FIG. 18, one or both of the lateral flanges 216, 218 may be formed such that the elastomeric layers 364, 366 therewithin includes a thickness, X that is about 0.25 inches, such as within a range of 0.15 inches to 0.30 inches, inclusive of all thicknesses within the range. In this embodiment, the thickness Y of the elastomeric layer 360 in the central portion 362 may be about 0.20 inches, such as within a range of 0.15 inches to 0.25 inches, inclusive of all thicknesses within the range. The thicknesses of elastomeric layers discussed herein refer to the static thickness of the elastomeric layers or the thickness of the elastomeric layers without an external load on the elastomeric layer. One or both of the lateral flange portions 364, 366 and central portions 362 may have a different thickness, with the upper portions being thicker than the central portion this can achieve a desired effect, generally of increasing the load or compression of one or both of the lateral flange portions 364, 366, which due to the material properties of the elastomeric layer additionally increases its strength and durability based upon the contemplated loading during railcar operation.

Figure 24:
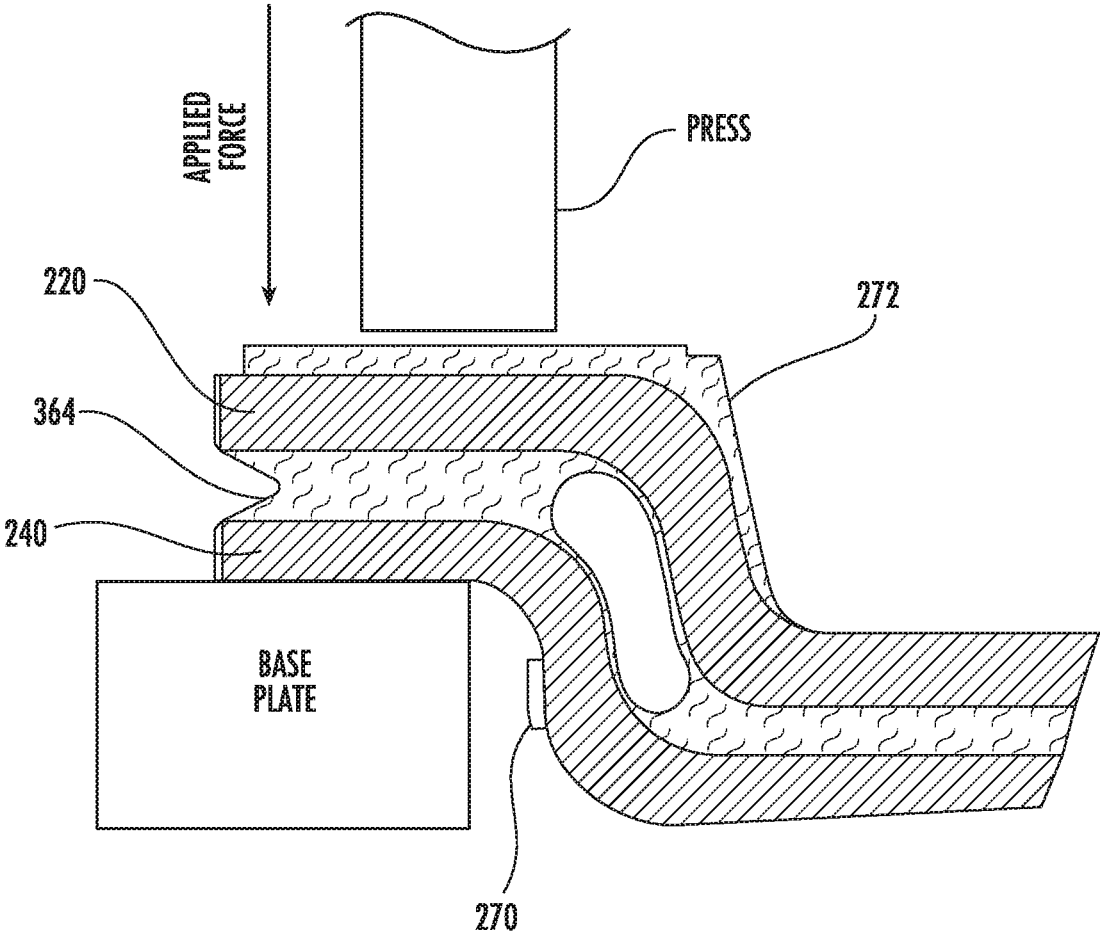
FIG. 24 is a depiction of a method of manufacturing an adapter pad according to aspects of the disclosure.

In some embodiments, as shown in FIG. 18, the adapter pad 200 can be formed by injection molding without bonding the top plate 220 (as shown in FIG. 18), or alternatively the bottom plate 240, to the elastomeric member 360. After vulcanization of the elastomeric member 360, the top plate 220 (as shown in FIG. 18), or alternatively the bottom plate 240, can be attached or bonded to the elastomeric member. Because the outer elastomeric members 364, 366 have a greater thickness than the center elastomeric member 362, the lateral flanges 216, 218 must be compressed to attach or bond the top plate 220 (as shown in FIG. 24), or alternatively the bottom plate 240, to the elastomeric member. In some embodiments, the center elastomeric member 362 will react the compression load keeping the wings in a state of compressive strain.

Figure 19:
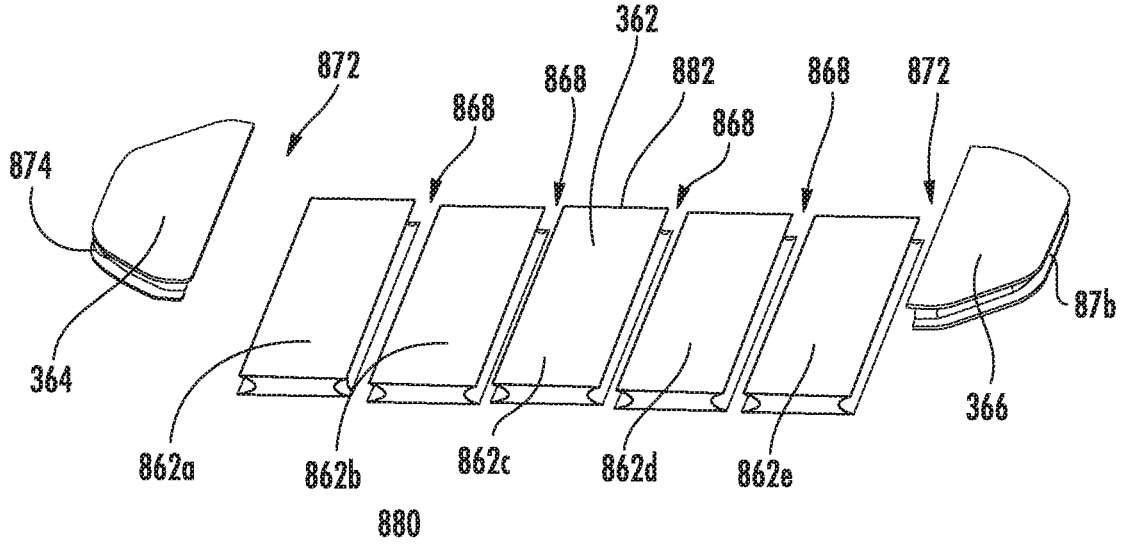
FIG. 19 is a perspective view of an elastomeric member of an adapter pad according to aspects of the disclosure.

In some embodiments, as shown in FIGS. 19-23, compression of the elastomeric member 360 in the region outside the pedestal roof 152, can be accomplished by forming the elastomeric member 360 with gaps in the central portion 362. In some embodiments, for example, the central portion 362 includes one or in other embodiments a plurality of elongate gaps 868 that partially or completely separate the central portion 362 into multiple portions 862*a*, 862*b*, 862*c*, 862*d*, 862*e* as shown in FIG. 19. The one or plurality (for convenience referred to as "a plurality hereafter, although a single gap is contemplated as well) of gaps 868 collectively establish a plurality of discontinuities within the central portion 362. When the adapter pad 200 is assembled between the side frame and the bearing adapter 199, the central portion 210 of the adapter pad 200 can carry significant compressive force, which is felt by the relatively compressible elastomeric portion 360 (when compared to the top and bottom plates 220, 240), which tends to deform and expand the elastomeric member 360 laterally and longitudinally (based upon the material being vertically compressed). The presence of the plurality of gaps 868 can provide a dedicated volume for the lateral expansion (in embodiments where the plurality of gaps 868 each extend longitudinally). Likewise, in embodiments where the plurality of gaps also or instead extend laterally, the presence of the gaps 868 provides a dedicated volume for longitudinal expansion.

As best shown in FIG. 19, in some embodiments, the plurality of gaps 868 each extend longitudinally between the opposite lateral edges of the 880, 882 of the elastomeric portion 860, and extend in parallel with each other. In some embodiments, the plurality of gaps 868 each communicate through both of the first and second longitudinal edges 880, 882 when the adapter pad 800 is in an unloaded configuration. Under load, all, or a portion of the plurality of gaps 868 may be deformed (as discussed above) such that only a portion of the respective gap 868 communicates through the respective longitudinal edge 880, 882, or in some embodiments, substantially the entire gap 868 may be closed intersecting the longitudinal edge 880, 882, such that no visual opening may be perceived into the gap 868 (which is visible from the respective edge 880, 882 in an unloaded configuration.

Figure 22:
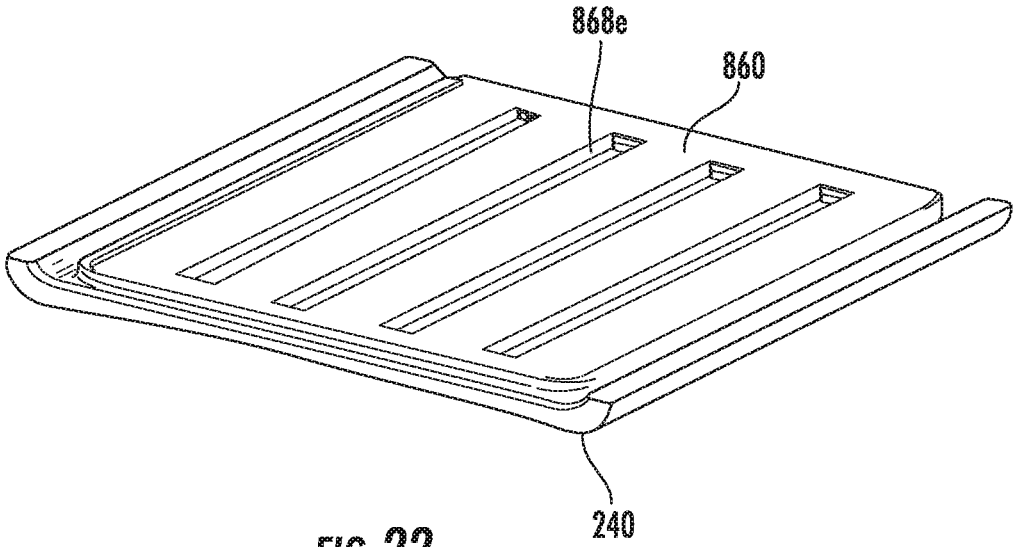
FIG. 22 is a sectional view of a portion of an adapter pad according to aspects of the disclosure, showing a representative alignment of the plurality of gaps within the elastomeric portion.

In some embodiments as shown in FIGS. 19 and 22, each of the plurality of gaps 868 may be formed with a uniform cross-section along its length, and either all of the plurality of gaps 868 may be formed with the same cross-section (in an unloaded state), or each of the plurality of gaps 868 may be defined with a constant cross-section along its length.

Figure 20A:
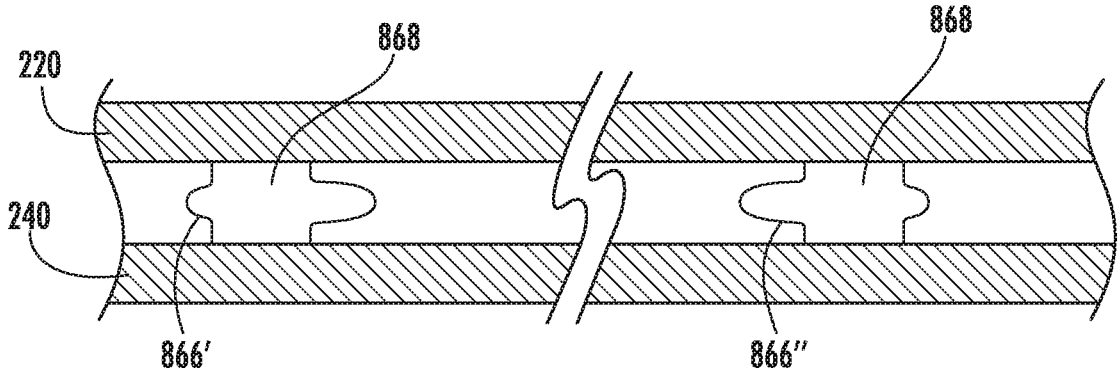
FIG. 20A-C are vertical sectional views of a portion of an adapter pad according to aspects of the disclosure showing various geometries for the plurality of gaps, with the adapter pad in an unloaded configuration.
Figure 20B:
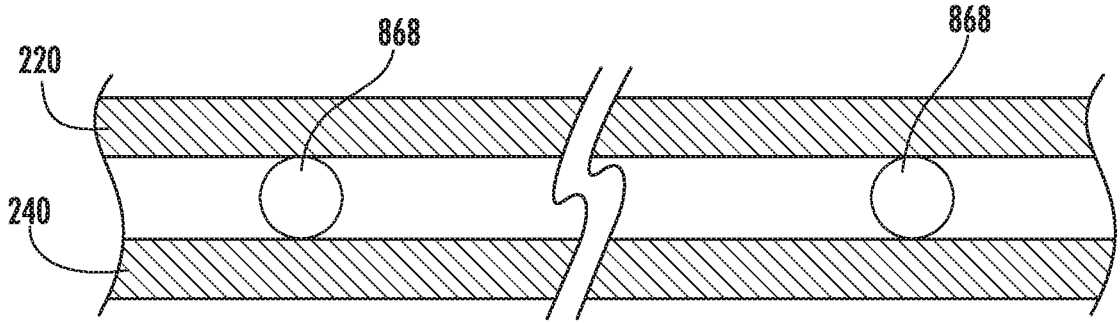
Figure 20C:
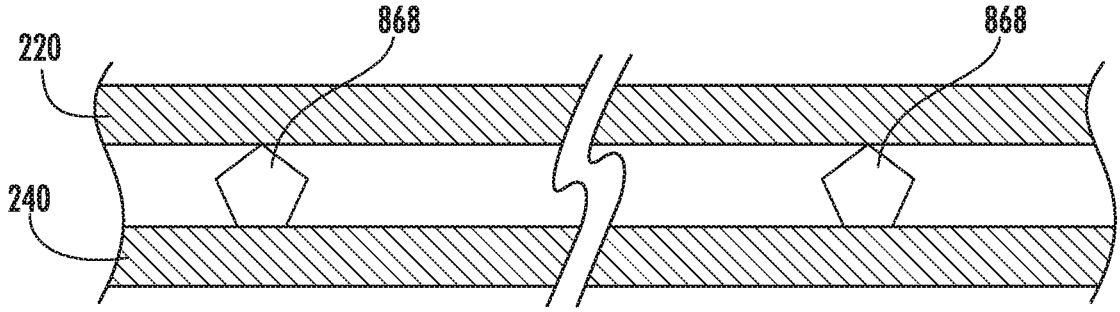

FIGS. 20A-20C depict various types of cross-sections for the plurality of gaps 868. Generally, the plurality of gaps 868 are contemplated to include one or more curved or planar sides, and each of the plurality of gaps 868 may include a combination of curved and planar features. For example, the plurality of gaps 868*a* that have a round cross-section, or include curved sides. In some embodiments, the opposite sides (that extend between the top and bottom plates 220, 240) may be of the same size and geometry, while as depicted in FIG. 20*a*, one side may have a different shape or size than the opposite side (see 866' and 868" in FIG. 20*a*).

Figure 21A:
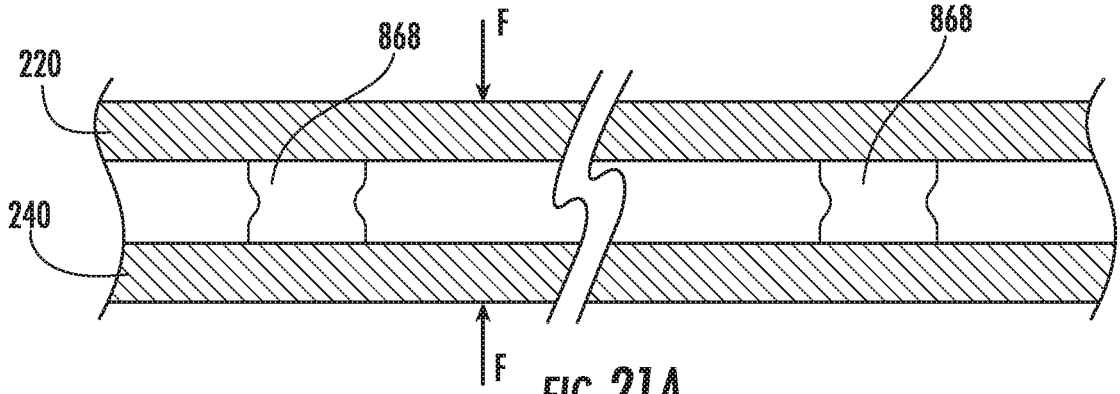
FIG. 21A-C are each views of the respective FIGS. 20*a*-20*c* schematically showing the geometry of the gaps altered when load is applied to the adapter pad.
Figure 21B:
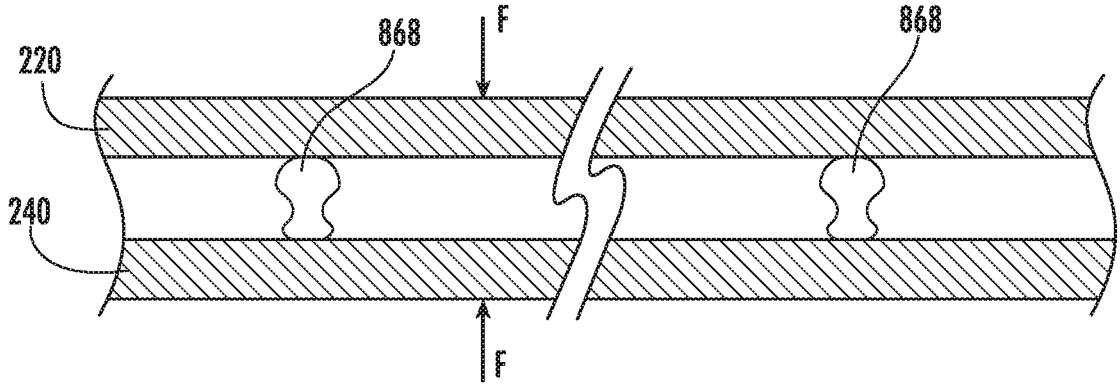
Figure 21C:
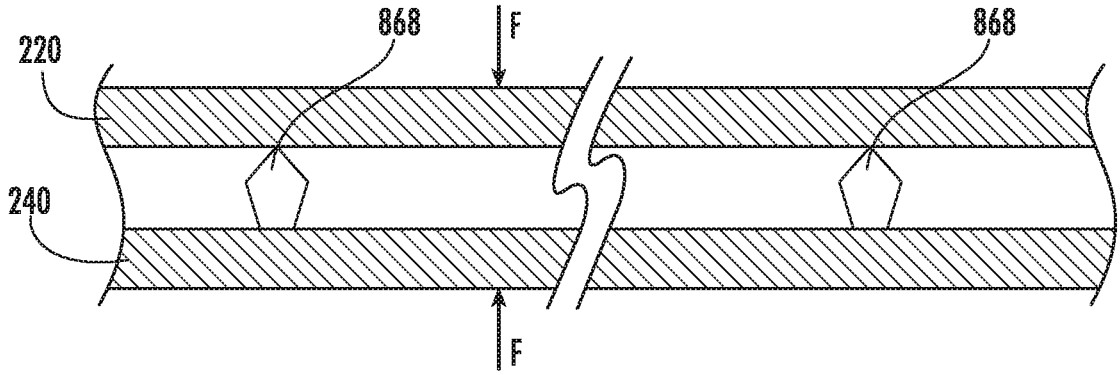

FIG. 20B depicts alternately shaped gaps 868*c* that are generally oval shaped. FIG. 20C depicts alternatively shaped gaps 868*d* that are shaped as a truncated diamond with two opposite planar sides (with the truncated portion contacting the bottom plate 240). FIGS. 21A-21C provide schematic representations of the potential shape of the various plurality of gaps 868 with a load (F) applied to the adapter pad 200.

In some embodiments, and as depicted in FIG. 22, the plurality of gaps 868*e* extend only a partial longitudinal distance through the elastomeric member 860 and as depicted do not reach the longitudinal edges 880, 882, while other placement (such as extending to one of the two longitudinal edges 880, 882, or with ends closer to one of the two longitudinal edges 880, 882 is contemplated). The gaps 868*d* in this embodiment may be sized and shaped based upon the various sizes and shapes contemplated above.

Figure 23:
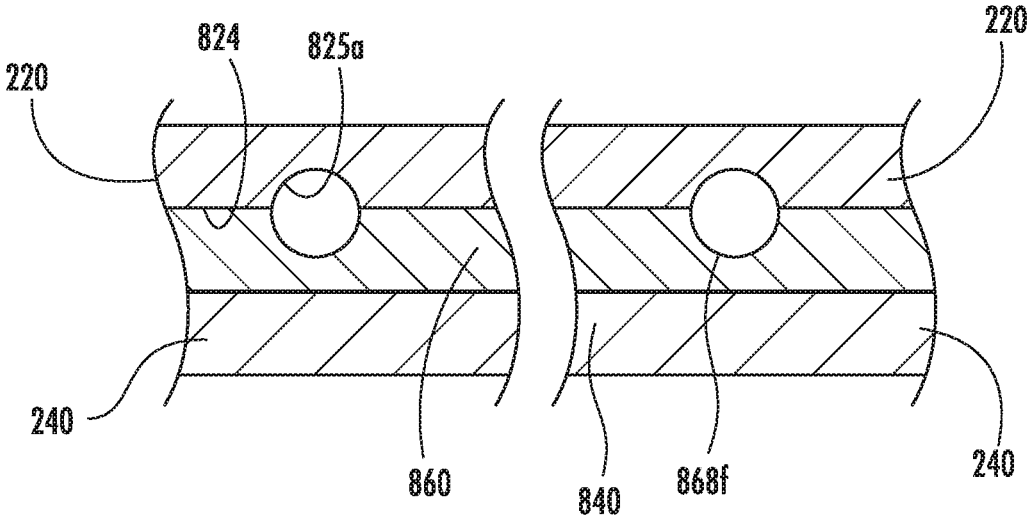
FIG. 23 is a sectional view of a portion of the adapter pad according to aspects of the disclosure showing a plurality of gaps extending only a partial thickness of the elastomeric layer.

In other embodiments depicted in FIG. 23, the plurality of gaps 868*f* may extend for a thickness that is less than a total distance between the top plate 220 and the bottom plate 240, with a portion of the elastomeric member being vertically disposed with respect to one or more of the plurality of gaps 868*f* and contacting one or both of the top and bottom plates 220, 240. As depicted in FIG. 23, the gap 868*f* contacts the lower surface of the top plate 220, but does not contact the bottom plate 240.

As best shown in FIG. 23, the inner surfaces of the top or bottom plate 220, 240 may include a recessed portion 825*a* located along the portions of the top or bottom plate 220, 240 that communicate with the plurality of gaps 868. The recessed portions 825*a* may be provided to index the tooling (such as a core or other types of molding equipment known in the art) for the elastomeric portion to establish the gaps 868 with respect to the top or bottom plate 220, 240. The recessed portion 825*a* may additionally provide space for expansion/deformation of the elastomeric member 860 under load, to minimize the size of the gaps 868 yet still provide the benefits of the expansion/deformation space as needed.

Additionally, other methods that can increase the compression of the elastomeric member 360 in the lateral flanges 216, 218 exist. For example, as shown in FIG. 24, in some embodiments, the lateral flanges 216, 218 can be compressed together after inserting the elastomeric members 364, 366 between the top and bottom plates 220, 240. Compressing the top and bottom plates 220, 240 together can induce plastic deformation of the steel. The plastic deformation of the top and bottom plates 220, 240 can induce a normal stress in the outer elastomer layers 364, 366 and can increase the compression. Compression of the top and bottom plates 220, 240 can be accomplished using a die or other suitable equipment. As used herein the term inserting can encompass a number of processes including inserting elastomer using an injection molding process or a casting process, and other known techniques.

In still other embodiments, for example, compression in the lateral flanges 216, 218 can be induced by manufacturing the lateral flanges 216, 218 of the top and bottom plates 220, 240 to angle towards each other and then mold the flanges to a generally parallel position. For example, the top plate 220 can be manufactured such that the lateral flanges 232, 234 are angled outward and downward and the bottom plate 240 lateral flanges 252, 254 are angled outward and upward prior to assembling the adapter pad 200. Thus, when originally manufactured, the lateral flanges of the top and bottom plates are not parallel and instead are angled towards each other. The plates 220, 240 are then assembled with the elastomeric section 360 and the lateral flanges 232, 234, 252, 254 are forced to elastically bend to a generally parallel alignment with each other. In some embodiments, this step can be accomplished, using an injection molding machine wherein the elastic member 360 is injected into the mold. Once the adapter pad is cured, there can be an elastic strain in the laterally projecting flanges that applies a normal load to the outer elastomer layers 364, 366 that can create compressive strain.

Figure 25:
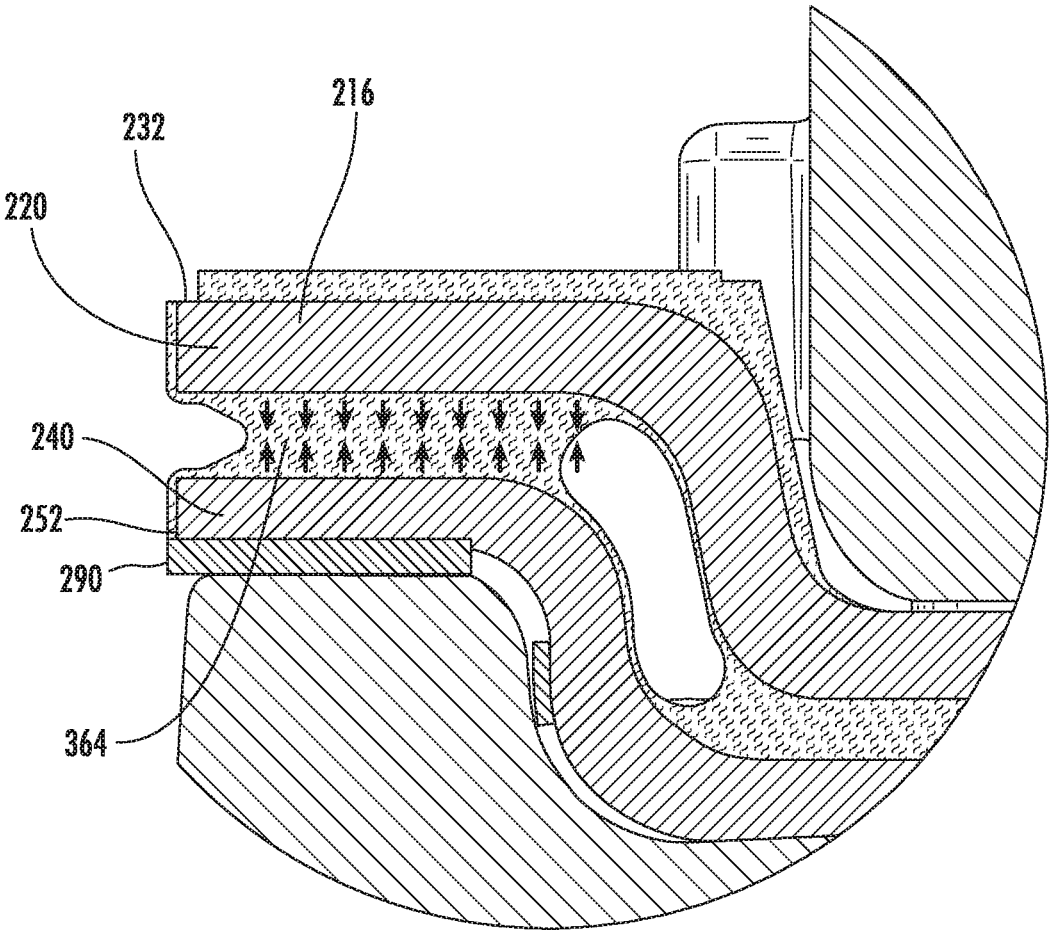
FIG. 25 is a depiction of a method of manufacturing an adapter pad according to aspects of the disclosure.
Figure 26:
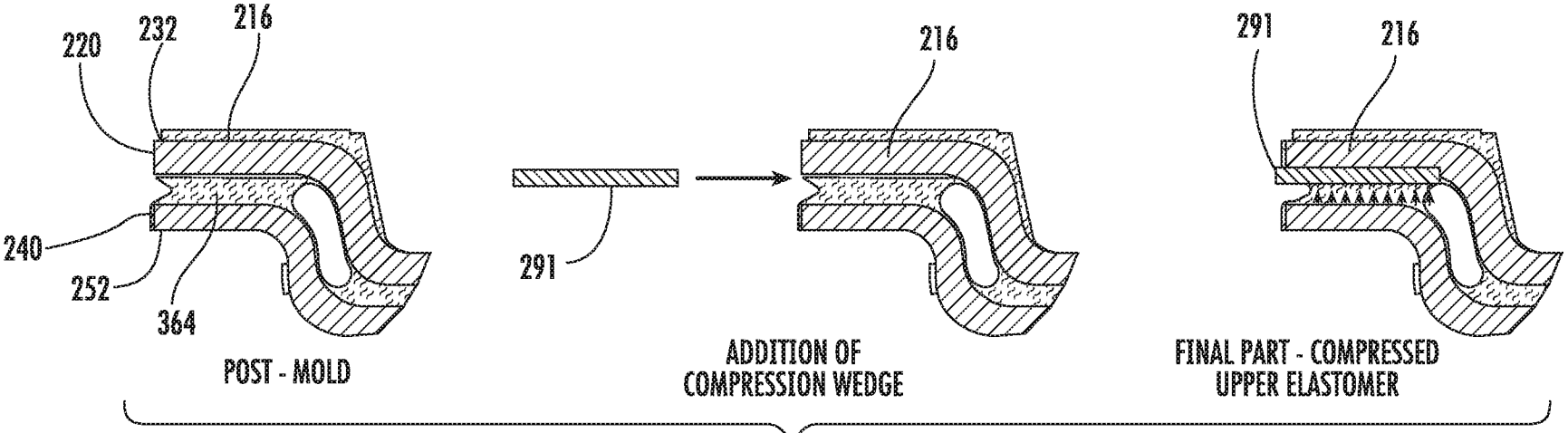
FIG. 26 is a depiction of a method of manufacturing an adapter pad according to aspects of the disclosure.

In still other embodiments, as shown in FIGS. 25 and 26, compression of the elastomeric member 360 in the lateral flanges 216, 218 can be increased by using compression shims within or under the lateral projecting flanges 216, 218. Compression shims can be used herein such that reaction of the vertical load at the vertical shoulders 106 provides a vertical force greater than 3000 pounds such that about 10 percent to 30 percent of vertical force is distributed to each of the adapter pad lateral flanges 216, 218 when a vertical force is applied to the central portion 210 of the adapter pad 200. Compression shims can in some embodiments force more of the vertical load of the car to be distributed from the center elastomer layer 360 to the outer elastomer layers 364, 366. As shown in FIG. 25, a first adapter compression shim 290 can be disposed between an upper surface of the vertical shoulder of the roller bearing adapter 199 and the outer surface 244 of the first lateral flange 216 of the bottom plate 240. Similarly, though not shown in a Figure, a second adapter compression shim 290 can be similarly placed in relation to the second lateral flange 218 (not shown). The adapter compression shims 290 can be about 0.05 inches thick or within the range of about 0.06 inches to about 0.18 inches. Compression shims as discussed herein can have any number of different shapes and configurations to provide the necessary loads to compress the outer elastomer. For example compression shims can be rectangular, square, trapezoidal, pyramidal, can have a hollow cross-section, and can be a plurality of compression shims. Further, compression shims as discussed herein can be integrally formed with the adapter pad during the molding process, can be integrally formed with the roller bearing adapter, or can be added to the roller bearing adapter system after the molding process.

Figure 25A:
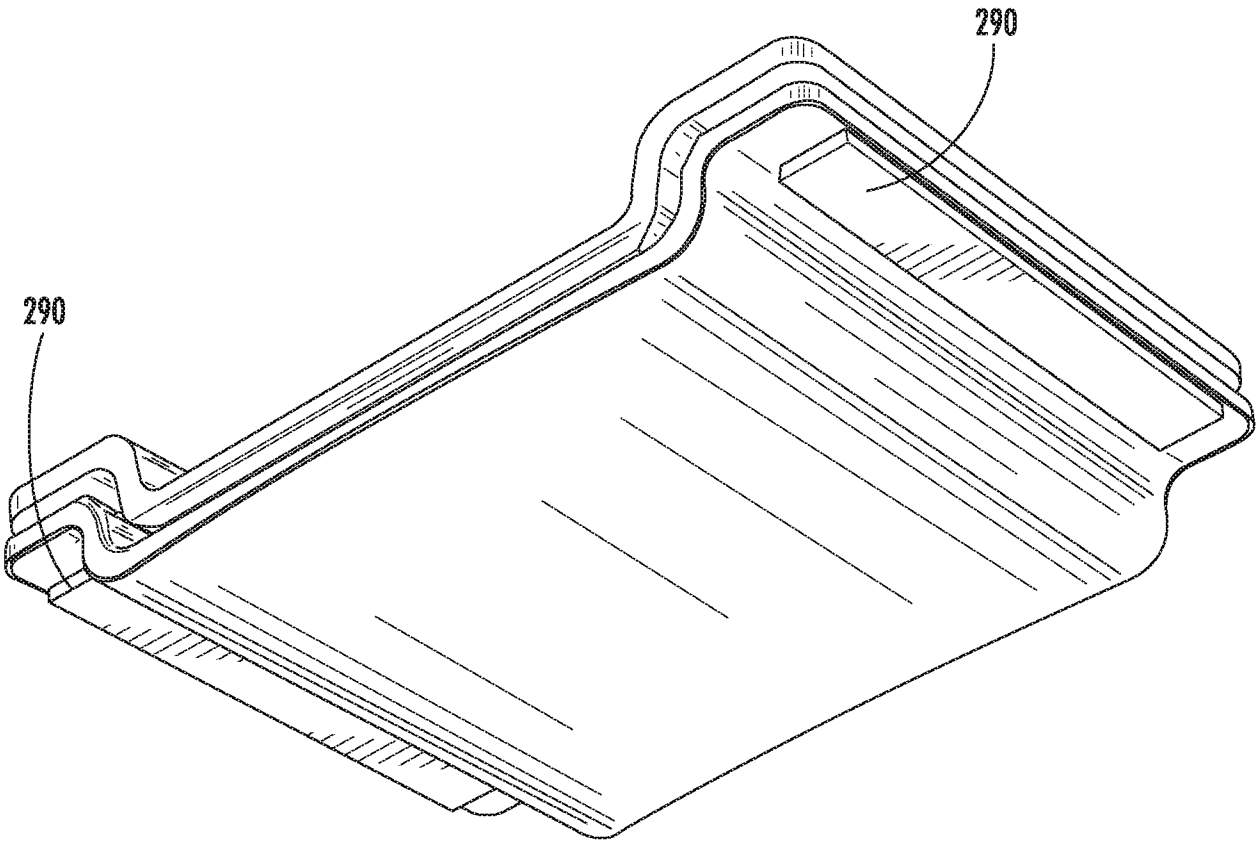
FIGS. 25A-25I are perspective views of adapter pads according to aspects of the disclosure.
Figure 25B:
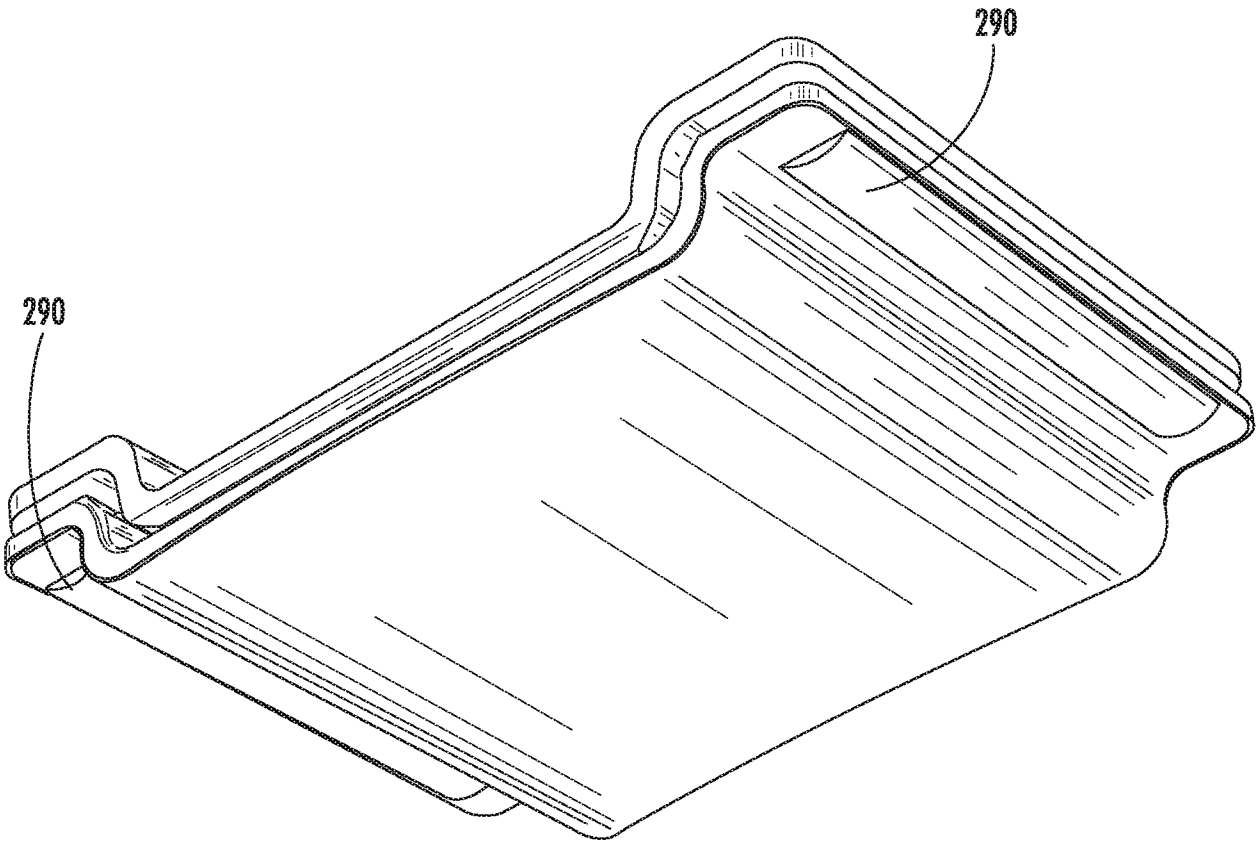
Figure 25C:
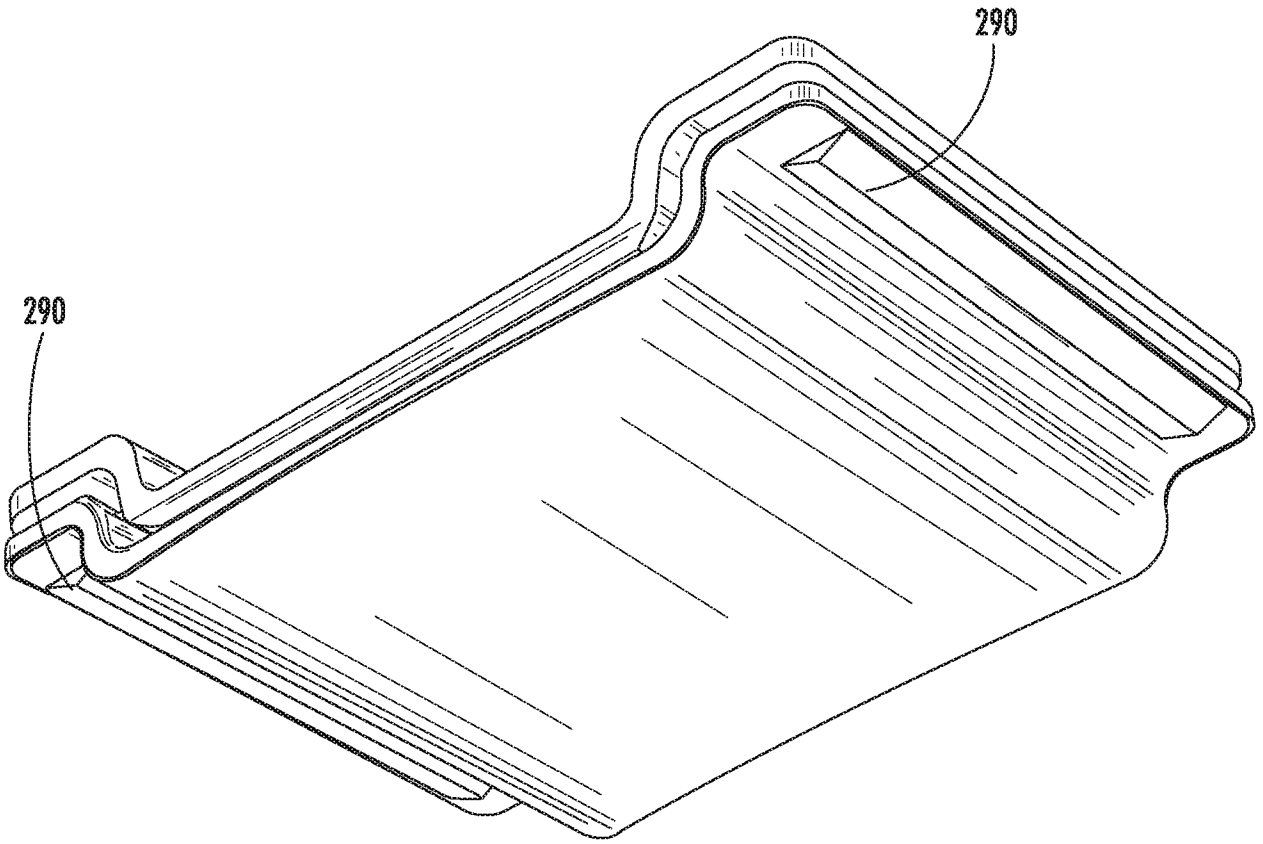
Figure 25D:
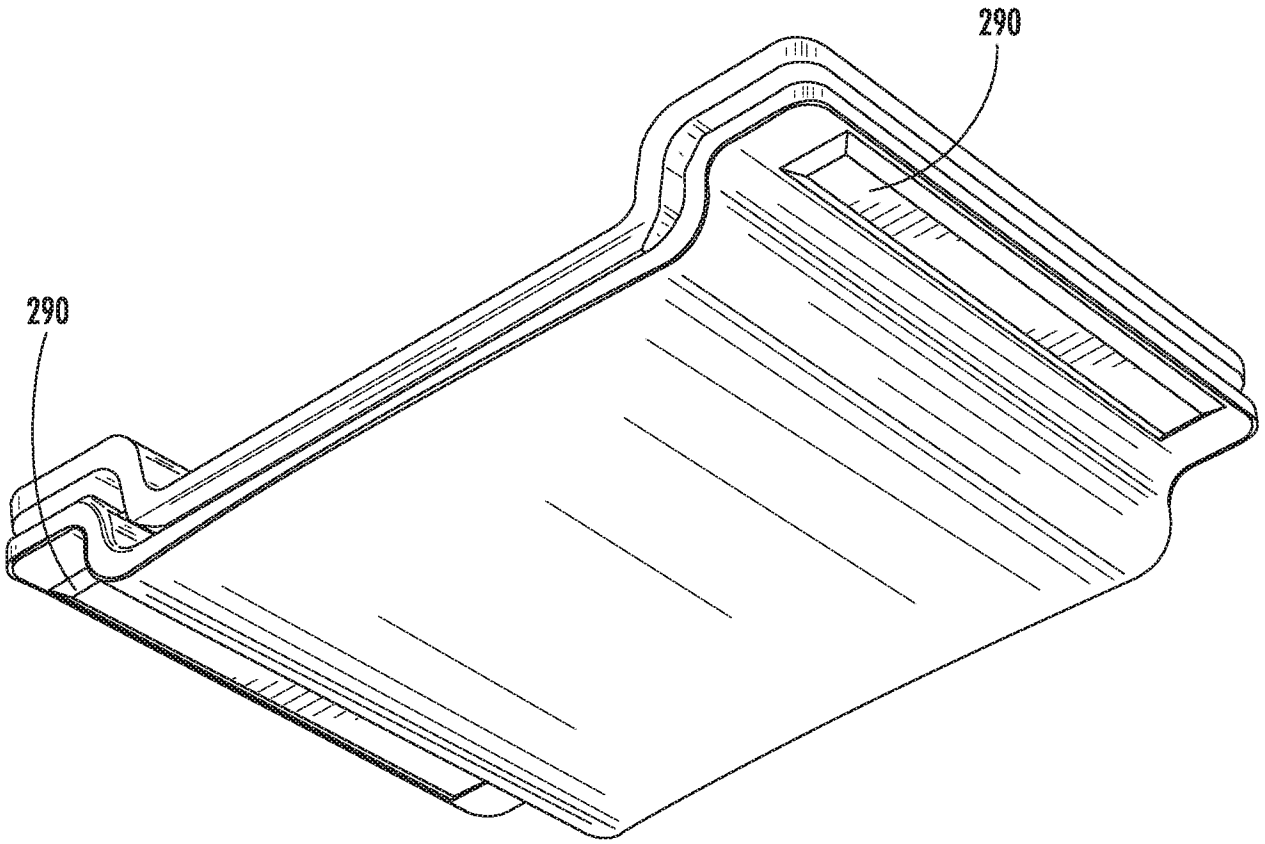
Figure 25E:
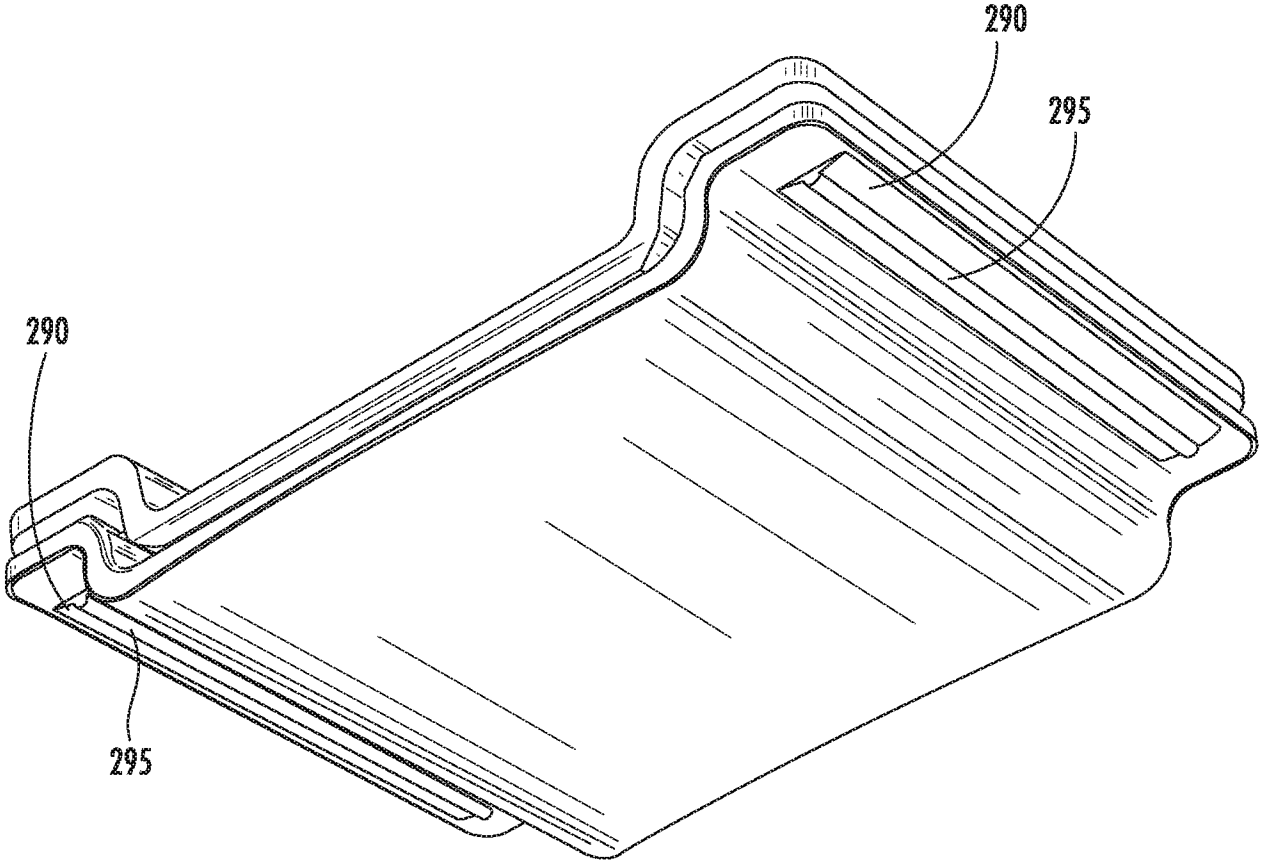
Figure 25F:
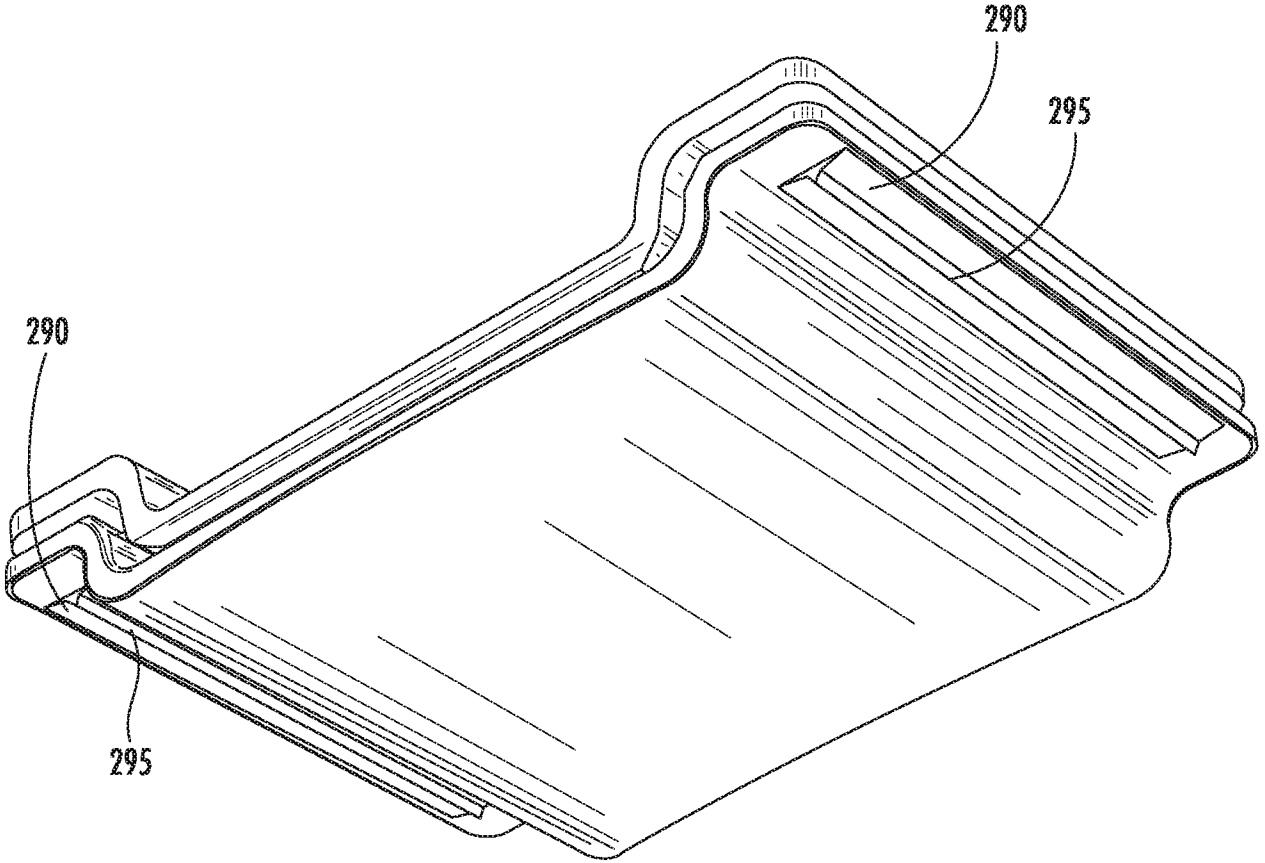
Figure 25G:
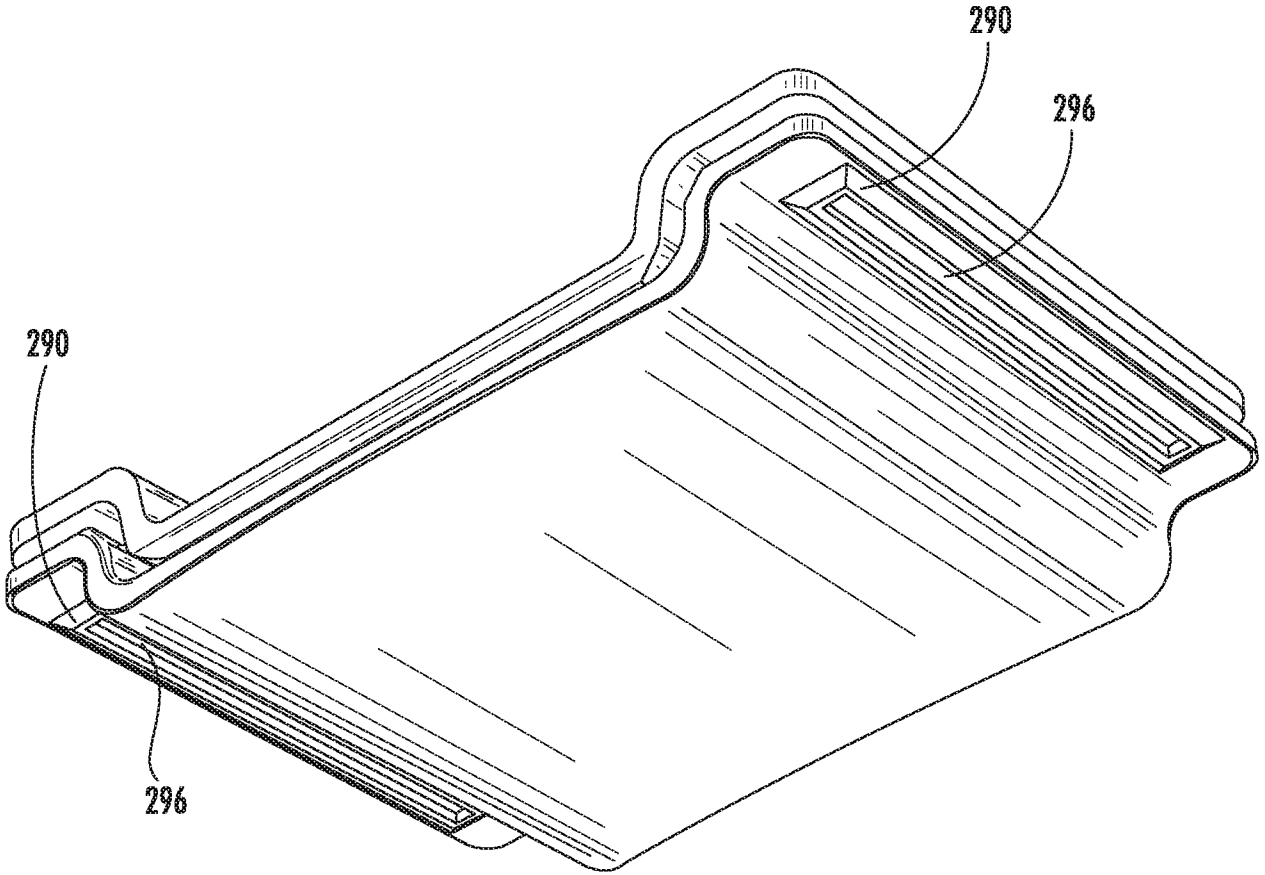
Figure 25H:
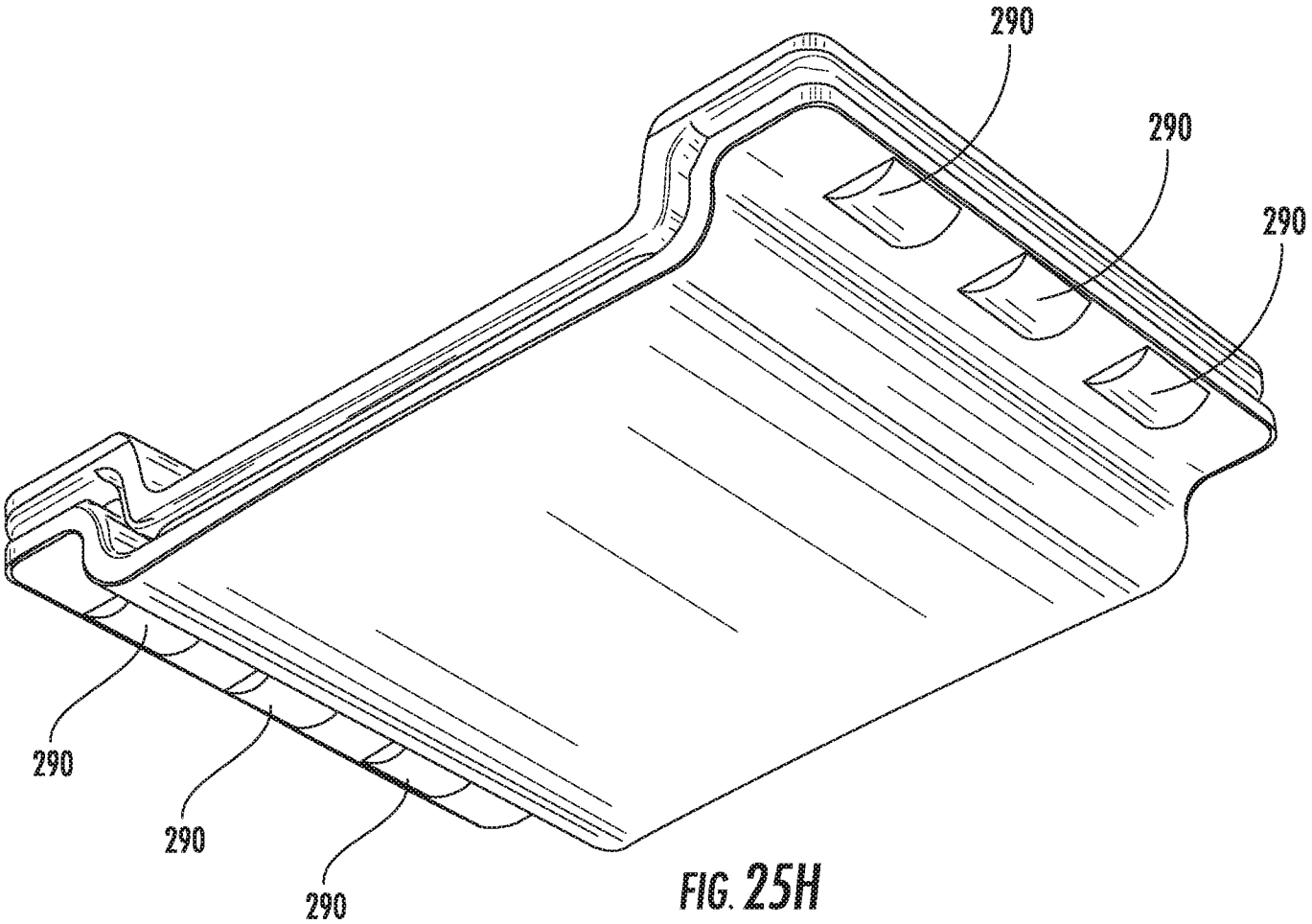
Figure 25I:
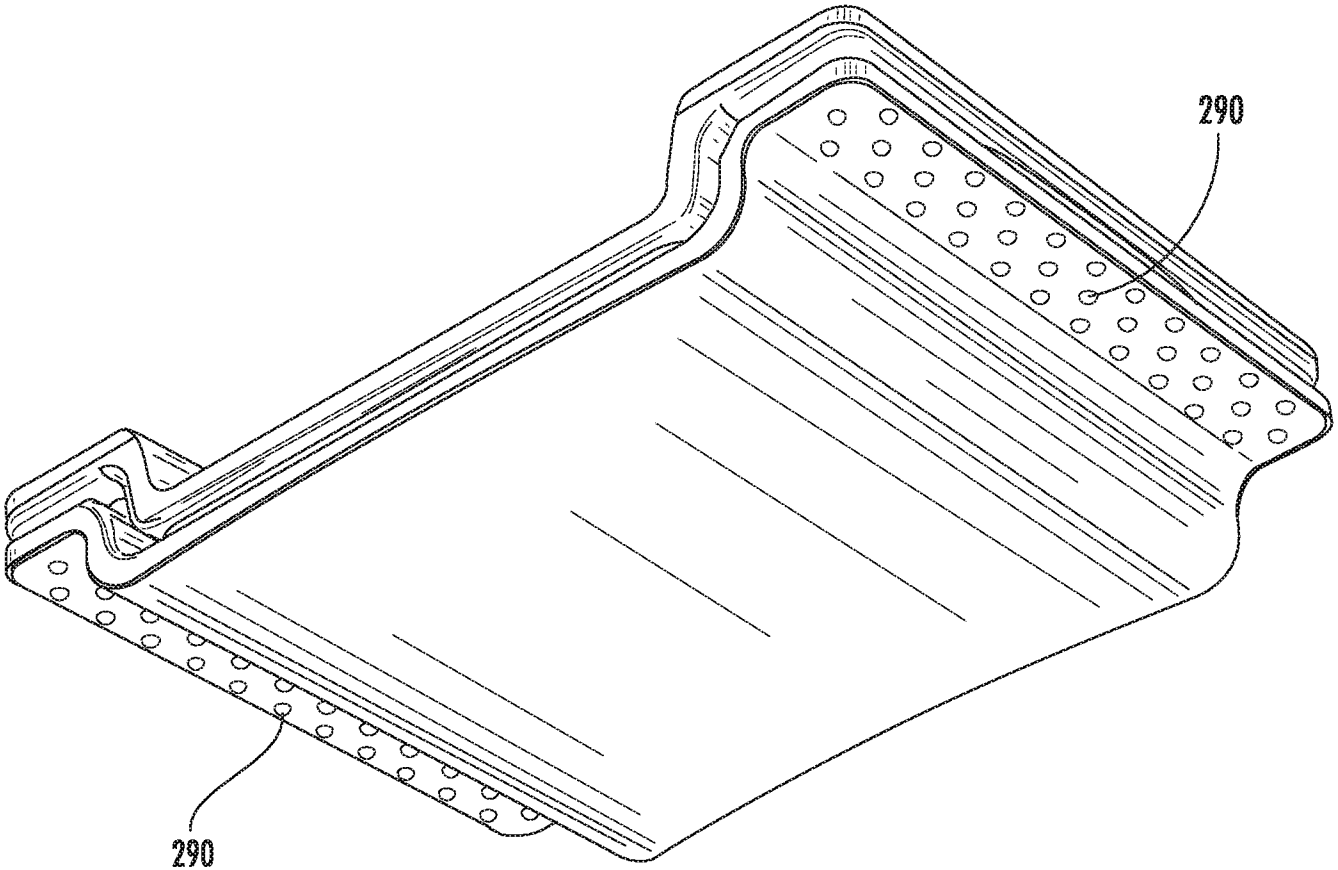

As shown, for example, in FIGS. 25A-I, compression shims as discussed herein can have a number of different shapes and configurations. As shown in FIG. 25A, the compression shims 290 can be substantially rectangular and can have a width equal to or less than the width of the outer surface 244 of the lateral flange 252, 254 of the bottom plate 240. Similarly, the compression shims 290 as shown in FIG. 25A can have a length that is less than or equal to the length of the outer surface 244 of the lateral flange 252, 254 of the bottom plate 240. The compression shims 290 can have a constant or variable thickness. As shown in FIGS. 25B, 25C, and 25D the compression shims 290 can have a curved, trapezoidal, or triangular cross-section shape. Additionally, as shown in FIGS. 25E and 25D the compression shims 290 can have a raised center portion 295 that can be generally curved as shown in FIG. 25E or generally triangular as shown in FIG. 25F, or any other suitable shape. As shown in FIG. 25G, the compression shims 290 can include a hollow portion 296. Additionally, as shown in FIGS. 25H, and 25I the compression shims 290 can comprise a plurality of compression shims.

As shown in FIG. 26, the adapter pad 200 can also include compression shims between the elastomeric member 360 and either the top or bottom plate 220, 240. As shown in FIG. 26, the adapter pad 200 can include a first upper adapter pad compression shim 291 disposed in the first lateral flange 216 between the top plate 220 and the first outer elastomeric member 364. Similarly, although not shown in a Figure, a second upper adapter pad compression shim 291 can be disposed in the second lateral flange 218 between the top plate 220 and the second outer elastomeric member 366. Additionally, although not shown in a Figure, similar first and second lower adapter pad compression shims can be disposed in the first and second lateral flanges 216, 218 between the elastomeric member 360 and the bottom plate 240. The upper and lower adapter pad compression shims 291 can be about 0.05 inches thick or within the range of about 0.06 inches to about 0.18 inches.

To apply the upper or lower adapter pad compression shims 291, shown in FIG. 26, the adapter pad 200 can be formed through injection molding without adhesive applied to one of the top or bottom plates 220, 240 in the laterally projecting flanges 216, 218. This can prevent the outer elastomer layer 364, 366 from adhering to the top or bottom plate 220. 240. After vulcanization, the upper or lower adapter pad compression shims 291 can be inserted between the outer elastomer 364, 366 and the top or bottom plate 220, 240. As discussed above, this can compress the elastomeric member 360 in the laterally projecting flanges 216, 218, increasing the normal stress.

As discussed above, it has been determined through testing that the performance of the adapter pad system 198 is a function of the stiffness of the adapter pad 200. More specifically in certain embodiments, it has been determined that adapter pad performance, including design life, can be improved by increasing the stiffness of the adapter pad system 198 (measured in pounds of force per inch of deformation).

Figure 27:
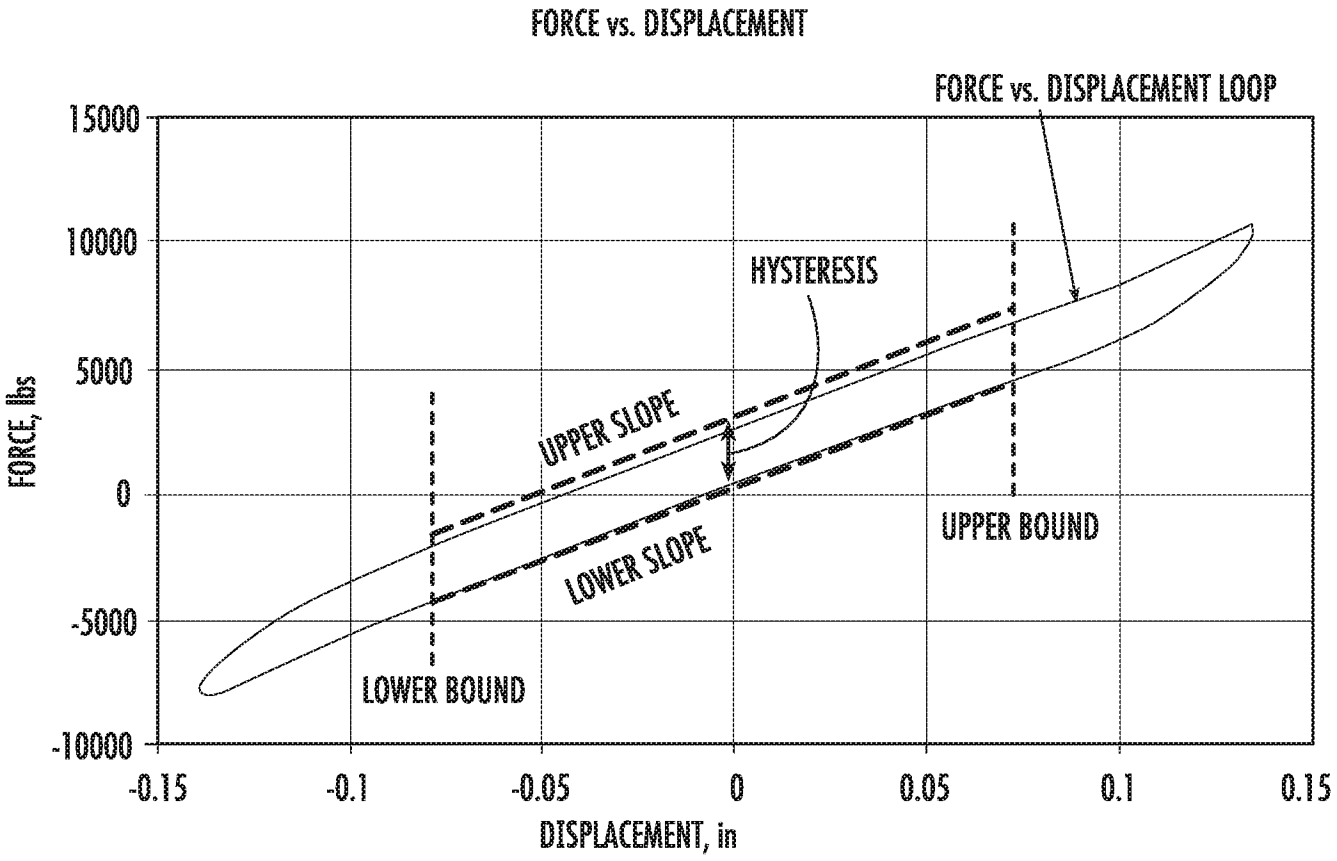
FIG. 27 is an exemplary graph depicting testing of an adapter pad according to aspects of the disclosure.

Physical measurement of the pad stiffness can be determined by cycling the adapter pad 200 in three principal directions: laterally, longitudinally, and rotationally; while withstanding a constant vertical load on the pad, typically of 35,000 pounds. The force to displace the pad relative to the distance the pad displaces is recorded throughout the measurement test. The data from the test can then be collected and plotted on force vs. displacement plots, an example of which is shown in FIG. 27. The stiffness, damping, and hysteresis for each direction of motion may then be determined using the following methods: Stiffness of the pad 200 can be determined by determining the upper and lower bounds which capture the linear portion of the force vs. displacement curve, then calculating the slope of the best fit line between the upper and lower bounds, for the upper and lower portion of the curve. The stiffness is then determined by averaging the upper and lower slopes. As discussed above, longitudinal stiffness is measured in the rail or track direction, lateral stiffness is measured perpendicular to the track direction, and rotational stiffness is measured as resisting rotation of the adapter about a vertical axis at the longitudinal and lateral centerline of the pedestal opening (annotated as "C" on FIG. 16A). The hysteresis is determined, an example of which is shown in FIG. 27, by measuring the upper and lower y-intercepts and subtracting the lower y-intercept from the upper y-intercept. The damping is determined, as shown in FIG. 27 by measuring the area within the force displacement loop. The amount of pad damping over the given displacement range is directly proportional to the area contained within the loop at the desired frequency.

The target damping value for embodiments disclosed herein is 0.10 to 0.30 tan $\delta$ with a rubber/elastomeric material durometer target of 60 A to 80 A. Tan $\delta$ is a measure of the material damping when subjected to cyclic loads, defined as the ratio of the out-of-phase load (90 degrees on a sinusoidal load) to the in-phase load (0 degrees). Typical values for elastomers can be 0.04 to 0.35.

A more direct measure of the energy absorption for an adapter pad is the area of the hysteresis loop per cycle. For the embodiments described herein, the hysteretic energy absorption can be estimated by $\pi 3G \tan \delta \varepsilon^2$ where G is the shear modulus of ~360 psi, Tan $\delta$~0.3 and $\varepsilon$ the strain during hunting at ~100%=1. At 4 Hz, the energy absorption would be about 4,070 in-lb./sec. A reasonable range may be +/−25%.

As discussed herein, certain embodiments include elastomeric member 360 (portions 364, and 366) in shear, outside of the area beneath the pedestal roof 152. In such embodiments, there can be more elastomeric material than can be used in shear than in a typical adapter pad. This can allow the adapter pad 200 to achieve increased stiffness without decreasing the shear thickness, or increasing elastomer durometer. Decreasing the shear thickness and/or increasing the elastomer durometer which can increase the strain and reduce the useful life of the pad. Thus, the adapter pad 200 can increase the stiffness of the adapter pad system 198 which can improve railcar overall performance while increasing the useful life of the adapter pad 200. The outer elastomer layers 364, 366 can increase the rotational stiffness of the adapter pad 200 by providing additional elastomer at a distance farther from the axis of rotation. In some embodiments, for example, the outer elastomeric layers 364, 366 can account for about 15% or about 10% to about 20%, or greater than 10% of the total lateral and longitudinal stiffness of the adapter pad 200, and can account for about 33% or about 25% to about 40%, or greater than 25% of the rotational stiffness of the adapter pad 200.

Embodiments disclosed herein can have high lateral and longitudinal stiffness, without having high force vs. displacement hysteresis. Hysteresis is proportional to energy dissipated through the displacement cycles, and can be lost in the form of heat or noise. Generally, the higher the hysteresis, the greater the temperature rise in the adapter pad 200, and the lower the fatigue life. Embodiments disclosed herein attain high stiffness of the adapter pad, while improving fatigue life by minimizing hysteresis and allowing the pad to displace to maximum magnitudes set by the AAR: 41 milliradians rotationally, 0.23 inches laterally, and 0.14 inches longitudinally.

Embodiments disclosed herein may require increasing amounts of force to displace the top plate 220 relative to the bottom plate 240 with higher magnitudes. The thickness, length, and amount of elastomeric material in the hollow section 372 can be adjusted to change the slope, and shape of the force vs. displacement graphs. In some embodiments, it is possible to have different stiffness properties for the elastomeric material of the pad located adjacent to the upturned adapter wings compared to the properties of the elastomeric material located in the central area of the adapter pad.

Using the above described test methods, exemplary measurements and testing results of embodiments disclosed herein are shown below in Table 2. It is understood that these embodiments are examples, and that other structural embodiments with other testing results can exist.

TABLE 2

| | Embodiments Described Herein |
|---|---|
| Elastomer Normal Area ($in^2$) | 55.5 $in^2$ or about 50 $in^2$ to about 70 $in^2$ |
| Elastomer Normal Area Outside of Pedestal Roof Contact ($in^2$) | 15.5 $in^2$ or about 5 $in^2$ to about 30 $in^2$ |
| Pad Elastomer Shear Width (Lateral Length) (in) | 9.6 $in^2$ or about 6 $in^2$ to about 14 $in^2$ |
| Pad Elastomer Shear Length (Longitudinal Length) (in) | 6.9 $in^2$ or about 6 $in^2$ to about 10 $in^2$ |
| Lateral Stiffness (tested at 3 hz cycling frequency and 35 kip vertical load) | 60 kips/in or about 45 kips/into about 80 kips/in or at least 45 kips/in |
| Longitudinal Stiffness (tested at 3 hz cycling frequency and 35 kip vertical load) | 64 kips/in or about 45 kips/into about 80 kips/in or at least 45 kips/in |
| Rotational Stiffness (tested at 3 hz cycling frequency and 35 kip vertical load) | 670 kip*in/mRad or about 250 kip*in/mRad to about 840 kip*in/mRad or at least 250 kip*in/mRad |
| Vertical Stiffness | at least 5,000 kips/in |
| Lateral Hysteresis (tested at 3 hz cycling frequency and 35 kip vertical load) | 5000 lbs. or about 3750 lbs. to about 6250 lbs. or less than 6000 lbs. |
| Longitudinal Hysteresis (tested at 3 hz cycling frequency and 35 kip vertical load) | 500 lbs. or about 375 lbs. to about 1500 lbs. or less than 1500 lbs. |
| Rotational Hysteresis (tested at 3 hz cycling frequency and 35 kip vertical load) | 12000 lbs.*in or about 9000 lbs.*in to about 16000 lbs.*in or less than 16000 lbs.*in |
| Center Elastomer Layer Shear Perimeter | 25.5 in. or about 20 in. to about 30 in. |
| Outer Elastomer Layer Shear Perimeter | 13.1 in. each or about 8 to 18 in. each |
| Composite Elastomer Layer Shear Perimeter | 51.7 in. or about 35 in. to 75 in. |
| Center Elastomer Layer Shape Factor | 8.3 or about 6 to 10 |
| Outer Elastomer Layer Shape Factor | 1.6 each or about .5 to 3 each |
| Composite Shape Factor | 4.5 or about 2.5 to about 7 |

An additional embodiment of an adapter pad 400 is shown in FIGS. 28-43. The embodiment of the adapter pad 400 shown in FIGS. 28-43 is similar in many ways to adapter pad embodiments previously discussed. As described above, the adapter pad 400 is configured to be disposed between and can engage with the roller bearing adapter 199 (as shown in FIGS. 36A-36E) and the side frame pedestal roof 152 of the side frame 4. As shown in FIGS. 28-43, the adapter pad 400 generally includes an upper member or top plate 420 having an inner surface 422 and an outer surface 424, a lower member or bottom plate 440 having an inner surface 442 and an outer surface 444, and an elastomeric member 560 disposed between the inner surfaces 422, 442 of the top and bottom plates 420, 440 along a portion of the adapter pad 400. The adapter pad 400 includes a central portion 410 that is disposed under the lower surface of the pedestal roof 152 with each plate 420, 440 having a corresponding central portion 426, 446. The adapter pad 400 further includes first and second upturned regions 412, 414 and first and second lateral flanges 416, 418. The top plate 420 has corresponding first and second upturned regions 428, 430 projecting upward from opposite edges of the central portion 426 of the upper plate 420, a first lateral flange 432 projecting outward from the first upturned region, and a second lateral flange 434 projecting outward from the second upturned region 430. Similarly, the bottom plate 440 has corresponding first and second upturned regions 448, 450 projecting upward from opposite edges of the central portion 446 of the bottom plate 440, a first lateral flange 452 projecting outward from the first upturned region, and a second lateral flange 454 projecting outward from the second upturned region 450. The lateral flanges 416, 418 are disposed laterally outboard of the pedestal roof 152 when the truck system is assembled, and the central portion 410 is disposed below the pedestal roof 152. First and second upturned regions 412, 414 are disposed between the central portion 410 and the respective first and second lateral flanges 416, 418 and provide a transition therebetween.

Figure 30:
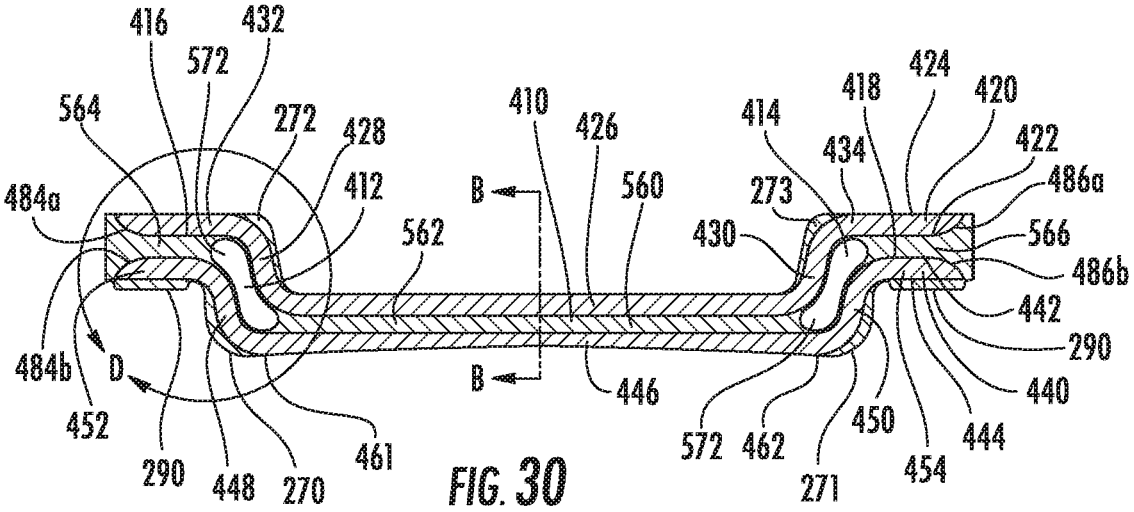
FIG. 30 is a cross-sectional view taken along line A-A of FIG. 29.

As described above, with regard to other embodiments, the central portion 410 can comprise primarily three parts including the central portion 426 of the top plate, the central portion 446 of the bottom plate and the elastomeric member 560 disposed therebetween. As discussed above, the adapter pad 400 is disposed between the side frame pedestal roof 152, which generally has a substantially flat horizontal engaging surface, and the roller bearing adapter 199 which can generally have a curved or crowned roof. As shown in FIG. 30, the central portion 446 of the bottom plate 440 can have a curved lower surface such that the outer surface 444 generally follows the curve or crown of the adapter 199. More specifically, in some embodiments the central portion 446 can have a greater thickness toward the edges 461, 462 of the central section 446 than at the center of the central section 446. As described above, the thickness at the center of the center portion 246 can be about 0.15 inches or in the range of about 0.06 inches to about 0.35 inches and the thickness at the edges 461, 462 can be about 0.26 inches or in the range of about 0.15 inches to about 0.5 inches.

In some embodiments, the central section 426 of the top plate 420 can include an outer surface 424 and an inner surface 422 that are substantially horizontal and parallel as shown in FIG. 30. The thickness of the center portion 426 of the top plate 420 can be about 0.25 inches or in the range of about 0.15 inches to about 0.5 inches. In such a system, the thickness of the elastomeric section 560 can be substantially similar throughout the central portion 410 which can in some embodiments increase performance characteristics.

Figure 31:
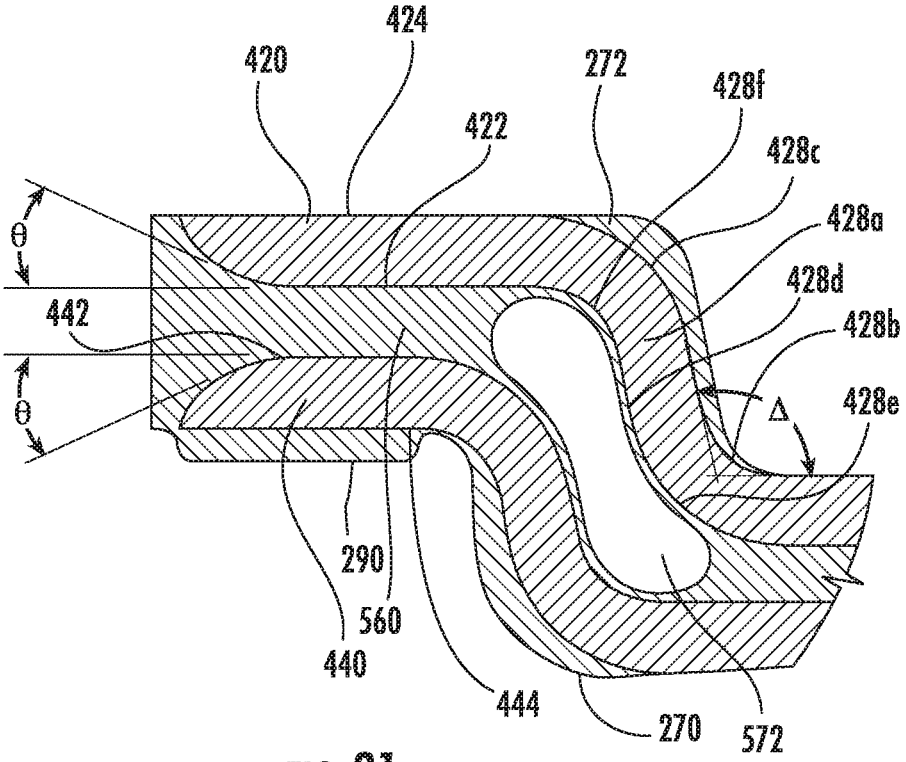
FIG. 31 is a detail view of a portion of FIG. 30.
Figure 31A:
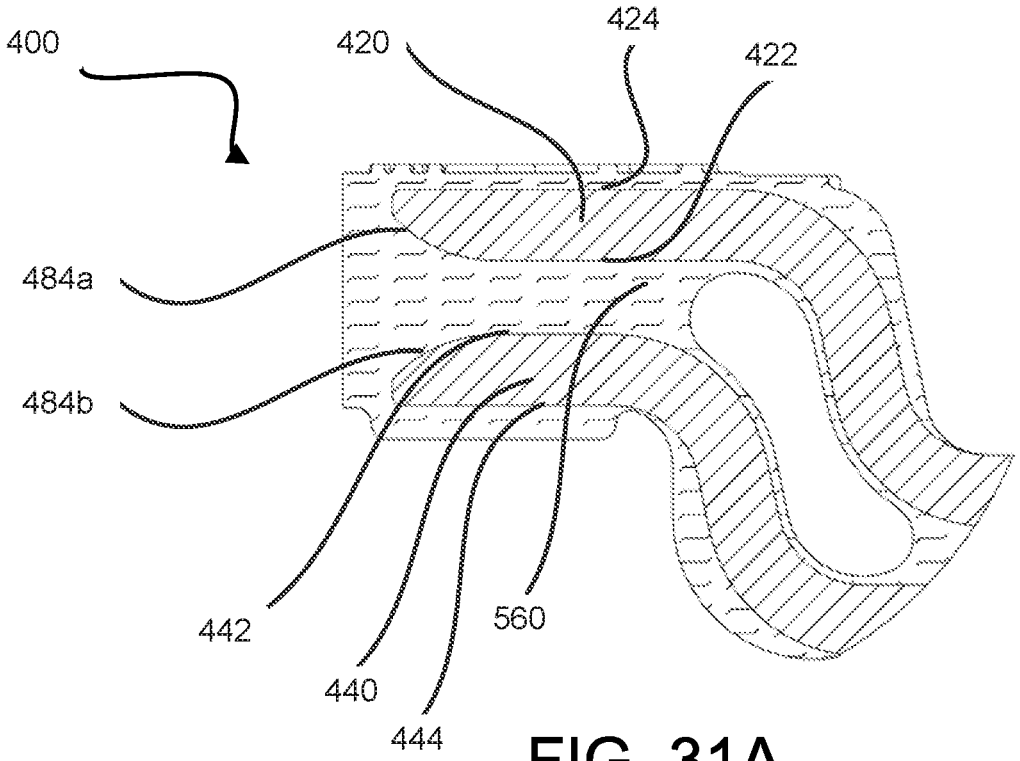
FIG. 31A is a detail view of another embodiment of a portion of an adapter pad similar to FIG. 31.

With further reference to FIG. 31, the first and second upturned portions 428, 430 of the top plate 420 can include outer planar portion 428*a*, 430*a* (only the first upturned region shown in FIG. 31) and an inner planar portion 428*d*, 430*d*. In some embodiments, the planar portions 428*a*, 430*a* and 428*d*, 430*d* can extend at an angle Δ with respect to a plane P that extends along the outer surface 424 of the center portion 426. In some embodiments, the angle Δ may be an obtuse angle and in some embodiments the angle can be within the range of about 95 degrees to about 115 degrees, such as 105 degrees, or any other angle within this range. In embodiments, as described in more detail below, where the first and/or second upturned portions 412, 414 include a grip, the planar surface may surround one or both sides of the grip, or may be alternatively arranged with respect to the grip. The first and second upturned portions 428, 430 of the top plate 420 can also include lower curved portions 428*b*, 430*b* and 428*e*, 430*e* that transition between the central portion 426 and the planar portions 428*a*, 430*a* and 428*d*, 430*d*. Similarly, the first and second upturned portions 428, 430 of the top plate 420 can also include upper curved portions 428*c*, 430*c* and 428*f*, 430*f* that transition between the lateral flanges 432, 434 and the planar portions 428*a*, 430*a* and 428*d*, 430*d*. The upper or lower curved portions 428*b*, 430*b*, 428*e*, 430*e*, 428*c*, 430*c*, 428*f*, and 430*f* may be formed with a constant curvature and/or a varying curvature. The bottom plate 440 can include similar planar portions and upper and lower curved regions. The upturned regions 412, 414 may in some embodiments not include a planar portion and may be formed with a constant curvature and/or a varying curvature.

With further reference to FIGS. 30 and 31, the first and second lateral flanges 416, 418 can extend laterally outside of the side frame 4 and are disposed at a vertical height or in a plane that is different or above the central portion 410, which is disposed under and in contact with the pedestal roof 152. Accordingly, the first and second lateral flanges 416, 418 are disposed in a vertically raised position with respect to the central portion 410. The lateral projecting flanges 416, 418 can provide more area for elastomer 560, and as discussed above, can increase stiffness of the adapter pad 400. In some embodiments, the outer surface 444 of the first and second lateral flanges 452, 454 of the bottom plate 440 may be about 0.92 inches above the outer surface 444 of the lowest edge of the bottom plate 440 or in the range of about 0.25 inches to about 2 inches. The first and second lateral flanges 416, 418 can include a planar and horizontal outer surfaces 424, 444, which can be parallel to the outer surface 444 of the central portion 426. In some embodiments, the outer surface 444 of the first and second lateral flanges 452, 454 of the bottom plate 440 can rest on the vertical shoulders 106 of the roller bearing adapter 199. In other embodiments, the outer surface 444 of the first and second lateral flanges 452, 454 of the bottom plate 440 does not contact the vertical shoulders 106. And in still other embodiments, the outer surface 444 of the first and second lateral flanges 452, 454 of the bottom plate 440 can indirectly contact the vertical shoulders 106 through another piece such as a compression shim 290. As discussed above, in some embodiments, about 2500 lbs, or about 5 percent to 30 percent of vertical force from the pedestal roof 152 can be distributed to each of the adapter pad lateral flanges 416, 418 when a vertical force is applied to the central portion 410 of the adapter pad.

Although the embodiment of the adapter pad 400 shown in at least FIGS. 28-43 includes upturned portions 412, 414 and lateral flanges 416, 418, it need not include these portions in all embodiments. The center portion 410 can in some embodiments be used without the lateral flanges 416, 418 and/or without the upturned portions 412, 414, although such designs may affect performance. In an embodiment, the lateral flanges 416, 418 can extend from the central portion without upturned portions, and without decreased performance characteristics. Similarly, in some embodiments the lateral flanges can extend outside of the central portion but in the same plane as the central portion. In still other embodiments, the adapter pad 400 can include downturned portions that can connect to lateral flanges.

Figure 29A:
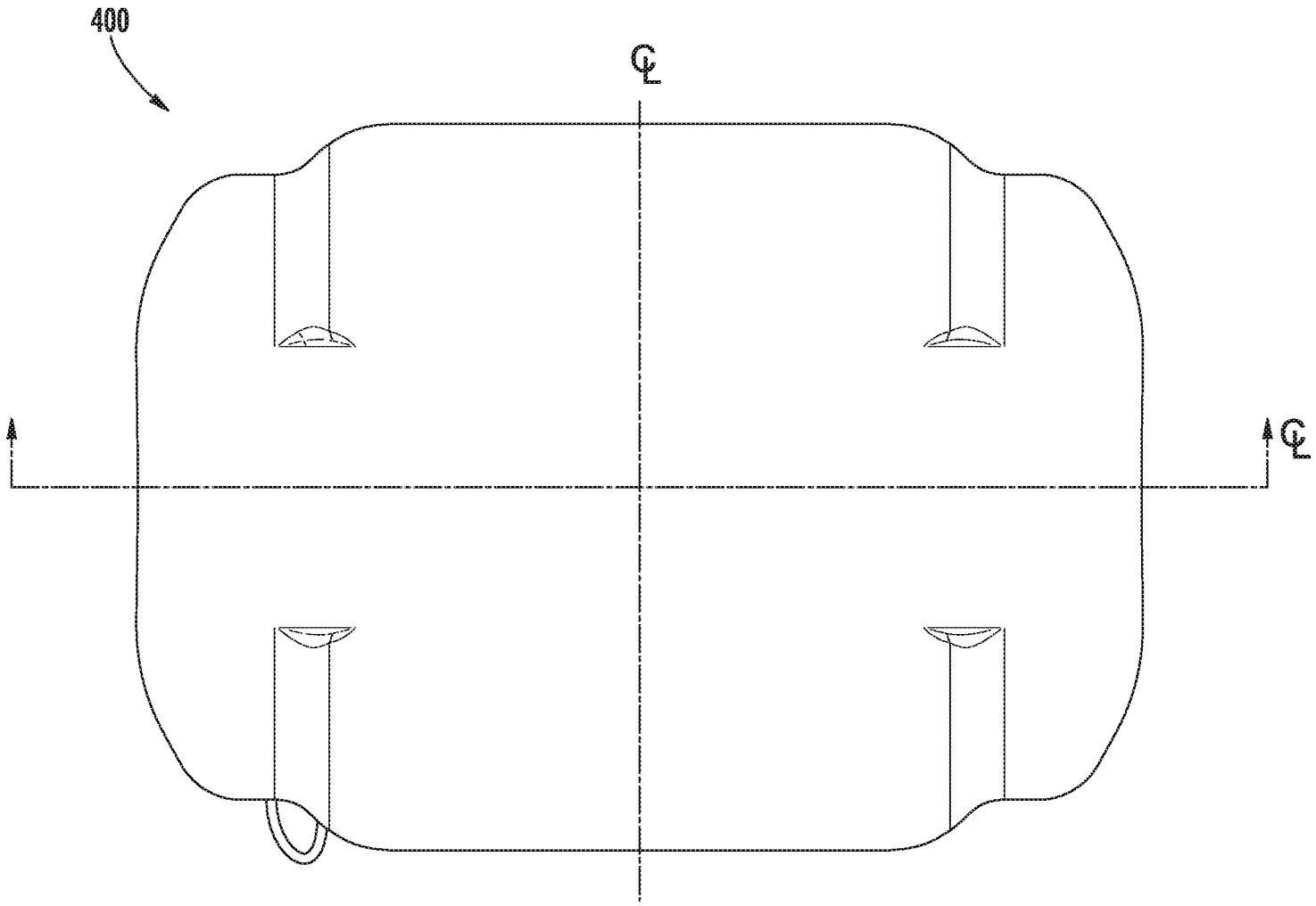
FIG. 29A is a top view of the adapter pad of FIG. 28.
Figure 31B:
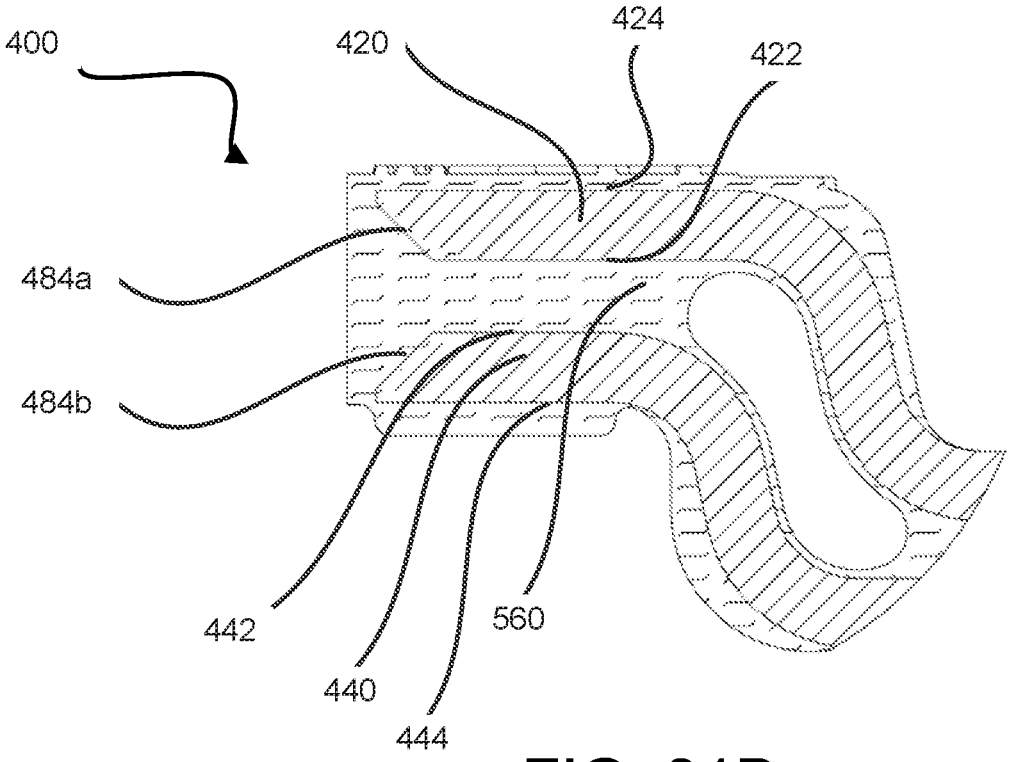
FIG. 31B is a detail view of another embodiment of a portion of an adapter pad similar to FIG. 31.
Figure 32:
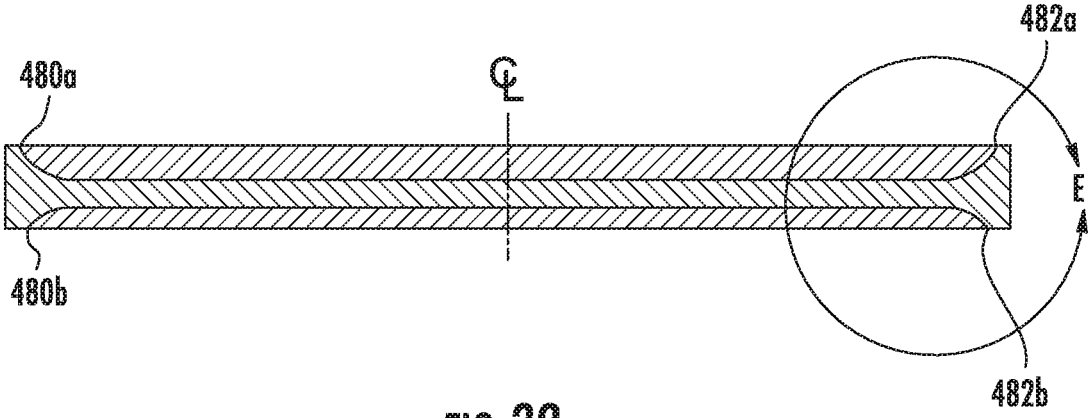
FIG. 32 is a cross-sectional view taken along line B-B of FIG. 30.
Figure 33:
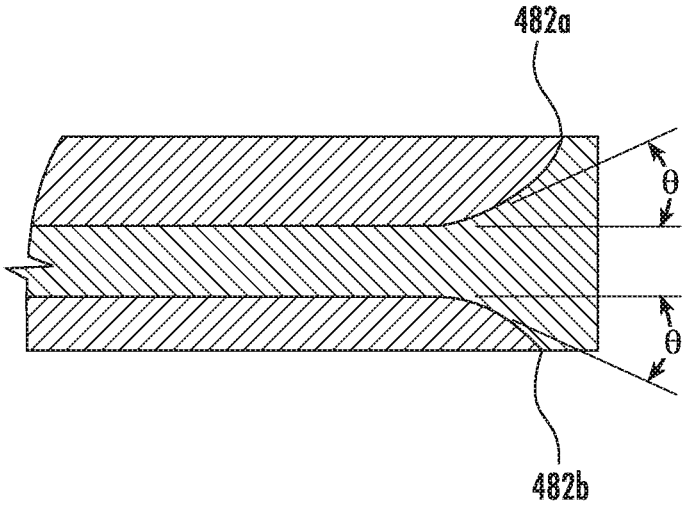
FIG. 33 is a detail view of a portion of FIG. 32.
Figure 33A:
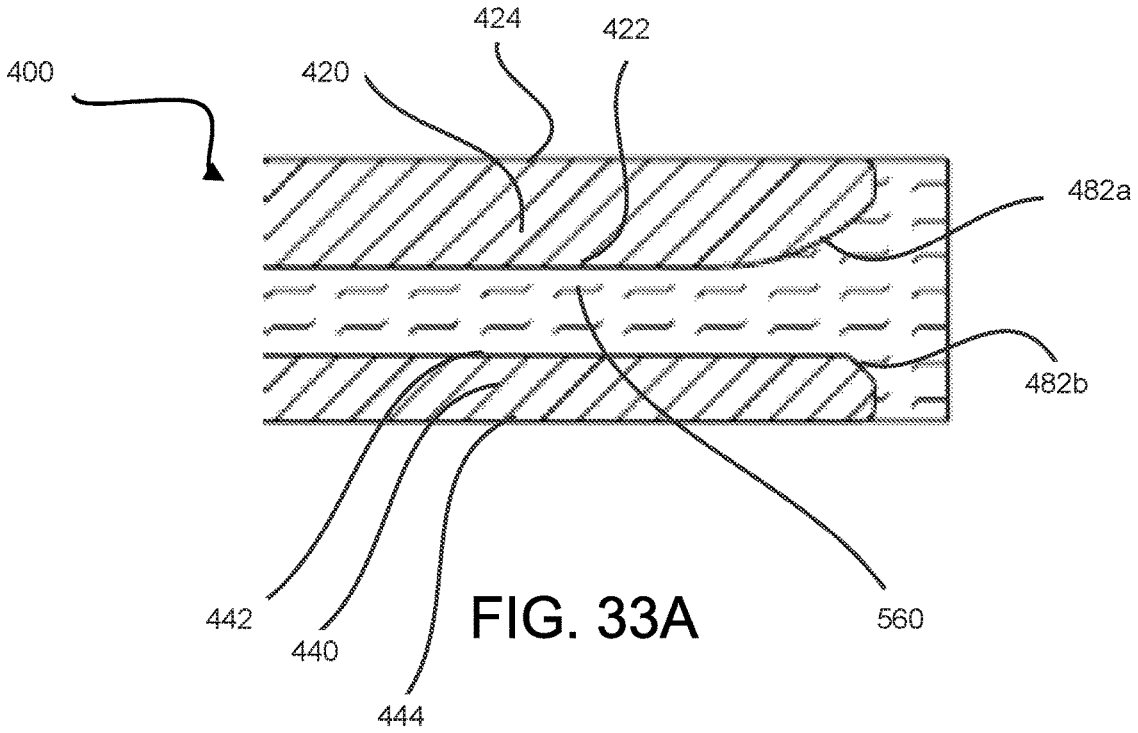
FIG. 33A is a detail view of another embodiment of a portion of an adapter pad similar to FIG. 33.
Figure 33B:
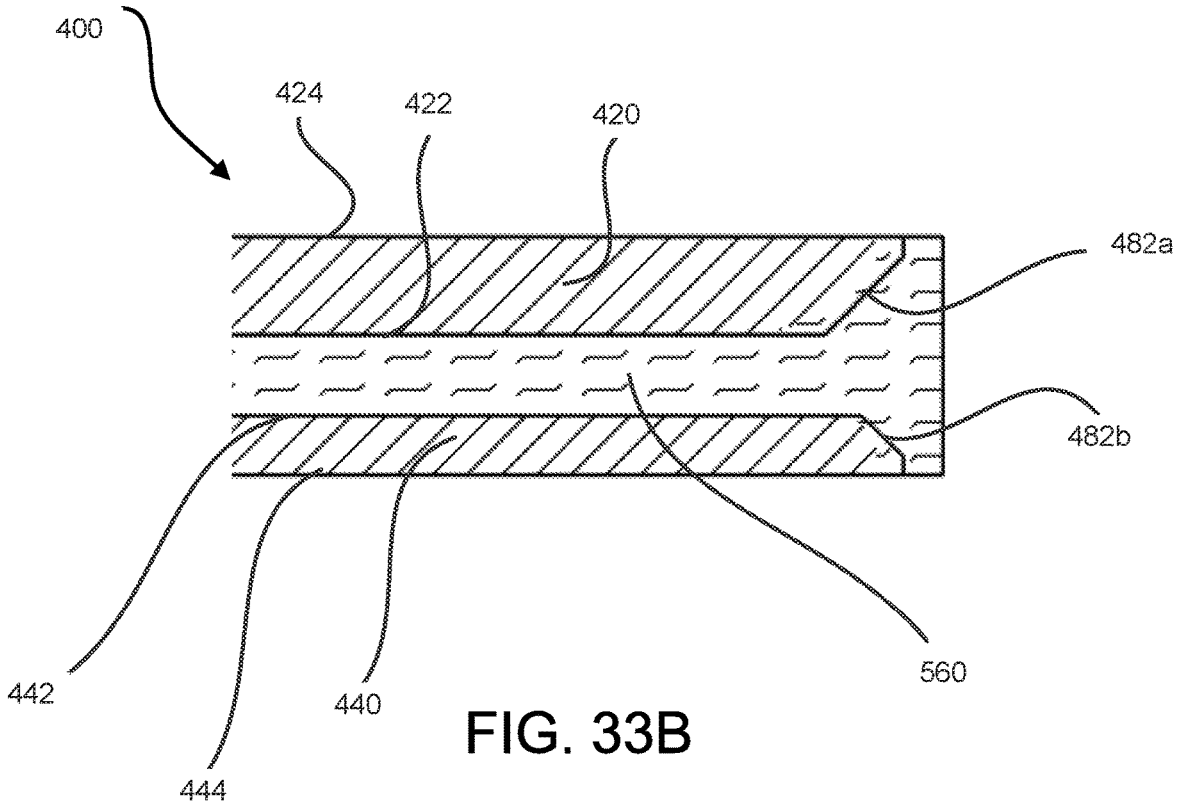
FIG. 33B is a detail view of another embodiment of a portion of an adapter pad similar to FIG. 33.

As shown, for example in FIG. 29 wherein the top 420 and bottom 440 plates are shown in dotted lines, the top and bottom plates 420, 440 may include lateral edges 480*a*, 480*b*, 482*a*, and 482*b*. The top and bottom plates 420, 440 may also include longitudinal edges 484*a*, 484*b*, 486*a*, and 486*b*. The edges 480*a*, 480*b*, 482*a*, 482*b*, 484*a*, 484*b*, 486*a*, and 486*b*, as viewed from a side or front or back, may be straight or may include curved or angled portions. As shown, for example, primarily in side views FIGS. 30-33 (including FIGS. 31A, 31B, 33A, and 33B), the edges 480*a*, 480*b*, 482*a*, 482*b*, 484*a*, 484*b*, 486*a*, and 486*b* of each of the top and bottom plate 420 and 440 may include a shape wherein the edges curve (FIGS. 31, 31A, 33, and 33A) or angle (FIGS. 33A, and 33B) inward from the outer surfaces 424, 444 toward the inner surfaces 422, 442 of the plates 420, 440 respectively. Additionally, as shown primarily in FIGS. 31A, 31B, 33A, and 33B one or more of the edges 480*a*, 480*b*, 482*a*, 482*b*, 484*a*, 484*b*, 486*a*, and 486*b* may include a substantially vertical portion. The substantially vertical portions may be adjacent the outer surfaces 424, 444 prior to the edges 480*a*, 480*b*, 482*a*, 482*b*, 484*a*, 484*b*, curving (FIGS. 31, 31A, 33, and 33A) or angling (FIGS. 31B, and 33B) inward from the outer surfaces 424, 444 toward the inner surfaces 422, 442 of the plates 420, 440. In other embodiments, the vertical portion, need not be vertical, for example, it may be at a different angle and/or different curve than the remaining portions of the edges 480*a*, 480*b*, 482*a*, 482*b*, 484*a*, 484*b*, 486*a*, and 486*b*. One or more portions of the perimeter of the top and bottom plates 420, 440, including edges 480*a*, 480*b*, 482*a*, 482*b*, 484*a*, 484*b*, 486*a*, and 486*b*, can include a continuous radius. In some embodiments, the continuous radius can be a radius of about 0.25 inches or greater than half the thickness of the plate. Additionally, one or more portions of the edges 480*a*, 480*b*, 482*a*, 482*b*, 484*a*, 484*b*, 486*a*, and 486*b* of the top and bottom plates 420, 440 can include a splined curvature profile around the perimeter including one or more varying radii and/or planar sections. The radii portions of the edges 480*a*, 480*b*, 482*a*, 482*b*, 484*a*, 484*b*, 486*a*, and 486*b* of the top and bottom plates 420, 440 can extend at a tangent angle θ with respect to the inner surfaces 422, 442 of the top and bottom plates 420, 440. In some embodiments, the angle θ may be an angle of about 25 degrees or in the range of about 10 degrees to about 40 degrees. In some embodiments the splined curvature profile will become tangent at a distance of 0.38 inches from the outermost portions of edges 480*a*, 480*b*, 482*a*, 482*b*, 484*a*, 484*b*, 486*a*, and 486*b* of the top and bottom plates 420, 440 or about 0.12 to 0.6 inches from the outermost portions of the edges. In some embodiments, the edges 480*a*, 480*b*, 482*a*, 482*b*, 484*a*, 484*b*, 486*a*, and 486*b* can extend from the outer surfaces 424, 444 of the top and bottom plates 420, 440 at an angle substantially perpendicular to the outer surfaces 424, 444 and extend from the inner surfaces 422, 442 of the top and bottom plates 420, 440 at an angle substantially tangent to the inner surfaces 442, 444. Additionally, in such embodiments, certain portions of the edges 480*a*, 480*b*, 482*a*, 482*b*, 484*a*, 484*b*, 486*a*, and 486*b* may not be perpendicular or tangent to the inner or outer surfaces 422, 442, 442, 444. For example, as shown in FIG. 33, edge 482*a* may not extend perpendicularly to the outer surface 444 at all locations around the perimeter of the top and bottom plates 420, 440.

In other embodiments, and as discussed above, the perimeter of the top and bottom plates 420, 440 may be constructed such that at the edges 480*a*, 480*b*, 482*a*, 482*b*, 484*a*, 484*b*, 486*a*, and 486*b* the outer surfaces 424, 444 extend further out than the substantially flat portion of the inner surfaces 422, 442. For example, in some embodiments, a chamfered or angled edge can be used around the perimeter of the plate.

In some embodiments, the lateral and/or longitudinal edges 480*a*, 480*b*, 482*a*, 482*b*, 484*a*, 484*b*, 486*a*, and 486*b* of the lateral flanges of the top and bottom plates 420,440 are each aligned along the same vertical plane, as best shown in FIGS. 30-33. In these embodiments, the lateral length of the lateral flange of the bottom plate 440 is less than the lateral length of the lateral flange of the top plate 420.

Figure 29B:
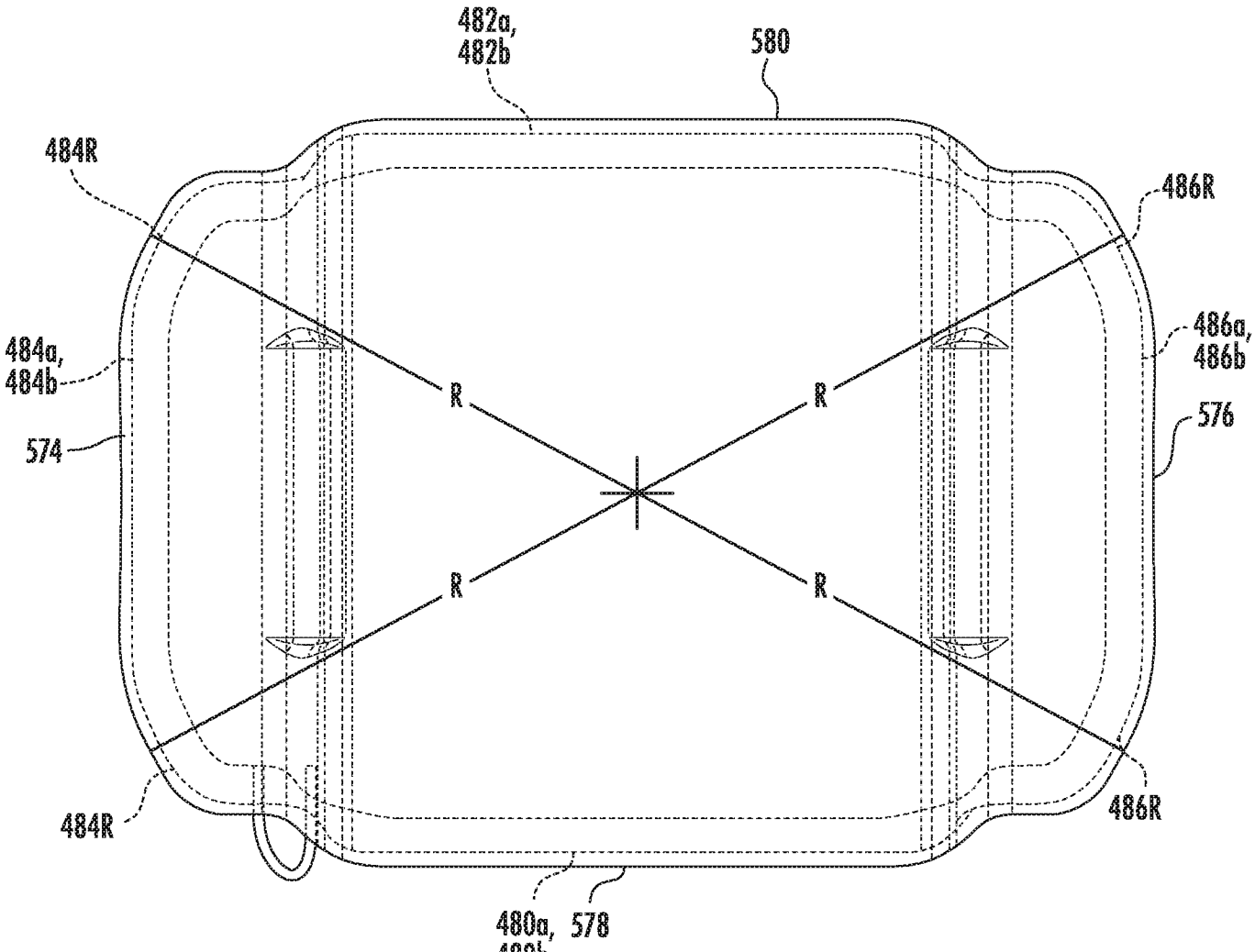
FIG. 29B is a top view of the adapter pad of FIG. 28 showing the plates in dotted lines.

In some embodiments, the outer edges 484*a*, 484*b*, 486*a*, 486*b*, as viewed from a top view and as shown in FIG. 29B, may include one or more curved portions. For example, at least a portion 484R, 486R of the outer edge 484*a*, 484*b*, 486*a*, 486*b* may be formed with a continuous radius (R) with respect to a geometric center of the adapter pad. In some embodiments each outer edge 484*a*, 484*b*, 486*a*, 486*b* may include two discontinuous curved edges 484R, 486R with a constant radius, with a center section between the two that may be straight or at a different curve(s) than the constant radius portions. In other embodiments, the constant radius portion may be continuous and extend from proximate to opposite lateral edges 480*a*, 480*b*, 482*a*, 482*b*.

In some embodiments, any point on the lateral edge of the roller bearing adapter when the top plate is rotated up to 41 milliradians from the neutral position relative to the bottom plate may have a linear displacement less than or equal to 0.234. Additionally, in some embodiments, any point on the lateral edge when the top plate is rotated up to 41 milliradians from the neutral position relative to the bottom plate has a linear displacement less than or equal to the maximum longitudinal displacement and maximum lateral displacement. As discussed above with regard to other embodiments, the top plate and bottom plates 420, 440 may be made from one or more different types of alloys with suitable strength and other performance characteristics. For example, the plates 420, 440 may be manufactured from ASTM A36 steel plate, or steels with a strength equivalent to or higher than those specified in ASTM A-572. In some embodiments, the entire top plate and/or bottom plate 420, 440 is formed (cast, machined, pressed, rolled, stamped, rolled, forged or another suitable metal forming operation) from a single monolithic member. In some embodiments, the plates 420, 440 may be formed from a material with a constant thickness throughout. In other embodiments, the plates 420, 440 have a variable thickness. For example, as shown in FIG. 30 and as described above, the bottom plate 440 may be thinner toward the center of the central section 446. Additionally, for example in some embodiments, the lateral flanges 432, 434, 452, 454 can have a thickness that is greater than or less than the thickness of the center portion 426, 446.

As discussed above with regard to other embodiments, and as shown primarily in FIGS. 30-33, an elastomeric member 560 is disposed between the top plate 420 and the bottom plate 440. As will be discussed in greater detail below the elastomeric member 560 can extend on the outside of the top and bottom plates 420, 440 and can extend beyond the lateral and longitudinal edges of the plates. For example, the elastomeric member can extend laterally and/or longitudinally at least 0.05 inches, or in the range of about 0.01 inches to 0.25 inches, beyond the respective lateral and longitudinal edges of the plates. The elastomeric member 560 supports the vertical load and allows limited longitudinal, lateral, and rotational motion of the top plate 420 (supporting the side frame) relative to the bottom plate 440 (supported by the adapter). This allows the relative motion of the side frame relative to the adapter by a low stiffness, and hence, low loads as compared to sliding adapter designs. As discussed above the movement of the top plate 420 relative to the bottom plate 440 can be measured in longitudinal displacement (FIG. 17B), lateral displacement (FIG. 17C), and rotational displacement (FIG. 17D). The adapter pad elastomeric material 560 may be materials as previously discussed.

In general the elastomeric member 560 can be attached to the top and bottom plates 420, 440 through injection molding. Generally the top and bottom plates 420, 440 can be placed within the mold. In some embodiments, portions of the top and bottom plates 420, 440 can be coated with adhesive to allow the elastomeric member 560 to adhere to the plates. Additionally, in some embodiments, spacers can be placed within the mold in certain areas where the elastomeric material is not needed. Once setup is complete, elastomeric material can be heated and inserted into the mold, and the elastomeric material can flow throughout the mold cavity, adhering to the areas applied with adhesive. In some embodiments, the top plate 420 and/or the bottom plate 440 may include one or more apertures to allow elastomeric material to pass through the respective plate during the molding process. The elastomeric can then undergo vulcanization and/or curing.

As previously discussed, the elastomeric member 560 may provide for dampening within the adapter pad 400, allow for discrete changes in stiffness and/or flexibility within the adapter pad 400, and to allow for differences in the dampening, stiffness, flexibility or other parameters within the different portions of the adapter pad 400 to allow for a suitable design.

As shown in FIG. 30, the elastomeric member 560 may include a central portion 562 that is disposed within the central portion 410 of the adapter pad 400, and first and second outer elastomeric members 564, 566 that are disposed within the respective first and second lateral flanges 416, 418. The outer elastomeric members 564, 566, increase the shear area and volume of the elastomer layer 560 by extending the elastomeric material beyond the standard adapter clearance envelope through the use of the lateral flanges 416, 418. This provides more area for the elastomeric member 560 and can increase stiffness of the adapter pad 400.

The central elastomeric portion 562 can be generally square shaped and in some embodiments can have one or more rounded corners. Rounded corners throughout the elastomeric member 560 can reduce or eliminate stress concentrations as compared to an elastomeric member 560 with square corners. As discussed above, the elastomeric member 562 can have a uniform thickness throughout the central portion 410.

The central elastomeric portion 562 can be primarily disposed in the central portion 410, but in some embodiments can also be disposed in the first and second upturned regions 412, 414, as shown in FIGS. 30 and 31, and in the lateral flanges 416, 418. The central elastomeric member 562 can have similar dimensions to central elastomeric members discussed above. In some embodiments, and as shown in FIGS. 30 and 31, the elastomer 560 can be disposed between the top and bottom plates 420, 440 in the upturned regions 412, 414. In embodiments where elastomer 560 is disposed between the plates in the upturned region it can compress or shear under lateral loading. This compression of the elastomer in the upturned regions 412, 414, in concert with the shearing of the elastomer in the other regions, can allow the adapter pad to reach high stiffnesses which can increase performance.

As best shown in FIG. 29B, from a top view, the outer elastomeric portions 564, 566, at least a portion of which, is within one or both of the first and second lateral flanges 416, 418 forms an outer longitudinal edge 574, 576, respectively. The outer longitudinal edge 574, 576 of the elastomeric portion may extend outward beyond the top and bottom plates 420, 440. The distance the outer edge 574, 576 of the elastomeric portion extends beyond edges of the top and bottom plate 420, 440 may be substantially similar or may vary over the length of the edge. The elastomeric portion may also form lateral edges 578, 580. The outer lateral edge 578, 580 of the elastomeric portion may extend outward beyond the top and bottom plates 420, 440. The distance the outer edge 578, 580 of the elastomeric portion extends beyond edges of the top and bottom plate 420, 440 may be substantially similar or may vary over the length of the edge. One or more of the edges 574, 576, 578, 580, may be substantially straight in the vertical direction as shown, for example, in FIG. 28.

As described above with regard to other embodiments, outer surfaces of the plates 420, 440 may receive a coating of an elastomeric material 565 which may be the material that contacts the pedestal roof 152. The elastomeric coating 565 may be formed with a flat outer surface that follows along the geometric profile of the steel portion of the top plate 420, and can have a uniform thickness, either along the entire top plate 420, or in other embodiments, a uniform thickness within discrete portions of the pad (such as a uniform thickness in the central portion 410, a (potentially different or potentially the same) uniform thickness on one or both of the upper portions lateral flanges 432, 434, a (potentially different or potentially the same) uniform thickness on one or both of the upturned portions 428, 430, and the like.

In some embodiments the entire or a majority of adapter pad 400 can include a coating of an elastomeric material 565 which may be integrally formed with the elastomeric member 560. For example, in some embodiments, the majority of the adapter pad 400 may include a coating of elastomeric material 565 except for those portions of the adapter pad 400 which contact the pedestal roof 152 and the top surface of the adapter 199 such as the outer surface of the top and bottom plates 420, 440. In some embodiments, for example, the coating of elastomeric material 565 may contact the pedestal roof 152, the side frame 4, and the roller bearing adapter pad 199, including the pedestal crown surface 102 and the vertical shoulders 106. In other embodiments, for example, the portions of the adapter pad 400 that contact the pedestal roof 152, side frame 4, and the roller bearing adapter pad 199, can be free of elastomeric material. As discussed elsewhere herein, the elastomeric layer 565 may provide dampening and a calibrated flexibility to the pad, as well as a compressible surface to minimize wear between the adapter pad 400, the pedestal roof 152, and the roller bearing adapter 199. The elastomeric coating 565 may follow the outer surfaces of the adapter pad 400 and can have a uniform thickness, along the outer surfaces of the adapter pad 400, or in other embodiments, a uniform thickness within discrete portions of the pad such as a uniform thickness in the central portion 410, a (potentially different or potentially the same) uniform thickness on one or both of the upper portions lateral flanges 432, 434, a (potentially different or potentially the same) uniform thickness on one or both of the upturned portions 428, 430, and the like.

Figure 28:
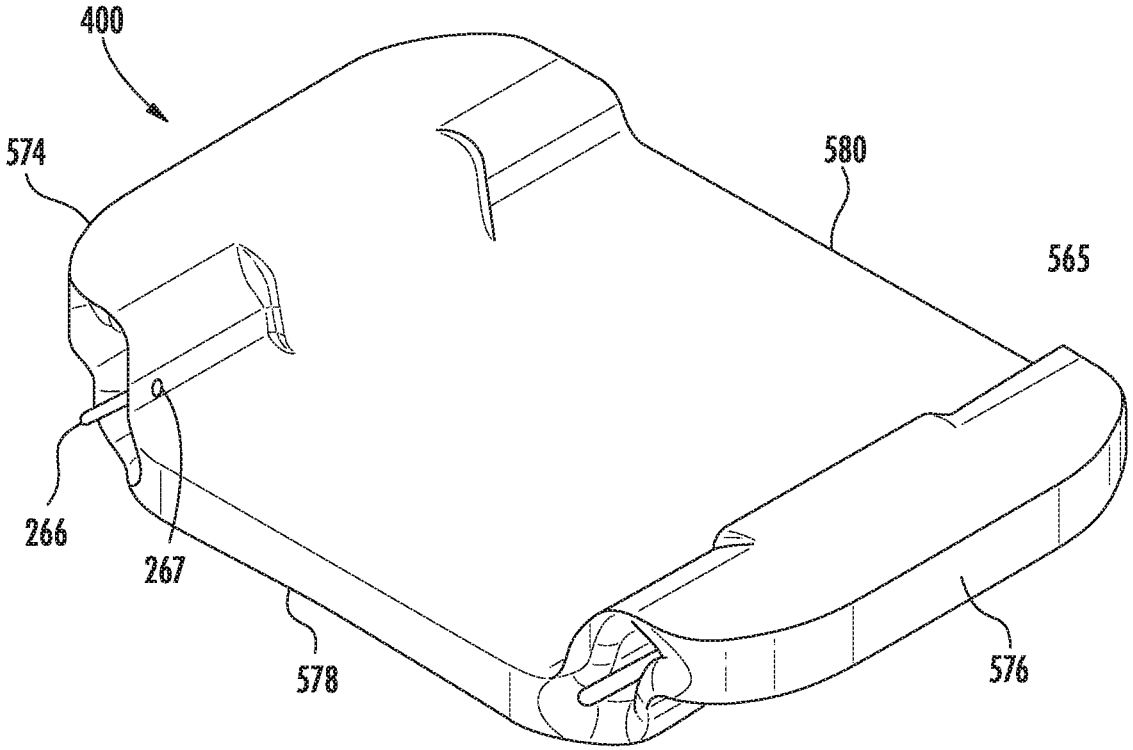
FIG. 28 is a perspective view of an adapter pad according to aspects of the disclosure.

As best shown in FIGS. 28-30, and as described above, one or both of the upturned portions 412, 414 may include a hollow portion(s) 572 within a cavity formed between the top and bottom plate 420, 440, which is a void where substantially no elastomeric material is provided, and can establish a discontinuity within the elastomeric member 560 within the respective first and/or second upturned portions 412, 414. The hollow portions 572 may provide a complete separation between the elastomeric member 560 disposed within the central portion 410, and the elastomeric member disposed in the lateral flanges 416, 418. In certain embodiments, the void may include a very small thickness layer of elastomeric material that contact each of the top and bottom plate 420, 440 through the transition, which can be a function of possible limitations of the tooling used in the molding process, but this thin layer (when existing) may not materially contribute to the performance of the adapter pad 400. Additionally, in some embodiments the hollow portion 572 can include small portions of elastomeric material that extend between the top and bottom plates 420, 440, but it is otherwise substantially hollow. In some embodiments, the width of the hollow portion 572 can be about 0.25 inches or in the range of about 0.1 inches to about 0.5 inches, or at least as wide as the maximum lateral and rotational motion on the adapter pad 200. In some embodiments, the hollow portion(s) 572 are configured to provide a lateral void between the top and bottom plate 420, 440 extending through the respective transition portion 412, 414, such that the respective inner surfaces of the top and bottom plates 420, 440 within the transition portion do not contact each other during lateral or rotation relative motion therebetween and/or in view of the lateral and/or rotational displacement during railcar operations with the adapter pad 400 disposed in position in the railcar truck system.

As described above, the hollow portion 572 can function to limit the bending stresses in the top and bottom plates 420, 440. The hollow portion 572 may be about 0.25 inches. At the about 0.25 inch motion range, the upturned regions of the top and bottom plate 420, 440 can engage and prevent further relative motion. This can put an upper limit on the elastomer strain in the lateral direction and the metal stress.

As described above, during use, there can be heat generation in the adaptor pad 400 through friction of the pad 400 and sliding relative to the side frame pedestal roof 152 and/or relative to the bearing adaptor 199; and or the hysteretic damping of the elastomeric member 560 of the adaptor pad 200. These heat sources can cause adaptor pad temperatures to increase, which can result in lower durability and reduced stiffnesses. As described above, in some embodiments, the adapter pad 400 can include features which can increase its ability to reduce heat in the adapter pad 200.

Additionally, as described above, one or both of the outer surfaces 424 of the central portion 426, or the inner surface 444 of the central portion 446 may include one or more of various surface features, and in some embodiments a pattern of surface features to make these surfaces non-smooth.

As described above, in some embodiments electrical conductivity may be provided between the top and bottom plates 420, 440. As shown in FIG. 28, a wire ground strap 266 can be attached to apertures in sides of the top and bottom plates 420, 440. The wire ground strap 266 may pass through the apertures in the top and bottom plates 220, 240. The top and bottom plates 420, 440 can be indented or deformed at a point 267 to crimp or secure the wire ground strap 266 in the top and bottom plate 420, 440. In some embodiments, the wire ground strap 266 may be stainless steel braid, about 0.100 inches in diameter, but may be as small as 0.050 inches.

The adapter pad 400 can, and as described above, include pads or grips on top and bottom plates 420, 440 of the adapter pad which can be configured to position the adapter pad 200 relative to the side frame pedestal roof 152 and the bearing adapter 199 and also engage and restrict movement of the adapter pad 400 relative to the pedestal roof 152 and the bearing adapter 199 which can focus movement (i.e. shear) of the adapter pad 200 to the elastomeric member 360. As described above, the assembly of the adapter pad 400 to the roller bearing adapter 199 can force the adapter pad 400 to be reasonably centered with regard to the roller bearing adapter 199, and the bearing by the use of the vertical shoulders 106 and including grips. Further, the adapter pad system 198 promotes the return of the adapter 200 and wheelset to a centered, or near zero force center position.

As described above, the adapter pad 400 may include a first and second lateral adapter grips 270, 271. The lateral adapter pad grips 270, 271 can be integrally formed with the bottom plate 440, including with being integrally formed with the elastomeric member 560 and/or any elastomeric coating 565 on the adapter pad 400. As described above, the adapter pad 400 can also include a first and second lateral side frame grips 272, 273. The lateral side frame grips 272, 273 can be integrally formed with the bottom plate 440, including with being integrally formed with the elastomeric member 560 and/or elastomeric coating 565 on the adapter pad 400.

As discussed above, the elastomeric member 560 and particularly the outer elastomeric members 564, 566 can be configured in such a manner that the elastomer's rotational shear stresses, through a displacement of up to 41 milliradians, are no greater than the elastomer's lateral and longitudinal shear stresses through a displacement of up to 0.23 inches laterally and of up to 0.14 inches longitudinally.

The elastomeric member 560 can be measured as described above with regard to other embodiments. The total shear width, or length in the lateral direction, of the elastomeric member 560 shown in FIGS. 28-33 can be about 10 inches or in the range of about 6 inches to about 14 inches. Similarly, the total shear length, or length in the longitudinal direction, of the elastomeric member 560 can be about 6.9 inches or in the range of about 6 inches to about 10 inches. The composite shear perimeter, or perimeter of all portions of the elastomeric member can be about 51.70 inches or in the range of about 35 inches to about 75 inches. The total surface area of the elastomeric member 560 in the shear plane can be about 55.5 square inches or in the range of about 50 square inches to about 70 square inches. The total surface area of the elastomeric member 560 outside of the central portion can be about 15.5 square inches or in the range of about 5 square inches to about 30 square inches, or greater than 5 square inches. Thus, the surface area of the elastomeric member in the lateral flanges 416, 418 can be about 7.75 square inches each or in the range of about 2.5 square inches to about 15 square inches, or greater than 2.5 square inches.

As discussed above, to reduce the stresses in the elastomeric member 560 under maximum shear displacement, it can be beneficial to provide normal stress, or compression, to the elastomeric member 560 during shear loading.

For example, as discussed above, the elastomeric member 560, outside the pedestal roof 152 area can be compressed greater than 0.020 inches, or greater than 7% of the static thickness of the elastomeric member 560. In certain embodiments, pre-compression of this magnitude allows for improved fatigue life of the elastomeric member 560. Additionally, in embodiments discussed herein about 10 percent to 30 percent of vertical force can be distributed to each of the adapter pad lateral flanges 416, 418 when a vertical force is applied to the central portion 410 of the adapter pad 400. And in embodiments discussed herein the reaction of the vertical load at the vertical shoulders 106 can provide a vertical force greater than 3000 pounds to precompress the elastomeric member.

Additionally, as discussed above, compression of the elastomeric member 560 in the region outside the pedestal roof 152 (in the outer elastomeric members 464, 466), can be accomplished with an elastomeric member 560 having a non-uniform thickness along the length of the elastomeric member 560. For example, the first and/or second outer portions 564, 566 may be formed with a thickness X while the central portion 462 may be formed with a different or smaller thickness Y. The geometry (such as the bends through the upturned portions 412, 414) of the top and bottom plates 420, 440 may be formed to accommodate the differences in thickness between X, Y allowing the elastomeric portions in the central and outer portions to contact the inner surfaces of the top and bottom plates 420, 440 as desired. In certain embodiments, the difference in thickness of the elastomeric member forming the first and/or second outer portions 464, 466 and the central portion 462 can assist in reducing the simple shear strains of the outer layers based upon in-plane forces applied to the adapter pad in the longitudinal, lateral, and rotational directions.

Additionally, as discussed above, one or both of the lateral flanges 416, 418 may be formed such that the elastomeric layers 564, 566 therewithin includes a thickness, X that is about 0.25 inches, such as within a range of 0.15 inches to 0.30 inches, inclusive of all thicknesses within the range. In this embodiment, the thickness Y of the elastomeric layer 560 in the central portion 562 may be about 0.20 inches, such as within a range of 0.15 inches to 0.25 inches, inclusive of all thicknesses within the range. The thicknesses of elastomeric layers discussed herein refer to the static thickness of the elastomeric layers or the thickness of the elastomeric layers without an external load on the elastomeric layer. One or both of the lateral flange portions 564, 566 and central portions 562 may have a different thickness, with the upper portions being thicker than the central portion this can achieve a desired effect, generally of increasing the load or compression of one or both of the lateral flange portions 564, 566, which due to the material properties of the elastomeric layer additionally increases its strength and durability based upon the contemplated loading during rail-car operation.

Additionally, as discussed above, and as shown in FIGS. 30 and 31, compression of the elastomeric member 560 in the lateral flanges 416, 418 can be increased by using compression shims 290 within or under the lateral projecting flanges 416, 418. Compression shims can be used herein such that reaction of the vertical load at the vertical shoulders 106 provides a vertical force greater than 3000 pounds such that about 10 percent to 30 percent of vertical force is distributed to each of the adapter pad lateral flanges 416, 418 when a vertical force is applied to the central portion 410 of the adapter pad 400. Compression shims can in some embodiments force more of the vertical load of the car to be distributed from the center elastomer layer 560 to the outer elastomer layers 564, 566. As shown in FIGS. 30 and 31, a first adapter compression shim 290 can be disposed between an upper surface of the vertical shoulder of the roller bearing adapter 199 and the outer surface 244 of the first lateral flange 416 of the bottom plate 440. A second adapter compression shim 290 can be similarly placed in relation to the second lateral flange 418. The adapter compression shims 290 can be about 0.05 inches thick or within the range of about 0.03 inches to about 0.18 inches. Compression shims as discussed herein can have any number of different shapes and configurations to provide the necessary loads to compress the outer elastomer. For example, compression shims can be rectangular, square, trapezoidal, pyramidal, can have a hollow cross-section, and can be a plurality of compression shims. Further, compression shims as discussed herein can be integrally formed with the adapter pad during the molding process, can be integrally formed with the roller bearing adapter, or can be added to the roller bearing adapter system after the molding process.

As discussed above, it has been determined through testing that the performance of the adapter pad system 198 is a function of the stiffness of the adapter pad 400. More specifically in certain embodiments, it has been determined that adapter pad performance, including design life, can be improved by increasing the stiffness of the adapter pad system 198 (measured in pounds of force per inch of deformation). Physical measurement of the pad stiffness can be determined as previously discussed.

Using the above described test methods, exemplary measurements and testing results of embodiments disclosed herein are shown below in Table 3. It is understood that these embodiments are examples, and that other structural embodiments with other testing results can exist.

TABLE 3

| | Embodiments Described Herein |
|---|---|
| Elastomer Normal Area ($in^2$) | 55.5 $in^2$ or about 50 $in^2$ to about 70 $in^2$ |
| Elastomer Normal Area Outside of Pedestal Roof Contact ($in^2$) | 15.5 $in^2$ or about 5 $in^2$ to about 30 $in^2$ |
| Pad Elastomer Shear Width (Lateral Length) (in) | 9.6 $in^2$ or about 6 $in^2$ to about 14 $in^2$ |

TABLE 3-continued

| | Embodiments Described Herein |
|---|---|
| Pad Elastomer Shear Length (Longitudinal Length) (in) | 6.9 $in^2$ or about 6 $in^2$ to about 10 $in^2$ |
| Lateral Stiffness (tested at 3 hz cycling frequency and 35 kip vertical load) | 60 kips/in or about 45 kips/into about 80 kips/in or at least 45 kips/in |
| Longitudinal Stiffness (tested at 3 hz cycling frequency and 35 kip vertical load) | 64 kips/in or about 45 kips/into about 80 kips/in or at least 45 kips/in |
| Rotational Stiffness (tested at 3 hz cycling frequency and 35 kip vertical load) | 670 kip*in/mRad or about 250 kip*in/mRad to about 840 kip*in/mRad or at least 250 kip*in/mRad |
| Vertical Stiffness | at least 5,000 kips/in |
| Lateral Hysteresis (tested at 3 hz cycling frequency and 35 kip vertical load) | 5000 lbs. or about 3750 lbs. to about 6250 lbs. or less than 6000 lbs. |
| Longitudinal Hysteresis (tested at 3 hz cycling frequency and 35 kip vertical load) | 500 lbs. or about 375 lbs. to about 1500 lbs. or less than 1500 lbs. |
| Rotational Hysteresis (tested at 3 hz cycling frequency and 35 kip vertical load) | 12000 lbs.*in or about 9000 lbs.*in to about 16000 lbs.*in or less than 16000 lbs.*in |
| Center Elastomer Layer Shear Perimeter | 25.5 in. or about 20 in. to about 30 in. |
| Outer Elastomer Layer Shear Perimeter | 13.1 in. each or about 8 to 18 in. each |
| Composite Elastomer Layer Shear Perimeter | 51.7 in. or about 35 in. to 75 in. |
| Center Elastomer Layer Shape Factor | 8.3 or about 6 to 10 |
| Outer Elastomer Layer Shape Factor | 1.6 each or about .5 to 3 each |
| Composite Shape Factor | 4.5 or about 2.5 to about 7 |

As discussed above, the elastomer layers 564, 566 outside of the central area 210 can contribute to the overall stiffness of the adapter pad 200. For example in some embodiments, the elastomeric member 560 outside of the central area 210 can contribute about 15%, or in the range of about 5% to about 30%, of the total lateral and longitudinal stiffness of the adapter pad, and 33%, or in the range of about 15% to about 60%, of the rotational stiffness of the adapter pad 200.

Figure 34A:
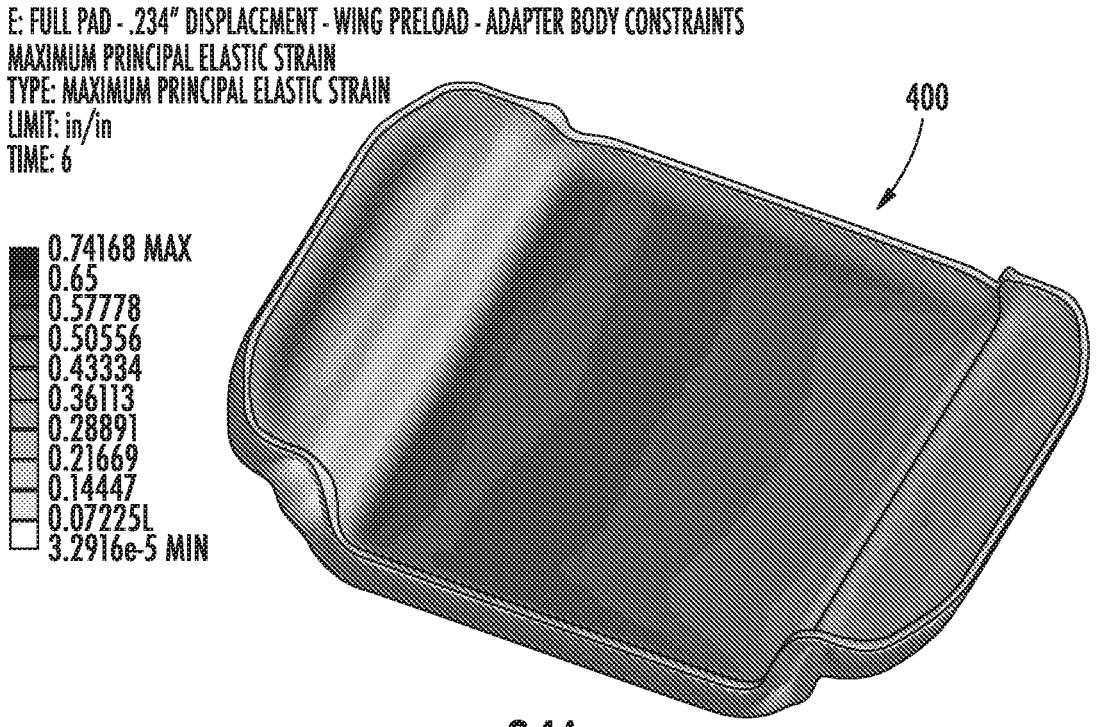
FIG. 34A is a screen shot of finite element analysis simulation results from a computer showing strain within the elastomeric portion when the top plate is displaced laterally relative to the bottom plate according to aspects of this disclosure.
Figure 34B:
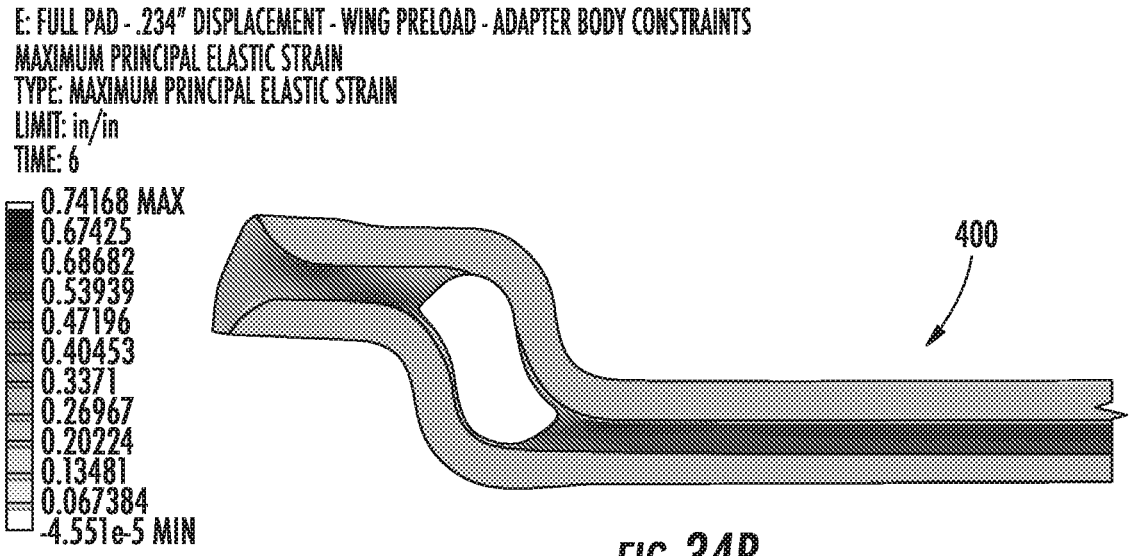
FIG. 34B is a screen shot of a portion of the finite element analysis simulation results of FIG. 34B.

As previously discussed, the elastomeric member 560, which can include elastomeric coating 565, of the adapter pad 400 provides shear resistance during loading in the lateral, longitudinal, and rotational directions under a vertical load. This shear resistance is caused by relative movement between the top and bottom plates 420, 440 reacted through the elastomeric member 560. Simple shear strain or strain is defined as d/t where d=displacement of the elastomeric member and t=thickness of the elastomeric member. FIGS. 34*a* and 34*b* depict simulations of lateral displacement of the top plate 420 relative to the bottom plate 440 of 0.234 inches. As shown in FIGS. 34*a* and 34*b* the strain is lower in the lateral flanges 416, 418 than it is in the center section 410. In some embodiments, this can improve the life of an adapter pad. Additionally, as shown in FIGS. 34*a* and 34*b*, the highest strain values occur inward of the outer edges of the elastomeric section. Similarly, FIGS. 35*a* and

Figure 35A:
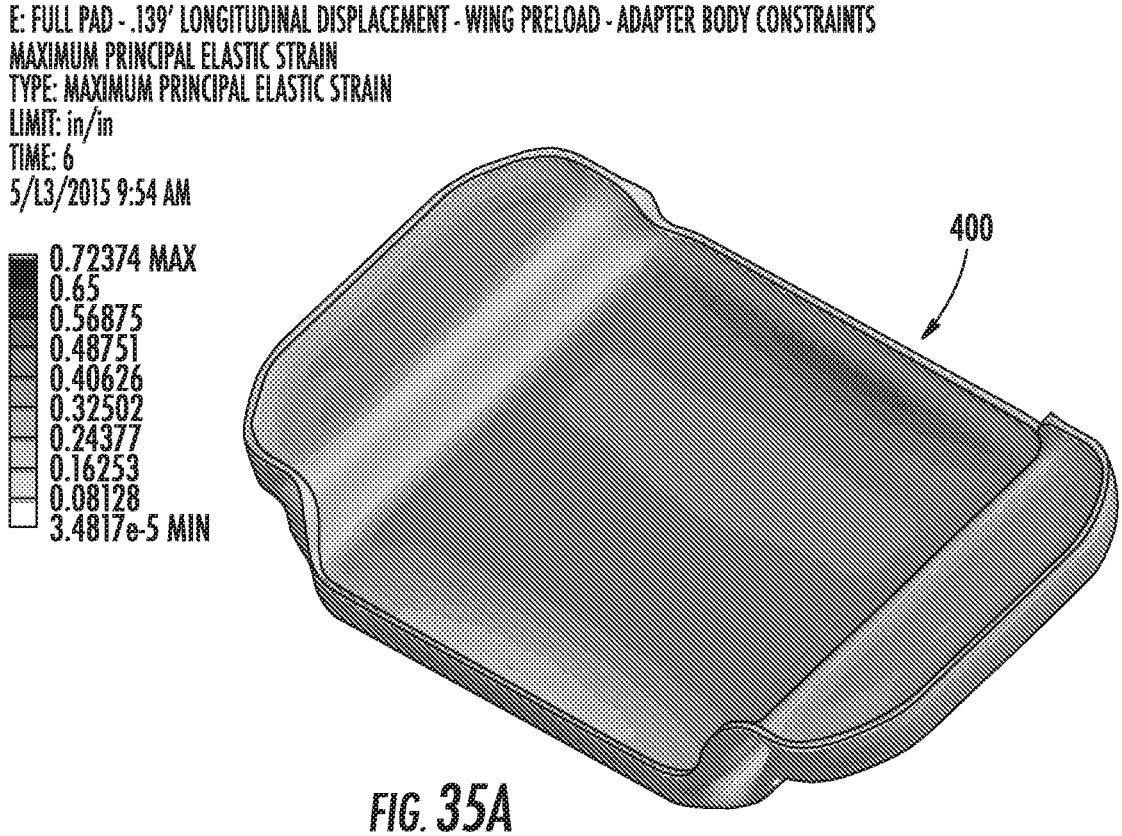
FIG. 35A is a screen shot of finite element analysis simulation results from a computer showing strain within the elastomeric portion when the top plate is displaced longitudinally relative to the bottom plate according to aspects of this disclosure.
Figure 35B:
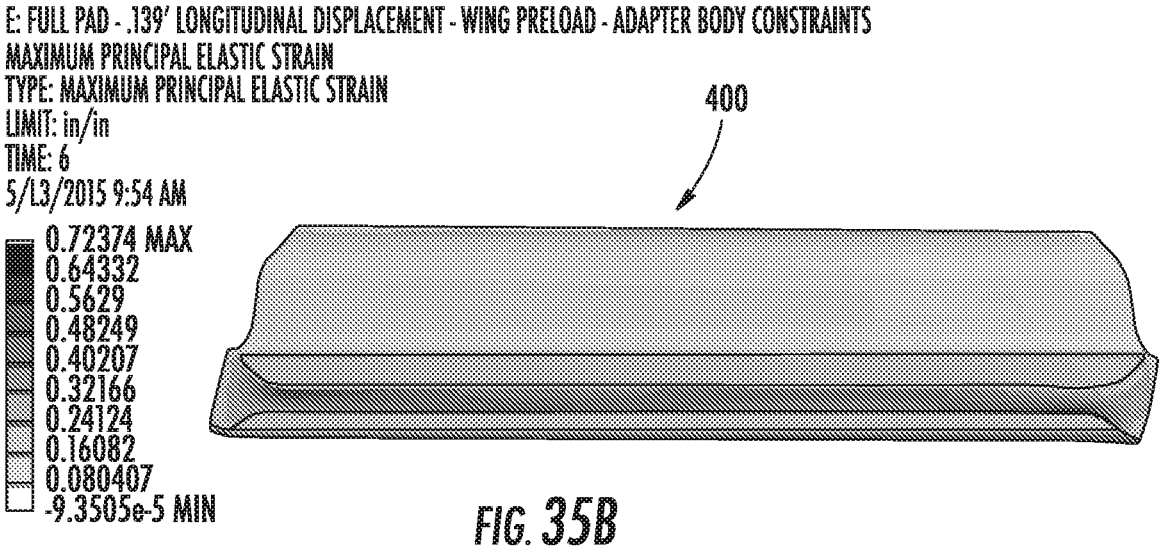
FIG. 35B is a screen shot of a portion of the finite element analysis simulation results of FIG. 35B.
Figure 36A:
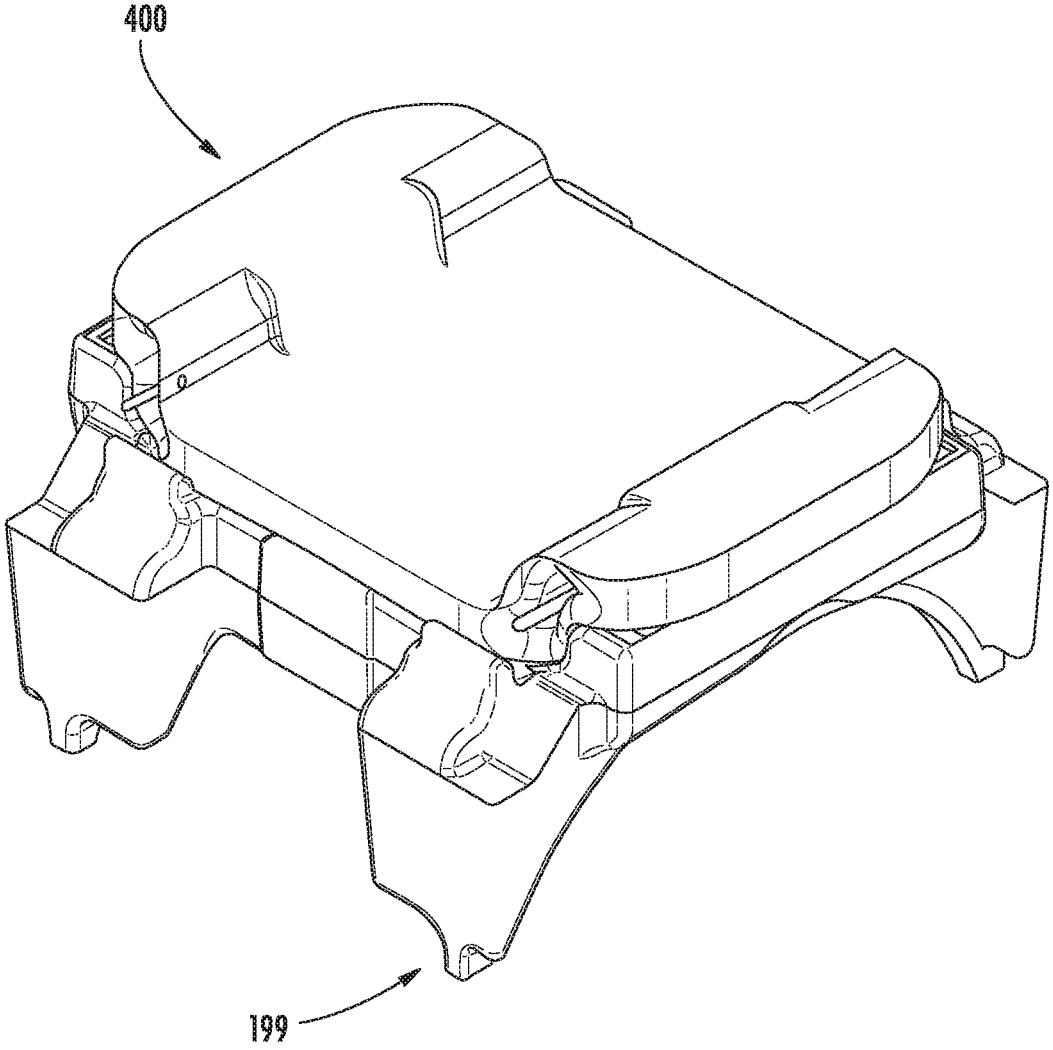
FIG. 36A is a perspective view of an adapter pad and roller bearing adapter according to aspects of the disclosure.
Figure 36B:
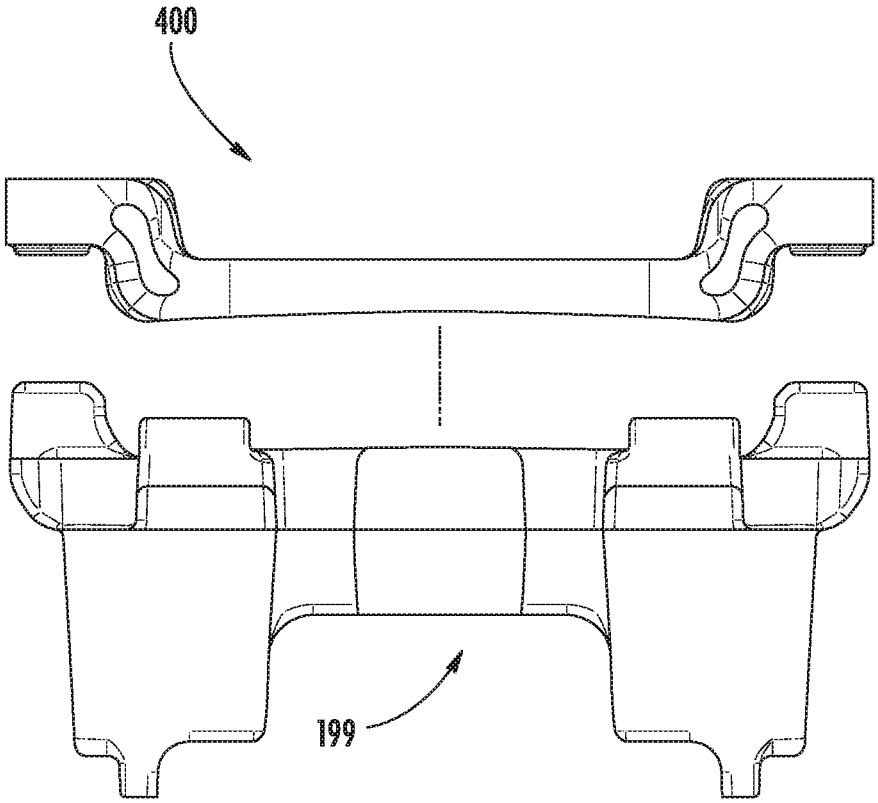
FIG. 36B is a side view of an adapter pad and roller bearing adapter according to aspects of the disclosure.
Figure 36C:
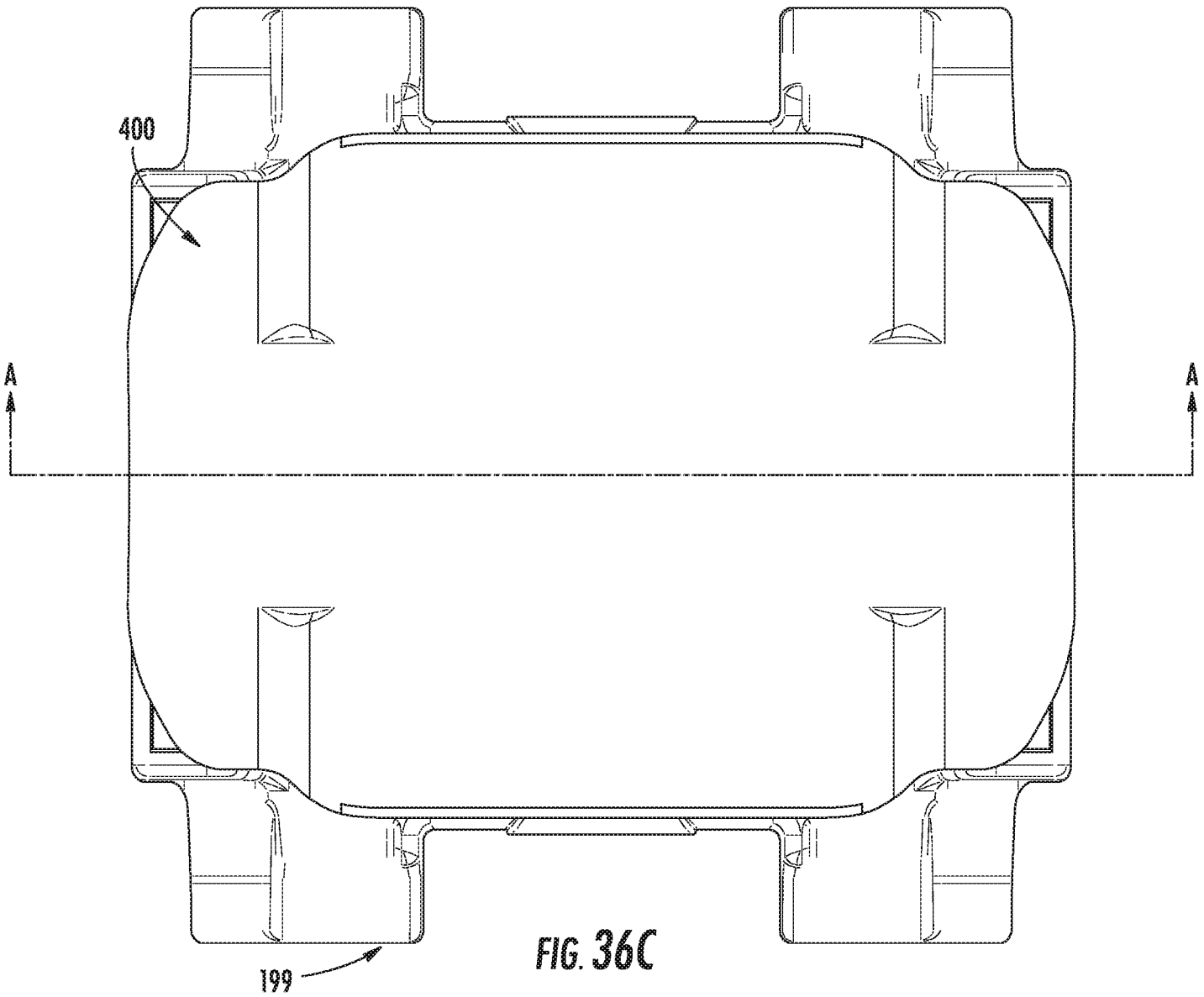
FIG. 36C is a top view of the adapter pad and roller bearing adapter of FIG. 36A.
Figure 36D:
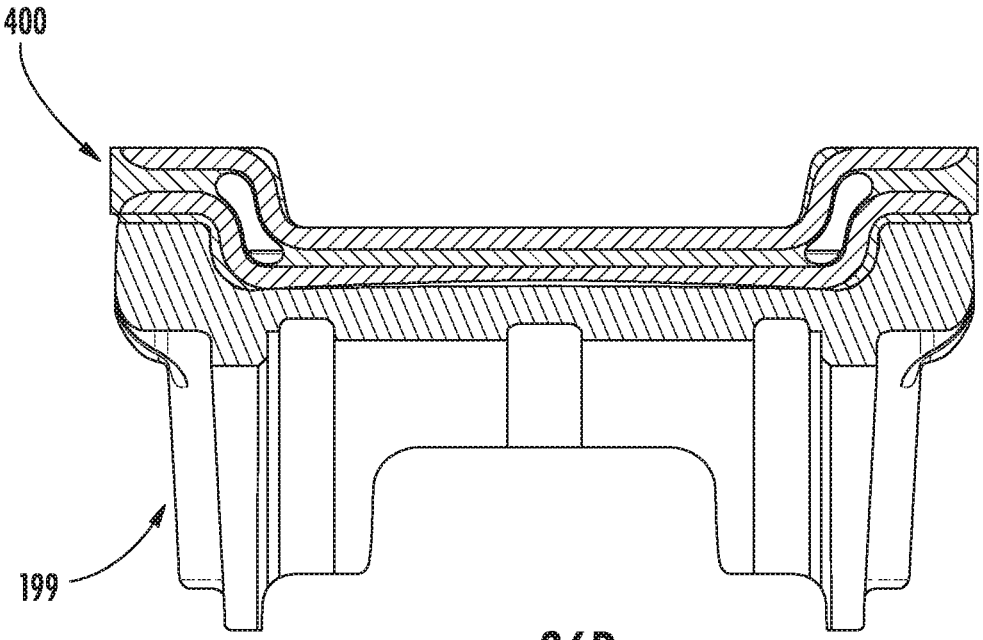
FIG. 36D is a cross-sectional view of the adapter pad and roller bearing adapter of FIG. 36C taken along the line A-A.
Figure 36E:
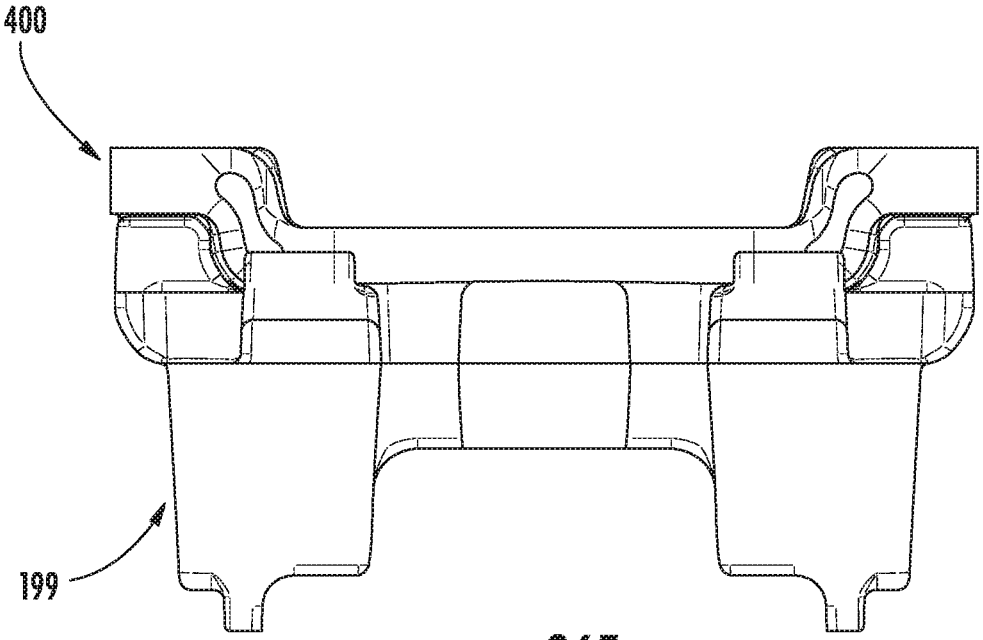
FIG. 36E is a front view of the adapter pad and roller bearing adapter of FIG. 36A.
Figure 37:
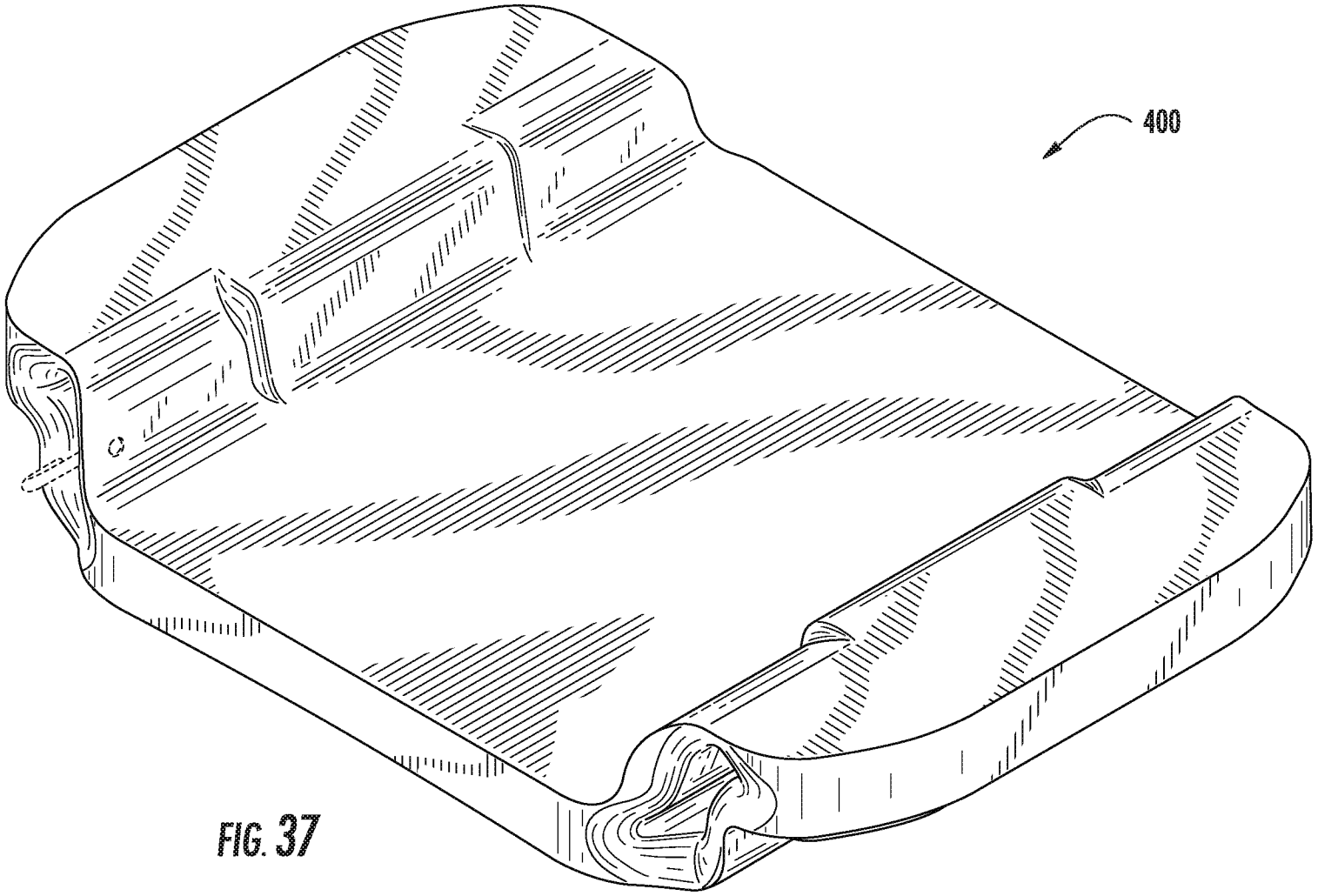
FIG. 37 is a perspective view of an adapter pad according to aspects of the disclosure.
Figure 38:
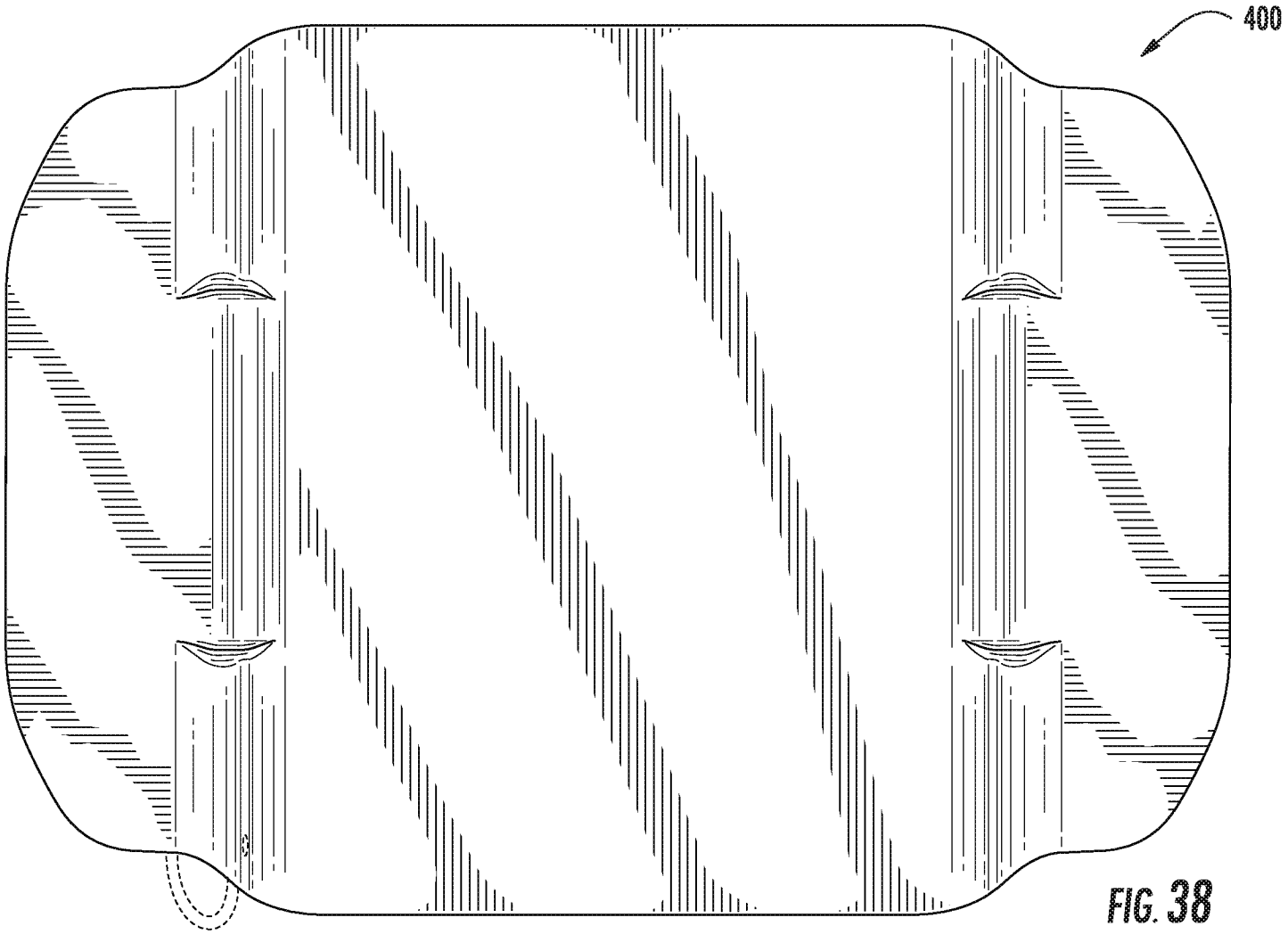
FIG. 38 is a top view of the adapter pad of FIG. 37.
Figure 39:
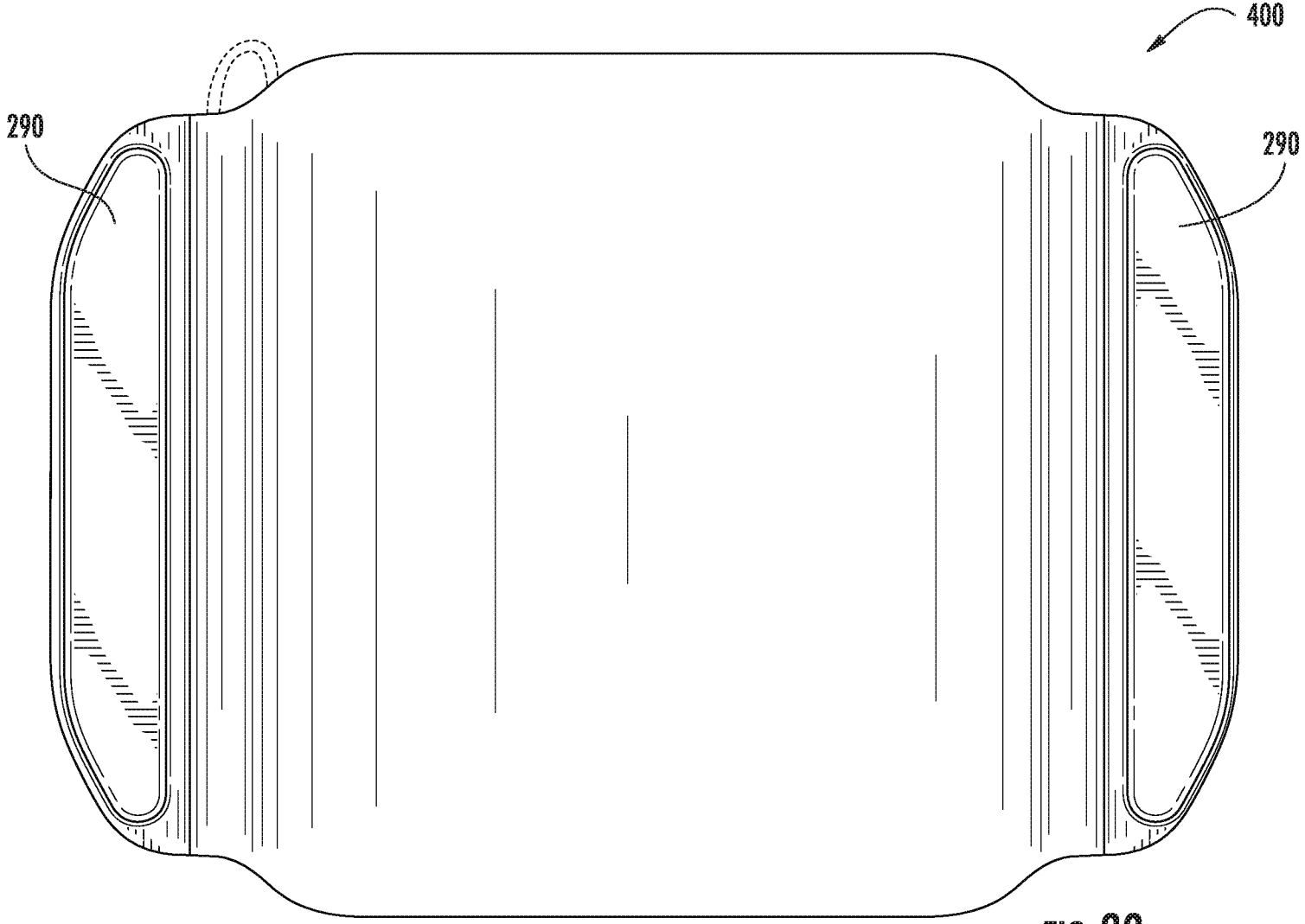
FIG. 39 is a bottom view of the adapter pad of FIG. 37.
Figure 40:
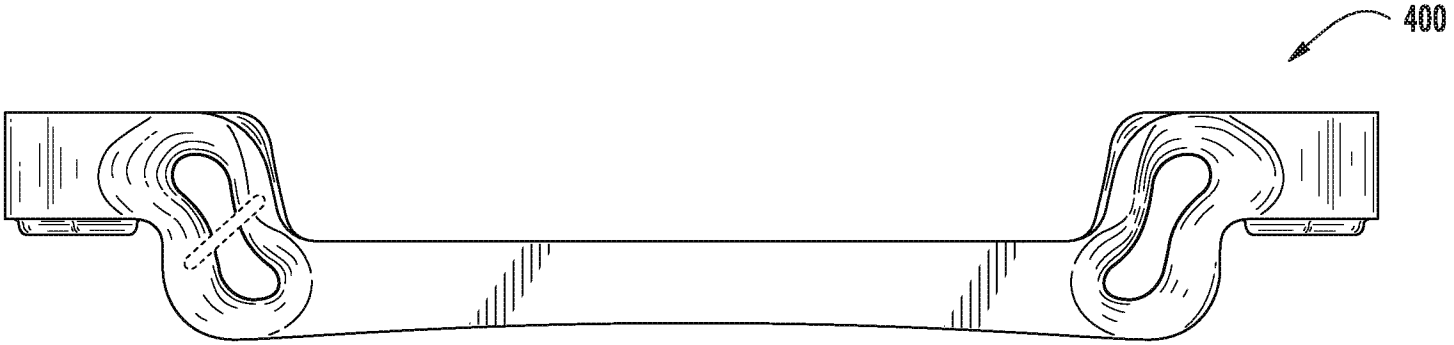
FIG. 40 is a front view of the adapter pad of FIG. 37.
Figure 41:
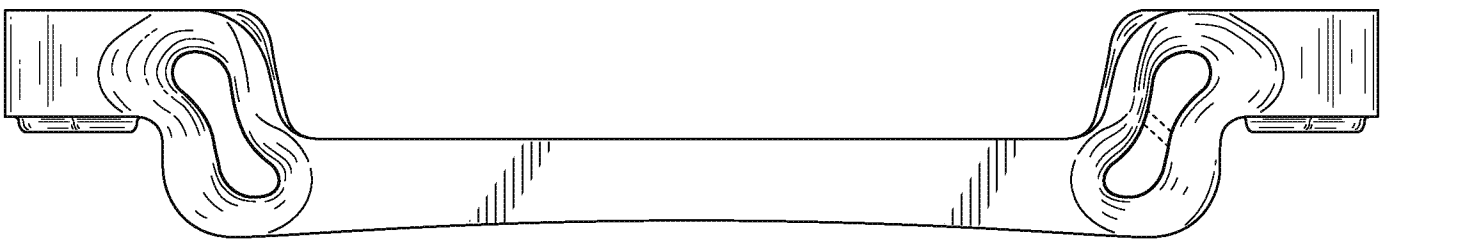
FIG. 41 is a back view of the adapter pad of FIG. 37.
Figure 42:
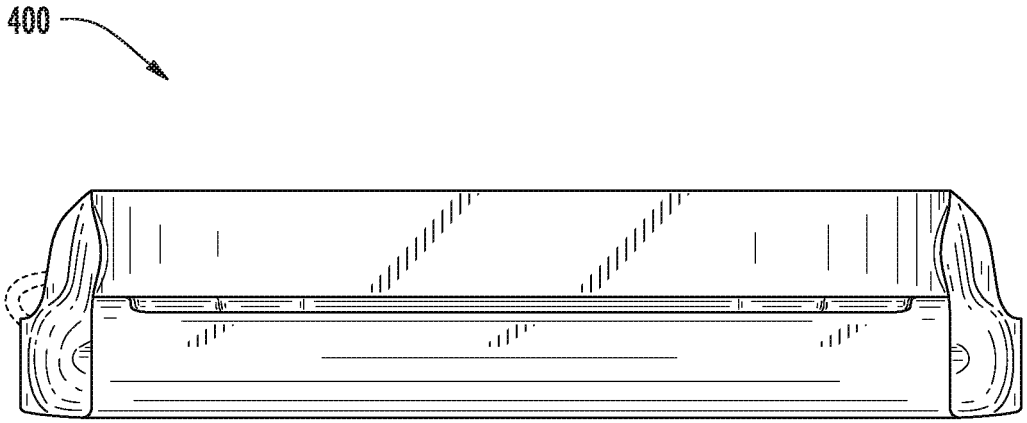
FIG. 42 is a side view of the adapter pad of FIG. 37.
Figure 43:
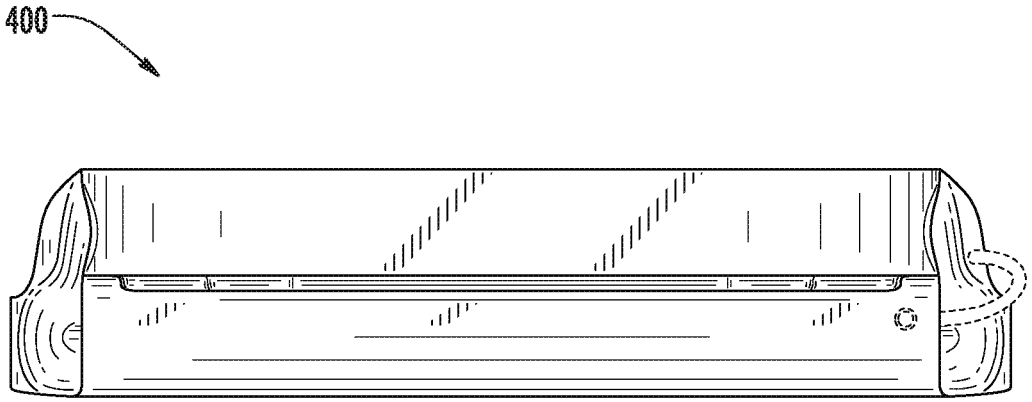
FIG. 43 is a side view of the adapter pad of FIG. 37.
Figure 44:
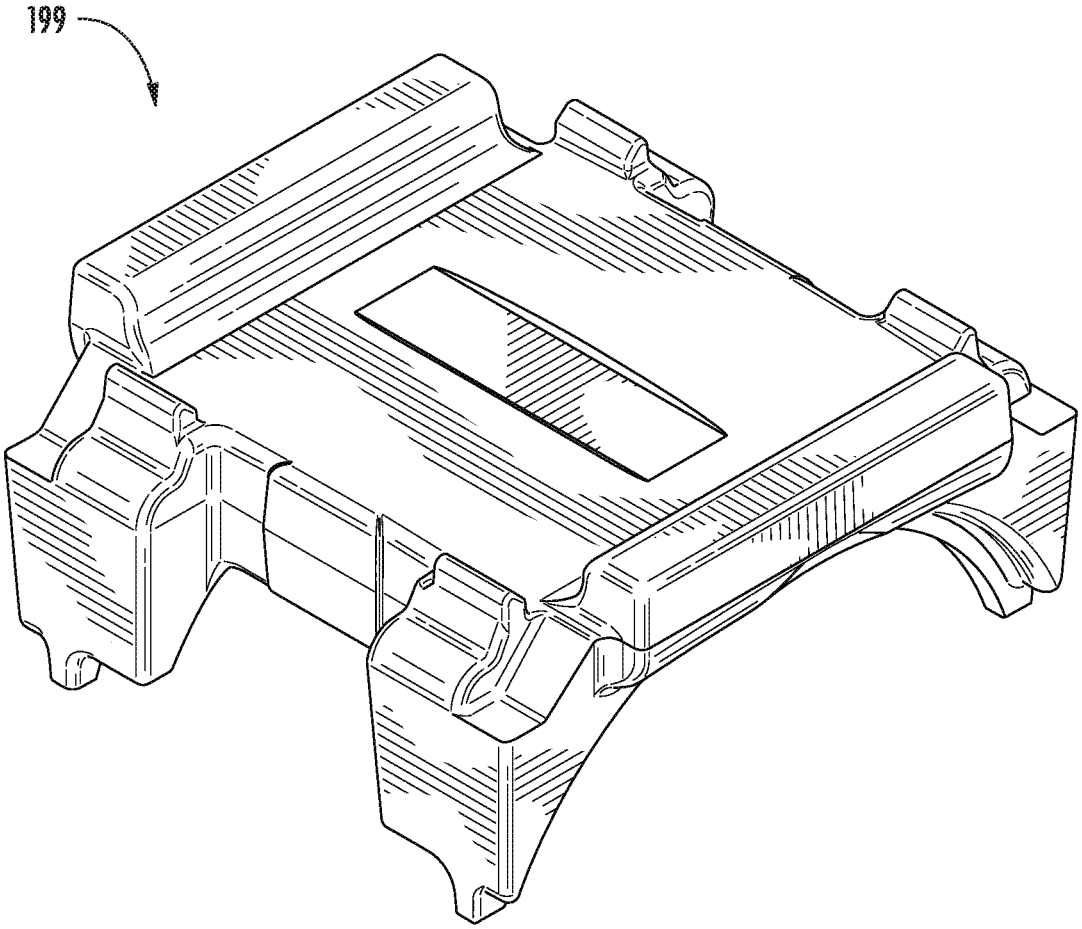
FIG. 44 is a perspective view of an adapter according to aspects of the disclosure.
Figure 45:
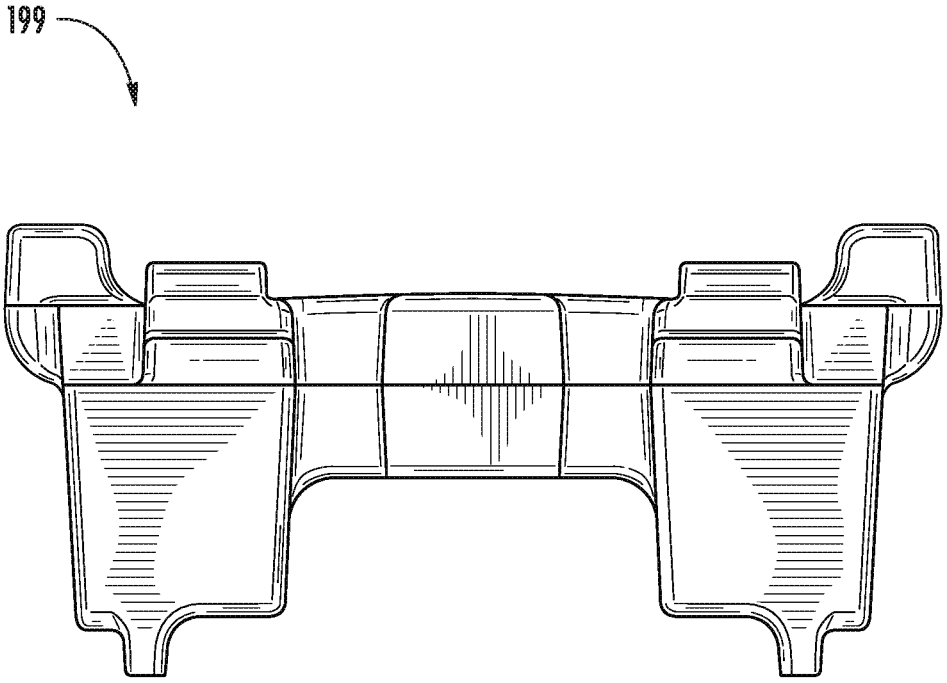
FIG. 45 is a front view of the adapter pad of FIG. 44.
Figure 46:
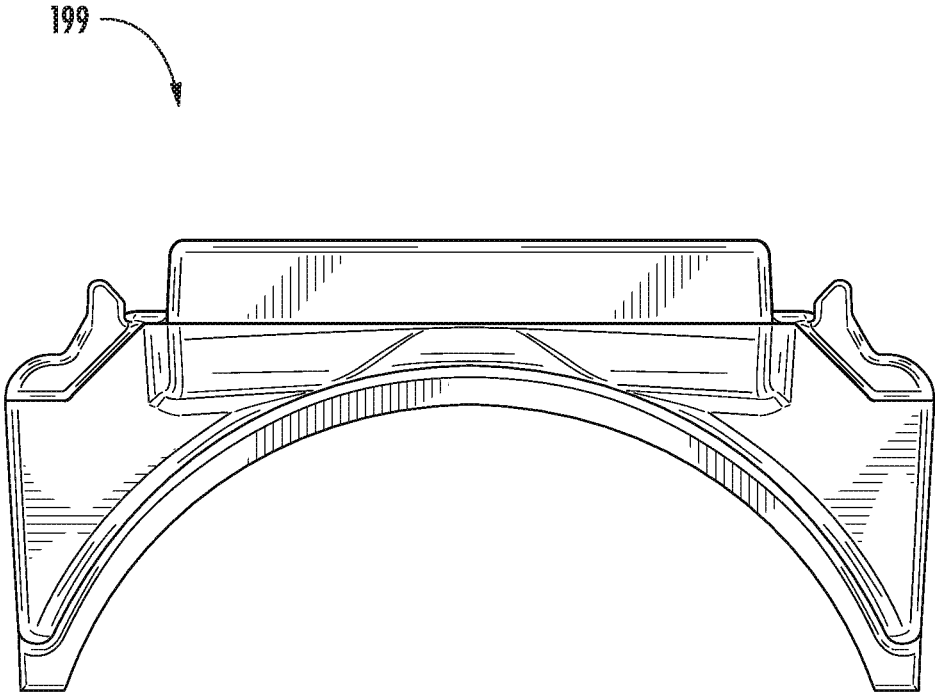
FIG. 46 is a side view of the adapter pad of FIG. 44.
Figure 47:
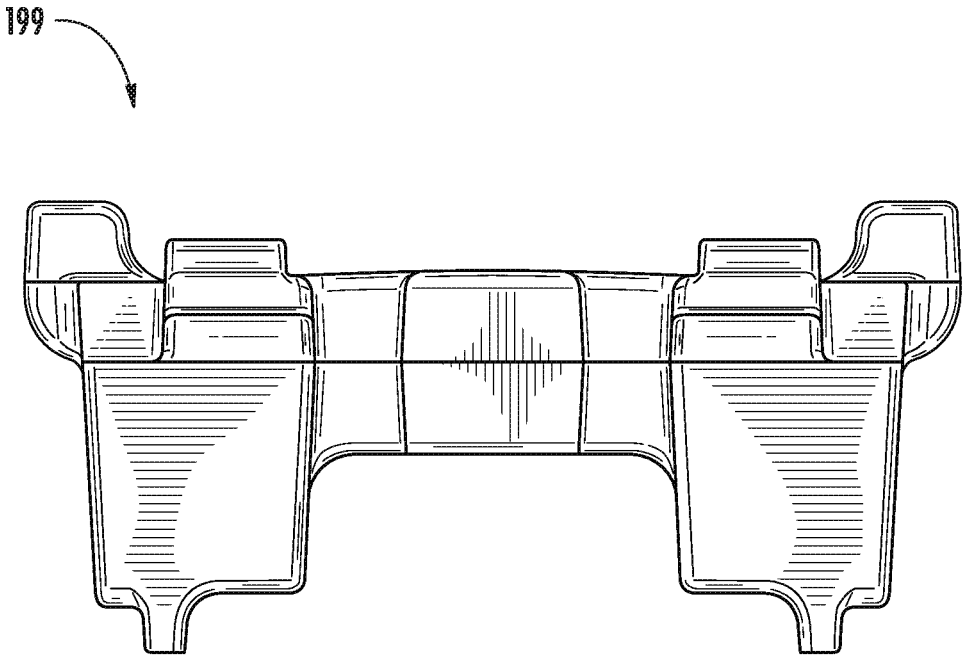
FIG. 47 is a back view of the adapter pad of FIG. 44.
Figure 48:
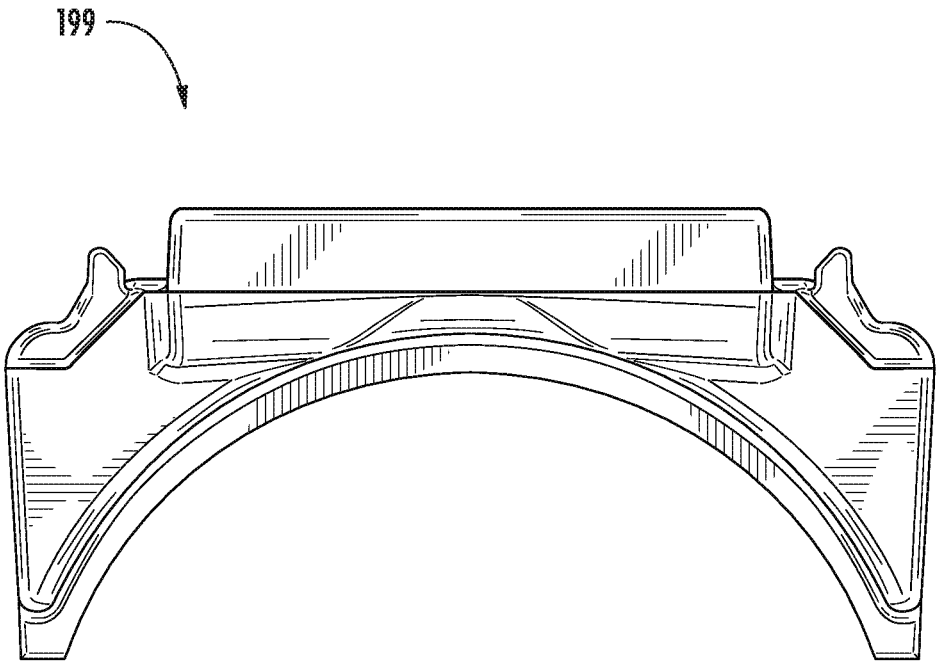
FIG. 48 is a side view of the adapter pad of FIG. 44.
Figure 49:
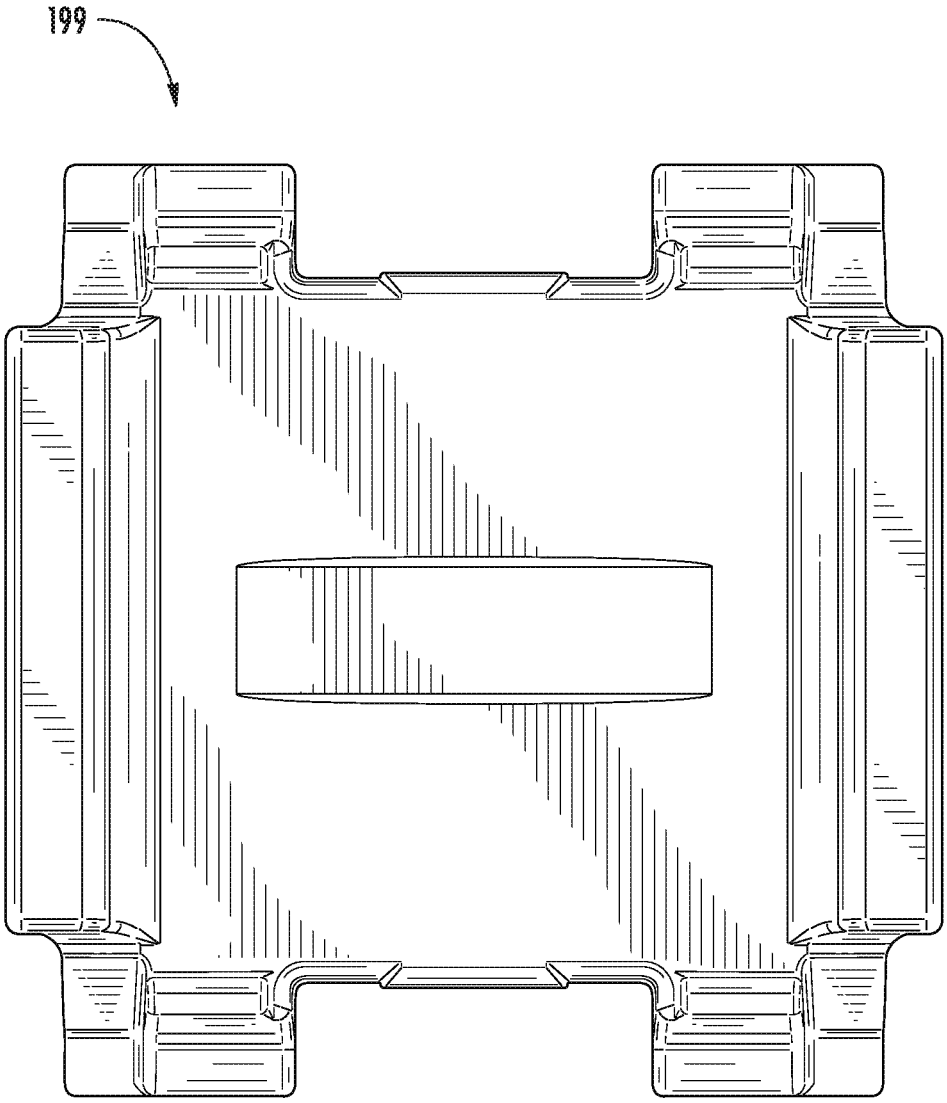
FIG. 49 is a top view of the adapter pad of FIG. 44.
Figure 50:
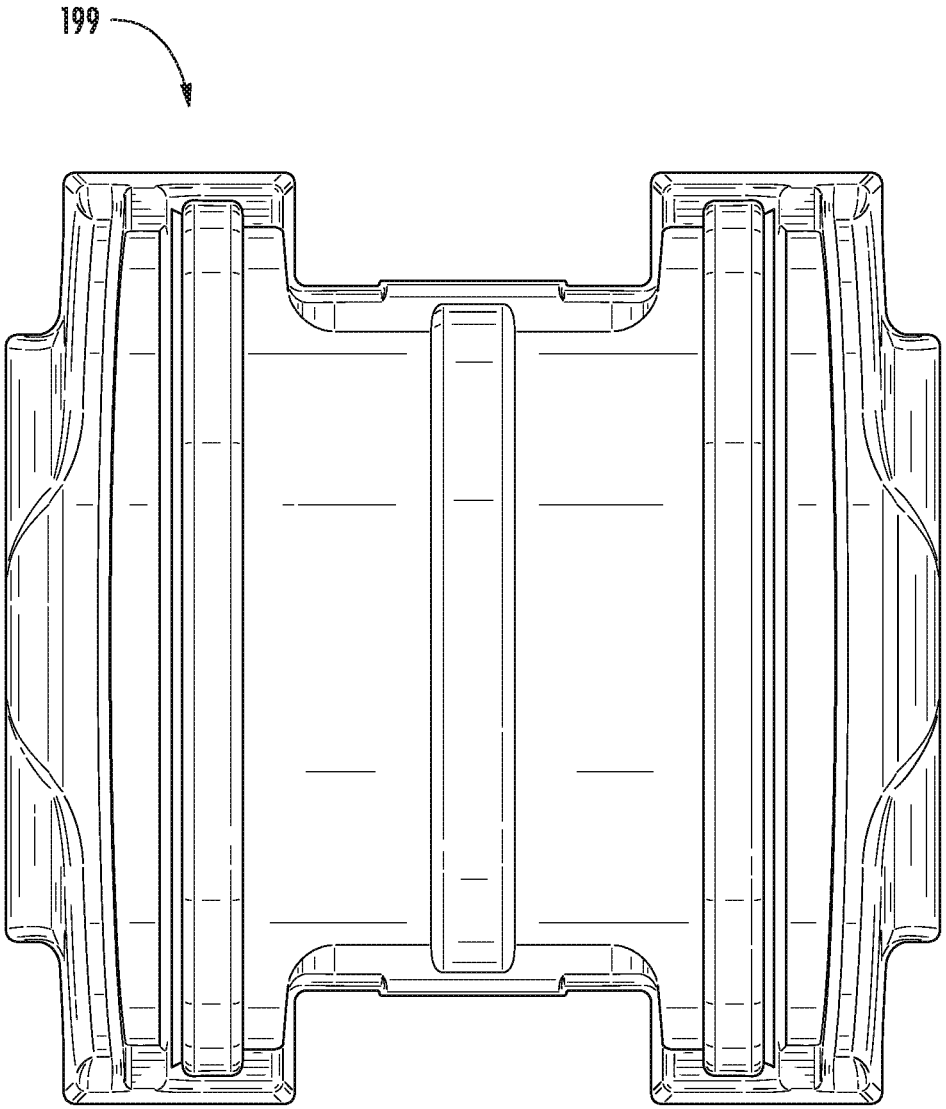
FIG. 50 is a bottom view of the adapter pad of FIG. 44.
Figure 51:
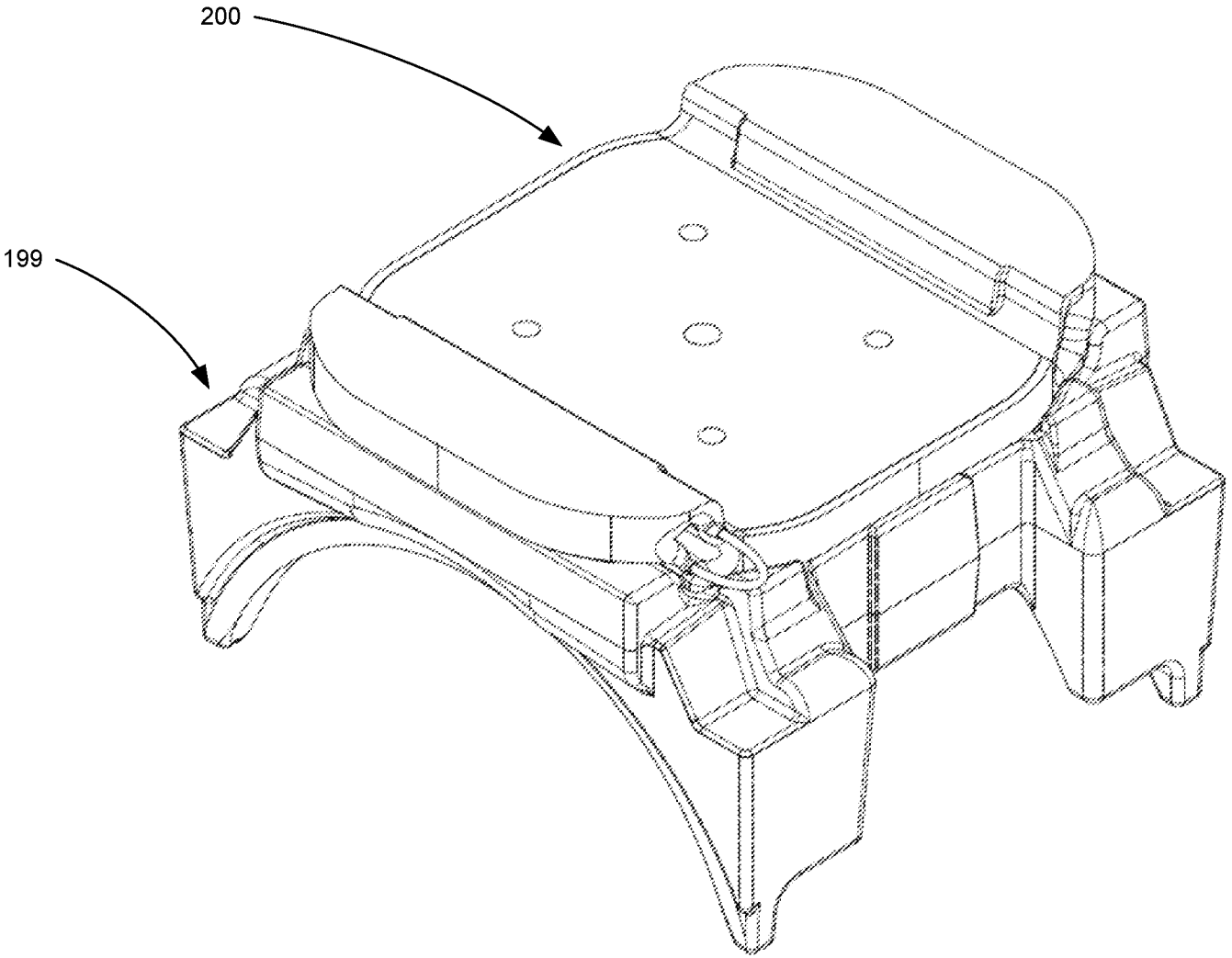
FIG. 51 is a perspective view of an adapter pad and roller bearing adapter according to aspects of the disclosure
Figure 52:
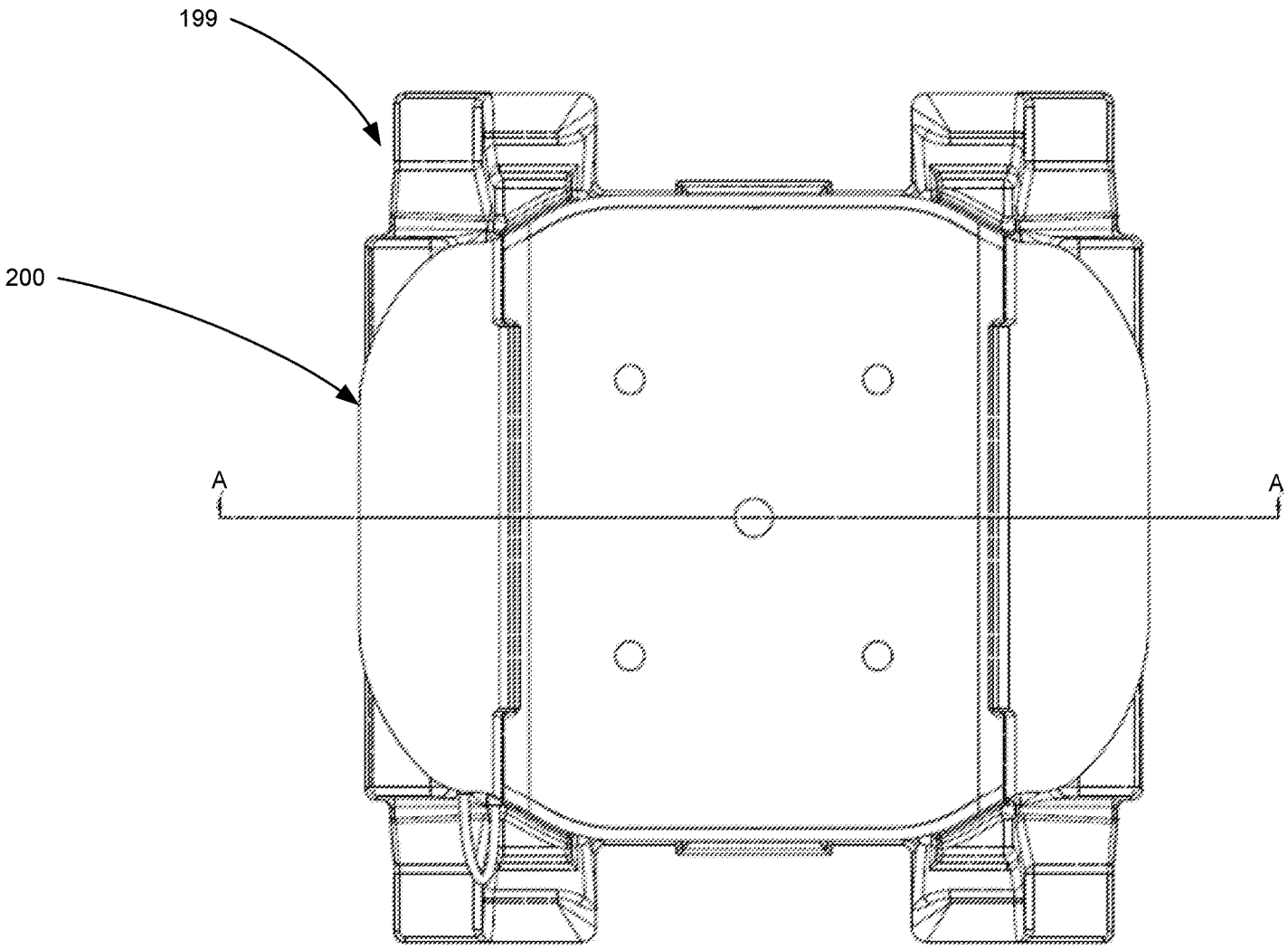
FIG. 52 is a top view of an adapter pad and roller bearing adapter according to aspects of the disclosure.
Figure 53:
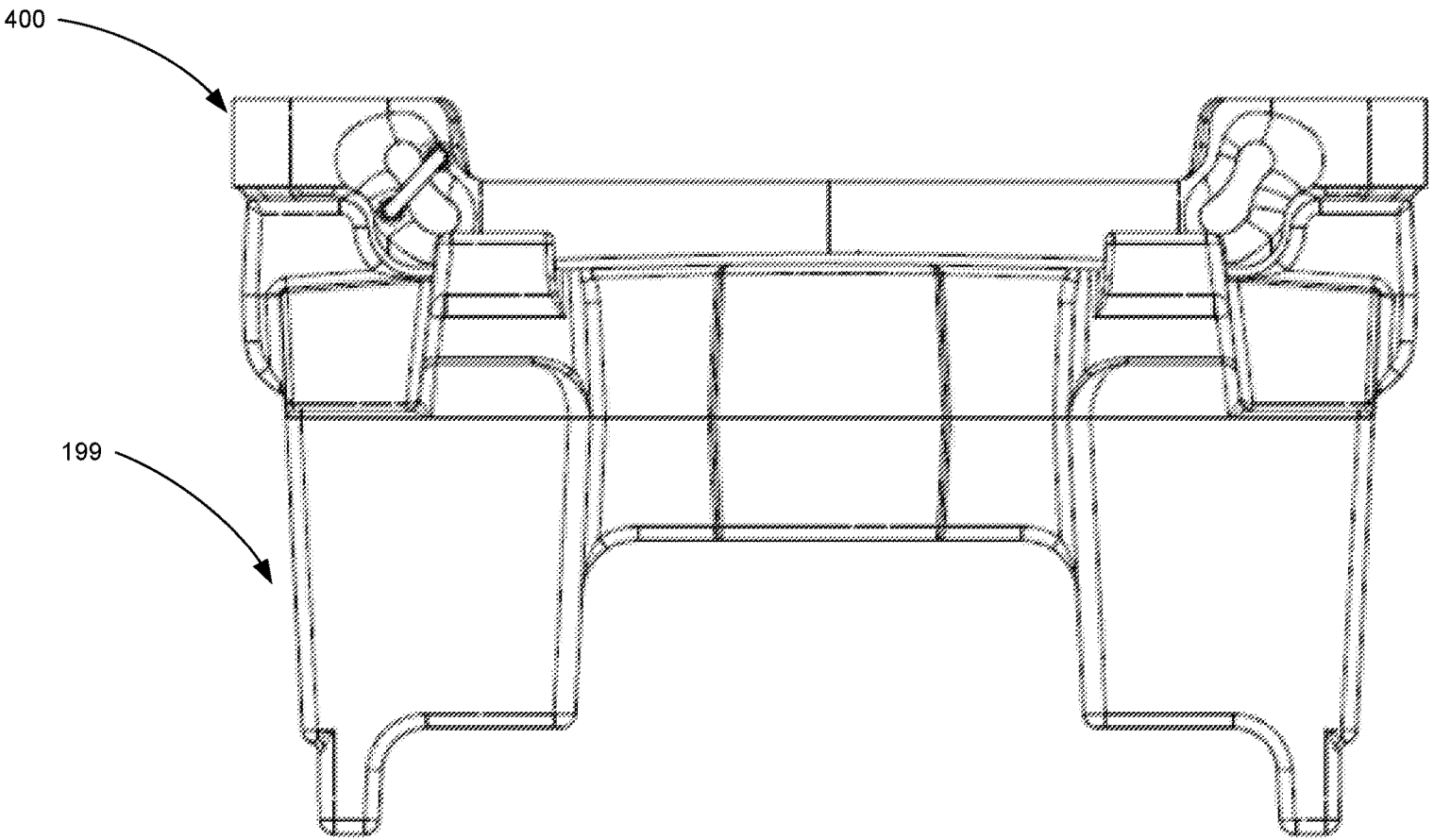
FIG. 53 is a side view of an adapter pad and roller bearing adapter according to aspects of the disclosure.
Figure 54:
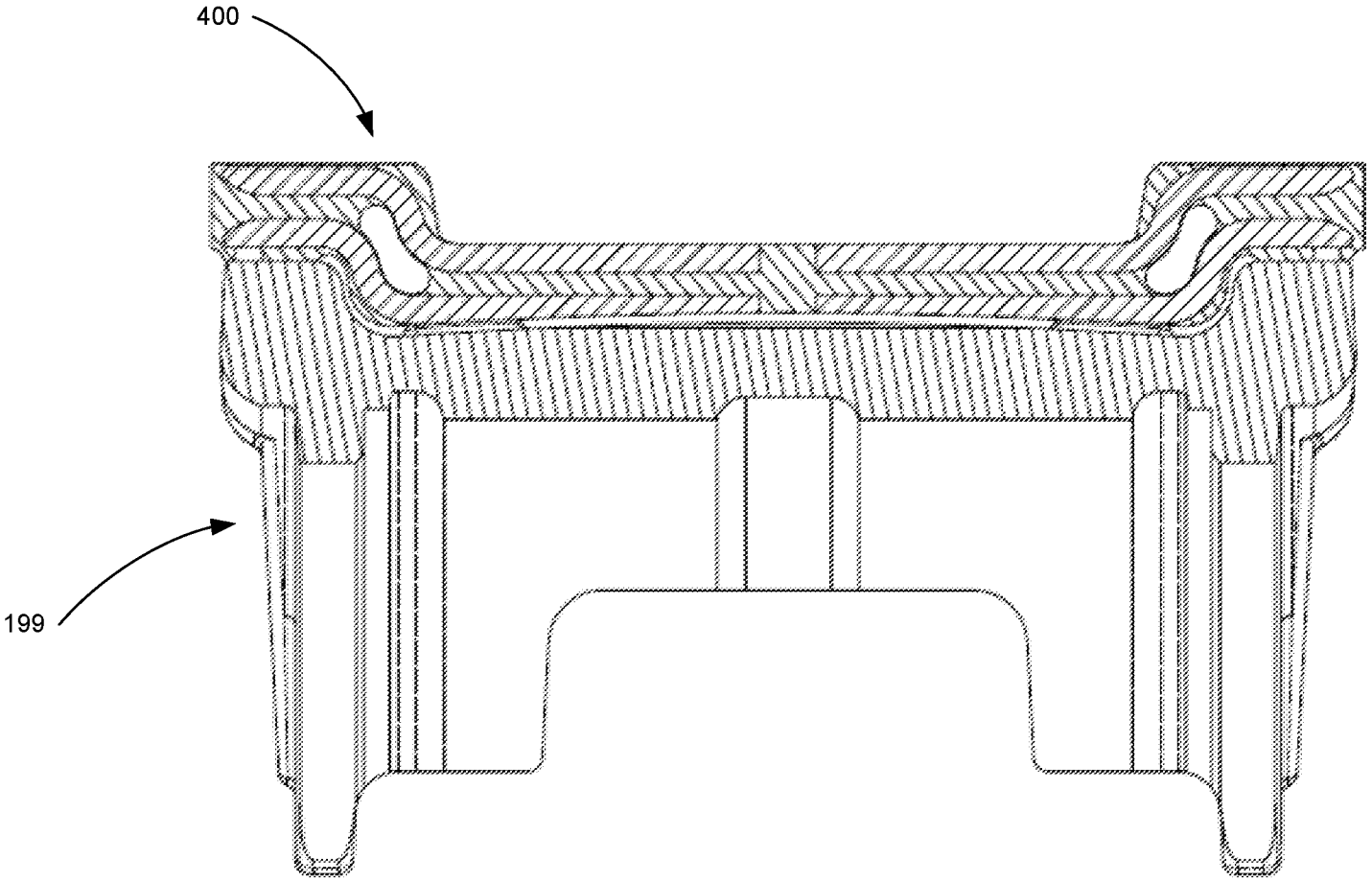
FIG. 54 is a side cross-sectional view of an adapter pad and roller bearing adapter taken along the line A-A in FIG. 52 according to aspects of the disclosure.
Figure 55:
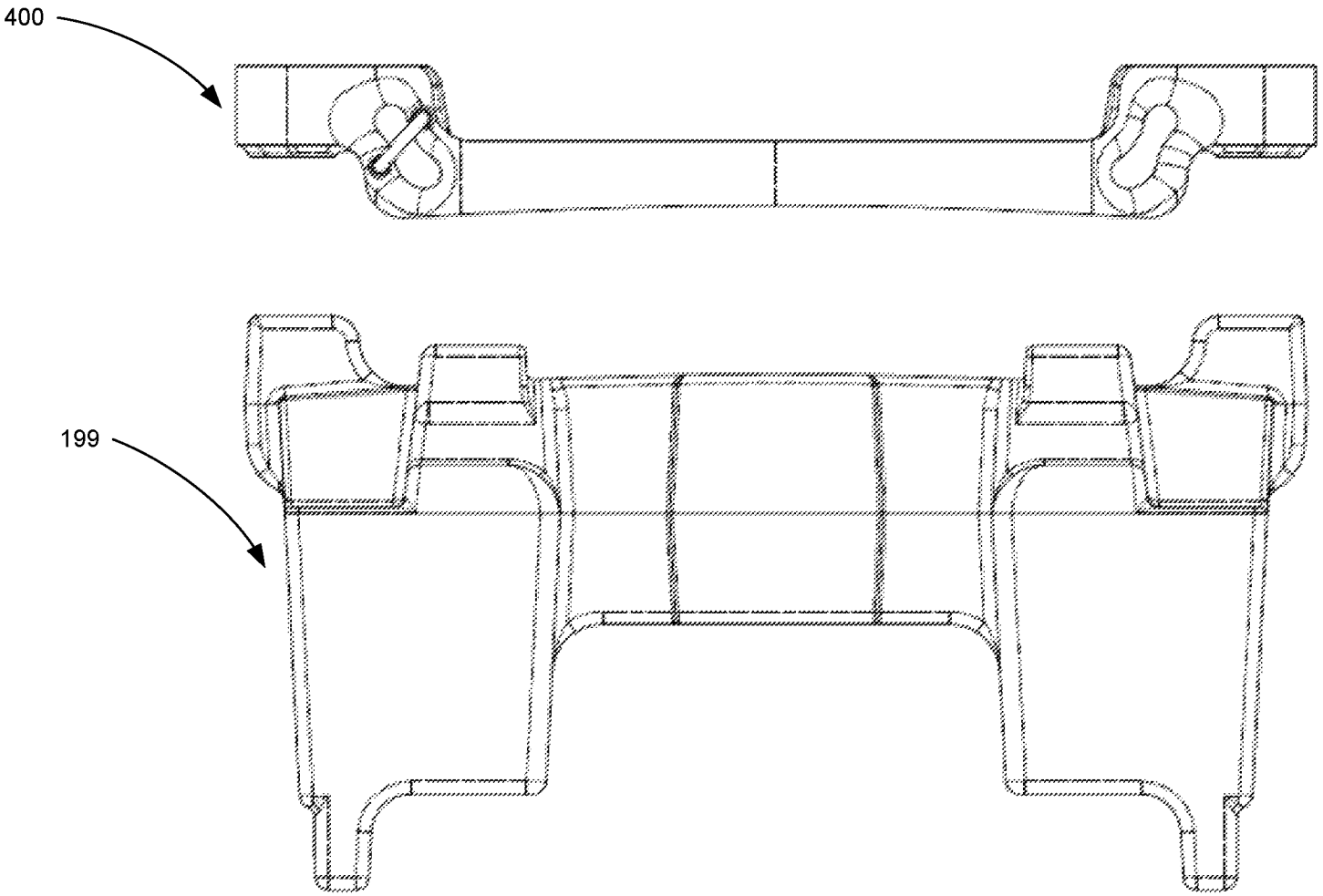
FIG. 55 is an exploded side view of an adapter pad and roller bearing adapter according to aspects of the disclosure.
Figure 56:
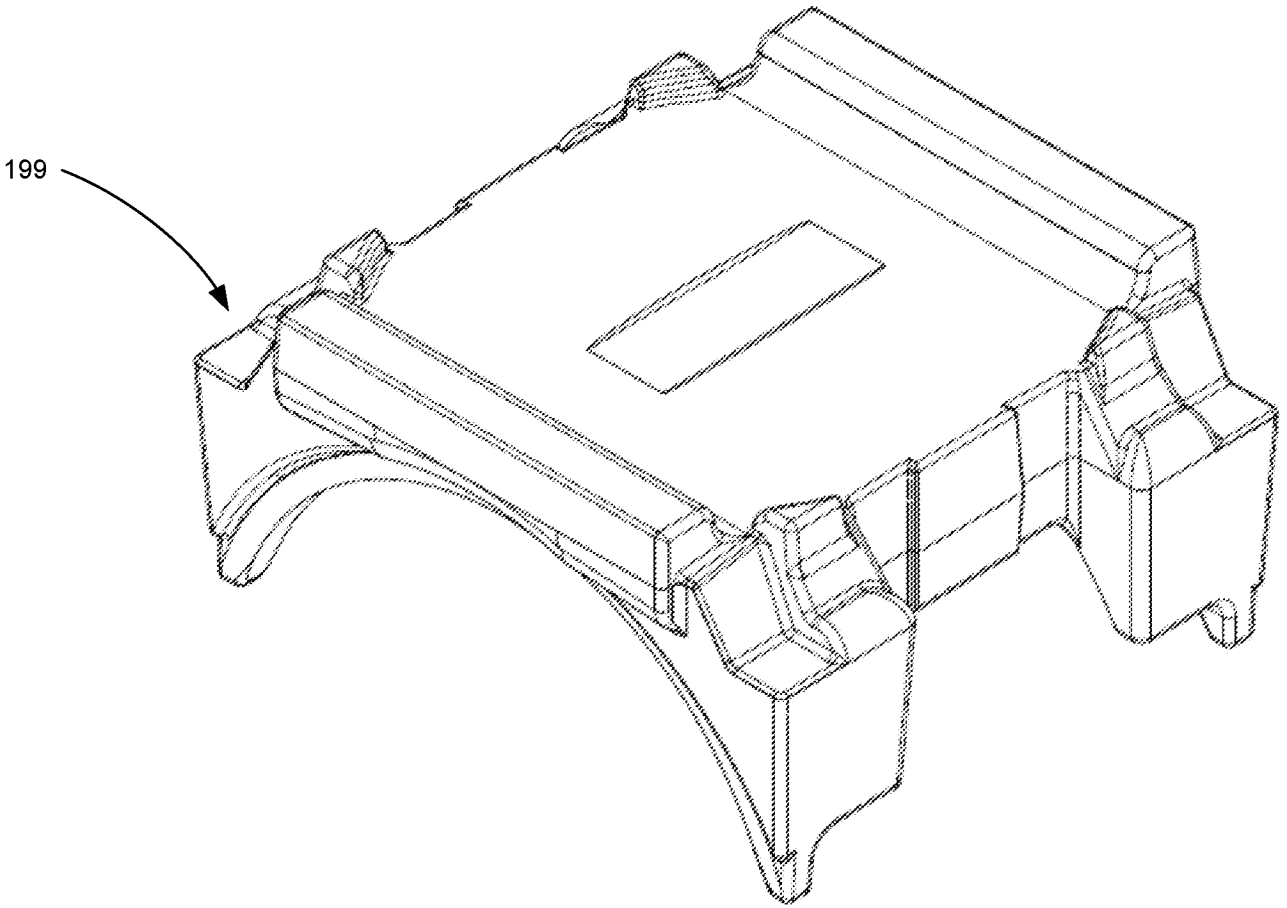
FIG. 56 is a perspective view of a roller bearing adapter according to aspects of the disclosure.
Figure 57:
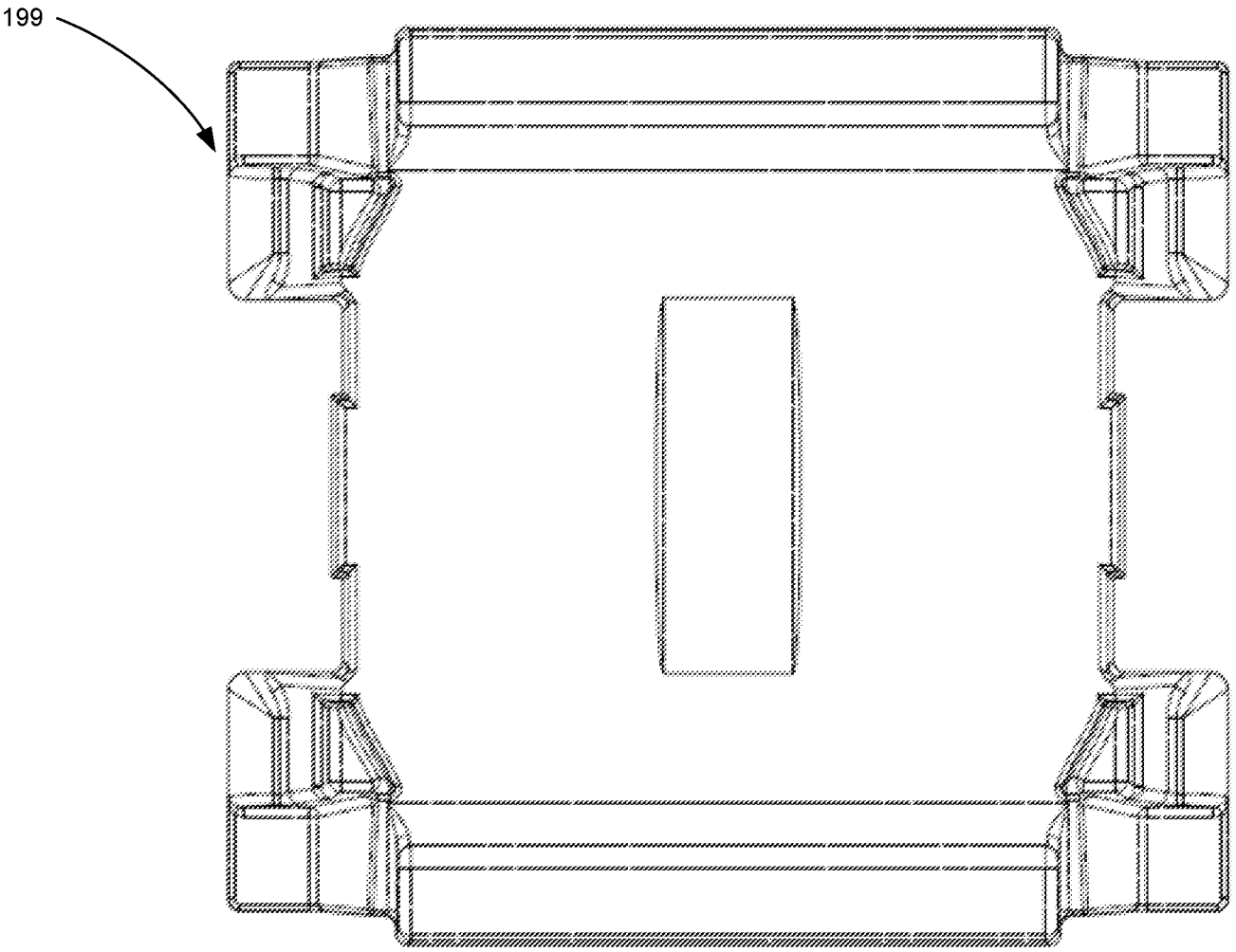
FIG. 57 is a top view of a roller bearing adapter according to aspects of the disclosure.
Figure 58:
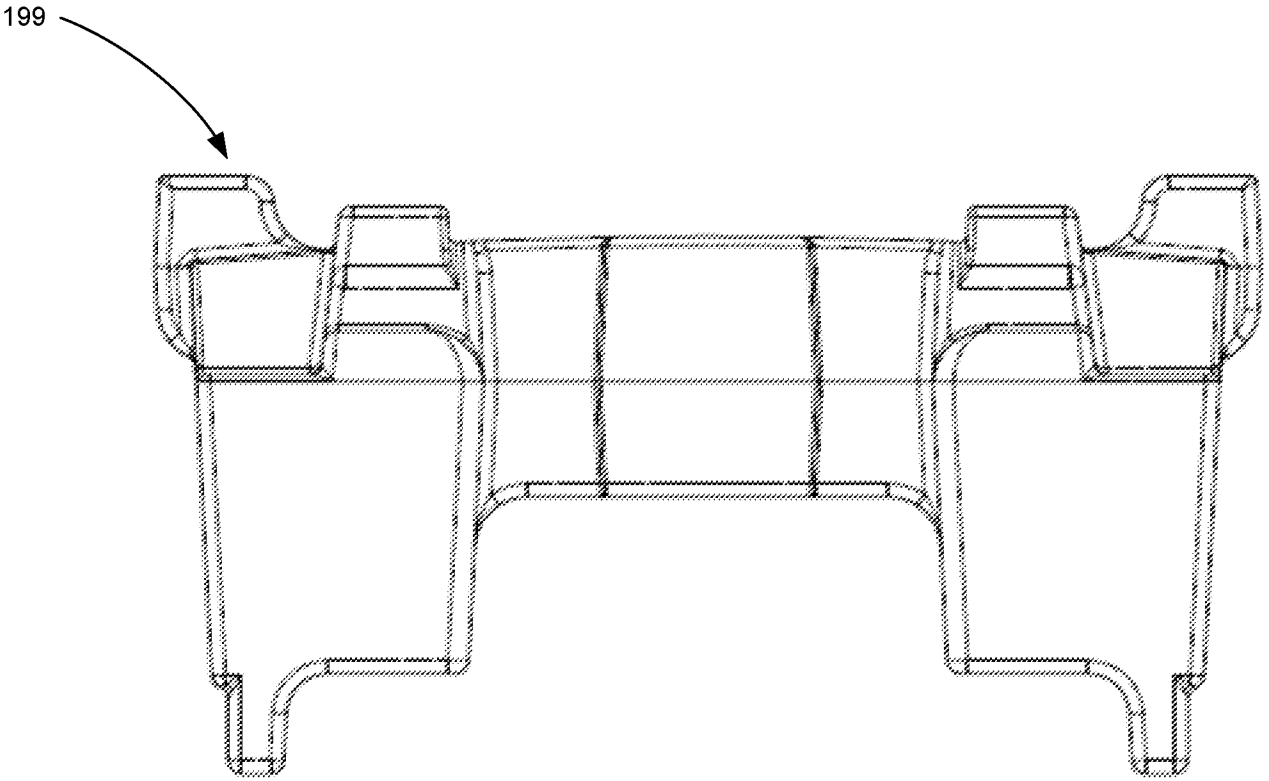
FIG. 58 is a side view of a roller bearing adapter according to aspects of the disclosure.
Figure 59:
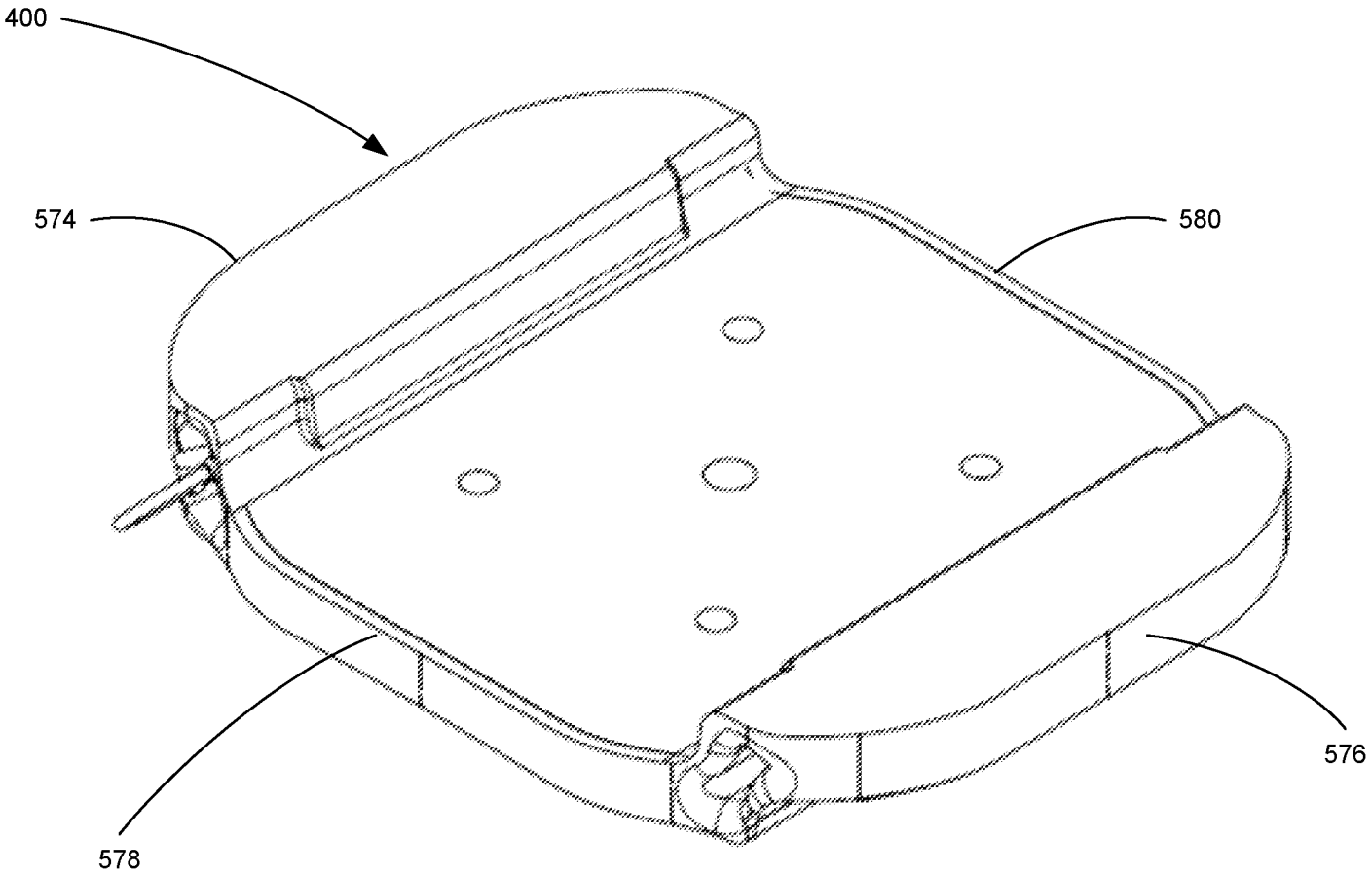
FIG. 59 is a perspective view of an adapter pad according to aspects of the disclosure.
Figure 60:
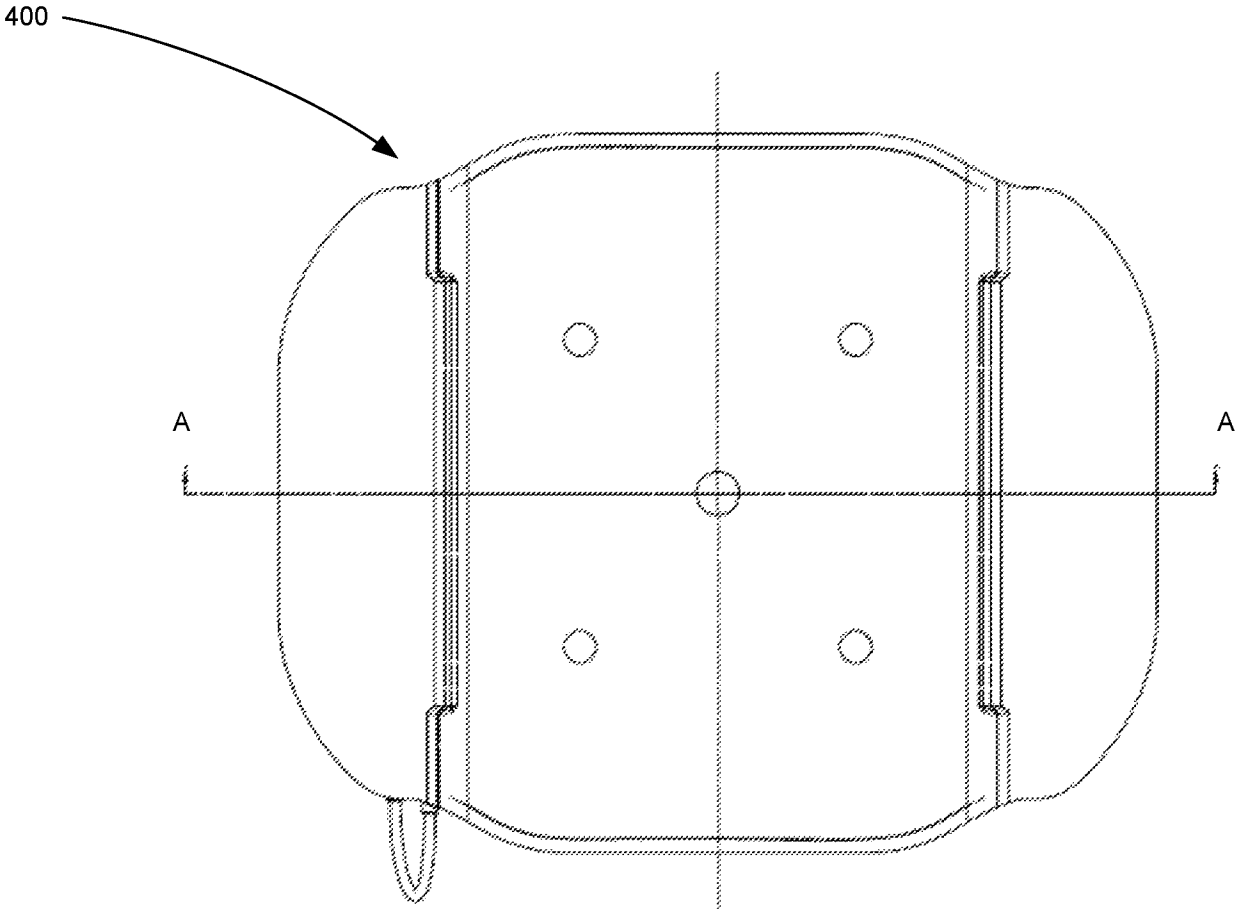
FIG. 60 is a top view of an adapter pad according to aspects of the disclosure.
Figure 61:
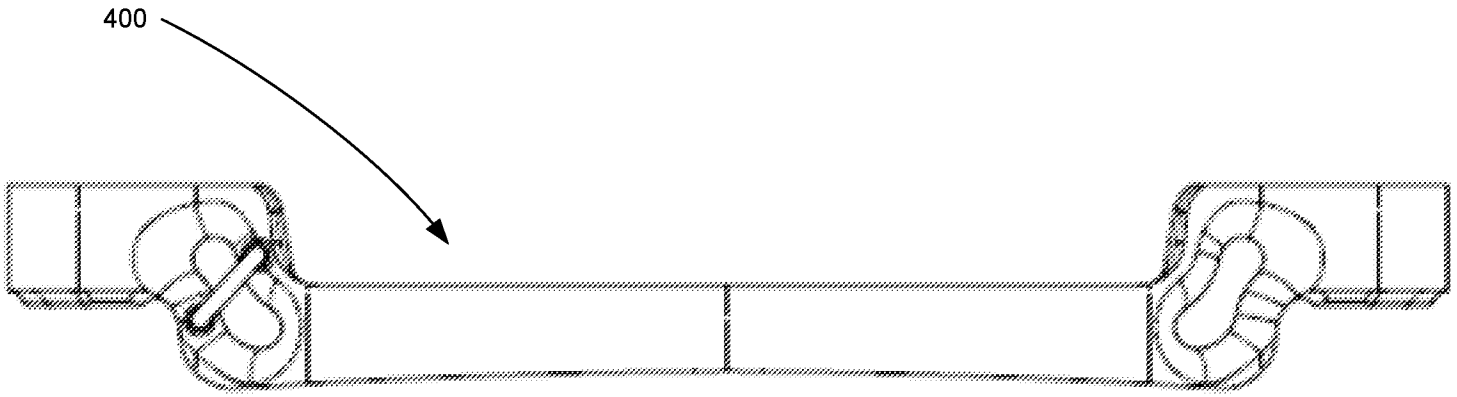
FIG. 61 is a side view of an adapter pad according to aspects of the disclosure.
Figure 62A:
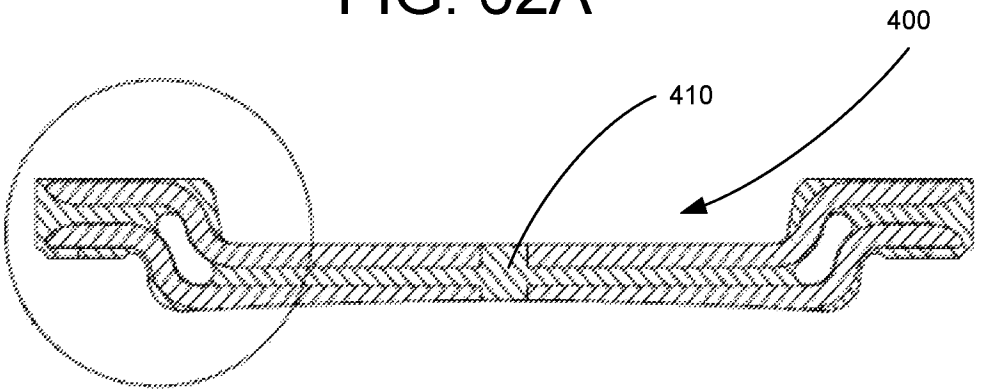
FIG. 62A is a side cross-sectional view of an adapter pad taken along line A-A in FIG. 60 according to aspects of the disclosure.
Figure 62B:
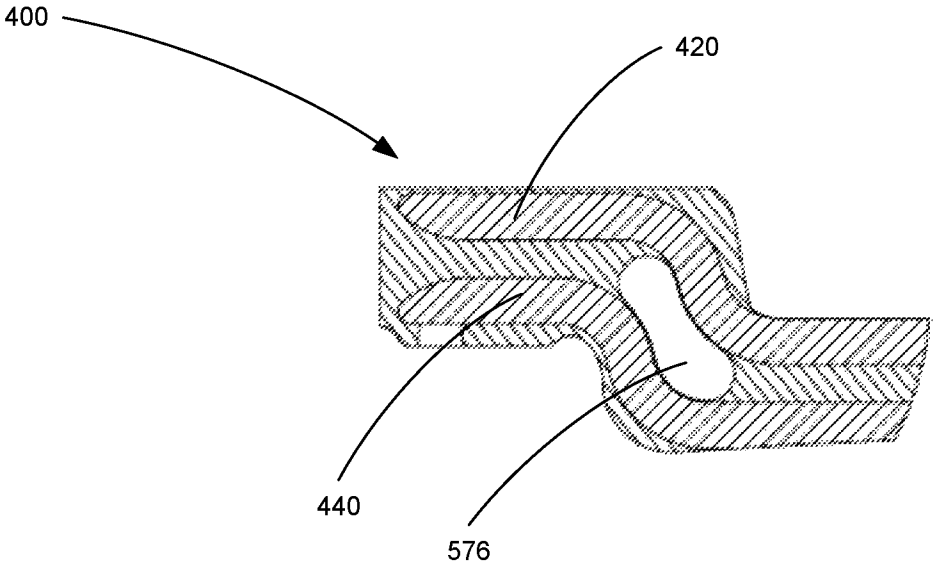
FIG. 62B is a detailed view of a portion of the adapter pad of FIG. 62A to aspects of the disclosure.

35*b* depict simulations of longitudinal displacement of the top plate 420 relative to the bottom plate 440 of 0.234 inches. As shown in FIGS. 35*a* and 35*b* the strain is lower in the lateral flanges 416, 418 than it is in the center section 410. In some embodiments, this can improve the life of an adapter pad. Additionally, as shown in FIGS. 35*a* and 35*b*, the highest strain values occur inward of the outer edges of the elastomeric section.

Additionally, in some embodiments, the shear strain of adapter pad 400 does not exceed 100% under maximum displacement conditions. For example, the lateral strain can be about 74% or under 80%, or under 90% for a lateral displacement of 0.234 inches. This may be about 45% less strain than existing adapter pad systems for a lateral displacement of 0.234 inches. Additionally, for example, the longitudinal strain can be about 72% or under 80%, or under 90% for a longitudinal displacement of 0.139 inches. This may be about 30% less strain than existing adapter pad systems for a longitudinal displacement of 0.139 inches.

Exemplary dimensions of the adapter pad 400 are shown and described in this application; however, other dimensions may be used for portions of the adapter pad, depending upon the fixed dimensions of the side frame and the bearings used with the particular railcar truck system.

125-Ton Adapter Pad System

As described above rail car types and services native to the North American Rail Industry require different truck sizes. While the adapter pad systems described throughout this document may be used with any size railcar, certain design changes may be advantageous for certain size railcars. Described below are aspects of adapter pad systems that may be advantageously used with rail cars designed for 125 ton service and/or services with Gross Rail Load greater than 286,000 lbs. In particular, these adapter pad systems can be targeted for use on cars which utilize articulated connectors at truck locations, thereby sharing the truck between two car bodies. These articulated truck locations typically utilize 4 truck side bearings and plastic centerbowl liners, which differ from conventional truck systems.

As described above, embodiments of the adapter pad system described herein provide a thrust lug opening width and spacing sufficient to not limit displacement within the AAR values, even with the use of high stiffness shear pads as described herein. The disclosed adapter design which may be optimized for 125 ton service may utilize target adapter displacements shown in Table 4 below.

TABLE 4

AAR ADAPTER TO SIDE FRAME CLEARANCE STACKUP NEW COMPONENTS

| Features | Maximun | Minimun |
|---|---|---|
| Longitudinal Clearance (Each direction from center: in.) | .139 | .017 |
| Lateral Clearance (Each direction from center: in.) | .279 | .126 |
| Rotataional Clearance (Each direction from center: mRad.) | 54.4 | 25.3 |

Additionally, adapter pad systems which may be optimized for 125 ton service disclosed herein may have a total height measured between an upper surface of the roller bearing 5 and the pedestal roof 152 of about 1.5 inches or in the range of about 1.15 inches to about 1.8 inches and may not require the use of a special side frame. Additional possible dimensions of the adapter pad system which may be optimized for 125 ton service are shown in table 5 below.

While this embodiment is specific to the 125 T truck, the disclosed adapter and matching adapter pad system can be scalable for use with and improve the performance of trucks for all car capacities (70 ton, 100 ton, 110 ton, and 125 ton), including those trucks that do not require compliance with the M-976 standard.

TABLE 5

125T Adapter/Pad Thickness

| Adapter Thickness | Adapter Pad Thickness | Total Thickness |
|---|---|---|
| 1.00" +/− 0.1 | 0.60" +/− 0.06 | 1.60" +/− 0.16 |
| 0.80" +/− 0.08 | 0.80" +/− 0.08 | 1.60" +/− 0.16 |
| 1.20" +/− 0.12 | 0.40" +/− 0.04 | 1.60" +/− 0.16 |
| 0.84" +/− 0.084 | 0.61" +/− 0.061 | 1.45" +/− 0.16 |

Additionally, using the above described test methods, exemplary measurements and testing results of embodiments which may be optimized for 125 ton service disclosed herein are shown below in Table 6 below. It is understood that these embodiments are examples, and that other structural embodiments with other testing results can exist.

TABLE 6

| | Embodiments Described Herein |
|---|---|
| Elastomer Normal Area ($in^2$) | 68.3 $in^2$ or about 60 $in^2$ to about 100 $in^2$ |
| Elastomer Normal Area Outside of Pedestal Roof Contact ($in^2$) | 16.9 $in^2$ or about 5 $in^2$ to about 30 $in^2$ |
| Pad Elastomer Shear Width (Lateral Length) (in) | 10.2 in or about 6 $in^2$ to about 14 $in^2$ |
| Pad Elastomer Shear Length (Longitudinal Length) (in) | 8.3 in or about 6 $in^2$ to about 10 $in^2$ |
| Lateral Stiffness (tested at 3 hz cycling frequency and 35 kip vertical load) | 60 kips/in or about 45 kips/into about 80 kips/in or at least 45 kips/in |
| Longitudinal Stiffness (tested at 3 hz cycling frequency and 35 kip vertical load) | 64 kips/in or about 45 kips/into about 80 kips/in or at least 45 kips/in |
| Rotational Stiffness (tested at 3 hz cycling frequency and 35 kip vertical load) | 670 kip*in/mRad or about 250 kip*in/mRad to about 840 kip*in/mRad or at least 250 kip*in/mRad |
| Vertical Stiffness | at least 5,000 kips/in |
| Lateral Hysteresis (tested at 3 hz cycling frequency and 35 kip vertical load) | 5000 lbs. or about 3750 lbs. to about 6250 lbs. or less than 6000 lbs. |
| Longitudinal Hysteresis (tested at 3 hz cycling frequency and 35 kip vertical load) | 500 lbs. or about 375 lbs. to about 1500 lbs. or less than 1500 lbs. |
| Rotational Hysteresis (tested at 3 hz cycling frequency and 35 kip vertical load) | 12000 lbs.*in or about 9000 lbs.*in to about 16000 lbs.*in or less than 16000 lbs.*in |
| Center Elastomer Layer Shear Perimeter | 27.5 in. or about 25 in. to about 35 in. |
| Outer Elastomer Layer Shear Perimeter | 15 in. each or about 10 to 25 in. each |
| Composite Elastomer Layer Shear Perimeter | 57.5 in. or about 50 in. to 80 in. |

TABLE 6-continued

| | Embodiments Described Herein |
|---|---|
| Center Elastomer Layer Shape Factor | 6.2 or about 6 to 10 |
| Outer Elastomer Layer Shape Factor | 1.2 each or about .5 to 3 each |
| Composite Shape Factor | 3.0 or about 2.5 to about 7 |

In certain embodiments, including those which may be optimized for 125 ton service, it may be advantageous to increase the stiffness of the adapter pad system. An additional embodiment of an adapter pad system (including an adapter pad and a roller bearing adapter) which may be optimized for 125 ton service is shown in FIGS. 51-62B. The embodiment of the adapter pad system shown in FIGS. 51-62B includes an adapter pad 400 and roller bearing adapter 199 which are similar to embodiments described above and therefore descriptions of similar parts are not repeated with respect to the embodiment shown in FIGS. 51-62B. As described above, the adapter pad system 198 may include an adapter pad and a roller bearing adapter 199. The system is configured to be disposed between a roller bearing and a side frame pedestal roof of a side frame.

Generally, the adapter pad system including the adapter pad 400 and the roller bearing adapter 199 shown in FIGS. 51-62B has a greater ratio of lateral length to longitudinal length than the adapter pad shown in FIGS. 28-43. For example the adapter pad 40 shown in FIGS. 51-62B may have an overall longitudinal length of about 7.5 inches to about 9.5 inches, and and an overall lateral length of about 9 inches to about 11 inches; and in some embodiments the adapter pad 400 may have an overall longitudinal length of about 8.31 inches and an overall an overall lateral length of about 10.16 inches. Additionally, the adapter pad 400 and roller bearing adapter 199 shown in FIGS. 51-62B may have other dimensional differences than the adapter pad 400 and roller bearing adapter 199 described above. For example, the thickness of the center portion of the roller bearing adapter 199 can be less than 0.95 inches, or in the range of about 0.75 to about 0.95 inches, as measured at the longitudinal centerline from a bearing surface to a pedestal crown surface of the adapter 199. The roller bearing adapter 199 shown in FIGS. 51-62B can have a cross-sectional moment of inertia of a cross-section at the longitudinal centerline of the roller bearing adapter around a lateral axis about 5.9 inches above a center axis of an axle that is about 1.1 $in^4$, or in the range of about 1.0 to about 2.0 $in^4$. The lateral axis can be between about 5.5 inches and 6.5 inches from the center axis of the axle. The roller bearing adapter can have a cross-sectional moment of inertia of a cross-section at the longitudinal centerline of the roller bearing adapter around a vertical axis at the center of the adapter that can be about can be about 90.5 $in^4$, or in the range of about 75 to about 125 $in^4$.

EXAMPLES

In one example an adapter pad system configured to be disposed between a wheelset roller bearing and side frame pedestal roof of a railcar truck is disclosed. The adapter pad system can include a roller bearing adapter having first and second vertical shoulders that project upward from a top surface of the adapter. The adapter pad system can also include an adapter pad configured to interface with the roller bearing adapter with a top plate having inner and outer surfaces, a central portion, first and second upturned regions projecting upward from opposite edges of the central portion, a first lateral flange projecting outward from the first upturned region, and a second lateral flange projecting outward from the second upturned region; a bottom plate having inner and outer surfaces, a central portion, first and second upturned regions projecting upward from opposite edges of the central portion, a first lateral flange projecting outward from the first upturned region, and a second lateral flange projecting outward from the second upturned region. The first and second laterally projecting flanges of the top plate and the bottom plate of the adapter pad system can be disposed above the vertical shoulders of the roller bearing adapter.

The roller bearing adapter of the adapter pad system can be cast or forged. The adapter pad can be engaged with the side frame and engaged with the roller bearing adapter. The top plate of the adapter pad can be engaged with the side frame such that movement between the top plate and the side frame is restricted. The bottom plate of the adapter pad can be engaged with the roller bearing adapter such that movement between the bottom plate and the roller bearing adapter is restricted. The roller bearing adapter can include longitudinal stops configured to restrict longitudinal movement of the bottom plate with respect to the roller bearing adapter. The vertical shoulders can be configured to restrict lateral movement of the bottom plate with respect to the roller bearing adapter. The roller bearing adapter top surface can include a crowned surface. The longitudinal stops and vertical shoulders can be configured to restrict rotational movement of the bottom plate with respect to the roller bearing adapter. The roller bearing adapter can be symmetrical about a lateral centerline. The roller bearing adapter can be symmetrical about a longitudinal centerline. The top plate of the roller bearing adapter can be continuous. The bottom plate of the roller bearing adapter can be continuous.

The adapter pad system can include an elastomeric member disposed between the inner surfaces of the top plate and the bottom plate. The elastomeric member disposed between the top plate and the bottom plate can be a plurality of elastomeric members. The plurality of elastomeric members can include a first outer elastomeric member disposed between the first lateral flanges of the top and bottom plates, a second outer elastomeric member disposed between the second lateral flanges of the top and bottom plates, and a central elastomeric member disposed between the central portion of the top and bottom plates. A first hollow portion can be disposed between the central elastomeric member and the first outer elastomeric member and a second hollow portion can be disposed between the central elastomeric member and the second outer elastomeric member. The first and second hollow portions can be about 0.25 inches wide. The first and second hollow portions can be configured to limit bending stresses in the top and bottom plates. The outer elastomeric members can be in compression. The thickness of the outer elastomeric members can be compressed at least 0.020 inches from a static state. The thickness of the outer elastomeric members can be compressed at least 7% from a static state. The first outer elastomeric member, second outer elastomeric member, and central elastomeric member can each be substantially planar and each can be substantially horizontal when the adapter pad is disposed below a side frame pedestal roof of a railcar truck. The elastomeric material can be positioned normal to the direction of lateral displacement to increase compression stiffness. The elastomeric material can be positioned normal to the direction of longitudinal displacement to increase compression stiffness. The elastomeric material can be positioned normal to the direction of rotational displacement to increase compression stiffness. The elastomeric material can be positioned normal to the direction of vertical displacement to increase compression stiffness.

The surface area of the first outer elastomeric member at a cross-sectional plane through the first outer elastomeric member centered between the inner surfaces the top and bottom plates can be greater than 2.5 square inches. The surface area of the second outer elastomeric member at a cross-sectional plane through second outer elastomeric member in a plane centered between the inner surfaces of the top and bottom plates can be greater than 2.5 square inches. The combined surface area of the first and second outer elastomeric members at cross-sectional planes through the first and second outer elastomeric members in planes centered between the inner surfaces of the top and bottom plates can be greater than 5 square inches. The combined surface area of the first and second outer elastomeric members at cross-sectional planes through the first and second outer elastomeric members in planes centered between the inner surfaces of the top and bottom plates can be at least 10 percent of the surface area of the central elastomeric member at a cross-section plane through the center of the central elastomeric member in a centered between the inner surfaces of the top and bottom plates.

The central elastomeric member can define a plurality of gaps that establish a plurality of discontinuities within the elastomeric member disposed between the central portion of the top plate and the central portion of the bottom plate. The plurality of gaps can be a thickness less than a total distance between the top plate and the bottom plate, with a portion of the elastomeric member being vertically disposed with respect to the one or more of the plurality of gaps and contacting one or both of the top and bottom plates.

The central elastomeric member can define an outer edge, wherein one or more portions of the outer edge is curved from a top view. At least a portion of the outer edge of the central elastomeric portion can define an internally recessed contour. The first and second outer elastomeric members can define an outer edge, wherein one or more portions of the outer edge is curved from a top view. One or more portions of outer edges of elastomeric members can include a continuous radius measured from a center point of the central portion of the top plate. Any edge of the elastomeric member can define an internally recessed contour.

One or both of the first and second outer elastomeric members can define an outer edge, wherein one or both of the first and second lateral flanges of the top and bottom plates extend outward past at least a portion of the outer edge within the respective first and second lateral flanges.

The adapter pad can include an elastomeric support disposed between the outer surfaces of the first and second lateral flanges of the bottom plate and the vertical shoulders of the roller bearing adapter.

At least a portion of an outer edge of the elastomeric members can define an internally recessed contour. The internally recessed contour can be defined by a first linear portion that extends from proximate to the inner surface of the top plate and a second linear portion that extends from proximate to the inner surface of the bottom plate. The first and second linear portions can be connected with a transition as it extends between the first and second linear portions. The first and second linear portions can each extend from the neighboring respective top or bottom plate at an angle within the range of about 25 degrees to about 35 degrees to a plane through the surface of the respective top or bottom plate from which the respective linear portion extends.

The first and second outer elastomeric members can be the same or greater thickness than the central elastomeric member. The thickness of the first and second outer elastomeric members can be within the range of about 0.15 inches to about 0.30 inches. The thickness of the central elastomeric member can be within the range of about 0.15 inches to about 0.25 inches. The thickness of the adapter pad can be within the range of about 0.4 inches to about 0.8 inches.

The adapter pad system can also include an elastomeric layer disposed above an outer surface of the top plate and/or can include an elastomeric layer disposed below an outer surface of the bottom plate. The elastomeric layer can cover all or portions of the outer surface of the adapter pad. The top and bottom plates of the adapter pad can be of non-uniform thickness. The top and bottom plates can be of uniform thickness. The top plate can have a non-uniform thickness. The top plate can have a uniform thickness. The bottom plate can have a non-uniform thickness. The bottom plate can have a uniform thickness.

The adapter pad system can be configured to return to a neutral or central position within the side frame pedestal after removal of a load placed thereon.

The first and second lateral flanges of the top plate can include a planar outer surface that can be parallel to the outer surface of the central portion of the top plate.

The inner surfaces of each of the first and second upturned regions of the first and second plates of the adapter pad can include a planar portion. The inner surfaces of each of the first and second upturned regions of the first and second plates of the adapter pad can include a curved portion. The first and second upturned regions of the first and second plates of the adapter pad can include at least a portion that extends at an obtuse angle to a plane through the outer surface of the central portion of the top plate.

The first and second lateral flanges of the top plate of the adapter pad can include exposed outer surfaces when the adapter pad contacts a side frame pedestal. The first and second lateral flanges can contact air outside of the envelope of the side frame at the pedestal opening. The first and second lateral flanges can be configured to reduce heat of the adapter pad. The first and second lateral flanges can be configured to reduce heat of the adapter pad system.

The adapter pad can include a lateral length of the central portion that can be equal to the distance between the sidewalls of at the pedestal roof surface. The lateral length of the central portion can be about 0.125 inches greater than the length between the side walls of the side frame at the pedestal roof surface. The overall lateral length of the top plate can be at least 7.5 inches.

The adapter pad system can also include a first lateral adapter grip disposed between an inside surface of the first vertical shoulder of the roller bearing adapter and the first upturned region of the bottom plate; and a second lateral adapter grip disposed between an inside surface of the second vertical shoulder of the roller bearing adapter and the second upturned region of the bottom plate. The first and second lateral adapter grips can be formed of an elastomeric material. The first and second lateral adapter grips can be configured to limit sliding or relative movement between the roller bearing adapter and the outer surface of the bottom plate of the adapter pad. The first and second lateral adapter grips can be configured to center the bottom plate of the adapter pad on the roller bearing adapter.

The adapter pad system can also include a first lateral side frame grip disposed on the outer surface of the first upturned region of the top plate; and a second lateral side frame grip disposed on the outer surface of the second upturned region of the top plate. The first lateral side frame grip can be disposed between the outer surface of the first lateral flange of the top plate and a side frame pedestal, and the second lateral side frame grip can be disposed between the outer surface of the second lateral flange of the top plate and a side frame pedestal. The first and second lateral side frame grips can be formed of an elastomeric material. The first and second lateral side frame grips can be configured to limit sliding or relative movement between an outer surface of the top plate and the side frame immediately above the pedestal area.

In some examples, the adapter pad system can be configured to restrict the elastomer temperatures below the degradation temperature of the specific elastomeric and/or adhesive material used in pad construction. The adapter pad system can also be configured to reduce melting of the elastomeric member.

The adapter pad system can include a first adapter compression shim disposed between an upper surface of the first vertical shoulder of the roller bearing adapter and the outer surface of the first lateral flange of the bottom plate. The adapter pad system can also include a second adapter compression shim is disposed between an upper surface of the second vertical shoulder of the roller bearing adapter and the outer surface of the second lateral flange of the bottom plate. The thickness of the first and second adapter compression shims can be within the range of about 0.06 inches to about 0.18 inches.

The adapter pad can include a lower first adapter pad compression shim disposed between the elastomeric member and the first lateral flange of the bottom plate. The adapter pad can also include a second lower adapter pad compression shim is disposed between the elastomeric member and the second lateral flange of the bottom plate. The thickness of the first and second lower adapter pad compression shims can be within the range of about 0.06 inches to about 0.18 inches.

The adapter pad can include a first upper adapter pad compression shim disposed between the first lateral flange of the top plate and the first outer elastomeric member. The adapter pad can also include a second upper adapter pad compression shim is disposed between the second lateral flange of the top plate and the second outer elastomeric member. The thickness of the first and second upper adapter pad compression shims can be within the range of about 0.06 inches to about 0.18 inches.

The compression shims can be configured to provide at least 3000 pounds of vertical compressive load into the outer elastomeric members when a vertical load of 35,000 pounds is applied to the central portions of the adapter pad. The compression shims can be rectangular. The compression shims can have a rectangular cross-section shape, a curved cross-sectional shape, a triangular cross-sectional shape, or a trapezoidal cross-sectional shape. The compression shims can include a raised portion. The compression shims can include a hollow portion. The compression shims can comprise a plurality of compression shims.

The lateral flanges of the adapter pad can be vertically supported by the vertical shoulders of the roller bearing adapter. About 10 percent to 30 percent of vertical force can be distributed to each of the adapter pad lateral flanges when a vertical force is applied to the central portions of the adapter pad. The reaction of the vertical load at the vertical shoulders can provide a vertical force of at least 3000 pounds to precompress the elastomeric member.

The combined top plate, bottom plate, and elastomeric member of the adapter can pad provide a longitudinal stiffness that can be at least 45,000 pounds per inch through a longitudinal displacement of the top plate relative to the bottom plate of up to 0.139 inches from a central position, when a vertical load of 35,000 pounds is applied to the central portions of the adapter pad. The longitudinal hysteresis of the adapter pad system can be less than about 1500 lbs.

The combined top plate, bottom plate, and elastomeric member of the adapter pad can provide a lateral stiffness that can be at least 45,000 pounds per inch through a lateral displacement of the top plate relative to the bottom plate of up to 0.234 inches from a central position, when a vertical load of 35,000 pounds is applied to the central portions of the adapter pad. The lateral displacement hysteresis of the adapter pad system can be less than about 6,000 lbs.

The top plate, bottom plate, and elastomeric member of the adapter pad can provide a rotational stiffness that can be at least 250,000 pound*inches per radian of rotation through a rotational displacement of the top plate relative to the bottom plate of up to 41 milliradians from a central position when a vertical load of 35,000 pounds is applied to the central portions of the adapter pad. The twist hysteresis can be less than about 16,000 lbs.*in.

The top plate, bottom plate, and elastomeric member of the adapter pad can provide a vertical stiffness that can be at least 5,000,000 pounds per inch through a vertical displacement of 0.05 inches. Vertical displacement can be non-linear and can range from 5,000,000 pounds per inch to 30,000,000 pounds per inch depending on variations in durometer, thickness tolerances, and non-linearity of the compression stiffness.

The combined top plate, bottom plate, and elastomeric member of the adapter pad can provide a lateral stiffness that is within about ten percent of a longitudinal stiffness when a vertical load is applied to the central portions of the adapter pad.

The combined top plate, bottom plate, and elastomeric member of the adapter pad can provide a lateral strain in the elastomeric member that is substantially similar throughout the elastomeric member when a vertical load is applied to the central portions of the adapter pad.

The combined top plate, bottom plate, and elastomeric member of the adapter pad can provide a longitudinal strain in the elastomeric member that is substantially similar throughout the elastomeric member when a vertical load is applied to the central portions of the adapter pad.

The combined top plate, bottom plate, and elastomeric member of the adapter pad can provide a rotational strain in the elastomeric member that can be substantially similar throughout the elastomeric member when a vertical load is applied to the central portions of the adapter pad.

The combined top plate, bottom plate, and elastomeric member of the adapter pad can provide a rotational strain that is less than or equal to the lateral strain at any point in the elastomeric member when a vertical load is applied to the central portions of the adapter pad.

The combined top plate, bottom plate, and elastomeric member of the adapter pad can provide shear strain that does not exceed 120% under maximum displacement The thickness of the central portion of the bottom plate of the adapter pad can be non-uniform. The thickness of the central portion of the bottom plate can be greater at the lateral edges than at the center of the central portion.

The thickness of the elastomeric member disposed between the central portions of the top and bottom plate can be substantially uniform.

In another example a method for forming an adapter pad can include providing a top plate having a central portion, first and second upturned regions projecting upward from opposite edges of the central portion, a first lateral flange projecting outward from the first upturned lateral portion, and a second lateral flange projecting outward from the second upturned lateral portion; providing a bottom plate having a central portion, first and second upturned regions projecting upward from opposite edges of the central portion, a first lateral flange projecting outward from the first upturned lateral portion, and a second lateral flange projecting outward from the second upturned lateral portion; inserting an elastomeric member between the top plate and the bottom plate wherein a first outer elastomeric member is disposed between the first lateral flanges, a second outer elastomeric member is disposed between the second lateral flanges, and a central elastomeric member is disposed between the central portions; and compressing the first lateral flange of the top plate and the first lateral flange of the bottom plate towards each other; and compressing the second lateral flange of the top plate and the second lateral flange of the bottom plate towards each other.

The compressing steps can create deformation of the first and second lateral flanges after the molding operation is complete. This deformation can result in preloading of the outer elastomeric members. The compressing steps can apply greater than 3000 pounds force of compression in the outer elastomer members. The compressing steps can compress the outer elastomeric member at least 0.02 inches of a static thickness of the outer elastomeric members. The compressing steps compress the outer elastomeric member greater than 7 percent of a static thickness of the outer elastomeric members.

In another example a method for forming an adapter pad can include providing a top plate having a central portion, first and second upturned regions projecting upward from opposite edges of the central portion, a first lateral flange projecting outward and downward from the first upturned lateral portion, and a second lateral flange projecting outward and projecting downward from the second upturned lateral portion; providing a bottom plate having a central portion, first and second upturned regions projecting upward from opposite edges of the central portion, a first lateral flange projecting outward and upward from the first upturned lateral portion, and a second lateral flange projecting outward and projecting upward from the second upturned lateral portion; inserting an elastomeric member between the top plate and the bottom plate; and compressing the top plate and the bottom plate such that the lateral portions of the top and bottom plates are substantially parallel.

The compressing steps can compress the outer elastomeric member at least 0.02 inches of a static thickness of the outer elastomeric members. The compressing steps can compress the outer elastomeric member greater than 7 percent of a static thickness of the outer elastomeric members.

In another example a method for forming an adapter pad can include providing a top plate having a central portion, first and second upturned regions projecting upward from opposite edges of the central portion, a first lateral flange projecting outward from the first upturned lateral portion, and a second lateral flange projecting outward from the second upturned lateral portion; providing a bottom plate having a central portion, first and second upturned regions projecting upward from opposite edges of the central portion, a first lateral flange projecting outward from the first upturned lateral portion, and a second lateral flange projecting outward from the second upturned lateral portion; inserting a first outer elastomeric member between the first lateral flange of the top plate and the first lateral flange of the bottom plate; and inserting a second outer elastomeric member between the second lateral flange of the top plate and the second lateral flange of the bottom plate; and inserting a central elastomeric member between the central region of the top plate and the central region of the bottom plate The thickness of the central elastomeric member can be less than or equal to the thickness of the first and second outer elastomeric members.

In another example a method for forming an adapter pad can include providing a top plate having a central portion, first and second upturned regions projecting upward from opposite edges of the central portion, a first lateral flange projecting outward from the first upturned lateral portion, and a second lateral flange projecting outward from the second upturned lateral portion; providing a bottom plate having a central portion, first and second upturned regions projecting upward from opposite edges of the central portion, a first lateral flange projecting outward from the first upturned lateral portion, and a second lateral flange projecting outward from the second upturned lateral portion; inserting a first outer elastomeric member between the first lateral flange of the top plate and the first lateral flange of the bottom plate; and inserting a second outer elastomeric member between the second lateral flange of the top plate and the second lateral flange of the bottom plate; and inserting a central elastomeric member between the central region of the top plate and the central region of the bottom plate; compressing the first and second lateral flanges of the top plate and the bottom plate together; and bonding the top plate to the first outer elastomeric member, the second outer elastomeric member, and the central elastomeric member.

The thickness of the central elastomeric member can be less than the thickness of the first and second outer elastomeric members.

The compressing steps can compress the outer elastomeric member at least 0.02 inches of a static thickness of the outer elastomeric members. The compressing steps compress the outer elastomeric member greater than 7 percent of a static thickness of the outer elastomeric members.

In another example, an adapter pad system for use between a railcar side frame pedestal and a rail car axle roller bearing adapter is disclosed. The side frame pedestal can define a first outer side, an opposite second outer side, and a pedestal roof located and extending between the first outer side and the second outer side. The adapter pad system can include a bearing adapter defining a bottom surface and a top surface, the bottom surface mounted to the railcar axle roller bearing, the top surface defining opposing first and second vertical shoulders that project upwardly from the top surface, on either side of the side frame just above the pedestal roof. The adapter pad system can include an adapter pad configured to interface with the bearing adapter including a top plate having inner and outer surfaces, a central portion, first and second upturned regions projecting upwardly from opposite edges of the central portion, a first lateral flange projecting outwardly from the first upturned region, and a second lateral flange projecting outwardly from the second upturned region; and a bottom plate having inner and outer surfaces, a central portion, first and second upturned regions projecting upwardly from opposite edges of the central portion, a first lateral flange projecting outwardly from the first upturned region, and a second lateral flange projecting outwardly from the second upturned region.

The top plate and bottom plate central portions can be disposed beneath the pedestal roof of the side frame pedestal, and the first and second laterally projecting flanges of the top plate and the bottom plate can be disposed above the vertical shoulders of the roller bearing adapter and outside of the pedestal roof of the side frame pedestal and along the first and second outer sides of the side frame pedestal.

In another example, an adapter pad configured to be disposed between an adapter and a side frame pedestal roof of a railcar truck is disclosed. The adapter pad can include a top plate having inner and outer surfaces, a central portion, first and second upturned regions projecting upward from opposite edges of the central portion, a first lateral flange projecting outward from the first upturned region, and a second lateral flange projecting outward from the second upturned region; and a bottom plate having inner and outer surfaces, a central portion, first and second upturned regions projecting upward from opposite edges of the central portion, a first lateral flange projecting outward from the first upturned region, and a second lateral flange projecting outward from the second upturned region.

The outer surfaces of the first and second laterally projecting flanges of the bottom plate can be vertically higher than the outer surface of the central portion of the top plate.

In another example, a method for forming an adapter pad can include providing a top plate having a central portion, first and second upturned regions projecting upward from opposite edges of the central portion, a first lateral flange projecting outward from the first upturned lateral portion, and a second lateral flange projecting outward from the second upturned lateral portion; providing a bottom plate having a central portion, first and second upturned regions projecting upward from opposite edges of the central portion, a first lateral flange projecting outward from the first upturned lateral portion, and a second lateral flange projecting outward from the second upturned lateral portion; inserting a first outer elastomeric member between the first lateral flange of the top plate and the first lateral flange of the bottom plate; inserting a second outer elastomeric member between the second lateral flange of the top plate and the second lateral flange of the bottom plate; inserting a central elastomeric member between the central region of the top plate and the central region of the bottom plate; vulcanizing or curing the elastomeric members; inserting a first compression shim in the first lateral flange; and inserting a second compression shim in the second lateral flange. In some embodiments compression shims can be added after vulcanization or curing of the elastomer is complete.

In another example, a method for forming an adapter pad can include, providing a top plate having a central portion, first and second upturned regions projecting upward from opposite edges of the central portion, a first lateral flange projecting outward from the first upturned lateral portion, and a second lateral flange projecting outward from the second upturned lateral portion; providing a bottom plate having a central portion, first and second upturned regions projecting upward from opposite edges of the central portion, a first lateral flange projecting outward from the first upturned lateral portion, and a second lateral flange projecting outward from the second upturned lateral portion; inserting a first outer elastomeric member between the first lateral flange of the top plate and the first lateral flange of the bottom plate; and inserting a second outer elastomeric member between the second lateral flange of the top plate and the second lateral flange of the bottom plate; and inserting a central elastomeric member between the central region of the top plate and the central region of the bottom plate; curing the elastomeric members; inserting a first compression shim in the first lateral flange; and inserting a second compression shim in the second lateral flange. The steps of inserting the first and second compression shims can be performed after curing the elastomeric members.

The compressing steps can compress the outer elastomeric member at least 0.02 inches of a static thickness of the outer elastomeric members. The compressing steps compress the outer elastomeric member greater than 7 percent of a static thickness of the outer elastomeric members.

In another example, an adapter pad system for use between a railcar side frame pedestal and a rail car axle roller bearing is disclosed. The side frame pedestal can define a first outer side, an opposite second outer side, and a pedestal roof located and extending between the first outer side and the second outer side. The adapter pad system can include a bearing adapter defining a bottom surface and a top surface, the bottom surface mounted to the railcar axle roller bearing. The adapter pad can be configured to interface with the bearing adapter and can further include a top plate having inner and outer surfaces, a central portion, and outer portions; a bottom plate having inner and outer surfaces, a central portion, and outer portions, and an elastomeric member having a central portion and outer portions disposed between the inner surfaces of the top and bottom plates.

The top plate and bottom plate central portions can be disposed beneath the pedestal roof of the side frame pedestal, and the outer portions of the top and bottom plate can be disposed outside of the pedestal roof of the side frame pedestal.

The adapter pad system can include a continuous top plate. The adapter pad system can include a continuous bottom plate.

The combined surface area of the outer portions of the elastomeric member at cross-sectional planes through the outer portions of the elastomeric members in planes centered between the inner surfaces of the top and bottom plates can be greater than 5 square inches.

The combined surface area of the outer portions of the elastomeric members at cross-sectional planes through the outer portions of the elastomeric members in planes centered between the inner surfaces of the top and bottom plates can be at least 10 percent of the surface area of the central portion of the elastomeric member at a cross-sectional plane through the center of the central portion of the elastomeric member in a plane centered between the inner surfaces of the top and bottom plates.

The central portion of the elastomeric member can be in a different plane than the outer portions of the elastomeric member. The central portion of the elastomeric member can be in a parallel plane with the outer portions of the elastomeric member. The outer portions can be vertically spaced from the central portions.

The top plate can be engaged with the side frame, and the bottom plate can be engaged with the roller bearing adapter.

In another example, an adapter pad system for use between a railcar side frame pedestal and a rail car axle roller bearing is disclosed. The side frame pedestal can define a first outer side, an opposite second outer side, and a pedestal roof located and extending between the first outer side and the second outer side. The adapter pad system can include a bearing adapter defining a bottom surface and a top surface, the bottom surface mounted to the railcar axle roller bearing. The adapter pad system can include an adapter pad configured to interface with the bearing adapter that includes a top plate having inner and outer surfaces, a central portion, and outer portions; a bottom plate having inner and outer surfaces, a central portion, and outer portions, and an elastomeric member having a central portion and outer portions disposed between the inner surfaces of the top and bottom plates.

The top plate and bottom plate central portions can be disposed beneath the pedestal roof of the side frame pedestal, and the outer portions of the top and bottom plate can be disposed outside of the pedestal roof of the side frame pedestal.

The outer portions of the top and bottom plates can be configured to accept about 10 percent to 30 percent of vertical force applied to the central portions.

The outer portions of the adapter pad can be supported by vertical shoulders of the bearing adapter.

In another example, a roller bearing adapter configured to be disposed between a roller bearing and an adapter pad of a railcar truck is disclosed. The roller bearing adapter can have a bearing surface, an adapter crown surface, a longitudinal centerline, and first and second vertical shoulders that project upward from the pedestal crown surface of the adapter. The thickness of the center section of the roller bearing adapter can be less than 0.75 inches as measured at the longitudinal centerline from a bearing surface to a pedestal crown surface of the adapter.

The thickness of the roller bearing adapter can be between approximately 0.60 and 0.75 inches as measured at the longitudinal centerline from a bearing surface to a pedestal crown surface of the adapter. The width of the vertical shoulders can be at least 0.5 inches.

The roller bearing adapter can have a cross-sectional moment of inertia of a cross-section at the longitudinal centerline of the roller bearing adapter around a lateral axis about 5.2 inches above a center axis of an axle that is about 1.4 $in^4$, or in the range of about 1.0 to about 2.0 $in^4$. The lateral axis can be between about 5.0 inches and 5.5 inches from the center axis of the axle. The roller bearing adapter can have a cross-sectional moment of inertia of a cross-section at the longitudinal centerline of the roller bearing adapter around a vertical axis at the center of the adapter that can be about can be about 86.8 $in^4$, or in the range of about 50 to about 100 $in^4$.

The present invention is disclosed above and in the accompanying drawings with reference to a variety of examples. The purpose served by the disclosure, however, is to provide examples of the various features and concepts related to the invention, not to limit the scope of the invention. The terms and descriptions used herein are set forth by way of illustration only and are not meant as limitations. One skilled in the relevant art will recognize that numerous variations and modifications may be made to the examples described above without departing from the scope of the present invention. For example, the steps of the methods need not be executed in a certain order, unless specified, although they may have been presented in that order in the disclosure.

The invention claimed is:

1. A roller bearing adapter pad system configured for use with a three-piece truck comprising:

a roller bearing adapter configured to engage a roller bearing, the roller bearing adapter comprising:

a top surface; and a bottom surface configured to engage a roller bearing;

wherein the roller bearing adapter has cross-sectional moment of inertia of a cross-section at the longitudinal centerline of the roller bearing adapter around a lateral axis about 5.9 inches above a center axis of an axle that is in the range of about 1.0 $in^4$ to about 2.0 $in^4$;

wherein the roller bearing adapter has a cross-sectional moment of inertia of a cross-section at the longitudinal centerline of the roller bearing adapter around a vertical axis at the center of the adapter that is in the range of about 75 $in^4$ to about 125 $in^4$; and an adapter pad configured to engage a side frame pedestal roof, the adapter pad comprising:

a top plate;

a bottom plate; and an elastomeric member disposed between the top plate and bottom plate;

wherein the adapter pad has a pad elastomer shear width of about 6 in to about 14 in and a pad elastomer shear length of about 6 in to about 10 in.

2. The roller bearing adapter pad system of claim 1, wherein the bottom plate of the adapter pad has a first lateral flange and second lateral flange.

3. The roller bearing adapter pad system of claim 1, wherein the combined top plate, bottom plate, and elastomeric member of the adapter pad provide a longitudinal stiffness of at least 45,000 pounds per inch through a longitudinal displacement of the top plate relative to the bottom plate of up to 0.139 inches from a central position, a lateral stiffness of at least 45,000 pounds per inch through a lateral displacement of the top plate relative to the bottom plate of up to 0.279 inches from the central position, and a rotational stiffness of at least 250,000 pound*inches per radian of rotation through a rotational displacement of the top plate relative to the bottom plate of up to 54.4 milliradians from the central position when a vertical load of 35,000 pounds is applied to a central portion of the adapter pad.

4. The roller bearing adapter pad system of claim 1 wherein the roller bearing adapter has cross-sectional moment of inertia of a cross-section at the longitudinal centerline of the roller bearing adapter around a lateral axis about 5.9 inches above a center axis of an axle that is about 1.1 $in^4$.

5. The roller bearing adapter pad system of claim 1, wherein the roller bearing adapter has a cross-sectional moment of inertia of a cross-section at the longitudinal centerline of the roller bearing adapter around a vertical axis at the center of the adapter that is about 95 $in^4$.

6. A roller bearing adapter pad system configured for use with a three-piece truck having a roller bearing adapter and a side frame pedestal roof, the roller bearing adapter pad system comprising:

an adapter pad comprising:

a top plate;

a bottom plate; and an elastomeric member disposed between the top plate and bottom plate, the elastomeric member comprising a center elastomer layer; and wherein the center elastomer layer has a shear perimeter of about 20 in to about 35 in; and wherein the combined top plate, bottom plate, and elastomeric member provide a longitudinal stiffness of at least 45,000 pounds per inch through a longitudinal displacement of the top plate relative to the bottom plate of up to 0.139 inches from a central position, a lateral stiffness of at least 45,000 pounds per inch through a lateral displacement of the top plate relative to the bottom plate of up to 0.279 inches from the central position, and a rotational stiffness of at least 250,000 pound*inches per radian of rotation through a rotational displacement of the top plate relative to the bottom plate of up to 54.4 milliradians from the central position when a vertical load of 35,000 pounds is applied to a central portion of the adapter pad.

7. The roller bearing adapter pad system of claim 6, wherein the center elastomer layer shear perimeter is about 25 in to about 35 in.

8. The roller bearing adapter pad system of claim 6, further comprising an outer elastomer layer.

9. The roller bearing adapter pad system of claim 8, wherein the outer elastomer layer has a shear perimeter of about 8 in to about 25 in.

10. The roller bearing adapter pad system of claim 8, wherein the outer elastomer layer shear perimeter is about 10 in to about 25 in.

11. The roller bearing adapter pad system of claim 8, wherein the composite elastomer layer shear perimeter is about 50 in to about 80 in.

12. The roller bearing adapter pad system of claim 6, wherein the total height measured between a top surface of the roller bearing and the pedestal roof is about 1.15 inches to about 1.8 inches.

13. The roller bearing adapter pad system of claim 6, wherein the total height measured between the top surface of the roller bearing and the pedestal roof is about 1.5 inches.

14. The roller bearing adapter pad system of claim 6, wherein the roller bearing adapter pad system has an overall longitudinal length of about 7.5 inches to about 9.5 inches and an overall lateral length of about 9 inches to about 11 inches.

15. A roller bearing adapter pad system configured for use with a three-piece truck having a roller bearing adapter and a side frame pedestal roof, the roller bearing adapter system comprising:

an adapter pad comprising:

a top plate;

a bottom plate; and an elastomeric member disposed between the top plate and bottom plate;

wherein the combined top plate, bottom plate, and elastomeric member provide a longitudinal stiffness of at least 45,000 pounds per inch through a longitudinal displacement of the top plate relative to the bottom plate of up to 0.139 inches from a central position, a lateral stiffness of at least 45,000 pounds per inch through a lateral displacement of the top plate relative to the bottom plate of up to 0.279 inches from the central position, and a rotational stiffness of at least 250,000 pound*inches per radian of rotation through a rotational displacement of the top plate relative to the bottom plate of up to 54.4 milliradians from the central position when a vertical load of 35,000 pounds is applied to a central portion of the adapter pad.

16. The roller bearing adapter pad system of claim 15, wherein the adapter pad has an overall longitudinal length of about 7.5 inches to about 9.5 inches, and wherein the adapter pad has an overall lateral length of about 9 inches to about 11 inches.

17. The roller bearing adapter pad system of claim 15, wherein the adapter pad has an overall longitudinal length of about 8.31 inches.

18. The roller bearing adapter pad system of claim 15, wherein the adapter pad has an overall an overall lateral length of about 10.16 inches.

19. The roller bearing adapter pad system of claim 16, wherein the total height measured between a top surface of the roller bearing and the pedestal roof is about 1.15 inches to about 1.8 inches.

* * * * *